US005514505A

United States Patent [19]

Limburg et al.

[11] Patent Number: 5,514,505

[45] Date of Patent: May 7, 1996

[54] METHOD FOR OBTAINING IMPROVED IMAGE CONTRAST IN MIGRATION IMAGING MEMBERS

[75] Inventors: William W. Limburg; Joseph Mammino, both of Penfield, N.Y.; George Liebermann, Mississauga, Canada; Clifford H. Griffiths; Michael M. Shahin, both of Pittsford, N.Y.; Shadi L. Malhotra, Mississauga, Canada; Liqin Chen, Mississauga, Canada; Marie-Eve Perron, Mississauga, Canada

[73] Assignee: Xerox Corporation, Stamford, Conn.

[21] Appl. No.: 441,360

[22] Filed: May 15, 1995

[51] Int. Cl.[6] ..... G03G 17/10

[52] U.S. Cl. ..... 430/41

[58] Field of Search ..... 430/41

[56] References Cited

U.S. PATENT DOCUMENTS

| | | | |
|---|---|---|---|
| 3,653,885 | 4/1972 | Levy et al. | 430/41 |
| 3,950,167 | 4/1976 | Tutihasi et al. | 430/41 X |
| 4,029,502 | 6/1977 | Goffe | 430/41 |
| 4,065,307 | 12/1977 | Goffe | 430/41 |
| 4,082,549 | 4/1978 | Haas et al. | 430/41 |
| 4,084,966 | 4/1978 | Haas et al. | 430/41 |
| 4,101,321 | 7/1978 | Levy et al. | 430/41 |
| 4,241,156 | 12/1980 | Haas et al. | 430/41 |
| 4,252,890 | 2/1981 | Haas et al. | 430/292 |
| 4,536,457 | 8/1985 | Tam | 430/41 |
| 4,853,307 | 8/1989 | Tam et al. | 430/41 |
| 4,880,715 | 11/1989 | Tam et al. | 430/41 |
| 4,937,163 | 6/1990 | Tam et al. | 430/41 |

*Primary Examiner*—Roland Martin
*Attorney, Agent, or Firm*—Judith L. Byorick

[57] ABSTRACT

Disclosed is a process which comprises (a) providing a migration imaging member comprising (1) a substrate and (2) a softenable layer comprising a softenable material and a photosensitive migration marking material present in the softenable layer as a monolayer of particles situated at or near the surface of the softenable layer spaced from the substrate; (b) uniformly charging the imaging member; (3) imagewise exposing the charged imaging member to activating radiation at a wavelength to which the migration marking material is sensitive; (d) subsequent to step (c), causing the softenable material to soften and enabling a first portion of the migration marking material to migrate through the softenable material toward the substrate in an imagewise pattern while a second portion of the migration marking material remains substantially unmigrated within the softenable layer; and (e) contacting the second portion of the migration marking material with a transparentizing agent which transparentizes migration marking material.

44 Claims, 5 Drawing Sheets

METHOD FOR OBTAINING IMPROVED IMAGE CONTRAST IN MIGRATION IMAGING MEMBERS

BACKGROUND OF THE INVENTION

The present invention is directed to methods for obtaining improved contrast density in migration imaging members. More specifically, the present invention is directed to processes for improving the contrast density of migration imaging members by selective transparentization of migration marking material. One embodiment of the present invention is directed to a process which comprises (a) providing a migration imaging member comprising (1) a substrate and (2) a softenable layer comprising a softenable material and a photosensitive migration marking material present in the softenable layer as a monolayer of particles situated at or near the surface of the softenable layer spaced from the substrate; (b) uniformly charging the imaging member; (c) imagewise exposing the charged imaging member to activating radiation at a wavelength to which the migration marking material is sensitive; (d) subsequent to step (c), causing the softenable material to soften and enabling a first portion of the migration marking material to migrate through the softenable material toward the substrate in an imagewise pattern while a second portion of the migration marking material remains substantially unmigrated within the softenable layer; and (e) contacting the second portion of the migration marking material with a transparentizing agent which transparentizes migration marking material. Optionally, thereafter, the migration imaging member can be uniformly charged and uniformly exposed to activating radiation at a wavelength to which the migration marking material is sensitive, followed by again causing the softenable material to soften and enabling the first portion of the migration marking material to migrate further through the softenable material toward the substrate.

Migration imaging systems capable of producing high quality images of high optical contrast density and high resolution have been developed. Such migration imaging systems are disclosed in, for example, U.S. Pat. Nos. 5,215,838, 5,202,206, 5,102,756, 5,021,308, 4,970,130, 4,937,163, 4,883,731, 4,880,715, 4,853,307, 4,536,458, 4,536,457, 4,496,642, 4,482,622, 4,281,050, 4,252,890, 4,241,156, 4,230,782, 4,157,259, 4,135,926, 4,123,283, 4,102,682, 4,101,321, 4,084,966, 4,081,273, 4,078,923, 4,072,517, 4,065,307, 4,062,680, 4,055,418, 4,040,826, 4,029,502, 4,028,101, 4,014,695, 4,013,462, 4,012,250, 4,009,028, 4,007,042, 3,998,635, 3,985,560, 3,982,939, 3,982,936, 3,979,210, 3,976,483, 3,975,739, 3,975,195 , and 3,909,262, the disclosures of each of which are totally incorporated herein by reference, and in "Migration Imaging Mechanisms, Exploitation, and Future Prospects of Unique Photographic Technologies, XDM and AMEN", P. S. Vincett, G. J. Kovacs, M. C. Tam, A. L. Pundsack, and P. H. Soden, *Journal of Imaging Science* 30 (4) July/August, pp. 183–191 (1986), the disclosure of which is totally incorporated herein by reference.

The expression "softenable" as used herein is intended to mean any material which can be rendered more permeable, thereby enabling particles to migrate through its bulk. Conventionally, changing the permeability of such material or reducing its resistance to migration of migration marking material is accomplished by dissolving, swelling, melting, or softening, by techniques, for example, such as contacting with heat, vapors, partial solvents, solvent vapors, solvents, and combinations thereof, or by otherwise reducing the viscosity of the softenable material by any suitable means.

The expression "fracturable" layer or material as used herein means any layer or material which is capable of breaking up during development, thereby permitting portions of the layer to migrate toward the substrate or to be otherwise removed. The fracturable layer is preferably particulate in the various embodiments of the migration imaging members. Such fracturable layers of marking material are typically contiguous to the surface of the softenable layer spaced apart from the substrate, and such fracturable layers can be substantially or wholly embedded in the softenable layer in various embodiments of the imaging members.

The expression "contiguous" as used herein is intended to mean in actual contact, touching, also, near, though not in contact, and adjoining, and is intended to describe generically the relationship of the fracturable layer of marking material in the softenable layer with the surface of the softenable layer spaced apart from the substrate.

The expression "optically sign-retained" as used herein is intended to mean that the dark (higher optical density) and light (lower optical density) areas of the visible image formed on the migration imaging member correspond to the dark and light areas of the illuminating electromagnetic radiation pattern.

The expression "optically sign-reversed" as used herein is intended to mean that the dark areas of the image formed on the migration imaging member correspond to the light areas of the illuminating electromagnetic radiation pattern and the light areas of the image formed on the migration imaging member correspond to the dark areas of the illuminating electromagnetic radiation pattern.

The expression "optical contrast density" as used herein is intended to mean the difference between maximum optical density ($D_{max}$) and minimum optical density ($D_{min}$) of an image. Optical density is measured for the purpose of this invention by diffuse densitometers with a blue Wratten No. 94 filter. The expression "optical density" as used herein is intended to mean "transmission optical density" and is represented by the formula:

$$D=\log_{10}[I_o/I]$$

where I is the transmitted light intensity and $I_o$ is the incident light intensity. For the purpose of this invention, all values of transmission optical density given in this invention include the substrate density of about 0.2 which is the typical density of a metallized polyester substrate.

High optical density in migration imaging members allows high contrast densities in migration images made from the migration imaging members. High contrast density is highly desirable for most information storage systems. Contrast density is used herein to denote the difference between maximum and minimum optical density in a migration image. The maximum optical density value of an imaged migration imaging member is, of course, the same value as the optical density of an unimaged migration imaging member.

There are various other systems for forming such images, wherein non-photosensitive or inert marking materials are arranged in the aforementioned fracturable layers, or dispersed throughout the softenable layer, as described in the aforementioned patents, which also disclose a variety of methods which can be used to form latent images upon migration imaging members.

Various means for developing the latent images can be used for migration imaging systems. These development methods include solvent wash away, solvent vapor softening, heat softening, and combinations of these methods, as well as any other method which changes the resistance of the softenable material to the migration of particulate marking material through the softenable layer to allow imagewise migration of the particles in depth toward the substrate. In the solvent wash away or meniscus development method, the migration marking material in the light struck region migrates toward the substrate through the softenable layer, which is softened and dissolved, and repacks into a more or less monolayer configuration. In migration imaging films supported by transparent substrates alone, this region exhibits a maximum optical density which can be as high as the initial optical density of the unprocessed film. On the other hand, the migration marking material in the unexposed region is substantially washed away and this region exhibits a minimum optical density which is essentially the optical density of the substrate alone. Therefore, the image sense of the developed image is optically sign reversed. Various methods and materials and combinations thereof have previously been used to fix such unfixed migration images. One method is to overcoat the image with a transparent abrasion resistant polymer by solution coating techniques. In the heat or vapor softening developing modes, the migration marking material in the light struck region disperses in the depth of the softenable layer after development and this region exhibits $D_{min}$ which is typically in the range of 0.6 to 0.7. This relatively high $D_{min}$ is a direct consequence of the depthwise dispersion of the otherwise unchanged migration marking material. On the other hand, the migration marking material in the unexposed region does not migrate and substantially remains in the original configuration, i.e. a monolayer. In migration imaging films supported by transparent substrates, this region exhibits a maximum optical density ($D_{max}$) of about 1.8 to 1.9. Therefore, the image sense of the heat or vapor developed images is optically sign-retained.

Techniques have been devised to permit optically sign-reversed imaging with vapor development, but these techniques are generally complex and require critically controlled processing conditions. An example of such techniques can be found in U.S. Pat. No. 3,795,512, the disclosure of which is totally incorporated herein by reference.

For many imaging applications, it is desirable to produce negative images from a positive original or positive images from a negative original (optically sign-reversing imaging), preferably with low minimum optical density. Although the meniscus or solvent wash away development method produces optically sign-reversed images with low minimum optical density, it entails removal of materials from the migration imaging member, leaving the migration image largely or totally unprotected from abrasion. Although various methods and materials have previously been used to overcoat such unfixed migration images, the post-development overcoating step can be impractically costly and inconvenient for the end users. Additionally, disposal of the effluents washed from the migration imaging member during development can also be very costly.

The background portions of an imaged member can sometimes be transparentized by means of an agglomeration and coalescence effect. In this system, an imaging member comprising a softenable layer containing a fracturable layer of electrically photosensitive migration marking material is imaged in one process mode by electrostatically charging the member, exposing the member to an imagewise pattern of activating electromagnetic radiation, and softening the softenable layer by exposure for a few seconds to a solvent vapor thereby causing a selective migration in depth of the migration material in the softenable layer in the areas which were previously exposed to the activating radiation. The vapor developed image is then subjected to a heating step. Since the exposed particles gain a substantial net charge (typically 85 to 90 percent of the deposited surface charge) as a result of light exposure, they migrate substantially in depth in the softenable layer towards the substrate when exposed to a solvent vapor, thus causing a drastic reduction in optical density. The optical density in this region is typically in the region of 0.7 to 0.9 (including the substrate density of about 0.2) after vapor exposure, compared with an initial value of 1.8 to 1.9 (including the substrate density of about 0.2). In the unexposed region, the surface charge becomes discharged due to vapor exposure. The subsequent heating step causes the unmigrated, uncharged migration material in unexposed areas to agglomerate or flocculate, often accompanied by coalescence of the marking material particles, thereby resulting in a migration image of very low minimum optical density (in the unexposed areas) in the 0.25 to 0.35 range. Thus, the contrast density of the final image is typically in the range of 0.35 to 0.65. Alternatively, the migration image can be formed by heat followed by exposure to solvent vapors and a second heating step which also results in a migration image with very low minimum optical density. In this imaging system as well as in the previously described heat or vapor development techniques, the softenable layer remains substantially intact after development, with the image being self-fixed because the marking material particles are trapped within the softenable layer.

The word "agglomeration" as used herein is defined as the coming together and adhering of previously substantially separate particles, without the loss of identity of the particles.

The word "coalescence" as used herein is defined as the fusing together of such particles into larger units, usually accompanied by a change of shape of the coalesced particles towards a shape of lower energy, such as a sphere.

Generally, the softenable layer of migration imaging members is characterized by sensitivity to abrasion and foreign contaminants. Since a fracturable layer is located at or close to the surface of the softenable layer, abrasion can readily remove some of the fracturable layer during either manufacturing or use of the imaging member and adversely affect the final image. Foreign contamination such as finger prints can also cause defects to appear in any final image. Moreover, the softenable layer tends to cause blocking of migration imaging members when multiple members are stacked or when the migration imaging material is wound into rolls for storage or transportation. Blocking is the adhesion of adjacent objects to each other. Blocking usually results in damage to the objects when they are separated.

The sensitivity to abrasion and foreign contaminants can be reduced by forming an overcoating such as the overcoatings described in U.S. Pat. No. 3,909,262, the disclosure of which is totally incorporated herein by reference. However, because the migration imaging mechanisms for each development method are different and because they depend critically on the electrical properties of the surface of the softenable layer and on the complex interplay of the various electrical processes involving charge injection from the surface, charge transport through the softenable layer, charge capture by the photosensitive particles and charge ejection from the photosensitive particles, and the like, application of an overcoat to the softenable layer can cause changes in the delicate balance of these processes and result in degraded photographic characteristics compared with the non-overcoated migration imaging member. Notably, the photographic contrast density can degraded. Recently, improvements in migration imaging members and processes for forming images on these migration imaging members have been achieved. These improved migration imaging members and processes are described in U.S. Pat. No. 4,536,458 and U.S. Pat. No. 4,536,457.

U.S. Pat. No. 4,937,163 (Tam et al.), the disclosure of which is totally incorporated herein by reference, discloses an imaging member which comprises an ionically conductive film forming polymer, such as sulfonated polystyrene, and an electrically insulating softenable layer comprising a fracturable layer containing electrically photosensitive migration marking particles.

U.S. Pat. No. 4,880,715 (Tam et al.), the disclosure of which is totally incorporated herein by reference, discloses an imaging system in which an imaging member comprising a substrate and an electrically insulating softenable layer on the substrate, the softenable layer comprising migration marking material located at least at or near the surface of the softenable layer spaced from the substrate, and a charge transport material in the softenable layer is imaged by eletrostatically charging the member, exposing the member to activating radiation in an imagewise pattern, decreasing the resistance to migration of marking material in the softenable layer sufficiently to allow the migration marking material struck by said activating radiation to retain a slight net charge which allows only slight agglomeration, slight coalescence, slight migration in depth of marking material towards said substrate or combination thereof in image configuration during a further decreasing of the resistance to migration towards the substrate in image configuration, and further decreasing the resistance to migration of marking material in the softenable layer sufficiently to allow non-exposed marking material to agglomerate and coalesce substantially. This imaged member may be used as a xeroprinting master in a xeroprinting process comprising uniformly charging the master, uniformly exposing the charged master to activating illumination to form an electrostatic latent image, developing the latent image to form a toner image and transferring the toner image to a receiving member. A charge transport spacing layer comprising a film forming binder and a charge transport compound may be employed between the substrate and the softenable layer in order to increase the surface potential associated with the surface charges of the latent image.

U.S. Pat. No. 4,853,307 (Tam et al.), the disclosure of which is totally incorporated herein by reference, discloses an imaging system including a migration imaging member comprising a substrate and an electrically insulating softening layer adjacent the substrate, the softenable layer comprising a fracturable layer of electrically photosensitive migration marking material located substantially at or near the surface of the softenable layer spaced from the substrate, and a copolymer of styrene and ethyl acrylate in at least one layer adjacent the substrate, the copolymer comprising between about 40 and about 80 mole percent styrene, between about 20 and about 60 mole percent ethyl acrylate, the copolymer having a $M_n$ between about 4,000 and about 35,000, a $M_w$ between about 10,000 and about 80,000, a $T_g$ between about 30° C. and about 75° C., and a melt viscosity between about $1\times10^2$ poise and about $\times10^6$ poise at 115° C. The migration imaging member may be imaged by charging, imagewise exposing to activating radiation and developing with heat, solvent vapor, or solvent vapor pretreatment followed by heat. Some embodiments of the imaged member, wherein the softenable layer contains a charge transport material, may be utilized as a master in a xeroprinting process. The copolymer of styrene and ethyl acrylate may be in an adhesive layer of charge transport spacing layer between the substrate and the softenable layer, or in the softenable layer itself. If desired, the copolymer in any of the aforesaid layers may be a terpolymer of styrene, ethyl acrylate and a copolymerizable organic acid having carbon-to-carbon unsaturation or a copolymerizable derivative of the organic acid.

U.S. Pat. No. 4,536,457 (Tam), the disclosure of which is totally incorporated herein by reference, discloses an imaging method comprising providing a migration imaging member comprising a substrate and an electrically insulating softenable layer on the substrate, the softenable layer comprising migration marking material located at least at or near the surface of the softenable layer spaced from the substrate and a charge transport material in the softenable layer, electrostatically charging the member, exposing the member to activating radiation in an imagewise pattern, decreasing the resistance to migration of marking material in the softenable layer sufficiently to allow slight migration in depth of marking material towards the substrate in image configuration, and further decreasing the resistance to migration of marking material in the softenable layer sufficiently to allow nonmigrated marking material to agglomerate.

U.S. Pat. No. 4,252,890 (Haas et al.), the disclosure of which is totally incorporated herein by reference, discloses an imaging system wherein a migration-type imaging member comprising a softenable layer containing agglomerable migration marking material is provided, and the member is exposed to an image pattern of electromagnetic radiation of sufficient energy to cause a simultaneous imagewise migration at least in depth in the softenable layer and agglomeration of the agglomerable migration marking material in the imagewise exposed areas of the imaging member. In another embodiment, a microscopically discontinuous layer of imaging material on a stable substrate is agglomeration or evaporation imaged by the inventive system.

U.S. Pat. No. 4,241,156 (Haas et al.), the disclosure of which is totally incorporated herein by reference, discloses an imaging system wherein a migration-type imaging member comprising a softenable layer containing agglomerable migration marking material is provided, and the member is exposed to an image pattern of electromagnetic radiation of sufficient energy to cause a simultaneous imagewise migration at least in depth in the softenable layer and agglomeration of the agglomerable migration marking material in the imagewise exposed areas of the imaging member. In another embodiment, a microscopically discontinuous layer of imaging material in a stable substrate is agglomeration or evaporation imaged by the inventive system.

U.S. Pat. No. 4,101,321 (Levy et al.), the disclosure of which is totally incorporated herein by reference, discloses an imaging system wherein an imaged migration-type imaging member is provided and either the background of image areas of said image are selectively reduced to a more transparent condition. The imaged member comprises a softenable layer containing agglomerable materials in both image and complementary background configurations. This member is contacted with solvent vapors capable of softening the softenable layer and heated, thereby causing the agglomerable material to selectively agglomerate in one of either the background or image areas.

U.S. Pat. No. 4,084,966 (Haas et al.), the disclosure of which is totally incorporated herein by reference, discloses an imaging system wherein a migration-type imaging member comprising a softenable layer containing agglomerable migration marking material is provided, and the member is exposed to an image pattern of electromagnetic radiation of sufficient energy to cause a simultaneous imagewise migration at least in depth in the softenable layer and agglomeration of the agglomerable migration marking material in the imagewise exposed areas of the imaging member. In another embodiment, a microscopically discontinuous layer of imaging material on a stable substrate is agglomeration or evaporation imaged by the inventive system.

U.S. Pat. No. 4,065,307 (Goffe), the disclosure of which is totally incorporated herein by reference, discloses an imaging system comprising providing an imaging member comprising an agglomerable layer in contact with an imagewise hardenable-softenable layer and imagewise hardening said member. An image is developed by imagewise softening said member to cause relative transparentizing in the imagewise softened areas due to an agglomeration of the agglomerable layer in the imagewise softened portions of said member.

U.S. Pat. No. 4,029,502 (Goffe), the disclosure of which is totally incorporated herein by reference, discloses an imaging system comprising providing an imaging member comprising an agglomerable layer contacting a softenable layer and imagewise softening said member to cause relative transparentizing of said member in softened areas due to an agglomeration of the agglomerable layer in softened portions of said member.

U.S. Pat. No. 5,108,861 (Kovacs et al.), the disclosure of which is totally incorporated herein by reference, discloses an electrostatographic device which includes a metal halide conductive transparent layer which is free of nonuniformities. Very thin layers of metal halides are formed for imaging members by vacuum evaporation and exhibit adequate conductivity and transparency.

Migration imaging members are also suitable for use as masks for exposing the photosensitive material in a printing plate. The migration imaging member can be laid on the plate prior to exposure to radiation, or the migration imaging member layers can be coated or laminated onto the printing plate itself prior to exposure to radiation, and removed subsequent to exposure.

U.S. Pat. No. 5,102,756 (Vincett et al.), the disclosure of which is totally incorporated herein by reference, discloses a printing plate precursor which comprises a base layer, a layer of photohardenable material, and a layer of softenable material containing photosensitive migration marking material. Alternatively, the precursor can comprise a base layer and a layer of softenable photohardenable material containing photosensitive migration marking material. Also disclosed are processes for preparing printing plates from the disclosed precursors.

Copending application U.S. Ser. No. 08/353,461, filed Dec. 9, 1994, entitled "Improved Migration Imaging Members," with the named inventors Edward G. Zwartz, Carol A. Jennings, Man C. Tam, Philip H. Soden, Arthur Y. Jones, Arnold L. Pundsack, Enrique Levy, Ah-Mee Hor, and William W. Limburg, the disclosure of which is totally incorporated herein by reference, discloses a migration imaging member comprising a substrate, a first softenable layer comprising a first softenable material and a first migration marking material contained at or near the surface of the first softenable layer spaced from the substrate, and a second softenable layer comprising a second softenable material and a second migration marking material. Also disclosed is a migration imaging process employing the aforesaid imaging member.

Copending application U.S. Ser. No. 08/413,667, filed Mar. 30, 1995, entitled "Improved Apparatus and Process for Preparation of Migration Imaging Members," with the named inventors Philip H. Soden and Arnold L. Pundsack, the disclosure of which is totally incorporated herein by reference, discloses an apparatus for evaporation of a vacuum evaporatable material onto a substrate, said apparatus comprising (a) a walled container for the vacuum evaporatable material having a plurality of apertures in a surface thereof, said apertures being configured so that the vacuum evaporatable material is uniformly deposited onto the substrate; and (b) a source of heat sufficient to effect evaporation of the vacuum evaporatable material from the container through the apertures onto the substrate, wherein the surface of the container having the plurality of apertures therein is maintained at a temperature equal to or greater than the temperature of the vacuum evaporatable material.

Copending application U.S. Ser. No. 442,227, filed concurrently herewith, entitled "Improved Migration Imaging Members," with the named inventors Shadi L. Malhotra, Liquin Chen, and Marie-Eve Perron, the disclosure of which is totally incorporated herein by reference, discloses a migration imaging member comprising (a) a substrate, (b) a softenable layer comprising a softenable material and a photosensitive migration marking material, and (c) a transparentizing agent which transparentizes migration marking material in contact therewith contained in at least one layer of the migration imaging member. Also disclosed is a process which comprises (1) providing a migration imaging member comprising (a) a substrate, (b) a softenable layer comprising a softenable material and a photosensitive migration marking material, and (c) a transparentizing agent which transparentizes migration marking material in contact therewith contained in at least one layer of the migration imaging member; (2) uniformly charging the imaging member; (3) subsequent to step (2), exposing the charged imaging member to activating radiation at a wavelength to which the migration marking material is sensitive; (4) subsequent to step (3), causing the softenable material to soften and enabling a first portion of the migration marking material to migrate through the softenable material toward the substrate in an imagewise pattern while a second portion of the migration marking material remains substantially unmigrated within the softenable layer, wherein subsequent to migration of the first portion of migration marking material, either (a) the first portion of migration marking material contacts the transparentizing agent and the second portion of migration marking material does not contact the transparentizing agent; or (b) the second portion of migration marking material contacts the transparentizing agent and the first portion of migration marking material does not contact the transparentizing agent.

While known apparatus and processes are suitable for their intended purposes, a need remains for methods of improving the optical contrast density of migration imaging members. Further, there is a need for methods for improving optical contrast density of migration imaging members wherein the optical density of the $D_{min}$ areas of the imaged member is decreased without a corresponding decrease in the optical density of the $D_{max}$ areas of the imaged member. Additionally, there is a need for methods for improving optical contrast density of migration imaging members wherein the optical density of the $D_{min}$ areas of the imaged member with respect to ultraviolet light passing through the imaging member is decreased without a corresponding decrease in the optical density of the $D_{max}$ areas of the imaged member with respect to ultraviolet light passing through the imaging member. There is also a need for methods of developing migration imaging members wherein the image is sign-reversed.

SUMMARY OF THE INVENTION

It is an object of the present invention to provide methods for improving the optical contrast density of migration imaging members with the above noted advantages.

It is another object of the present invention to provide methods for improving optical contrast density of migration imaging members wherein the optical density of the $D_{min}$ areas of the imaged member is decreased without a corresponding decrease in the optical density of the $D_{max}$ areas of the imaged member.

It is yet another object of the present invention to provide methods for improving optical contrast density of migration imaging members wherein the optical density of the $D_{min}$ areas of the imaged member with respect to ultraviolet light passing through the imaging member is decreased without a corresponding decrease in the optical density of the $D_{max}$ areas of the imaged member with respect to ultraviolet light passing through the imaging member.

It is still another object of the present invention to provide methods of developing migration imaging members wherein the image is sign-reversed.

These and other objects of the present invention (or specific embodiments thereof) can be achieved by providing a process which comprises (a) providing a migration imaging member comprising (1) a substrate and (2) a softenable layer comprising a softenable material and a photosensitive migration marking material present in the softenable layer as a monolayer of particles situated at or near the surface of the softenable layer spaced from the substrate; (b) uniformly charging the imaging member; (c) imagewise exposing the charged imaging member to activating radiation at a wavelength to which the migration marking material is sensitive; (d) subsequent to step (c), causing the softenable material to soften and enabling a first portion of the migration marking material to migrate through the softenable material toward the substrate in an imagewise pattern while a second portion of the migration marking material remains substantially unmigrated within the softenable layer; and (e) contacting the second portion of the migration marking material with a transparentizing agent which transparentizes migration marking material. Optionally, thereafter, the migration imaging member can be uniformly charged and uniformly exposed to activating radiation at a wavelength to which the migration marking material is sensitive, followed by again causing the softenable material to soften and enabling the first portion of the migration marking material to migrate further through the softenable material toward the substrate.

DETAILED DESCRIPTION OF THE INVENTION

The present invention encompasses contacting an imaged migration imaging member with an agent for transparentizing migration marking material in a manner such that unmigrated marking material is transparentized while migrated migration marking material is not transparentized. The transparentizing agent is a material that affects migration marking material which comes into contact therewith by reducing the optical density of the softenable layer containing the migration marking material in said areas.

Figure 1:
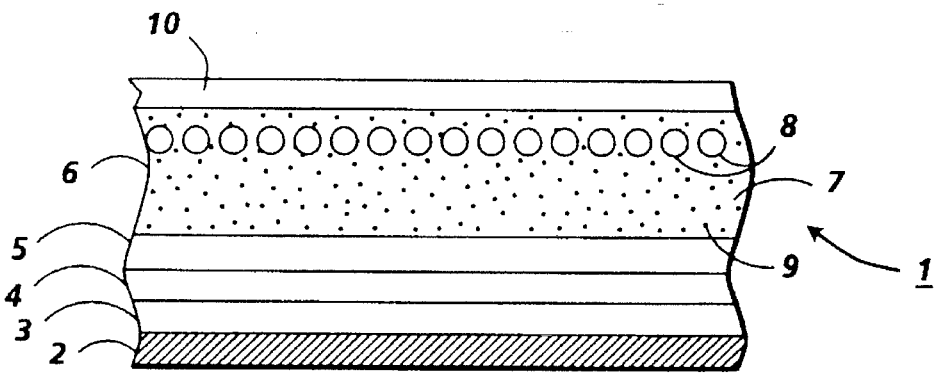
FIG. 1 illustrates schematically one migration imaging member suitable for the present invention.

An example of a migration imaging member suitable for the present invention is illustrated schematically in FIG. 1. As illustrated schematically in FIG. 1, migration imaging member 1 comprises a substrate 2, an optional adhesive layer 3 situated on the substrate 2, an optional charge blocking layer 4 situated on optional adhesive layer 3, an optional charge transport layer 5 situated on optional charge blocking layer 4, and a softenable layer 6 situated on optional charge transport layer 5, said softenable layer 6 comprising softenable material 7, migration marking material 8 situated at or near the surface of the layer spaced from the substrate, and optional charge transport material 9 dispersed throughout softenable material 7. Optional overcoating layer 10 is situated on the surface of softenable layer 6 spaced from the substrate 2. Any or all of the optional layers and materials can be absent from the imaging member. In addition, any of the optional layers present need not be in the order shown, but can be in any suitable arrangement. The migration imaging member can be in any suitable configuration, such as a web, a foil, a laminate, a strip, a sheet, a coil, a cylinder, a drum, an endless belt, an endless mobius strip, a circular disc, or any other suitable form.

The substrate can be either electrically conductive or electrically insulating. When conductive, the substrate can be opaque, translucent, semitransparent, or transparent, and can be of any suitable conductive material, including copper, brass, nickel, zinc, chromium, stainless steel, conductive plastics and rubbers, aluminum, semitransparent aluminum, steel, cadmium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. When insulative, the substrate can be opaque, translucent, semitransparent, or transparent, and can be of any suitable insulative material, such as paper, glass, plastic, polyesters such as Mylar® (available from Du Pont) or Melinex® 442 (available from ICI Americas, Inc.), and the like. In addition, the substrate can comprise an insulative layer with a conductive coating, such as vacuum-deposited metallized plastic, such as titanized or aluminized Mylar® polyester, wherein the metallized surface is in contact with the softenable layer or any other layer situated between the substrate and the softenable layer. The substrate has any effective thickness, typically from about 6 to about 250 microns, and preferably from about 50 to about 200 microns, although the thickness can be outside these ranges.

The softenable layer can comprise one or more layers of softenable materials, which can be any suitable material, typically a plastic or thermoplastic material which is soluble in a solvent or softenable, for example, in a solvent liquid, solvent vapor, heat, or any combinations thereof. When the softenable layer is to be softened or dissolved either during or after imaging, it should be soluble in a solvent that does not attack the migration marking material. By softenable is meant any material that can be rendered by a development step as described herein permeable to migration material migrating through its bulk. This permeability typically is achieved by a development step entailing dissolving, melting, or softening by contact with heat, vapors, partial solvents, as well as combinations thereof. Examples of suitable softenable materials include styrene-acrylic copolymers, such as styrene-hexylmethacrylate copolymers, styrene acrylate copolymers, styrene butylmethacrylate copolymers, styrene butylacrylate ethylacrylate copolymers, styrene ethylacrylate acrylic acid copolymers, and the like, polystyrenes, including polyalphamethyl styrene, alkyd substituted polystyrenes, styrene-olefin copolymers, styrene-vinyltoluene copolymers, polyesters, polyurethanes, polycarbonates, polyterpenes, silicone elastomers, mixtures thereof, copolymers thereof, and the like, as well as any other suitable materials as disclosed, for example, in U.S. Pat. No. 3,975,195 and other U.S. patents directed to migration imaging members which have been incorporated herein by reference. The softenable layer can be of any effective thickness, typically from about 1 to about 30 microns, preferably from about 2 to about 25 microns, and more preferably from about 2 to about 10 microns, although the thickness can be outside these ranges. The softenable layer can be applied to the conductive layer by any suitable coating process. Typical coating processes include draw bar coating, spray coating, extrusion, dip coating, gravure roll coating, wire-wound rod coating, air knife coating and the like.

The softenable layer also contains migration marking material. The migration marking material can be electrically photosensitive, photoconductive, or of any other suitable combination of materials, or possess any other desired physical property and still be suitable for use in the migration imaging members of the present invention. The migration marking materials preferably are particulate, wherein the particles are closely spaced from each other. Preferred migration marking materials generally are spherical in shape and submicron in size. The migration marking material generally is capable of substantial photodischarge upon electrostatic charging and exposure to activating radiation and is substantially absorbing and opaque to activating radiation in the spectral region where the photosensitive migration marking particles photogenerate charges. The migration marking material is generally present as a thin layer or monolayer of particles situated at or near the surface of the softenable layer spaced from the conductive layer. When present as particles, the particles of migration marking material preferably have an average diameter of up to 2 microns, and more preferably of from about 0.1 to about 1 micron. The layer of migration marking particles is situated at or near that surface of the softenable layer spaced from or most distant from the conductive layer. Preferably, the particles are situated at a distance of from about 0.01 to 0.1 micron from the layer surface, and more preferably from about 0.02 to 0.08 micron from the layer surface. Preferably, the particles are situated at a distance of from about 0.005 to about 0.2 micron from each other, and more preferably at a distance of from about 0.05 to about 0.1 micron from each other, the distance being measured between the closest edges of the particles, i.e. from outer diameter to outer diameter. The migration marking material contiguous to the outer surface of the softenable layer is present in any effective amount, preferably from about 5 to about 80 percent by total weight of the softenable layer, and more preferably from about 25 to about 80 percent by total weight of the softenable layer, although the amount can be outside of this range.

Examples of suitable migration marking materials include selenium, alloys of selenium with alloying components such as tellurium, arsenic, antimony, thallium, bismuth, or mixtures thereof, selenium and alloys of selenium doped with halogens, as disclosed in, for example, U.S. Pat. No. 3,312,548, the disclosure of which is totally incorporated herein by reference, and the like, phthalocyanines, and any other suitable materials as disclosed, for example, in U.S. Pat. No. 3,975,195 and other U.S. patents directed to migration imaging members and incorporated herein by reference.

The migration imaging members can optionally contain a charge transport material. The charge transport material can be any suitable charge transport material either capable of acting as a softenable layer material or capable of being dissolved or dispersed on a molecular scale in the softenable layer material. When a charge transport material is also contained in another layer in the imaging member, preferably there is continuous transport of charge through the entire film structure. The charge transport material is defined as a material which is capable of allowing the charge injection process for one sign of charge from the migration marking material into the softenable layer and also of transporting that charge through the softenable layer. The charge transport material can be either a hole transport material (transports positive charges) or an electron transport material (transports negative charges). The sign of the charge used to sensitize the migration imaging member during imaging can be of either polarity. Charge transporting materials are well known in the art. Typical charge transporting materials include the following:

Diamine transport molecules of the type described in U.S. Pat. No. 4,306,008, U.S. Pat. No. 4,304,829, U.S. Pat. No. 4,233,384, U.S. Pat. No. 4,115,116, U.S. Pat. No. 4,299,897, and U.S. Pat. No. 4,081,274, the disclosures of each of which are totally incorporated herein by reference. Typical diamine transport molecules include N,N'-diphenyl-N,N'-bis(3"-methylphenyl)-(1,1'-biphenyl)-4,4'-diamine, N,N'-diphenyl-N,N'-bis(4-methylphenyl)-(1,1'-biphenyl)-4,4'-diamine, N,N'-diphenyl-N,N'-bis(2-methylphenyl)-(1,1'-biphenyl)-4,4'-diamine, N,N'-diphenyl-N,N'-bis(3-ethylphenyl)-(1,1'-biphenyl)-4,4'-diamine, N,N'-diphenyl-N,N'-bis(4-ethylphenyl)-(1,1'-biphenyl)-4,4'-diamine, N,N'-diphenyl-N,N'-bis(4-n-butylphenyl)-(1,1'-biphenyl)-4,4'-diamine, N,N'-diphenyl-N,N'-bis(3-chlorophenyl)-[1,1'-biphenyl]-4,4'-diamine, N,N'-diphenyl-N,N'-bis(4-chlorophenyl)-[1,1'-biphenyl]-4,4'-diamine, N,N'-diphenyl-N,N'-bis(phenylmethyl)-[1,1'-biphenyl]-4,4'-diamine, N,N,N',N'-tetraphenyl-[2,2'-dimethyl-1,1'-biphenyl]-4,4'-diamine, N,N,N',N'-tetra-(4-methylphenyl)[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'- diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, and the like.

Pyrazoline transport molecules as disclosed in U.S. Pat. No. 4,315,982, U.S. Pat. No. 4,278,746, and U.S. Pat. No. 3,837,851, the disclosures of each of which are totally incorporated herein by reference. Typical pyrazoline transport molecules include 1-[lepidyl-(2)]-3-(p-diethylaminophenyl)-5-(p-diethylaminophenyl)pyrazoline, 1-[quinolyl-(2)]3-(p-diethylaminophenyl)-5-(p-diethylaminophenyl)pyrazoline, 1-[pyridyl(2)]-3-(p-diethylaminostyryl)-5-(p-diethylaminophenyl)pyrazoline, 1-[6-methoxypyridyl-(2)]-3-(p-diethylaminostyryl)-5-(p-diethylaminophenyl)pyrazoline, 1-phenyl-3-[p-dimethylaminostyryl]-5-(P-dimethylaminostyryl)pyrazoline, 1-phenyl-3-[p-diethylaminostyryl]-5-(p-diethylaminostyryl)pyrazoline, and the like.

Substituted fluorene charge transport molecules as described in U.S. Pat. No. 4,245,021, the disclosure of which is totally incorporated herein by reference. Typical fluorene charge transport molecules include 9-(4'-dimethylaminobenzylidene)fluorene, 9-(4'-methoxybenzylidene)fluorene, 9-(2',4'-dimethoxybenzylidene)fluorene, 2-nitro-9-benzylidene-fluorene,2-nitro-9-(4'-diethylaminobenzylidene)fluorene, and the like.

Oxadiazole transport molecules such as 2,5-bis(4-diethylaminophenyl)-1,3,4-oxadiazole, pyrazoline, imidazole, triazole, and the like. Other typical oxadiazole transport molecules are described, for example, in German Patent 1,058,836, German Patent 1,060,260, and German Patent 1,120,875, the disclosures of each of which are totally incorporated herein by reference.

Hydrazone transport molecules, such as p-diethylamino benzaldehyde-(diphenylhydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde-(diphenylhydrazone), 1-naphthalenecarbaldehyde 1-methyl-1-phenylhydrazone, 1-naphthalenecarbaldehyde 1,1-phenylhydrazone, 4-methoxynaphthlene-1-carbaldeyde 1-methyl-1-phenylhydrazone, and the like. Other typical hydrazone transport molecules are described, for example in U.S. Pat. No. 4,150,987, U.S. Pat. No. 4,385,106, U.S. Pat. No. 4,338,388, and U.S. Pat. No. 4,387,147, the disclosures of each of which are totally incorporated herein by reference.

Carbazole phenyl hydrazone transport molecules such as 9-methylcarbazole-3-carbaldehyde-1,1-diphenylhydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and the like. Other typical carbazole phenyl hydrazone transport molecules are described, for example, in U.S. Pat. No. 4,256,821 and U.S. Pat. No. 4,297,426, the disclosures of each of which are totally incorporated herein by reference.

Vinyl-aromatic polymers such as polyvinyl anthracene, polyacenaphthylene; formaldehyde condensation products with various aromatics such as condensates of formaldehyde and 3-bromopyrene; 2,4,7-trinitrofluorenone, and 3,6-dinitro-N-t-butylnaphthalimide as described, for example, in U.S. Pat. No. 3,972,717, the disclosure of which is totally incorporated herein by reference.

Oxadiazole derivatives such as 2,5-bis-(p-diethylaminophenyl)oxadiazole-1,3,4 described in U.S. Pat. No. 3,895,944, the disclosure of which is totally incorporated herein by reference.

Tri-substituted methanes such as alkyl-bis(N,N-dialkylaminoaryl)methane, cycloalkyl-bis(N,N-dialkylaminoaryl-)methane, and cycloalkenyl-bis(N,N-dialkylaminoaryl-)methane as described in U.S. Pat. No. 3,820,989, the disclosure of which is totally incorporated herein by reference.

9-Fluorenylidene methane derivatives having the formula

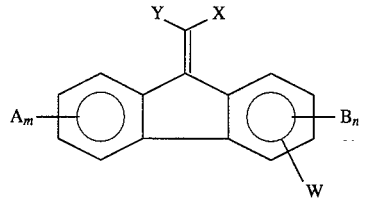

wherein X and Y are cyano groups or alkoxycarbonyl groups; A, B, and W are electron withdrawing groups independently selected from the group consisting of acyl, alkoxycarbonyl, nitro, alkylaminocarbonyl, and derivatives thereof; m is a number of from 0 to 2; and n is the number 0 or 1 as described in U.S. Pat. No. 4,474,865, the disclosure of which is totally incorporated herein by reference. Typical 9-fluorenylidene methane derivatives encompassed by the above formula include (4-n-butoxycarbonyl-9-fluorenylidene)malonontrile, (4-phenethoxycarbonyl-9-fluorenylidene)malonontrile, (4-carbitoxy-9-fluorenylidene)malonontrile, (4-n-butoxycarbonyl-2,7-dinitro-9-fluorenylidene)malonate, and the like.

Other charge transport materials include poly-1-vinylpyrene, poly-9-vinylanthracene, poly-9-(4-pentenyl)-carbazole, poly-9-(5-hexyl)carbazole, polymethylene pyrene, poly-1-(pyrenyl)-butadiene, polymers such as alkyl, nitro, amino, halogen, and hydroxy substitute polymers such as poly-3-amino carbazole, 1,3-dibromo-poly-N-vinyl carbazole, 3,6-dibromo-poly-N-vinyl carbazole, and numerous other transparent organic polymeric or non-polymeric transport materials as described in U.S. Pat. No. 3,870,516, the disclosure of which is totally incorporated herein by reference. Also suitable as charge transport materials are phthalic anhydride, tetrachlorophthalic anhydride, benzil, mellitic anhydride, S-tricyanobenzene, picryl chloride, 2,4-dinitrochlorobenzene, 2,4-dinitrobromobenzene, 4-nitrobiphenyl, 4,4-dinitrophenyl, 2,4,6-trinitroanisole, trichlorotrinitrobenzene, trinitro-O-toluene, 4,6-dichloro-1,3-dinitrobenzene, 4,6-dibromo-1,3-dinitrobenzene, P-dinitrobenzene, chloranil, bromanil, and mixtures thereof, 2,4,7-trinitro-9-fluorenone, 2,4,5,7-tetranitrofluorenone, trinitroanthracene, dinitroacridene, tetracyanopyrene, dinitroanthraquinone, polymers having aromatic or heterocyclic groups with more than one strongly electron withdrawing substituent such as nitro, sulfonate, carboxyl, cyano, or the like, including polyesters, polysiloxanes, polyamides, polyurethanes, and epoxies, as well as block, graft, or random copolymers containing the aromatic moiety, and the like, as well as mixtures thereof, as described in U.S. Pat. No. 4,081,274, the disclosure of which is totally incorporated herein by reference.

Also suitable are charge transport materials such as triarylamines, including tritolyl amine, of the formula

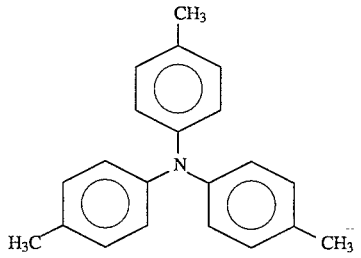

and the like, as disclosed in, for example, U.S. Pat. No. 3,240,597 and U.S. Pat. No. 3,180,730, the disclosures of which are totally incorporated herein by reference, and substituted diarylmethane and triarylmethane compounds, including bis-(4-diethylamino-2-methylphenyl)phenylmethane, of the formula

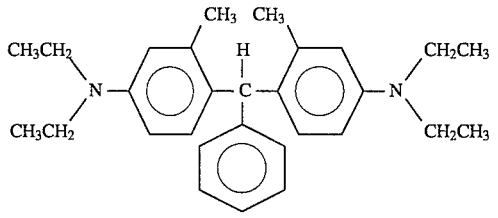

and the like, as disclosed in, for example, U.S. Pat. No. 4,082,551, U.S. Pat. No. 3,755,310, U.S. Pat. No. 3,647,431, British Patent 984,965, British Patent 980,879, and British Patent 1,141,666, the disclosures of which are totally incorporated herein by reference.

When the charge transport molecules are combined with an insulating binder to form the softenable layer, the amount of charge transport molecule which is used can vary depending upon the particular charge transport material and its compatibility (e.g. solubility) in the continuous insulating film forming binder phase of the softenable matrix layer and the like. Satisfactory results have been obtained using between about 5 percent to about 50 percent by weight charge transport molecule based on the total weight of the softenable layer. A particularly preferred charge transport molecule is one having the general formula

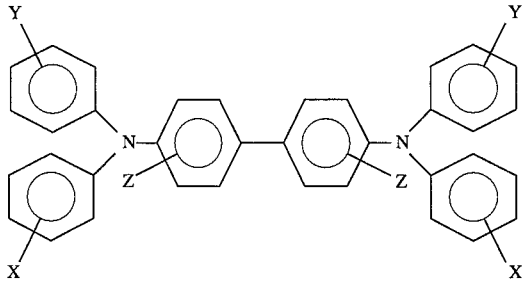

wherein X, Y and Z are selected from the group consisting of hydrogen, an alkyl group having from 1 to about 20 carbon atoms and chlorine, and at least one of X, Y and Z is independently selected to be an alkyl group having from 1 to about 20 carbon atoms or chlorine. If Y and Z are hydrogen, the compound can be named N,N'-diphenyl-N,N'-bis(alkylphenyl)-[1,1'-biphenyl]-4,4'-diamine wherein the alkyl is, for example, methyl, ethyl, propyl, n-butyl, or the like, or the compound can be N,N'-diphenyl-N,N'-bis(chlorophenyl)-[1,1'-biphenyl]-4,4'-diamine. results can be obtained when the softenable layer contains between about 8 percent to about 40 percent by weight of these diamine compounds based on the total weight of the softenable layer. Optimum results are achieved when the softenable layer contains between about 16 percent to about 32 percent by weight of N,N'-diphenyl-N,N'-bis(3"-methylphenyl)-(1,1'-biphenyl)-4,4'-diamine based on the total weight of the softenable layer.

The charge transport material is present in the softenable material in any effective amount, typically from about 5 to about 50 percent by weight and preferably from about 8 to about 40 percent by weight, although the amount can be outside these ranges. Alternatively, the softenable layer can employ the charge transport material as the softenable material if the charge transport material possesses the necessary film-forming characteristics and otherwise functions as a softenable material. The charge transport material can be incorporated into the softenable layer by any suitable technique. For example, it can be mixed with the softenable layer components by dissolution in a common solvent. If desired, a mixture of solvents for the charge transport material and the softenable layer material can be employed to facilitate mixing and coating. The charge transport molecule and softenable layer mixture can be applied to the substrate by any conventional coating process. Typical coating processes include draw bar coating, spray coating, extrusion, dip coating, gravure roll coating, wire-wound rod coating, air knife coating, and the like.

The optional adhesive layer can include any suitable adhesive material. Typical adhesive materials include copolymers of styrene and an acrylate, polyester resin such as DuPont 49000 (available from E. I. dupont de Nemours Company), copolymer of acrylonitrile and vinylidene chloride, polyvinyl acetate, polyvinyl butyral and the like and mixtures thereof. The adhesive layer can have any thickness, typically from about 0.05 to about 1 micron, although the thickness can be outside of this range. When an adhesive layer is employed, it preferably forms a uniform and continuous layer having a thickness of about 0.5 micron or less to ensure satisfactory discharge during the imaging process. It can also optionally include charge transport molecules.

The optional charge transport layer can comprise any suitable film forming binder material. Typical film forming binder materials include styrene acrylate copolymers, polycarbonates, co-polycarbonates, polyesters, co-polyesters, polyurethanes, polyvinyl acetate, polyvinyl butyral, polystyrenes, alkyd substituted polystyrenes, styrene-olefin copolymers, styrene-co-n-hexylmethacrylate, an 80/20 mole percent copolymer of styrene and hexylmethacrylate having an intrinsic viscosity of 0.179 dl/gm; other copolymers of styrene and hexylmethacrylate, styrene-vinyltoluene copolymers, polyalpha-methylstyrene, mixtures thereof, and copolymers thereof. The above group of materials is not intended to be limiting, but merely illustrative of materials suitable as film forming binder materials in the optional charge transport layer. The film forming binder material typically is substantially electrically insulating and does not adversely chemically react during the imaging process. Although the optional charge transport layer has been described as coated on a substrate, in some embodiments, the charge transport layer itself can have sufficient strength and integrity to be substantially self supporting and can, if desired, be brought into contact with a suitable conductive substrate during the imaging process. As is well known in the art, a uniform deposit of electrostatic charge of suitable polarity can be substituted for a conductive layer. Alternatively, a uniform deposit of electrostatic charge of suitable polarity on the exposed surface of the charge transport spacing layer can be substituted for a conductive layer to facilitate the application of electrical migration forces to the migration layer. This technique of "double charging" is well known in the art. The charge transport layer is of any effective thickness, typically from about 1 to about 25 microns, and preferably from about 2 to about 20 microns, although the thickness can be outside these ranges.

Charge transport molecules suitable for the charge transport layer are described in detail hereinabove. The specific charge transport molecule utilized in the charge transport layer of any given imaging member can be identical to or different from the charge transport molecule employed in the adjacent softenable layer. Similarly, the concentration of the charge transport molecule utilized in the charge transport spacing layer of any given imaging member can be identical to or different from the concentration of charge transport molecule employed in the adjacent softenable layer. When the charge transport material and film forming binder are combined to form the charge transport spacing layer, the amount of charge transport material used can vary depending upon the particular charge transport material and its compatibility (e.g. solubility) in the continuous insulating film forming binder. Satisfactory results have been obtained using between about 5 percent and about 50 percent based on the total weight of the optional charge transport spacing layer, although the amount can be outside this range. The charge transport material can be incorporated into the charge transport layer by techniques similar to those employed for the softenable layer.

The optional charge blocking layer can be of various suitable materials, provided that the objectives of the present invention are achieved, including aluminum oxide, polyvinyl butyral, silane and the like, as well as mixtures thereof. This layer, which is generally applied by known coating techniques, is of any effective thickness, typically from about 0.05 to about 0.5 micron, and preferably from about 0.05 to about 0.1 micron. Typical coating processes include draw bar coating, spray coating, extrusion, dip coating, gravure roll coating, wire-wound rod coating, air knife coating and the like.

The optional overcoating layer can be substantially electrically insulating, or have any other suitable properties, provided that it is permeable to the transparentizing agent and/or to any liquid employed to transport the transparentizing agent to the migration marking material. The overcoating preferably is substantially transparent, at least in the spectral region where electromagnetic radiation is used for imagewise exposure step in the imaging process. The overcoating layer is continuous and preferably of a thickness up to about 0.1 to 4 microns. More preferably, the overcoating has a thickness of between about 0.1 and about 2 micron to minimize residual charge buildup. Overcoating layers greater than about 4 microns thick can also be used. Typical overcoating materials include acrylic-styrene copolymers, methacrylate polymers, methacrylate copolymers, styrene-butylmethacrylate copolymers, butylmethacrylate resins, vinylchloride copolymers, fluorinated homo or copolymers, high molecular weight polyvinyl acetate, organosilicon polymers and copolymers, polyesters, polycarbonates, polyamides, polyvinyl toluene and the like. The overcoating layer generally protects the softenable layer to provide greater resistance to the adverse effects of abrasion during handling and imaging. The overcoating layer preferably adheres strongly to the softenable layer to minimize damage. The overcoating layer can also have abhesive properties at its outer surface which provide improved resistance to filming during handling and/or imaging. The abhesive properties can be inherent in the overcoating layer or can be imparted to the overcoating layer by incorporation of another layer or component of abhesive material. These abhesive materials should not degrade the film forming components of the overcoating and preferably have a surface energy of less than about 30 ergs/cm$^2$. Typical abhesive materials include fatty acids, salts and esters, fluorocarbons, silicones, and the like. The coatings can be applied by any suitable technique such as draw bar, spray, dip, melt, extrusion or gravure coating. It will be appreciated that these overcoating layers protect the imaging member before imaging, during imaging, after the members have been imaged.

Figure 2:
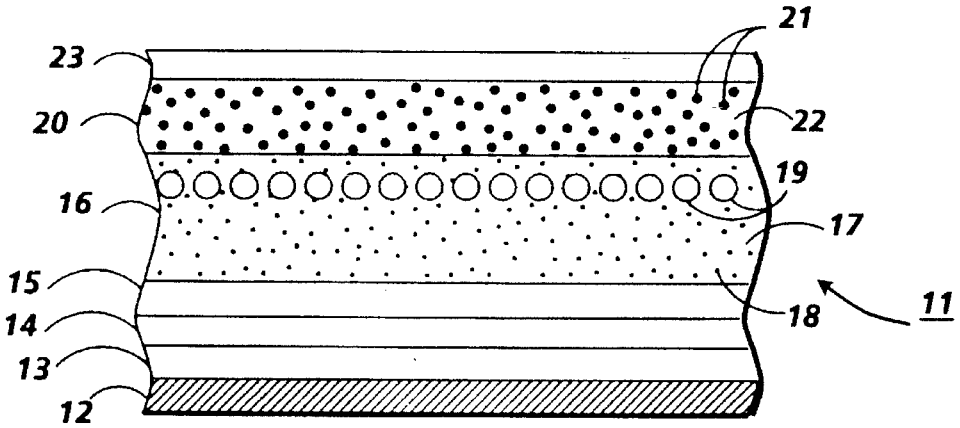
FIGS. 2 and 3 illustrate schematically infrared-sensitive migration imaging members suitable for the present invention.

As illustrated schematically in FIG. 2, migration imaging member 11 comprises in the order shown a substrate 12, an optional adhesive layer 13 situated on substrate 12, an optional charge blocking layer 14 situated on optional adhesive layer 13, an optional charge transport layer 15 situated on optional charge blocking layer 14, a softenable layer 16 situated on optional charge transport layer 15, said softenable layer 16 comprising softenable material 17, charge transport material 18, and migration marking material 19 situated at or near the surface of the layer spaced from the substrate, and an infrared or red light radiation sensitive layer 20 situated on softenable layer 16 comprising infrared or red light radiation sensitive pigment particles 21 optionally dispersed in polymeric binder 22. Alternatively (not shown), infrared or red light radiation sensitive layer 20 can comprise infrared or red light radiation sensitive pigment particles 21 directly deposited as a layer by, for example, vacuum evaporation techniques or other coating methods. Optional overcoating layer 23 is situated on the surface of imaging member 11 spaced from the substrate 12.

Figure 3:
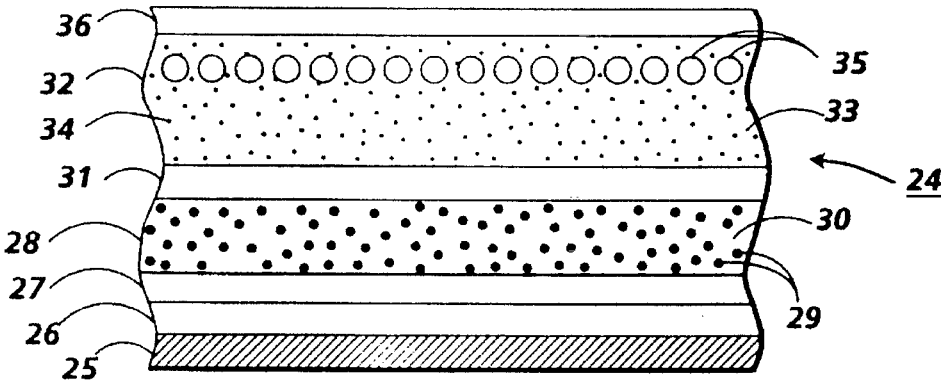

As illustrated schematically in FIG. 3, migration imaging member 24 comprises in the order shown a substrate 25, an optional adhesive layer 26 situated on substrate 25, an optional charge blocking layer 27 situated on optional adhesive layer 26, an infrared or red light radiation sensitive layer 28 situated on optional charge blocking layer 27 comprising infrared or red light radiation sensitive pigment particles 29 optionally dispersed in polymeric binder 30, an optional charge transport layer 31 situated on infrared or red light radiation sensitive layer 28, and a softenable layer 32 situated on optional charge transport layer 31, said softenable layer 32 comprising softenable material 33, charge transport material 34, and migration marking material 35 situated at or near the surface of the layer spaced from the substrate. Optional overcoating layer 36 is situated on the surface of imaging member 24 spaced from the substrate 25.

The infrared or red light sensitive layer generally comprises a pigment sensitive to infrared and/or red light radiation. While the infrared or red light sensitive pigment may exhibit some photosensitivity in the wavelength to which the migration marking material is sensitive, it is preferred that photosensitivity in this wavelength range be minimized so that the migration marking material and the infrared or red light sensitive pigment exhibit absorption peaks in distinct, different wavelength regions. This pigment can be deposited as the sole or major component of the infrared or red light sensitive layer by any suitable technique, such as vacuum evaporation or the like. An infrared or red light sensitive layer of this type can be formed by placing the pigment and the imaging member comprising the substrate and any previously coated layers into an evacuated chamber, followed by heating the infrared or red light sensitive pigment to the point of sublimation. The sublimed material recondenses to form a solid film on the imaging member. Alternatively, the infrared or red light sensitive pigment can be dispersed in a polymeric binder and the dispersion coated onto the imaging member to form a layer. Examples of suitable red light sensitive pigments include perylene pigments such as benzimidazole perylene, dibromoanthranthrone, crystalline trigonal selenium, beta-metal free phthalocyanine, azo pigments, and the like, as well as mixtures thereof. Examples of suitable infrared sensitive pigments include X-metal free phthalocyanine, metal phthalocyanines such as vanadyl phthalocyanine, chloroindium phthalocyanine, titanyl phthalocyanine, chloroaluminum phthalocyanine, copper phthalocyanine, magnesium phthalocyanine, and the like, squaraines, such as hydroxy squaraine, and the like as well as mixtures thereof. Examples of suitable optional polymeric binder materials include polystyrene, styrene-acrylic copolymers, such as styrene-hexylmethacrylate copolymers, styrene-vinyl toluene copolymers, polyesters, such as PE-200, available from Goodyear, polyurethanes, polyvinylcarbazoles, epoxy resins, phenoxy resins, polyamide resins, polycarbonates, polyterpenes, silicone elastomers, polyvinylalcohols, such as Gelvatol 20-90, 9000, 20-60, 6000, 20-30, 3000, 40-20, 40-10, 26-90, and 30-30, available from Monsanto Plastics and Resins Co., St. Louis, Mo., polyvinylformals, such as Formvar 12/85, 5/95E, 6/95E, 7/95E, and 15/95E, available from Monsanto Plastics and Resins Co., St. Louis, Mo., polyvinylbutyrals, such as Butvar B-72, B-74, B-73, B-76, B-79, B-90, and B-98, available from Monsanto Plastics and Resins Co., St. Louis, Mo., Zeneca resin A622, available from Zeneca Colours, Wilmington, Del., and the like as well as mixtures thereof. When the infrared or red light sensitive layer comprises both a polymeric binder and the pigment, the layer typically comprises the binder in an amount of from about 5 to about 95 percent by weight and the pigment in an amount of from about 5 to about 95 percent by weight, although the relative amounts can be outside this range. Preferably, the infrared or red light sensitive layer comprises the binder in an amount of from about 40 to about 90 percent by weight and the pigment in an amount of from about 10 to about 60 percent by weight. Optionally, the infrared sensitive layer can contain a charge transport material as described herein when a binder is present; when present, the charge transport material is generally contained in this layer in an amount of from about 5 to about 30 percent by weight of the layer. The optional charge transport material can be incorporated into the infrared or red light radiation sensitive layer by any suitable technique. For example, it can be mixed with the infrared or red light radiation sensitive layer components by dissolution in a common solvent. If desired, a mixture of solvents for the charge transport material and the infrared or red light sensitive layer material can be employed to facilitate mixing and coating. The infrared or red light radiation sensitive layer mixture can be applied to the substrate by any conventional coating process. Typical coating processes include draw bar coating, spray coating, extrusion, dip coating, gravure roll coating, wire-wound rod coating, air knife coating, and the like. An infrared or red light sensitive layer wherein the pigment is present in a binder can be prepared by dissolving the polymer binder in a suitable solvent, dispersing the pigment in the solution by ball milling, coating the dispersion onto the imaging member comprising the substrate and any previously coated layers, and evaporating the solvent to form a solid film. When the infrared or red light sensitive layer is coated directly onto the softenable layer containing migration marking material, preferably the selected solvent is capable of dissolving the polymeric binder for the infrared or red sensitive layer but does not dissolve the softenable polymer in the layer containing the migration marking material. One example of a suitable solvent is isobutanol with a polyvinyl butyral binder in the infrared or red sensitive layer and a styrene/ethyl acrylate/acrylic acid terpolymer softenable material in the layer containing migration marking material. The infrared or red light sensitive layer can be of any effective thickness. Typical thicknesses for infrared or red light sensitive layers comprising a pigment and a binder are from about 0.05 to about 2 microns, and preferably from about 0.1 to about 1.5 microns, although the thickness can be outside these ranges. Typical thicknesses for infrared or red light sensitive layers consisting of a vacuum-deposited layer of pigment are from about 200 to about 2,000 Angstroms, and preferably from about 300 to about 1,000 Angstroms, although the thickness can be outside these ranges.

The transparentizing agent can be applied to the unmigrated migration marking material by any suitable method. For example, the transparentizing agent can be dissolved or dispersed in a suitable solvent and applied to the surface of the softenable layer by any desired technique, such as draw bar coating, spray coating, extrusion, dip coating, gravure roll coating, wire-wound rod coating, air knife coating, wiping, painting, squeegee applicator, dabbing, or the like. In this embodiment, the transparentizing agent can be present in the solution or dispersion in any effective amount, typically from about 0.1 to about 50 percent by weight, and preferably from about 0.5 to about 2 percent by weight, although the amount can be outside these ranges. Examples of solvents include water, alcohols such as methanol, ethanol, isopropanol, and the like, hydrocarbons such as toluene, hexane, heptane, and the like, ethers such as diethyl ether, tetrahydrofuran, and the like, and any other suitable solvent.

The transparentizing agent preferably is applied to the migration imaging member in an amount ranging from about 0.5 part by weight transparentizing agent per 1 part by weight migration marking material to about 2 parts by weight transparentizing agent per 1 part by weight migration marking material, although the relative amounts can be outside this range.

The transparentizing agent can also be applied to the imaging member by coating the transparentizing agent, either alone or dispersed within a binder, onto a base sheet and then contacting the surface of the base sheet coated with the transparentizing agent to the surface of the imaged migration imaging member so that the transparentizing agent contacts the unmigrated migration marking material. For example, a layer of softenable material (either the same as or different from the softenable material employed in the softenable layer) can be prepared by admixing the softenable material and the transparentizing agent and applying the mixture to the base sheet by any desired method, such as draw bar coating, spray coating, extrusion, dip coating, gravure roll coating, wire-wound rod coating, air knife coating or the like. Alternatively, the transparentizing agent can be coated directly onto the base sheet, with no need for a binder or matrix, by dissolving or dispersing the transparentizing agent into a solvent, coating the solution or dispersion onto the base sheet, and allowing the solvent to evaporate. For transparentizing agents suitable for evaporation coating techniques, the transparentizing agent can be vacuum evaporated onto the base sheet. Preferably, the layer on the base sheet containing the transparentizing agent is from about 0.1 to about 4 microns thick, and preferably from about 0.1 to about 2 microns thick, although the thickness can be outside these ranges.

The transparentizing agent preferably is a monomeric material. In some instances, oligomeric materials (i.e., molecules having up to about four repeating monomer units) can also be employed as the transparentizing agent. Some polymeric materials may also be suitable if they contain some functional groups similar to those contained in suitable monomeric or oligomeric materials. While not being limited to any particular theory, it is believed that the transparentizing agent may chelate with the migration marking material, thereby rendering it transparent, or may enhance the ability of the migration marking material to agglomerate, or may oxidize the migration marking material, thereby rendering it transparent.

Examples of transparentizing agents suitable for the present invention include the following:

I. Azacyclic and azaheterocyclic compounds, including (A) piperidines and piperidine derivatives, including those of the general formulae:

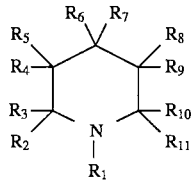

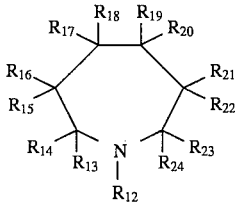

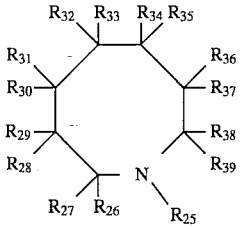

wherein $R_1$, $R_2$, $R_3$, $R_4$, $R_5$, $R_6$, $R_7$, $R_8$, $R_9$, $R_{10}$, $R_{11}$, $R_{12}$, $R_{13}$, $R_{14}$, $R_{15}$, $R_{16}$, $R_{17}$, $R_{18}$, $R_{19}$, $R_{20}$, $R_{21}$, $R_{22}$, $R_{23}$, $R_{24}$, $R_{25}$, $R_{26}$, $R_{27}$, $R_{28}$, $R_{29}$, $R_{30}$, $R_{31}$, $R_{32}$, $R_{33}$, $R_{34}$, $R_{35}$, $R_{36}$, $R_{37}$, $R_{38}$, and $R_{39}$ each, independently of the others, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, $R_8$, $R_9$, $R_{10}$, $R_{11}$, $R_{12}$, $R_{13}$, $R_{14}$, $R_{15}$, $R_{16}$, $R_{17}$, $R_{18}$, $R_{19}$, $R_{20}$, $R_{21}$, $R_{22}$, $R_{23}$, $R_{24}$, $R_{25}$, $R_{26}$, $R_{27}$, $R_{28}$, $R_{29}$, $R_{30}$, $R_{31}$, $R_{32}$, $R_{33}$, $R_{34}$, $R_{35}$, $R_{36}$, $R_{37}$, $R_{38}$, and $R_{39}$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds can also be in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like, as well as mixtures thereof.

Examples of suitable piperadine compounds and derivatives include (1) homopiperidine (Aldrich H1,040-1), of the formula

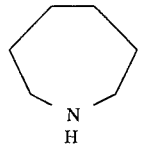

(2) piperidinethiocyanate (Aldrich 34,488-5), of the formula

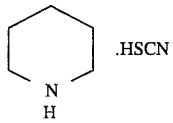

(3)(±)-2-piperidinemethanol (Aldrich 15,522-5), of the formula

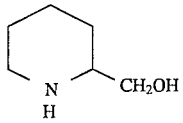

(4) 3-piperidinemethanol (Aldrich 15,523-3), of the formula

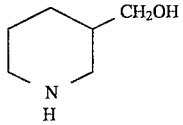

(5) 2-piperidineethanol (Aldrich 13,152-0), of the formula

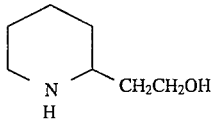

(6) 4-piperidineethanol (Aldrich P4,615-6), of the formula

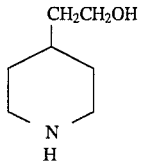

(7) 4-piperidine monohydrate hydrochloride (Aldrich 15,176-9), of the formula

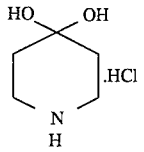

(8) 1-aminopiperidine (Aldrich A7,590-0), of the formula

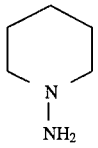

(9) 1-(2-aminoethyl)piperidine (Aldrich 14,166-6), of the formula

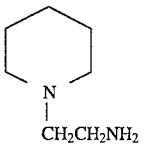

(10) 4-(aminomethyl)piperidine (Aldrich A6,515-8), of the formula

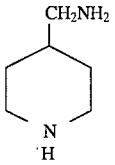

(11) 3-piperidino-1,2-propanediol (Aldrich 21,849-9), of the formula

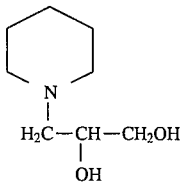

(12) 1-piperidine propionic acid (Aldrich 33,592-4), of the formula

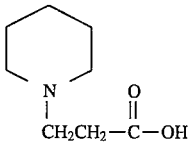

(13) 1-methyl-4-(methylamino)piperidine (Aldrich 22,140-6), of the formula

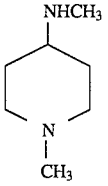

(14) 1-acetyl-3-methylpiperidine (Aldrich 34,472-9), of the formula

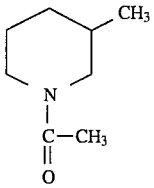

(15) 4'-piperidinoacetophenone (Aldrich 11,972-5), of the formula

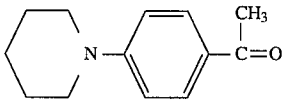

(16) 4-phenylpiperidine (Aldrich 14,826-1), of the formula

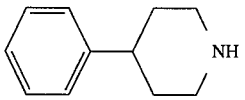

(17) 4-piperidinopiperidine (Aldrich 15,005-3), of the formula

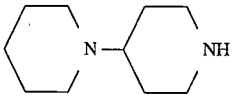

(18) 4-benzylpiperidine (Aldrich 14,236-0), of the formula

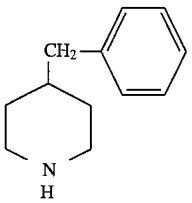

(19) 4-(4-methylpiperidino)pyridine (Aldrich 38,565-4), of the formula

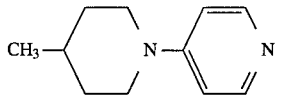

(20) 4-piperidone ethylene ketal (Aldrich 17,836-5), of the formula

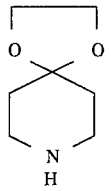

(21) bis(pentamethylene)urea (Aldrich B5,045-7), of the formula

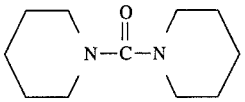

(22) 1-benzyl-4-hydroxypiperidine (Aldrich 15,298-6), of the formula

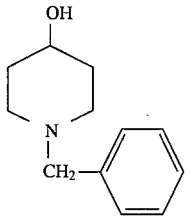

(23) 1-benzoyl-4-piperidone (Aldrich 10,732-8), of the formula

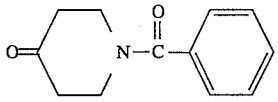

(24) 1,1'-methylenebis(3-methylpiperidine) (Aldrich 19,225-2), of the formula

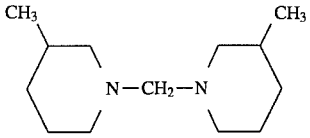

(25) 4,4'-trimethylenedipiperidine (Aldrich 12, 120-7), of the formula

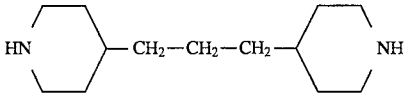

(26) 4,4'-trimethylenebis(1-menthylpiperidine) (Aldrich 19,226-0), of the formula

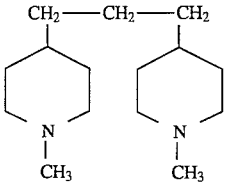

(27) 4,4'-trimethylenebis(1-piperidinepropionitrile) (Aldrich 34,479-6), of the formula

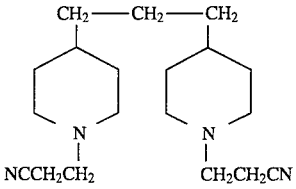

(28) 4,4'-trimethylenebis(1-piperidineethanol) (Aldrich 12,122-3), of the formula

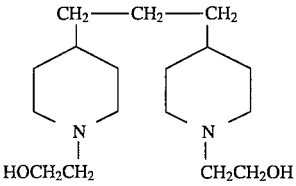

(29) 2,2,6,6-tetramethylpiperidine (Aldrich 11,574-4), of the formula

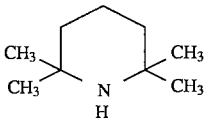

(30) 4-amino-2,2,6,6-tetramethylpiperidine (Aldrich 11,573-8), of the formula

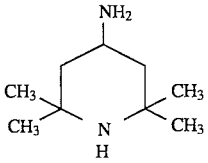

(31) 4-(dimethylamino)-1,2,2,6,6-pentamethylpiperidine (Aldrich 30,220-1), of the formula

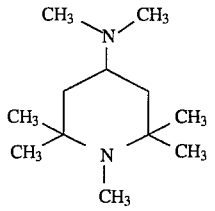

(32) N,N'-bis(2,2,6,6-tetramethyl-4-piperidinyl)-1,6-hexanediamine (Aldrich 38,942-0), of the formula

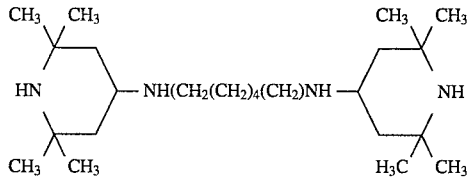

(33) tripiperidinophosphine oxide (Aldrich 21,625-9), of the formula

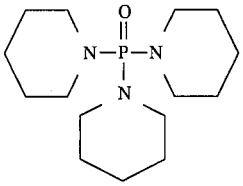

(34) tropane (Aldrich 37,870-4), of the formula

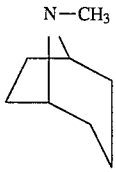

(35) tropinehydrate (Aldrich T8,940-0), of the formula

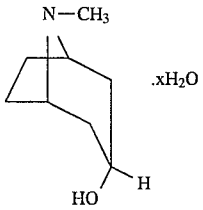

(36) tropinone (Aldrich T8,970-2), of the formula

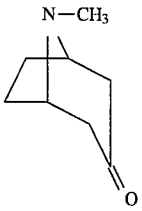

(37) 8-hydroxytropinone (Aldrich 11,914-8), of the formula

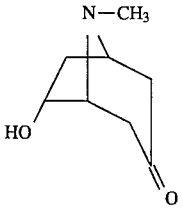

(38) 2-piperidine carboxylic acid (Alrich 23,775-2; P4,585-0; 26,806-2), of the formula

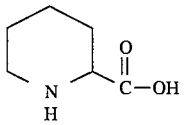

(39) 2-piperidone (Aldrich V,20-9), of the formula

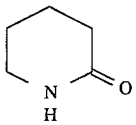

(40) 4,4'-trimethylene bis(1-piperidine carboxamide) (Aldrich 34,478-8), of the formula

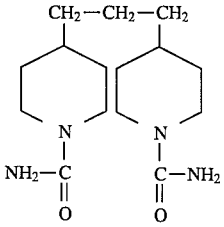

(41) 4-methyl-2-(piperidinomethyl)phenol (Aldrich 34,489-3), of the formula

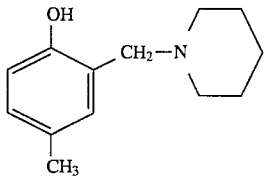

(42) 1-methyl-4-piperidinyl bis(chlorophenoxy)acetate (Aldrich 21,419-1), of the formula

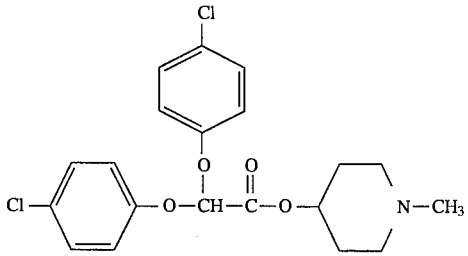

(43) 2-(hexamethylene imino)ethyl chloride monohydrochloride (Aldrich H1,065-7), of the formula

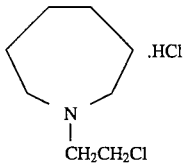

(44) 3-(hexahydro-1H-azepin-1-yl)-3'-nitropropiophenone hydrochloride (Aldrich 15,912-3), of the formula

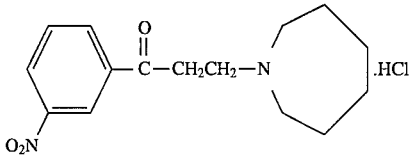

(45) imipramine hydrochloride [5-(3-dimethyl aminopropyl)-10,11-dihydro 5H-dibenz-(b,f) azepine hydrochloride] (Aldrich 28,626-5), of the formula

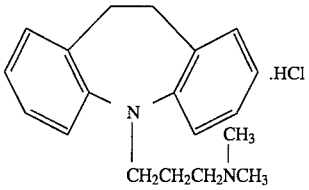

(46) carbamezepine[5H-dibenzo(b,f)-azepine-5-carboxamide] (Aldrich 30,948-6), of the formula

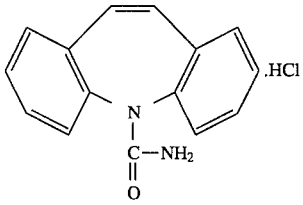

(47) 5,6,11,12-tetrahydro dibenz[b,f]azocine hydrochloride (Aldrich 18,761-5), of the formula

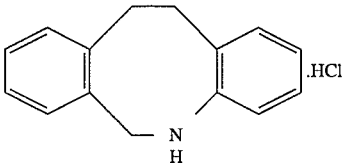

(48) quinuclidine hydrochloride (Aldrich 13,591-7), of the formula

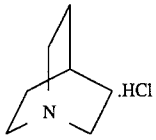

(54) quinidine sulfate dihydrate (Aldrich 14,589-0), of the formula

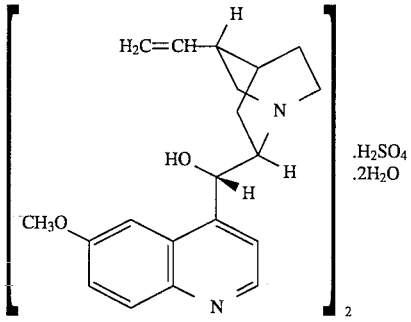

(55) quinine monohydrochloride dihydrate (Aldrich 14,592-0), of the formula

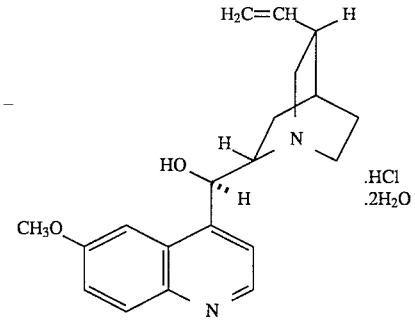

(49) 3-quinuclidinol hydrochloride (Aldrich Q188-3), of the formula

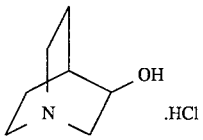

(50) 3-quinuclidinone hydrochloride (Aldrich Q190-5), of the formula

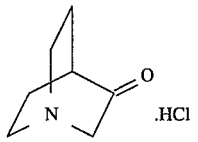

(51) 2-methylene-3-quinuclidinone dihydrate hydrochloride (Aldrich M4,612-8), of the formula

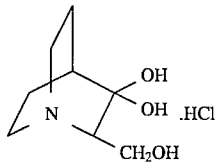

(52) 3-amino quinuclidine dihydrochloride (Aldrich 10,035-8), of the formula

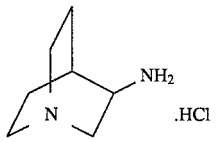

(53) 3-chloro quinuclidine hydrochloride (Aldrich 12,521-0), of the formula

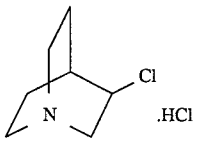

(58) hydroquinine hydrobromide dihydrate (Aldrich 34,132-0), of the formula

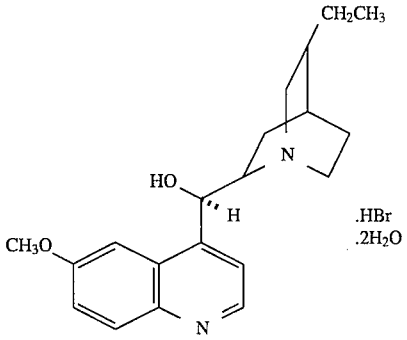

and the like;

(56) quinine sulfate monohydrate (Aldrich 14,591-2), of the formula

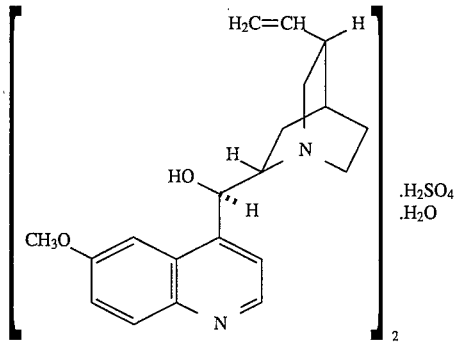

(57) hydroquinidine hydrochloride (Aldrich 25,481-9), of the formula

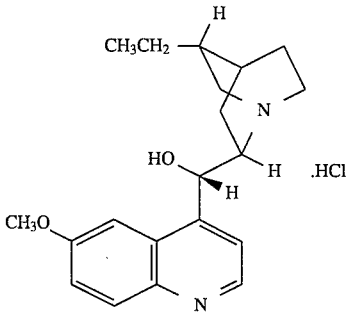

(B) piperazines and piperazine derivatives, including those of the general formulae

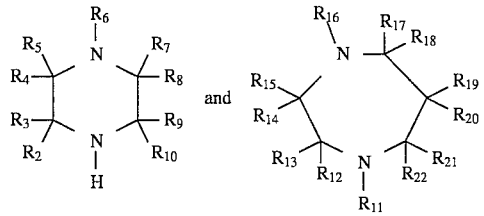

wherein $R_1$, $R_2$, $R_3$, $R_4$, $R_5$, $R_6$, $R_7$, $R_8$, $R_9$, $R_{10}$, $R_{11}$, $R_{12}$, $R_{13}$, $R_{14}$, $R_{15}$, $R_{16}$, $R_{17}$, $R_{18}$, $R_{19}$, $R_{20}$, $R_{21}$, and $R_{22}$ each, independently of the others, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, $R_8$, $R_9$, $R_{10}$, $R_{11}$, $R_{12}$, $R_{13}$, $R_{14}$, $R_{15}$, $R_{16}$, $R_{17}$, $R_{18}$, $R_{19}$, $R_{20}$, $R_{21}$, and $R_{22}$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds can also be in acid salt form, wherein they are associated with a compound of the general formula $xH_nY_{n^-}$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like, as well as mixtures thereof.

Examples of suitable piperazine compounds and derivatives include (1) piperazine (Aldrich P4,590-7) and piperazine hexahydrate (Aldrich P4,591-5), of the formulae

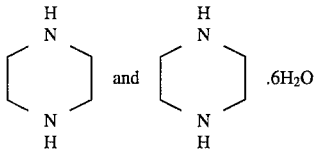

(2) homopiperazine (Aldrich H 1,660-4), of the formula

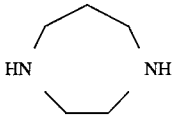

(3) 1-methylpiperazine (Aldrich 13,000-1), of the formula

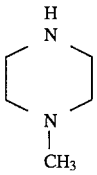

(4) 2-methylpiperazine (Aldrich M7240-4; 39,716-4), of the formula

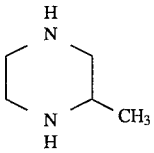

(5) 1-acetylpiperazine (Aldrich 35,951-3), of the formula

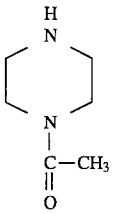

(6) 1-(2-hydroxyethyl)piperazine (Aldrich H2,880-7), of the formula

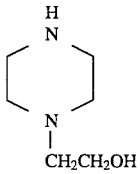

(7) 1-(2-aminoethyl)piperazine (Aldrich A5,520-9), of the formula

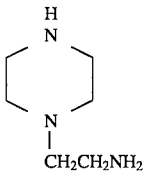

(8) tert-butyl 1-piperazinecarboxylate (Aldrich 34,353-6), of the formula

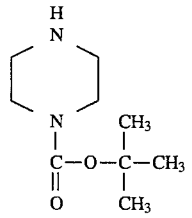

(9) N-isopropyl-1-piperazineacetamide (Aldrich 22,092-2), of the formula

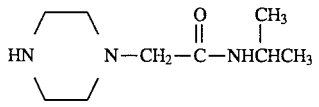

(10) 1-(2-methoxyphenyl)piperazine (Aldrich M2,260-1), of the formula

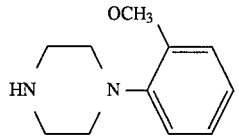

(11) 1-(2-pyridyl)piperazine (Aldrich 15,127-0), of the formula

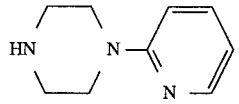

(12) 1-benzylpiperazine (Aldrich 13,683-2), of the formula

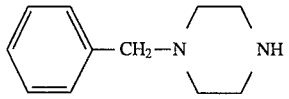

(13) 1-cinnamylpiperazine (Aldrich 40,447-0), of the formula

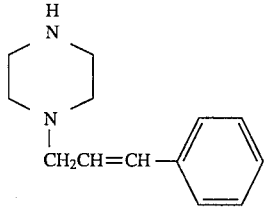

(14) 1-(4-chlorobenzhydryl)piperazine (Aldrich C2,450-7), of the formula

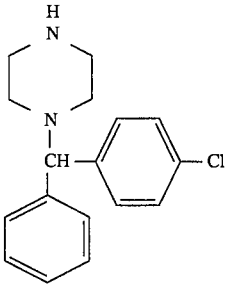

(15) 2,6-dimethylpiperazine (Aldrich D17,980-9), of the formula

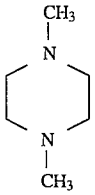

(16) 1-amino-4-methylpiperazine (Aldrich 25,568-8) of the formula

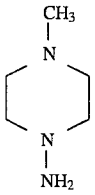

(17) 1-amino-4-(2-hydroxyethyl)piperazine (Aldrich 12,296-3), of the formula

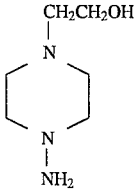

(18) 1,4-bis(2-hydroxyethyl)piperazine (Aldrich B4,540o2) of the formula

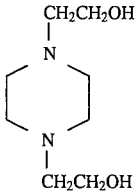

(19) 1,4-bis(3-aminopropyl)piperazine (Aldrich 23,948-8), of the formula

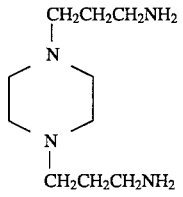

(20) tert-butyl-4-benzyl-1-piperazinecarboxylate (Aldrich 37,483-0), of the formula

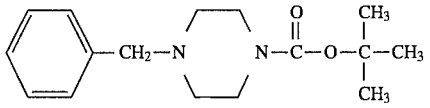

(21) 1-piperonyl piperazine (Aldrich 22,495-2), of the formula

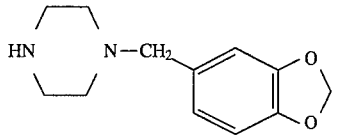

(22) bis(4-methyl-1-homopiperazinylthio-carbonyl)disulfide (Aldrich 85,662-2), of the formula

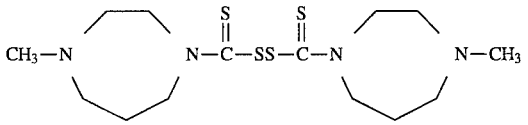

(23) 1-amino-4-methyl piperazine dihydrochloride monohydrate (Aldrich A6,513-1), of the formula

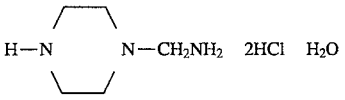

(24) 1-(3-chloropropyl)-piperazine dihydrochloride monohydrate (Aldrich 19,360-7), of the formula

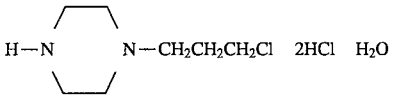

(25) 1-(2,3-xylyl) piperazine monohydrochloride (Aldrich 27,518-2), of the formula

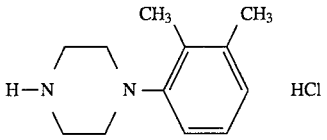

(26) 1,1-dimethyl-4-phenyl piperazineium iodide (Aldrich D17,750-4), of the formula

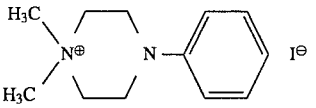

and the like;

(C) cyclic compounds wherein the ring contains three nitrogen atoms, including (1) 1,4,7-triazacyclononane (Aldrich 31,130-8), of the formula

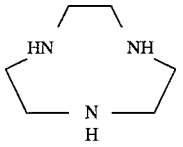

(2) 1,5,9-triazacyclododecane (Aldrich 31,979-1), of the formula

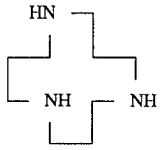

(3) triazoles and triazole derivatives, including those of the general formulae

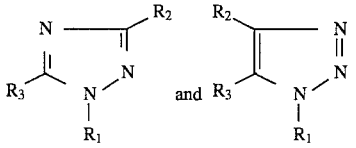

wherein $R_1$, $R_2$, and $R_3$ each, independently of the others, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, and $R_3$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds can also be in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like, as well as mixtures thereof, such as (a) 1,2,3-triazole (Aldrich 33,366-2), of the formula

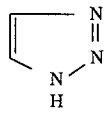

(b) 4-amino-1,2,4-triazole (Aldrich A8, 180-3), of the formula

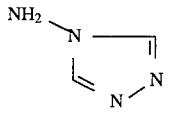

(c) 3-amino-5-methylthio-1H-1,2,4-triazole (Aldrich 19,068-3), of the formula

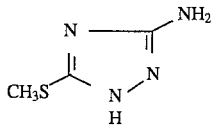

(d) benzotriazole (Aldrich B 1,140-0), of the formula

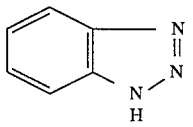

(e) 1-aminobenzotriazole (Aldrich 38,637-5), of the formula

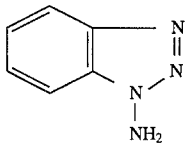

(f) 1-cyanobenzotriazole (Aldrich 38, 181-0), of the formula

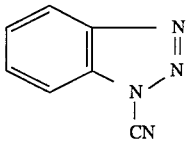

(g) 5-methyl-1H-benzotriazole (Aldrich 19,630-4), of the formula

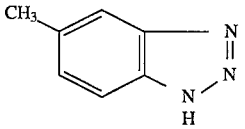

(h) 1H-benzotriazole-1-ylmethyl isocyanide (Aldrich 36,799-0), of the formula

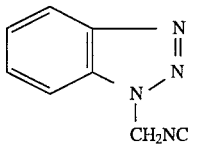

(i) 2-[3-(2H-benzotriazole-2-yl)-4-hydroxyphenyl]ethyl methacrylate (Aldrich 41,343-7), of the formula

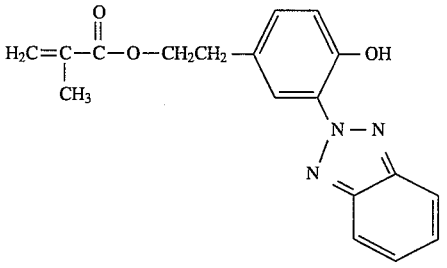

(j) 1,2,4-triazole (Aldrich T4,610-8), of the formula

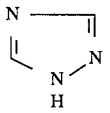

(k) 1,2,4-triazole sodium derivative (Aldrich 19,764-5), of the formula

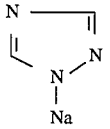

(l) 3-amino-1,2,4-triazole (Aldrich A8,160-9), of the formula

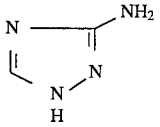

(m) 3,5-diamino-1,2,4-triazole (Aldrich D2,620-2), of the formula

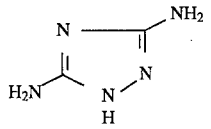

(n) 3-amino-5-mercapto-1,2,4-triazole (Aldrich 14,026-0), of the formula

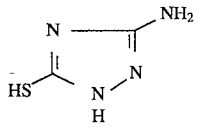

(o) 3-amino-1,2,4-triazole-5-carboxylic acid hemihydrate (Aldrich 28,207-3), of the formula

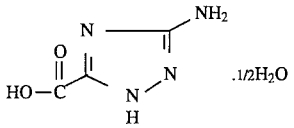

(p) 4-amino-3-hydrazino-5-mercapto-1,2,4-triazole (Aldrich 16,289-3), of the formula

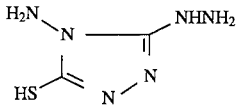

(q) 1,2,3-triazole-4,5-dicarboxylic acid monohydrate (Aldrich 26,972-7), of the formula

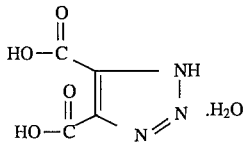

(r) nitron[4,5-dihydro-2,4-diphenyl-5-(phenylimino)-1H-1,2,4-triazolium hydroxide inner salt] (Aldrich 24,326-4), of the formula

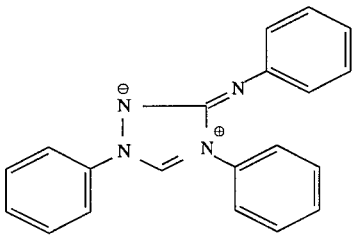

(s) 1-hydroxybenzotriazole hydrate (Aldrich 15,726-0), of the formula

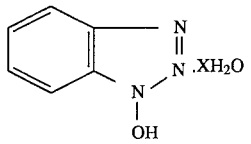

and the like;

(4) triazines and triazine derivatives, including those of the general formulae

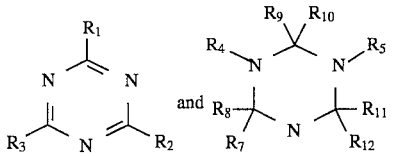

wherein $R_1$, $R_2$, $R_3$, $R_4$, $R_5$, $R_6$, $R_7$, $R_8$, $R_9$, $R_{10}$, $R_{11}$, and $R_{12}$ each, independently of the others, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, $R_8$, $R_9$, $R_{10}$, $R_{11}$, and $R_{12}$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds can also be in acid salt form, wherein they are associated with a compound of the general formula $xH_nY_{n^-}$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like, as well as mixtures thereof, such as (a) 1,3,5-triazine (Aldrich T4,605-1), of the formula

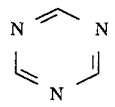

(b) cyanuric acid (Aldrich 18,580-9), of the formula

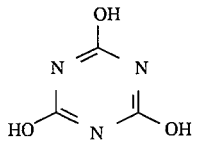

(c) trithiocyanuric acid (Aldrich 18,859-5), of the formula

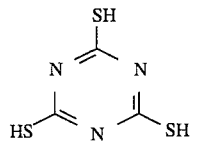

(d) 2,4-bis(methylthio)-6-chloro-1,3,5-triazine (Aldrich 21,386-1), of the formula

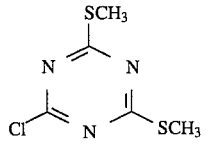

(e) 2-chloro-4,6-dimethoxy-1,3,5-triazine (Aldrich 37,521-7), of the formula

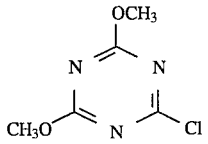

(f) 2-chloro-4,6-diamino-1,3,5-triazine (Aldrich C3,330-1), of the formula

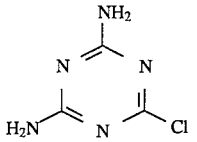

(g) trichloromelamine (Aldrich 10,624-0), of the formula

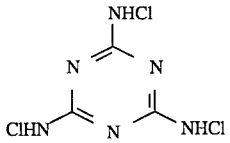

(h) cyanuric chloride (Aldrich C9,550-1), of the formula

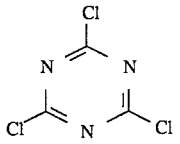

(i) 2,4,6-tris(perfluoroheptyl)-1,3,5-triazine (Aldrich 35,879-7), of the formula

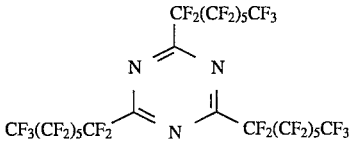

(j) hexahydro-2,4,6-trimethyl-1,3,5-triazine trihydrate (Aldrich 10,820-0), of the formula

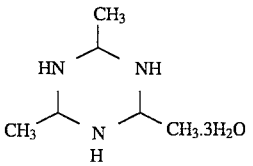

(k) 1,3,5-trimethylhexahydro-1,3,5-triazine (Aldrich 25,467-3), of the formula

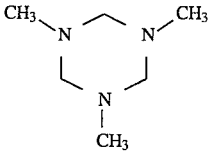

(l) 1,3,5-triethylhexahydro-1,3,5-triazine (Aldrich 22,143-0), of the formula

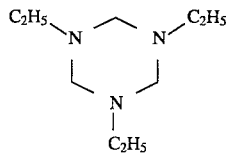

(m) 1,3,5-triclohexylhexahydro-1,3,5-triazine (Aldrich 22,144-9), of the formula

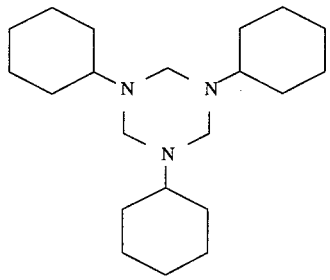

(n) 1,3,5-tribenzylhexahydro-1,3,5-triazine (Aldrich 33,772-2), of the formula

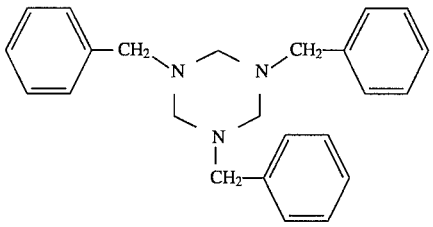

(o) trichloroisocyanuric acid (Aldrich 17,612-5), of the formula

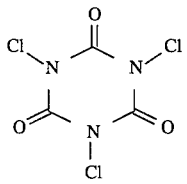

(p) tris(2,3-dibromopropylisocyanurate) (Aldrich 26,999-9), of the formula

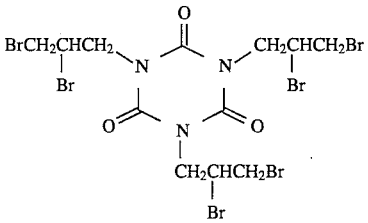

(q) cyanuric acid compound with melamine (Aldrich 37,242-0), of the formula

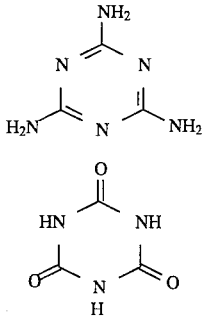

and the like;

(5) urazoles and urazole derivatives, including those of the general formulae

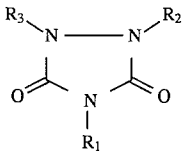

and

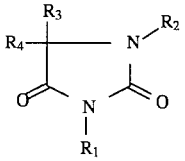

wherein $R_1$, $R_2$, $R_3$, and $R_4$ each, independently of the others, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, and $R_4$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds can also be in acid salt form, wherein they are associated with a compound of the general formula $xH_nY_n$-, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{-2}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like, as well as mixtures thereof, such as (a) urazole (Aldrich U 260-1), of the formula

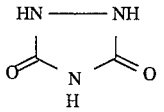

(b) 1-methyl urazole (Aldrich 27,619-7), of the formula

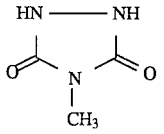

(c) 4-phenyl urazole (Aldrich 18,895-6), of the formula

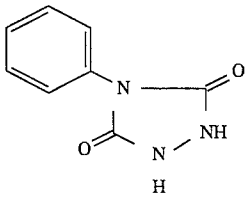

(d) D,L-5-(4-hydroxyphenyl)-5-phenyl hydantoin (Aldrich 16,154-3), of the formula

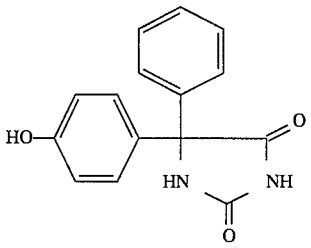

(e) β-tetralone hydantoin (Aldrich B635-2), of the formula

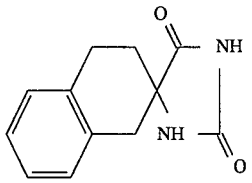

and the like;

(D) cyclic compounds wherein the ring contains four nitrogen atoms, including (1) cyclen(1,4,7,10-tetraazacyclododecane) (Aldrich 33,965-2), of the formula

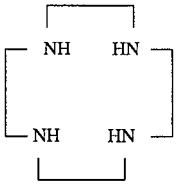

(2) 1,4,8,11-tetraazacyclotetradecane (Aldrich 25,916-0), of the formula

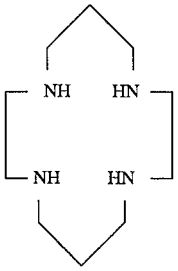

(3) 1,4,8,11-tetramethyl-1,4,8,11-tetraazacyclotetradecane (Aldrich 28,280-4), of the formula

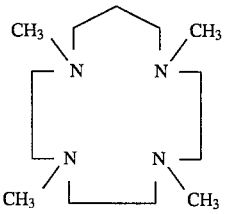

(4) 1,4,8,11-tetraazacyclotetradecane-5,7-dione (Aldrich 33,316-6), of the formula

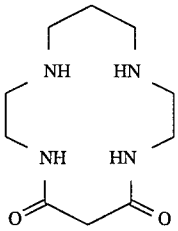

(5) 1,4,8,12-tetraazacyclopentadecane (Aldrich 25,915-2), of the formula

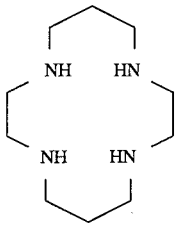

(6) porphines and porphine derivatives, including those of the general formula

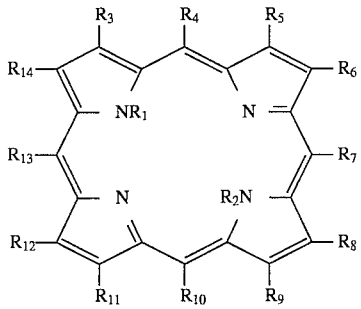

wherein $R_1$, $R_2$, $R_3$, $R_4$, $R_5$, $R_6$, $R_7$, $R_8$, $R_9$, $R_{10}$, $R_{11}$, $R_{12}$, $R_{13}$, and $R_{14}$ each, independently of the others, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, $R_8$, $R_9$, $R_{10}$, $R_{11}$, $R_{12}$, $R_{13}$, and $R_{14}$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds can also be in acid salt form, wherein they are associated with a compound of the general formula $xH_nY_n$-, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like, as well as mixtures thereof. Examples of suitable porphines and porphine derivatives include (a) 2,3,7,8,12,13,17,18-octaethyl-21H,23H-porphine (Aldrich 25,240-9), of the formula

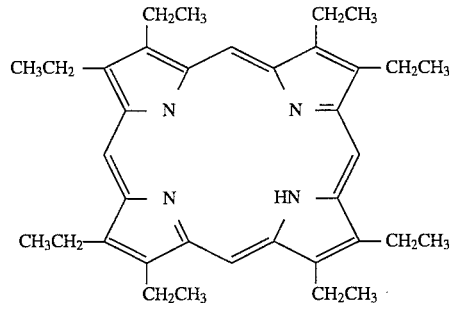

(b) dimethyl 3,7,12,17-tetramethyl-21H,23H-porphine-2,18-dipropionate (Aldrich 25,294-8), of the formula

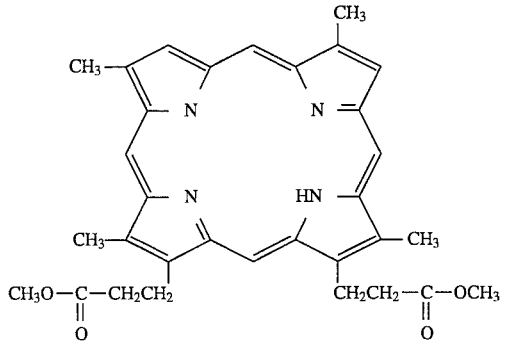

(c) dimethyl 7,12-diacetyl-3,8,13,17-tetramethyl-21H,23H-porphine-2,18-dipropionate (Aldrich 25,290-5), of the formula

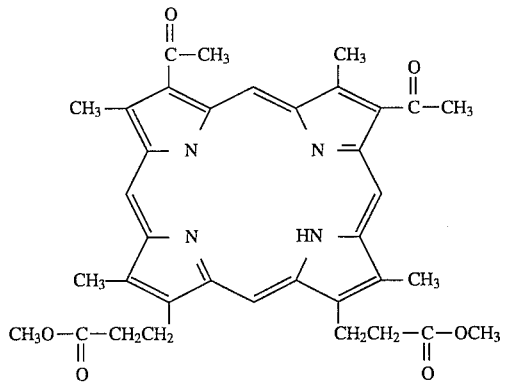

(d) 8,3-divinyl-3,7,12,17-tetramethyl-21H,23H-porphine-2,18-dipropionic acid, disodium salt (Aldrich 25,838-5), of the formula
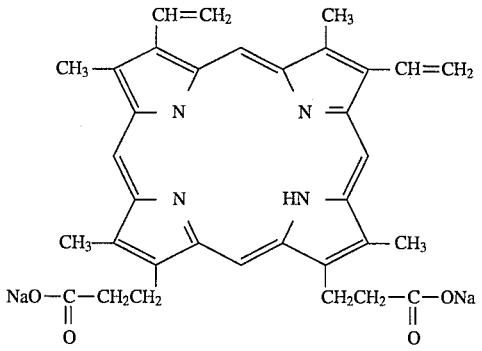
(e) 5,10,15,20-tetraphenyl-21H,23H-porphine (Aldrich 16,099-7), of the formula
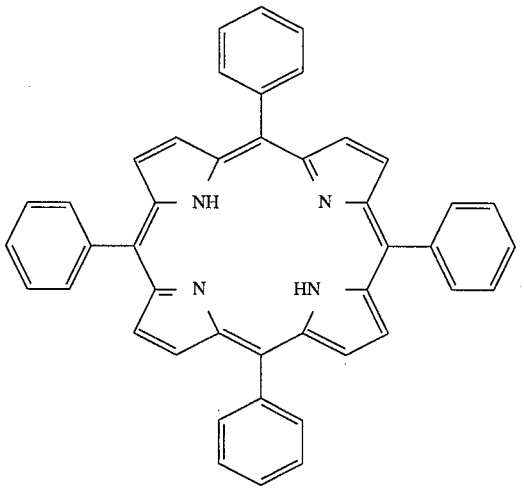
(f) 5,10,15,20-tetrakis(4-methoxyphenyl)-21H,23H-porphine (Aldrich 25,288-3), of the formula
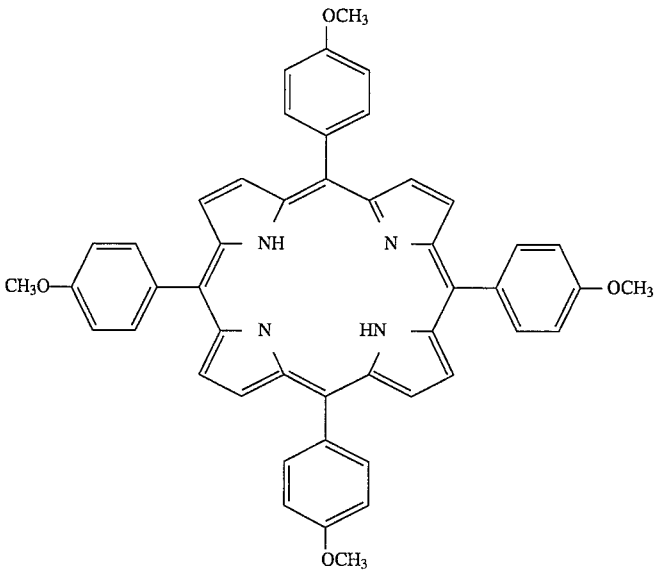
(g) 5,10,15-20-tetrakis[4-(trimethylamino)phenyl]-21H,23H-porphine tetra-p-tosylate salt (Aldrich 30,678-9), of the formula

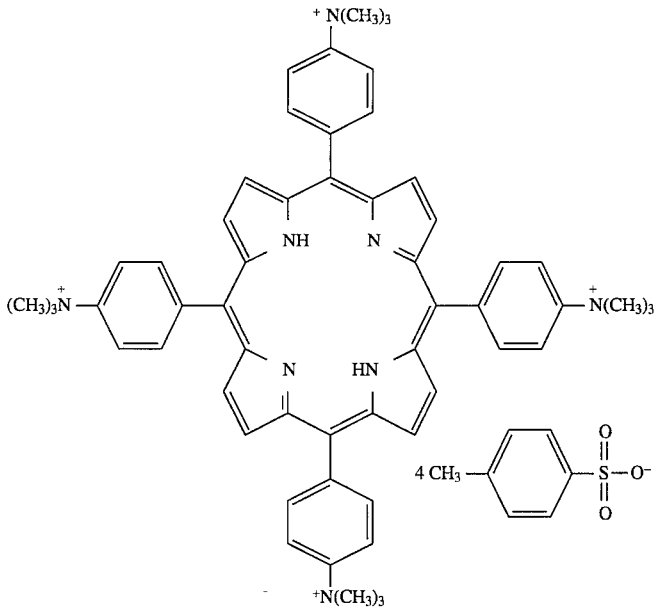

(h) 5,10,15,20-tetra(4-pyridyl)-21H,23H-porphine (Aldrich 25,761-3), of the formula

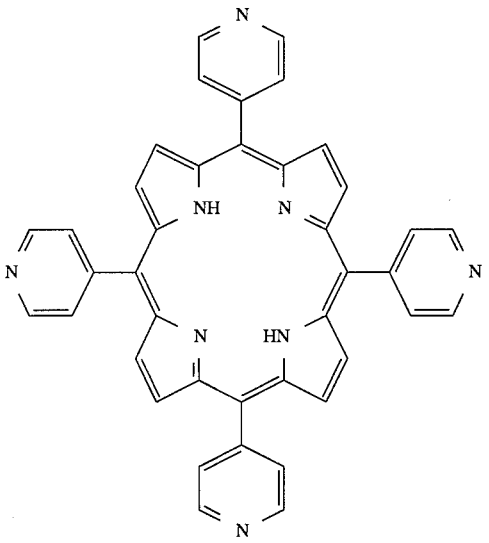

(i) 5,10,15,20-tetrakis(1-methyl-4-pyridyl)-21H,23H-porphine, tetra-p-tosylate salt) (Aldrich 32,249-7), of the formula

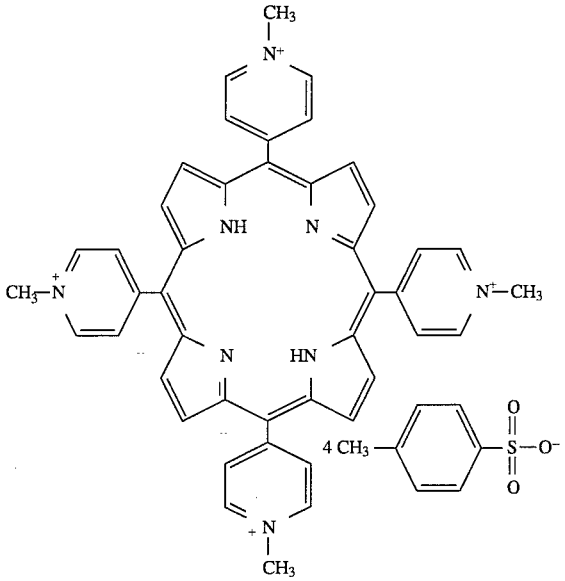

and the like;

(7) tetrazoles and tetrazole derivatives, including those of the general formula

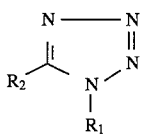

wherein $R_1$ and $R_2$ each, independently of the others, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$ and $R_2$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds can also be in acid salt form, wherein they are associated with a compound of the general formula $xH_nY_{n^-}$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like, as well as mixtures thereof, including (a) 1,5-pentamethylenetetrazole (Aldrich P720-7), of the formula

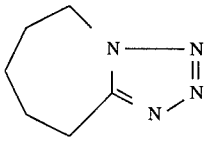

(b) 1-H-tetrazole (Aldrich 15,569-1), of the formula

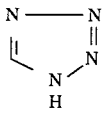

(c) 5-amino tetrazole monohydrate (Aldrich A8,060-2), of the formula

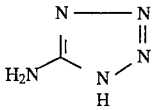

(d) 2,3,5-triphenyl-2H-tetrazolium chloride (Aldrich T8,485-9), of the formula

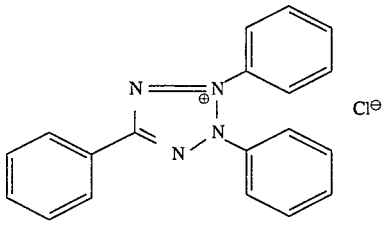

(e) 2-(4-iodophenyl)-5-(4-nitrophenyl)-3-phenyltetrazolium chloride (Aldrich I-1,040-6), of the formula

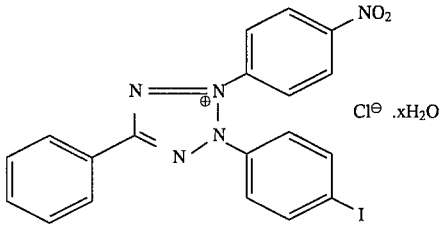

(f) 1,2,3,3-tetramethyl-3H-indolinium iodide (Aldrich 32,897-9), of the formula

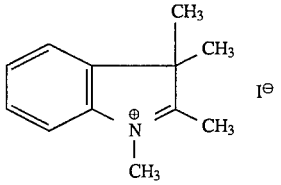

and the like;

(E) cyclic compounds wherein the ring contains six nitrogen atoms, including (1) hexacyclen trisulfate (Aldrich 19,393-3), of the formula

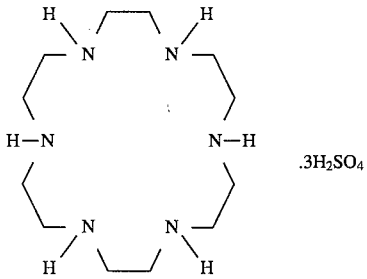

(2) hexamethylhexacyclen[1,4,7,10,13,16-hexamethyl-1,4,7,10,13-16-hexaazacyclooctadecane] (Aldrich 34,903-8), of the formula

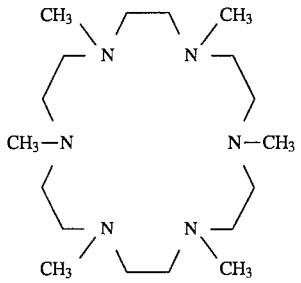

and the like;

(F) pyrrole compounds, including those of the general formula

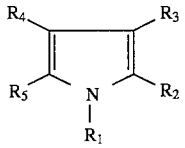

wherein $R_1$, $R_2$, $R_3$, $R_4$, and $R_5$ each, independently of the others, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_2$, $R_3$, $R_4$, and $R_5$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds can also be in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{-2}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like, as well as mixtures thereof; and (G) pyrrolidine compounds, including those of the general formula

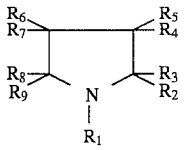

wherein $R_1$, $R_2$, $R_3$, $R_4$, $R_5$, $R_6$, $R_7$, $R_8$, and $R_9$ each, independently of the others, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, $R_8$, and $R_9$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds can also be in acid salt form, wherein they are associated with a compound of the general formula $xH_nY_n^-$, wherein n is an integer of 1, 2, or 3, x is a number indicating the relative ratio between pyrrole or pyrrolidine and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like, as well as mixtures thereof.

Examples of suitable pyrrole and pyrrolidine compounds include (1) pyrrole-2-carboxaldehyde (Aldrich P7,340-4), of the formula

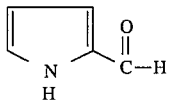

(2) L-proline amide (Aldrich 28,705-9), of the formula

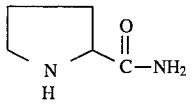

(3) 3-pyrrolidino-1,2-propane diol (Aldrich 21,851-0), of the formula

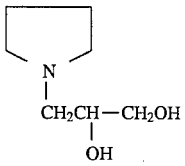

(4) 1-(pyrrolidino carbonylmethyl) piperazine (Aldrich 19,783-1), of the formula

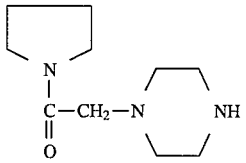

(5) 4-pyrrolidinopyridine (Aldrich 21,337-3), of the formula

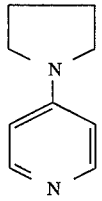

(6) 3-indolylacetonitrile (Aldrich 12,945-3), of the formula

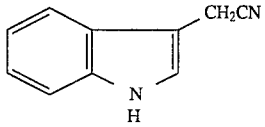

(7) 6-nitroindoline (Aldrich N1,773-4), of the formula

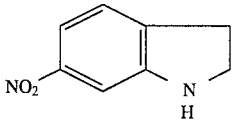

(8) 7-azaindole (Aldrich A9,550-2), of the formula

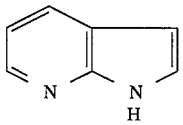

(9) indazole (Aldrich 1,240-1), of the formula

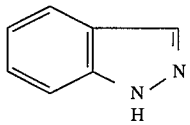

(10) 2-acetyl-pyrrole (Aldrich 24,735-9), of the formula

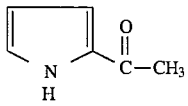

(11) 2-acetyl-1-methylpyrrole (Aldrich 16,086-5), of the formula

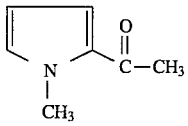

(12) 3-acetyl-1-methylpyrrole (Aldrich 30,986-9), of the formula

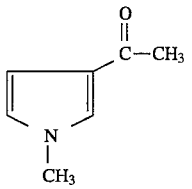

(13) 3-acetyl-2,4-dimethylpyrrole (Aldrich A1,480-4), of the formula

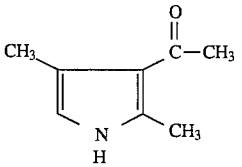

(14) pyrrole-2-carboxylic acid (Aldrich P7,360-9), of the formula

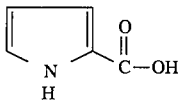

(15) 3-carboxy-1,4-dimethyl-2-pyrroleacetic acid (Aldrich 31,625-3), of the formula

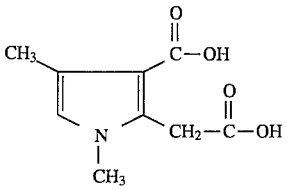

(16) proline (Aldrich 13,154-7; 17,182-4; 85,891-9), of the formula

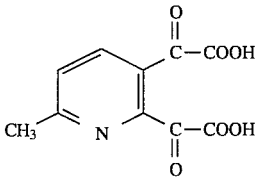

(17) 2-pyrrolidone-5-carboxylic acid (Aldrich P7,520; 29,291-5), of the formula

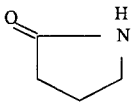

(18) 4-hydroxy-L-proline (Aldrich H5,440-9; 21,994-0; 21,995-9), of the formula

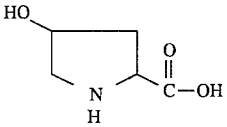

(19) 1,1'-ethylene bis(5-oxo-3-pyrrolidine carboxylic acid) (Aldrich 32,756-5), of the formula

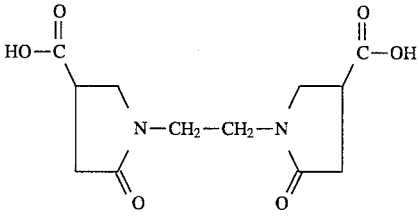

(20) kainic acid monohydrate (2-carboxy-4-isopropenyl-3-pyrrolidine acetic acid monohydrate) (Aldrich 28,634-6), of the formula

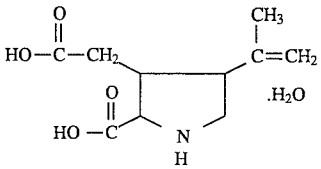

(21) 1-amino pyrrolidine hydrochloride (Aldrich 12,310-2), of the formula

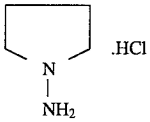

(22) 2-(2-chloroethyl)-1-methyl pyrrolidine hydrochloride (Aldrich 13,952-1), of the formula

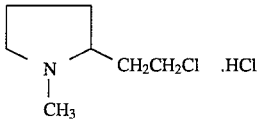

(23) 1-(2-chloroethyl) pyrrolidine hydrochloride (Aldrich C4,280-7), of the formula

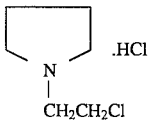

(24) tremorine dihydrochloride[1,1'-(2-butynylene)dipyrrolidine hydrochloride] (Aldrich T4,365-6), of the formula

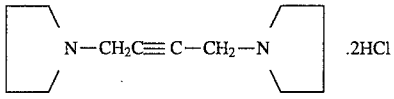

(25) L-proline methyl ester hydrochloride (Aldrich 28,706-7), of the formula

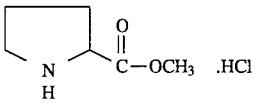

(26) ammonium pyrrolidine dithiocarbamate (Aldrich 14,269-7), of the formula

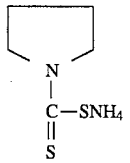

(27) pyrrolidone hydrotribromide (Aldrich 15,520-9), of the formula

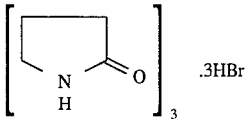

(28) 1-(4-chlorobenzyl)-2-(1-pyrrolidinyl methyl) benzimidazole hydrochloride (Aldrich 34,208-4), of the formula

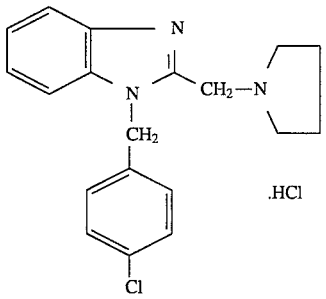

(29) billverdin dihydrochloride (Aldrich 25,824-5), of the formula

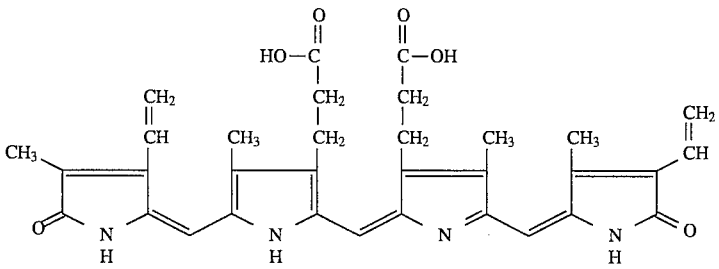

(30) indole (Aldrich 1-340-8), of the formula

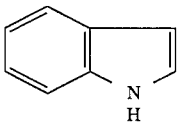

(31) 4,5,6,7-tetrahydroindole (Aldrich 32,490-6), of the formula

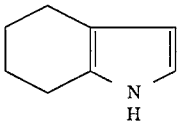

(32) 3-indolemethanol hydrate (Aldrich I-400-5), of the formula

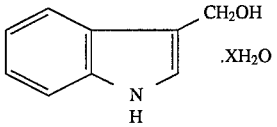

(33) 3-indole ethanol (tryptophol) (Aldrich T9,030-1), of the formula

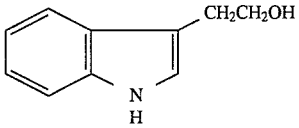

(34) indole-3-carboxaldehyde (Aldrich 12,944-5), of the formula

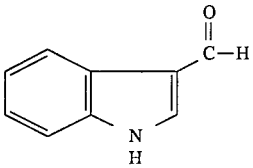

(35) 3-indolylacetate (3-acetoxyindole) (Aldrich 25,946-1), of the formula

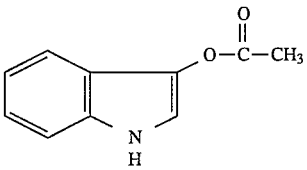

(36) indole-3-acetamide (Aldrich 28,628-1), of the formula

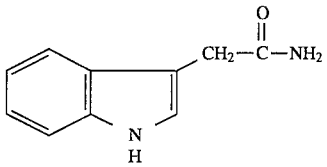

(37) indole-3-carboxylic acid (Aldrich 28,473-4), of the formula

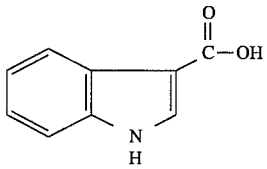

(38) indole-3-acetic acid (Aldrich 1-375-0), of the formula

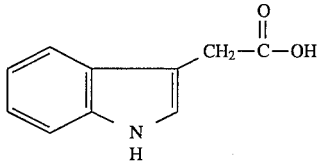

(39) 3-Indole propionic acid (Aldrich 22,002-7), of the formula

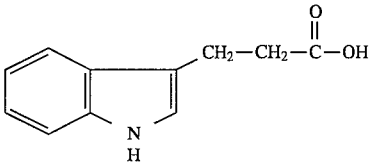

(40) 3-indole acrylic acid (Aldrich 1-380-7), of the formula

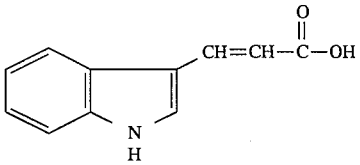

(41) 3-indole glyoxylic acid (Aldrich 22,001-9), of the formula

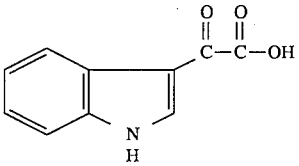

(42) indole-3-pyruvic acid (Aldrich 1-556-7), of the formula

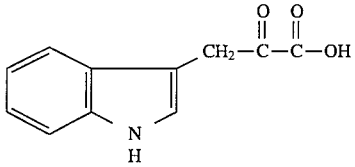

(43) D,L-3-indolelactic acid (Aldrich 1-550-8), of the formula

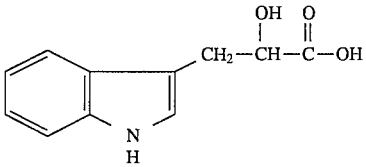

(44) 3-indole butyric acid (Aldrich 13,915-7), of the formula

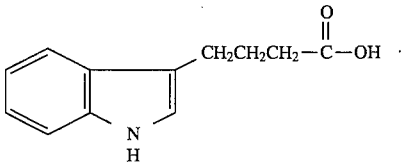

(45) N-acetyl-L-tryptophanamide (Aldrich 85,675-4), of the formula

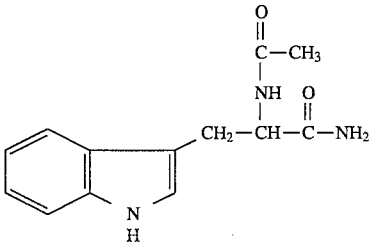

(46) N-(3-indolylacetyl)-L-alanine (Aldrich 34,591-1), of the formula

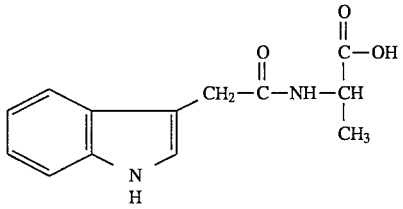

(47) N-(3-indolyl acetyl)-L-valine (Aldrich 34,792-2), of the formula

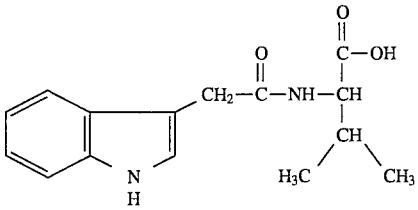

(48) N-(3-indolyl acetyl)-L-isoleucine (Aldrich 34,791-4), of the formula

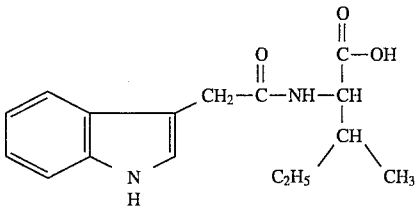

(49) N-(3-indolyl acetyl)-L-leucine (Aldrich 34,594-6), of the formula

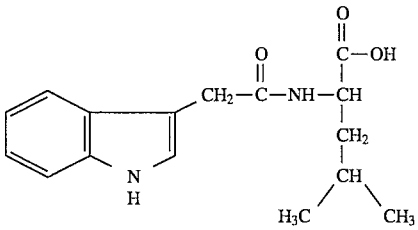

(50) N-(3-indolyl acetyl)-D,L-aspartic acid (Aldrich 34,593-8), of the formula

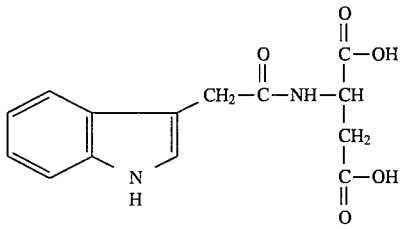

(51) N-(3-indolyl acetyl)-L-phenylalanine (Aldrich 34,595-4), of the formula

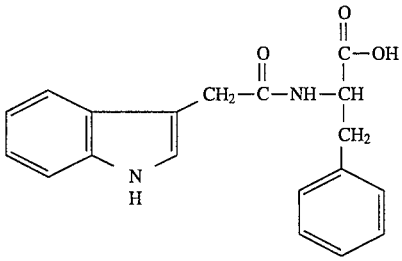

(52) 4-hydroxyindole (4-Indolol) (Aldrich 21,987-8), of the formula

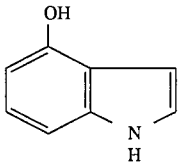

(53) indole-4-carboxylic acid (Aldrich 24,626-3), of the formula

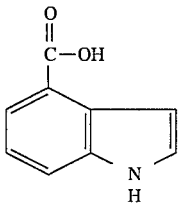

(54) 4-indolyl acetate (Aldrich 25,904-7), of the formula

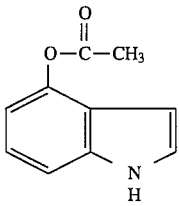

(55) 4-methyl indole (Aldrich 24,630-1), of the formula

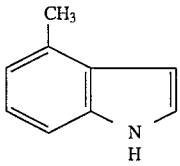

(56) 5-hydroxy indole (5-indolol) (Aldrich H3,185-9), of the formula

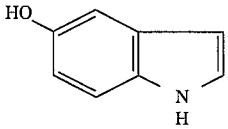

(57) 5-hydroxy indole-3-acetic acid (Aldrich H3,200-6), of the formula

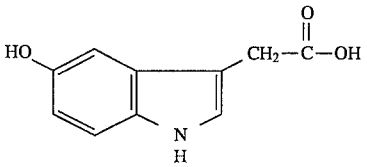

(58) 5-hydroxy-2-indole carboxylic acid (Aldrich 14,351-0), of the formula

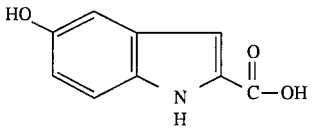

(59) N-acetyl-5-hydroxytryptamine (Aldrich 85,548-0), of the formula

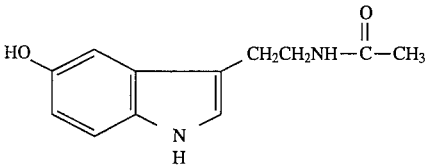

(60) indole-5-carboxylic acid (Aldrich I-540-0), of the formula

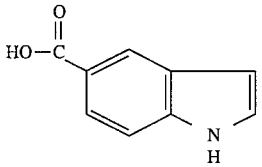

(61) 5-methyl indole (Aldrich 22,241-0), of the formula

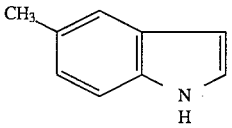

(62) 5-methoxy indole (Aldrich M, 1490-0), of the formula

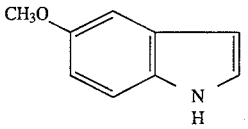

(63) indole-2-carboxylic acid (Aldrich I-510-9), of the formula

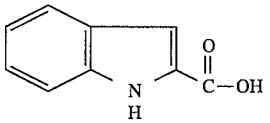

(64) D,L-indolene-2-carboxylic acid (Aldrich 30,224-4), of the formula

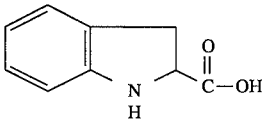

(65) indole-2,3-dione (isatin) (Aldrich 11,461-8), of the formula

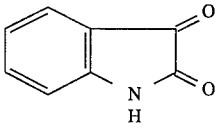

(66) 2-methyl indole (Aldrich M5,140-7), of the formula

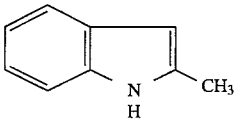

(67) 2,3,3-trimethyl indolenine (Aldrich T7,680-5), of the formula

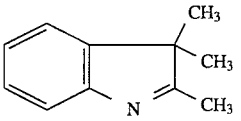

(68) tryptamine hydrochloride (Aldrich 13,224-1), of the formula

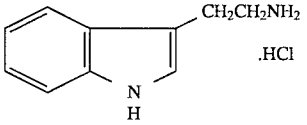

(69) 5-methyl tryptamine hydrochloride (Aldrich 13,422-8), of the formula

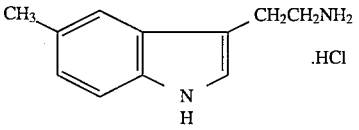

(70) serotonin hydrochloride hemihydrate (5-hydroxy tryptamine hydrochloride hemihydrate) (Aldrich 23,390-0), of the formula

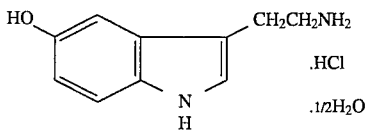

(71) norharman hydrochloride monohydrate (Aldrich 28,687-7), of the formula

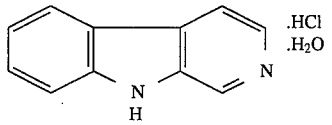

(72) harmane hydrochloride monohydrate (Aldrich 25,051-1), of the formula

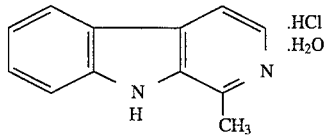

(73) harmine hydrochloride hydrate (Aldrich 12,848-1), of the formula

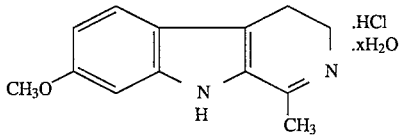

(74) harmaline hydrochloride dihydrate (Aldrich H10-9), of the formula

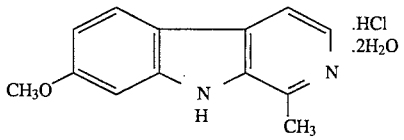

(75) harmol hydrochloride dihydrate (Aldrich 11,655-6), of the formula

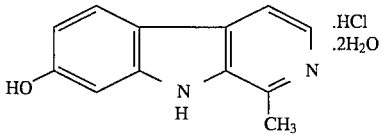

(76) harmalol hydrochloride dihydrate (Aldrich H12-5), of the formula

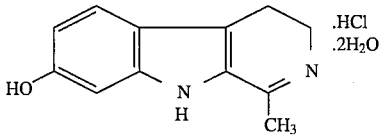

(77) 3,6-diamino acridine hydrochloride (Aldrich 13,110-5), of the formula

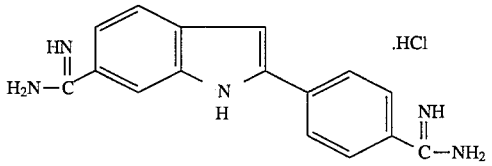

(78) S-(3-indolyl) isothiuronium iodide (Aldrich 16,097-0), of the formula

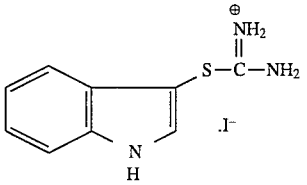

(79) yohimbine hydrochloride (Aldrich Y20-8), of the formula

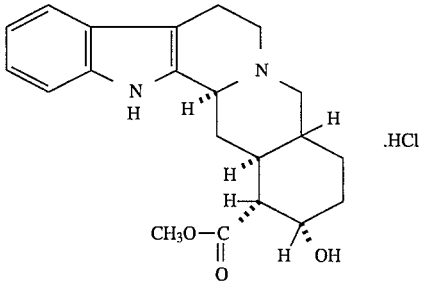

and the like.

(H) pyrazoles and pyrazole derivatives, including those of the general formula

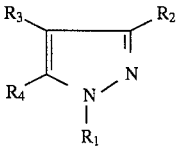

wherein $R_1$, $R_2$, $R_3$, and $R_4$ each, independently of the others, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, and $R_4$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds can also be in acid salt form, wherein they are associated with a compound of the general formula $xH_nY_n$-, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like, as well as mixtures thereof.

Examples of suitable pyrazole compounds include (1) pyrazole (Aldrich P5,660-7), of the formula

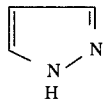

(2) 3-amino pyrazole (Aldrich 16,064-4), of the formula

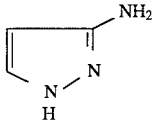

(3) 5-amino-1-ethylpyrazole (Aldrich 29,576-0), of the formula

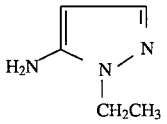

(4) 3-amino-4-carbethoxypyrazole (Aldrich A4,500-9), of the formula

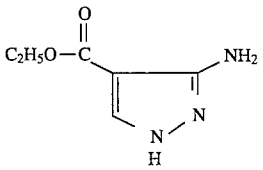

(5) 3-amino-5-methylpyrazole (Aldrich 34,020-0), of the formula

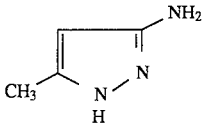

(6) 3-amino-5-phenylpyrazole (Aldrich 39,379-7), of the formula

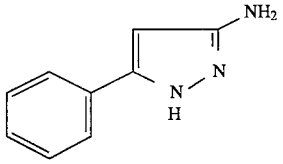

(7) ethyl 4-pyrazole carboxylate (Aldrich 30,078-0), of the formula

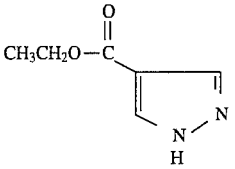

(8) diethyl 3,5-pyrazolecarboxylate (Aldrich 38,759-2), of the formula

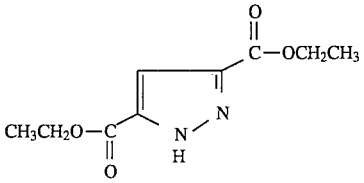

(9) 1,1'-(1-ethylpropylidene)bis 1H-pyrazole (Aldrich 39,414-9), of the formula

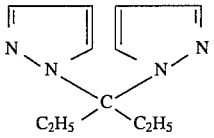

(10) 4-bromopyrazole (Aldrich 37,482-2), of the formula

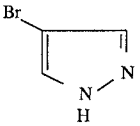

(11) 4-bromo-3-methyl pyrazole (Aldrich 27,823-8), of the formula

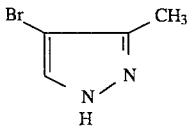

(12) 3,5-dimethyl pyrazole (Aldrich D18,200-1), of the formula

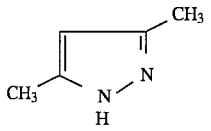

(13) 4-bromo-3,5-dimethyl pyrazole (Aldrich B6,440-7), of the formula

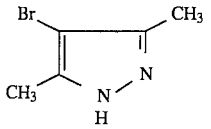

(14) 3,5-dimethyl pyrazole-1-carboxamide (Aldrich D18,220-6), of the formula

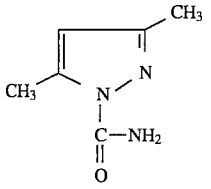

(15) 3,5-dimethylpyrazole-1-methanol (Aldrich 33,145-7), of the formula

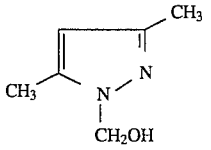

(16) 3-methyl-1-vinylpyrazole (Aldrich 37,727-9), of the formula

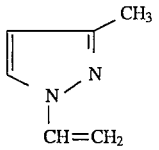

(17) 4-benzoyl-3-methyl-1-phenyl-2-pyrazolin-5-one (Aldrich 15,660-4), of the formula

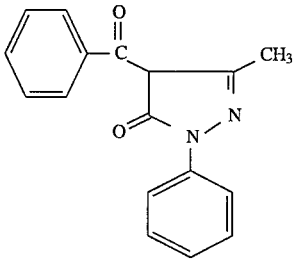

(18) 1-nitropyrazole (Aldrich 39,074-7), of the formula

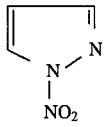

(19) 4-pyrazole carboxylic acid (Aldrich 30,071-3), of the formula

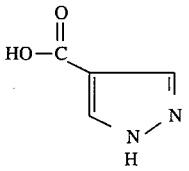

(20) 3,5-pyrazole dicarboxylic acid monohydrate (Aldrich P5,680-1), of the formula

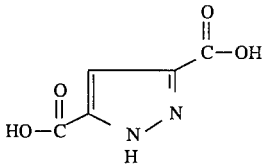

(21) 3-amino-5-hydroxypyrazole (Aldrich 33,144-9), of the formula

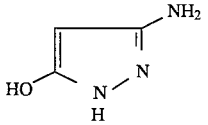

(22) 3-amino-4-pyrazole carbonitrile (Aldrich 15,304-4), of the formula

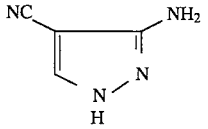

(23) 3-amino-4-pyrzaolecarboxylic acid (Aldrich A7,740-7), of the formula

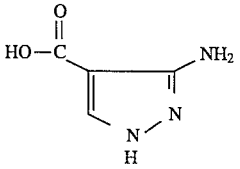

(24) 4-methyl pyrazole hydrochloride (Aldrich 28,667-2), of the formula

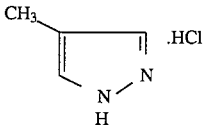

(25) 3,4-diamino-5-hydroxy pyrazole sulfate (Aldrich D1,900-1), of the formula

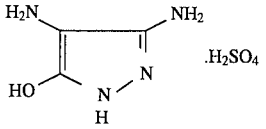

(26) (3,5-dimethyl pyrazole-1-carboxamidine nitrate) (Aldrich D 18,225-7), of the formula

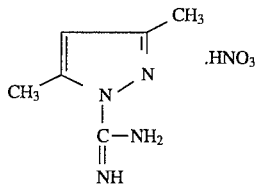

(27) 3-amino-4-pyrazole carboxamide hemisulfate (Aldrich 15,305-2), of the formula

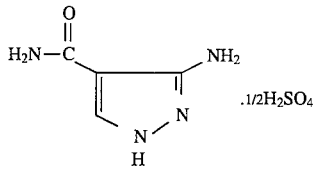

(28) acid salt of 6-amino indazole hydrochloride (Aldrich A5, 955-7), of the formula

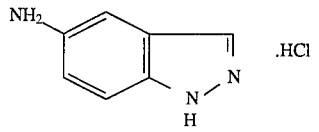

(29) 4-hydroxypyrazolo[3,4-d]pyrimidine (Aldrich H5,660-6), of the formula

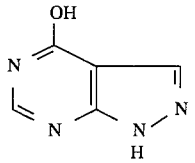

(30) 4-mercapto-1H-pyrazolo-[3,4-d]-pyrimidine (Aldrich 15,306-0), of the formula

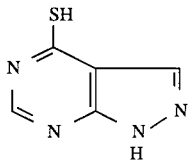

(31) indazole (Aldrich I,240-1), of the formula

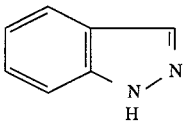

(32) 5-aminoindazole (Aldrich A5,955-7), of the formula

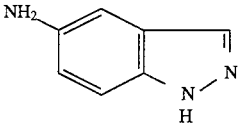

(33) 6-aminoindazole (Aldrich A5,956-5), of the formula

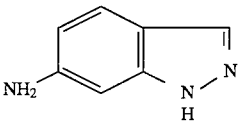

(34) 3-indazolinone (Aldrich 1 260-6), of the formula

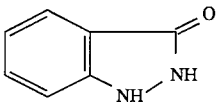

(35) N'-(6-indazolyl)sulfanilamide (Aldrich 15,530-6), of the formula

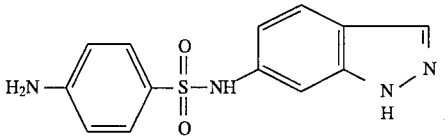

(36) 4,5-dihydro-3-(4-pyridinyl)-2H-benz[g]indazole methane sulfonate (Aldrich 21,413-2), of the formula

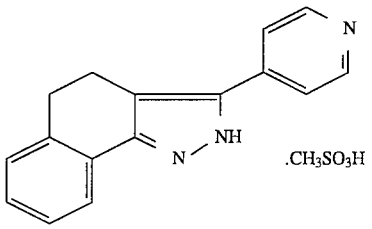

and the like;

(I) Imidazoles and imidazole derivatives, including those of the general formula

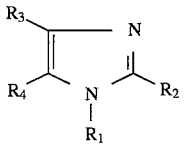

wherein $R_1$, $R_2$, $R_3$, and $R_4$ each, independently of the others, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, and $R_4$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds can also be in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like, as well as mixtures thereof.

Examples of suitable imidazole compounds include (1) imidazole (Aldrich I20-2), of the formula

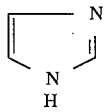

(2) 4-methylimidazole (Aldrich 19,988-5), of the formula

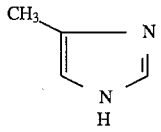

(3) 2-ethylimidazole (Aldrich 23,934-8), of the formula

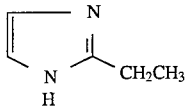

(4) 2-propylimidazole (Aldrich 37,537-3), of the formula

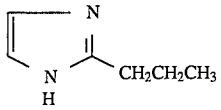

(5) 1-butylimidazole (Aldrich 34,841-4), of the formula

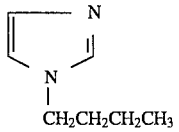

(6) 2-undecylimidazole (Aldrich 40,948-0), of the formula

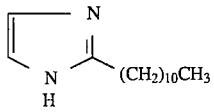

(7) histamine (Aldrich 27,165-9), of the formula

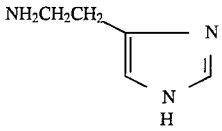

(8) 1-(3-aminopropyl) imidazole (Aldrich 27,226-4), of the formula

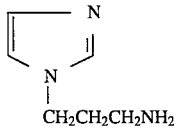

(9) 1-acetylimidazole (Aldrich 15,786-4), of the formula

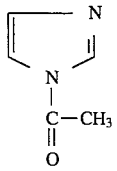

(10) 2-methyl-1-vinylimidazole (Aldrich 37,728-7), of the formula

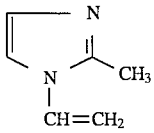

(11) 2-ethyl-4-methylimidazole (Aldrich E3,665-2), of the formula

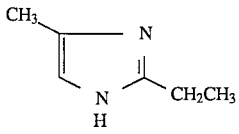

(12) 1-benzyl-2-methylimidazole (Aldrich 26,247-1 ), of the formula

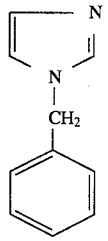

(13) 1-methylbenzimidazole (Aldrich 39,935-3), of the formula

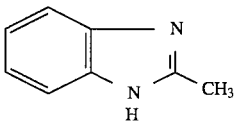

(14) 1-ethyl-3-methyl-1,H-imidazolinium chloride (Aldrich 27,284-1), of the formula

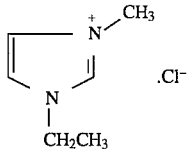

(15) 2-(aminomethyl) benzimidazole dihydrochloride hydrate (Aldrich 16,563-8), of the formula

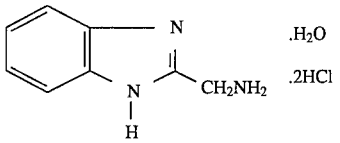

(16) 2,6-diamino-8-purinol hemisulfate monohydrate (Aldrich 11,187-2), of the formula

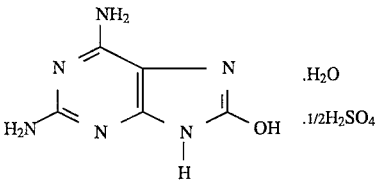

(17) purin-6-yl-trimethyl ammonium chloride (Aldrich P5,588-0), of the formula

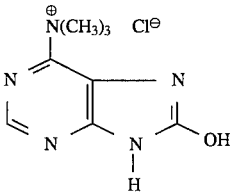

(18) 4-methyl-5-imidazole methanol hydrochloride (Aldrich 22,742-0), of the formula

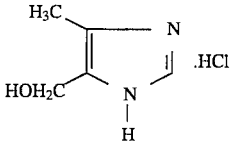

(19) N,N'-bis[3-(4,5-dihydro-1H-imidazol-2-yl)phenyl] urea dipropanoate (Aldrich 21,410-8), of the formula

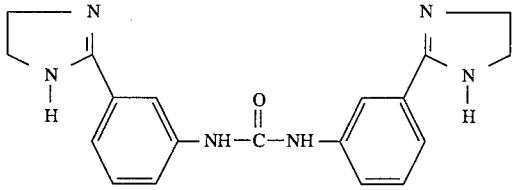

(20) 1-(p-tosyl)-3,4,4-trimethyl-2-imidazolinium iodide (Aldrich 31,757-8), of the formula

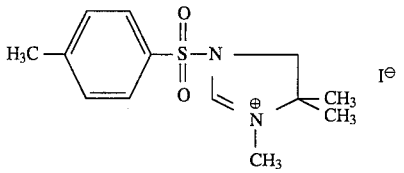

(21) 1-ethyl-3-methyl-1H-imidazolinium chloride (Aldrich 27,284-1), of the formula

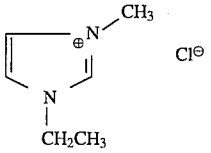

(22) 2-amino imidazole sulfate (Aldrich 19,791-2), of the formula

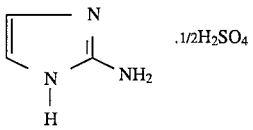

(23) 4-amino-5-imidazole carboxamide hydrochloride (Aldrich 16,496-8), of the formula

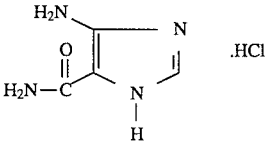

(24) 2-hydrazino-2-imidazoline hydrobromide (Aldrich 19,717-3), of the formula

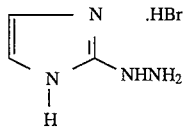

(25) imidazole hydrochloride (Aldrich 30,200-7), of the formula

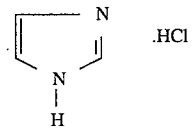

(26) 4-imidazole acetic acid hydrochloride (Aldrich 21,991-1), of the formula

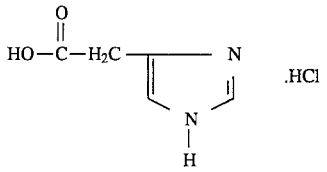

(27) 2-benzyl-2-imidazoline hydrochloride (Aldrich T3,546-7), of the formula

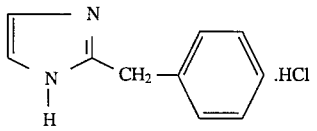

(28) propyl-1-(1-phenyl ethyl imidazole-5-carboxylate hydrochloride (Aldrich 22,082-5), of the formula

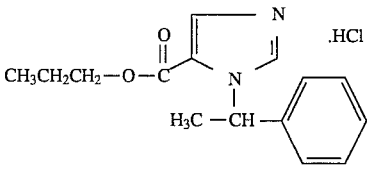

(29) 2,6-diamino purine sulfate hydrate (Aldrich 28,554-4), of the formula

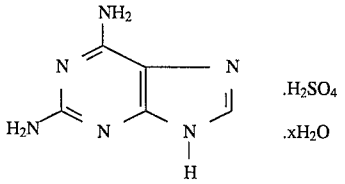

(30) 1-tallow amido ethyl-3-methyl-2-heptadecyl imidazolinium methyl sulfate (Carsosoft S-90, available from Lonza Inc.), of the formula

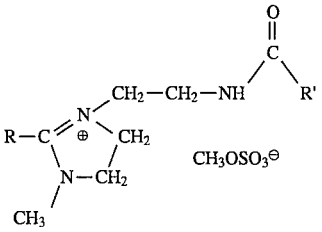

R = heptadecyl, R' = tallow

(31) isostearyl ethyl imidonium ethyl sulfate (Monaquat ISLES), of the formula

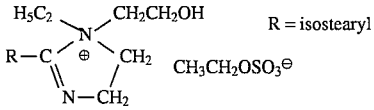

(32) methyl (1) tallow amido ethyl-2-tallow imidazolinium methyl sulfate (Accosoft 808, available from Stepan Chemicals), of the formula

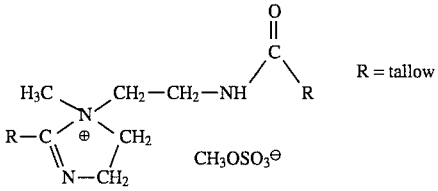

(33) isostearyl benzyl imidonium chloride (available from Scher Chemicals), of the formula

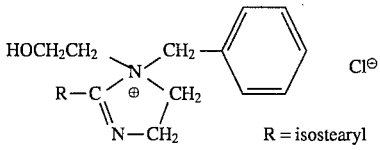

(34) methyl (1) hydrogenated tallow amido ethyl (2) hydrogenated tallow imidazolinium methyl sulfate (available from Sherex Chemicals), of the formula

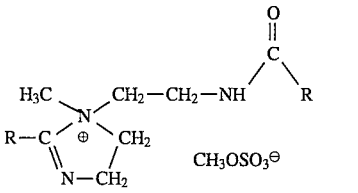

(35) 1-methyl-1-oleyl amido ethyl-2-oleyl-imidazolinium methyl sulfate (Varisoft 3690, available from Scherex Chemicals), of the formula

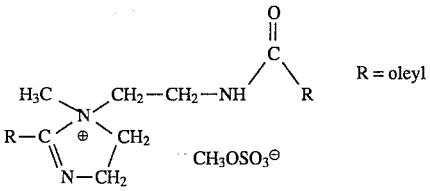

(36) cocohydroxyethyl polyethyleneglycol imidazolinium chloride phosphate (available from Mona Industries); (37) 1-methyl uric acid (Aldrich 36,023-6), of the formula

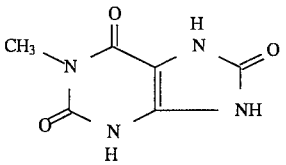

(38) guanine (Aldrich G1,195-0), of the formula

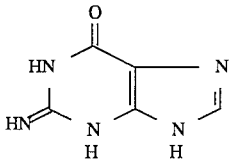

(39) guanosine hydrate (Aldrich G1,200-0), of the formula

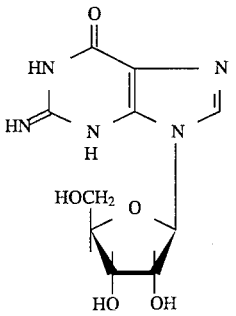

(40) xanthine (Aldrich 10,954-1), of the formula

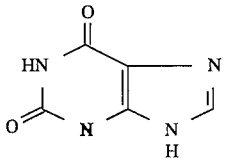

(41) 1-methylxanthine (Aldrich 28,098-4), of the formula

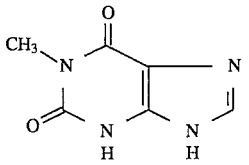

(42) 3-methylxanthine (Aldrich 22,252-6), of the formula

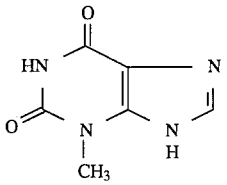

(43) 3-isobutyl-1-methyl xanthine (Aldrich 85,845-5), of the formula

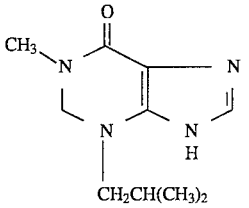

(44) hypoxanthine (Aldrich H6, 120-0), of the formula

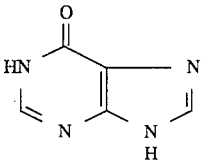

(45) xanthosine dihydrate (Aldrich 22,334-4), of the formula

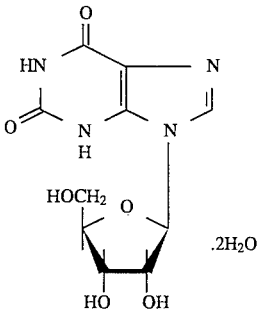

(46) 6-thioxanthene (Aldrich 85,257-0), of the formula

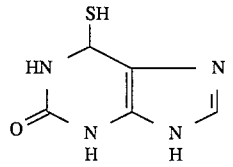

(47) purine (Aldrich P5,580-5), of the formula

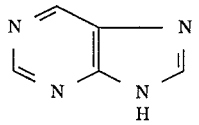

(48) 6-amino purine (adenine) (Aldrich 10,496-5), of the formula

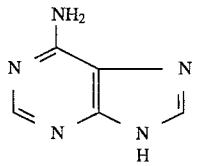

(49) 6-methoxy purine hemihydrate (Aldrich 85,270-8), of the formula

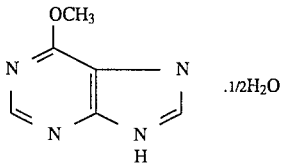

(50) 6-mercaptopurine monohydrate (Aldrich 85,267-8), of the formula

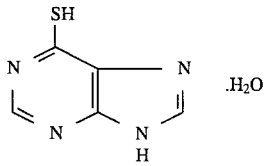

(51) 2-amino-6-chloropurine (Aldrich 10,978-9), of the formula

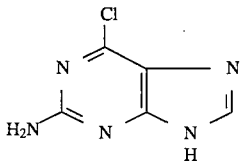

(52) 2-amino-6,8-dihydroxy purine (Aldrich 12,291-2), of the formula

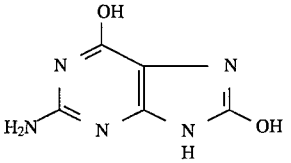

(53) theophylline (3,7 dihydro-1,3-dimethyl-1H-purine-2, 6-dione) (Aldrich 26,140-8), of the formula

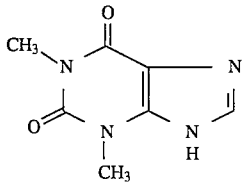

(54) kinetin (6-furfuryl amino purine) (Aldrich 85,264-3), of the formula

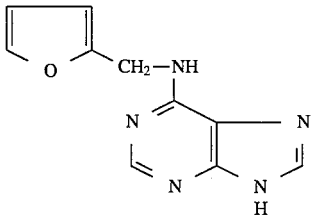

(55) 1-methyl adenine (Aldrich 21,532-5), of the formula

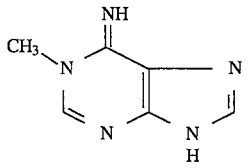

(56) 3-methyl adenine (Aldrich 28,087-9), of the formula

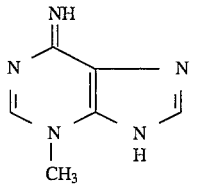

(57) (–)-adenosine (Aldrich 14,659-5), of the formula

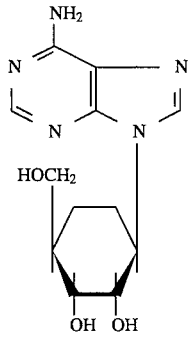

(58) (–)-inosine (Aldrich I-640-7), of the formula

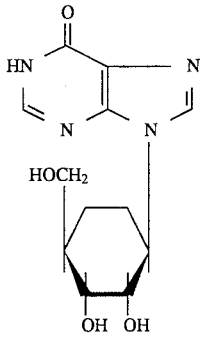

(59) 6-mercaptopurine riboside (Aldrich 85,268-6), of the formula

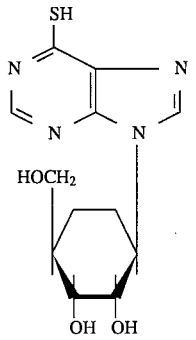

(60) 6-amino purine hydrochloride hemihydrate (Aldrich 27,193-4), of the formula

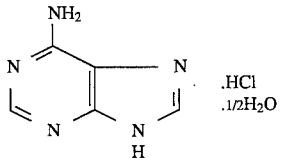

(61) 6-amino purine sulfate (Aldrich 14,581-5), of the formula

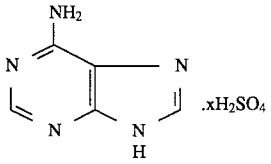

(62) 2,6-diamino-8-purinol hemisulfate monohydrate (Aldrich 11,187-2), of the formula

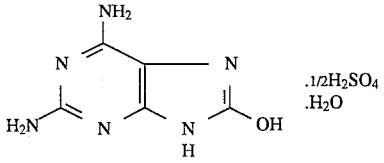

(63) benzimidazole (Aldrich 11,669-6), of the formula

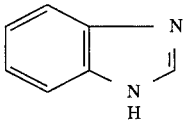

(64) 2-aminobenzimidazole (Aldrich 17,177-8), of the formula

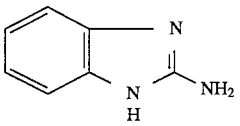

(65) 2-amino-5,6-dimethlybenzimidazole (Aldrich A5,120-3), of the formula

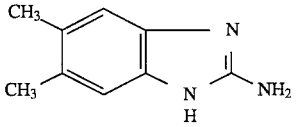

(66) 5-benzimidazole carboxylic acid (Aldrich 29,678-3), of the formula

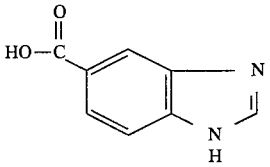

(67) 2,4,5-trimethyl benzimidazole (Aldrich T7,400-4), of the formula

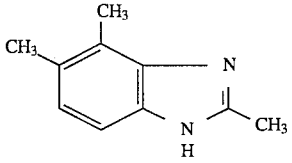

(68) 2-guanidinobenzimidazole (Aldrich G1,180-2), of the formula

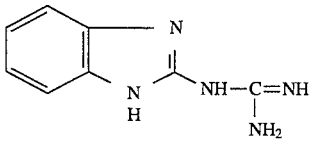

(69) 2-hydroxybenzimidazole (Aldrich H1,985-9), of the formula

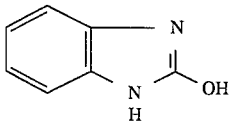

(70) 4-(2-keto-1-benzimidazolinyl)piperidine (Aldrich 12,955-0), of the formula

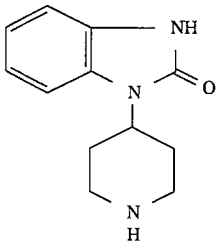

(71) 2-imidazolidine thione (Aldrich I-50-4), of the formula

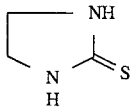

(72) 2-imidazolidone (Aldrich I-60-1), of the formula

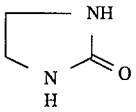

(73) hydantoin (Aldrich 15,631-1), of the formula

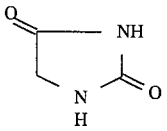

(74) 1-methyl hydantoin (Aldrich M4,988-7), of the formula

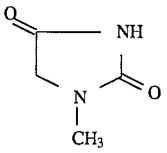

(75) creatinine (Aldrich 85,970-2), of the formula

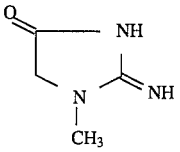

(76) 2-thiohydrantoin (Aldrich T3,040-6), of the formula

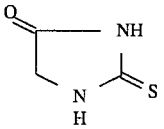

(77) 5-hydantoin acetic acid (Aldrich 85,062-4), of the formula

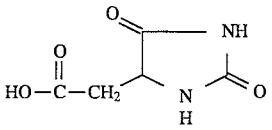

(78) 5-ureidohydantoin(allantoin) (Aldrich A2,839-2), of the formula

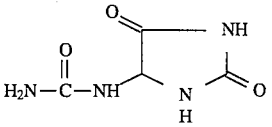

(79) 5,5-dimethyl hydantoin (Aldrich D16,140-3), of the formula

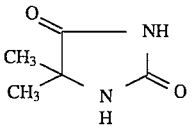

(80) 2-imidazolidone-4-carboxylic acid (Aldrich 8,6016-6), of the formula

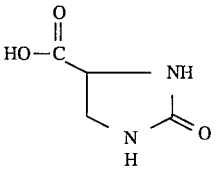

and the like;

(J) pyridines and pyridine derivatives, including those of the general formula

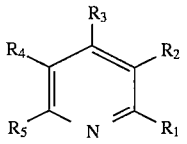

wherein $R_1$, $R_2$, $R_3$, $R_4$, and $R_5$ each, independently of the others, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, and $R_5$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds can also be in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_{32}^-$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{-2}$, $BrO_3^-$, $IO_3^-$, $ClO_3^-$, or the like, as well as mixtures thereof.

Examples of suitable pyridine compounds include (1) N,N-bis(2-hydroxyethyl)isonicotinamide (Aldrich 34,481-8), of the formula

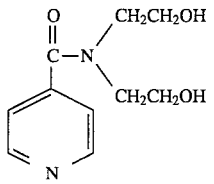

(2) 1,2-bis(4-pyridyl)ethylene (Aldrich B5,260-3), of the formula

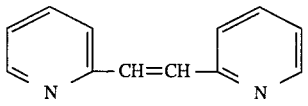

(3) 2-(2-piperidinoethyl)pyridine (Aldrich 30,396-8), of the formula

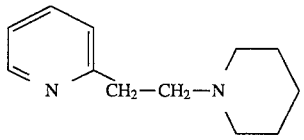

(4) 1,2-bis(4-pyridyl)ethane (Aldrich B5,180-1), of the formula

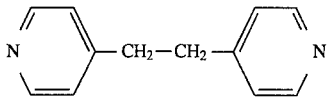

(5) 4,4'-trimethylene pyridine (Aldrich 12,119-3), of the formula

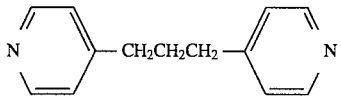

(6) aldrithiol-2 (Aldrich 14,304-9), of the formula

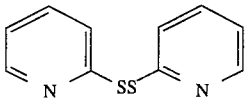

(7) aldrithiol-4 (Aldrich 14,305-7), of the formula

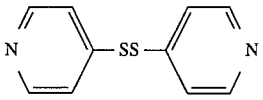

(8) 1,3-bis(3-pyridylmethyl)-2-thiourea (Aldrich 34,484-2), of the formula

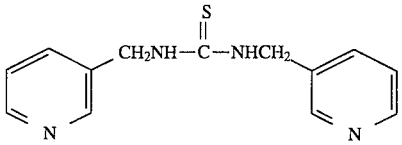

(9) 2,2':6',2"-terpyridine (Aldrich 23,467-2), of the formula

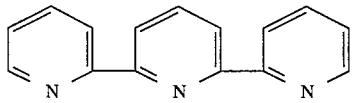

(10) 2-[N,N-bis(triflouromethylsulfonyl)amino]pyridine (Aldrich 40,363-6), of the formula

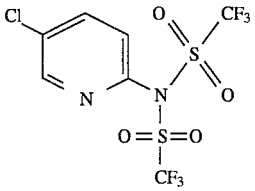

(11) 2,3-pyridine dicarboxylic acid (Aldrich P6,320-4), of the formula

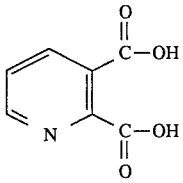

(12) 2,4-pyridine dicarboxylic acid monohydrate (Aldrich P6,339-5), of the formula

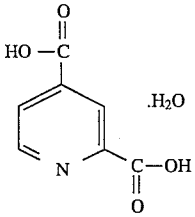

(13) 2,5-pyridine dicarboxylic acid (Aldrich P6,360-3), of the formula

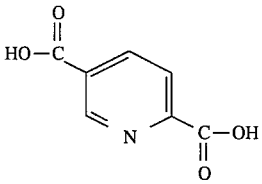

(14) 2,6-pyridine dicarboxylic acid (Aldrich P6,380-8), of the formula

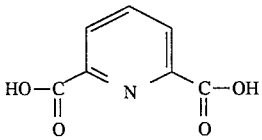

(15) 3,4-pyridine dicarboxylic acid (Aldrich P6,400-6), of the formula

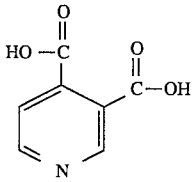

(16) 3,5-pyridine dicarboxylic acid (Aldrich P6,420-0), of the formula

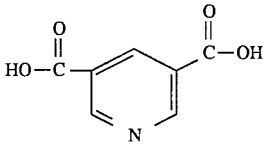

(17) 2,6-pyridine dicarboxaldehyde (Aldrich 25,600-5), of the formula

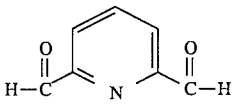

(18) 3,4-pyridine carboxamide (Aldrich 32,856-1), of the formula

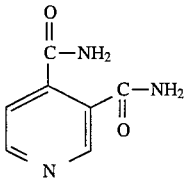

(19) 3,4-pyridine carboximide (Aldrich 32,858-8), of the formula

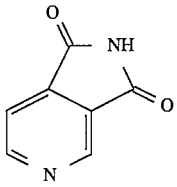

(20) 2,3-pyridine carboxylic anhydride (Aldrich P6,440-5), of the formula

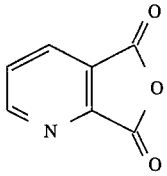

(21) 3,4-pyridine carboxylic anhydride (Aldrich 28,271-5), of the formula

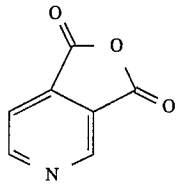

(22) 2,6-pyridine methanol (Aldrich 15,436-9), of the formula

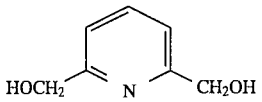

(23) 2-pyridine ethane sulfonic acid (Aldrich 30,392-5), of the formula

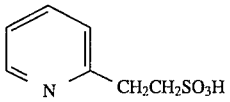

(24) 4-pyridine ethane sulfonic acid (Aldrich 14,242-5), of the formula

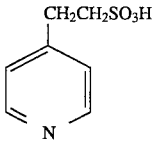

(25) 3-pyridine sulfonic acid (Aldrich P6,480-4), of the formula

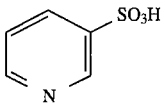

(26) pyridoxic acid (Aldrich 28,710-5), of the formula

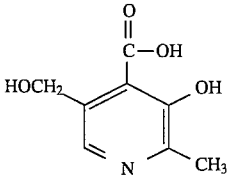

(27) trans-3-(3-pyridyl)acrylic acid (Aldrich P6,620-3), of the formula

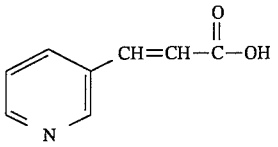

(28) 2-pyridyl hydroxymethane sulfonic acid (Aldrich 85,616-9), of the formula

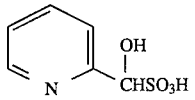

(29) 3-pyridyl hydroxymethane sulfonic acid (Aldrich P6,840-0), of the formula

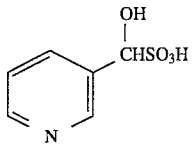

(30) 6-methyl-2,3-pyridine dicarboxylic acid (Aldrich 34,418-4), of the formula

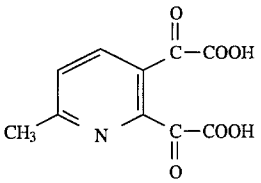

(31) isonicotinic acid (Aldrich I-1,750-8), of the formula

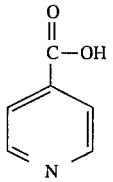

(32) pyridine hydrobromide (Aldrich 30,747-5), of the formula

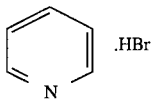

(33) pyridine hydrochloride (Aldrich 24,308-6), of the formula

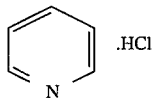

(34) 2-(chloromethyl) pyridine hydrochloride (Aldrich 16,270-1), of the formula

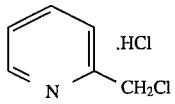

(33) 2-pyridylacetic acid hydrochloride (Aldrich P6,560-6), of the formula

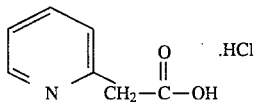

(36) nicotinoyl chloride hydrochloride (Aldrich 21,338-1), of the formula

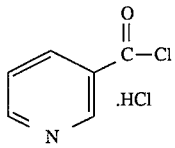

(37) 2-hydrazinopyridine dihydrochloride (Aldrich H1,710-4), of the formula

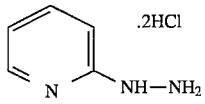

(38) 2-(2-methyl aminoethyl) pyridine dihydrochloride (Aldrich 15,517-9), of the formula

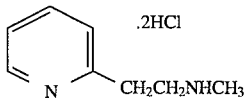

(39) 1-methyl-1,2,3,6-tetrahydropyridine hydrochloride (Aldrich 33,238-0), of the formula

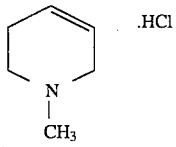

(40) 2,6-dihydroxypyridine hydrochloride (Aldrich D12,000-6), of the formula

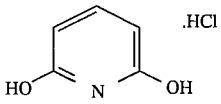

(41) 3-hydroxy-2(hydroxymethyl)pyridine hydrochloride (Aldrich H3,153-0), of the formula

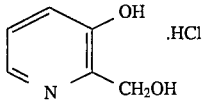

(42) pyridoxine hydrochloride (Aldrich 11,280-1 ), of the formula

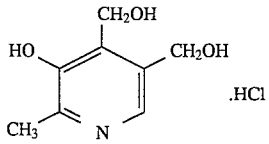

(43) pyridoxal hydrochloride (Aldrich 27,174-8), of the formula

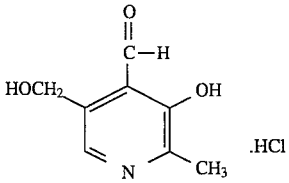

(44) pyridoxal 5-phosphate monohydrate (Aldrich 85,786-6), of the formula

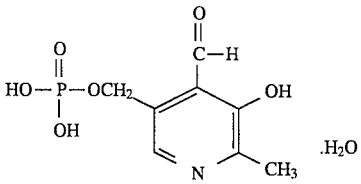

(45) 3-amino-2,6-dimethoxy pyridine hydrochloride (Aldrich 14,325-1), of the formula

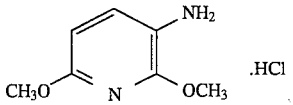

(46) pyridoxamine dihydrochloride monohydrate (Aldrich 28,709-1), of the formula

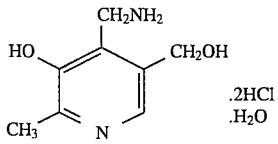

(47) iproniazid phosphate(isonicotinic acid 2-isopropyl hydrazide phosphate) (Aldrich I-1,265-4), of the formula

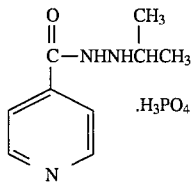

(48) tripelennamine hydrochloride (Aldrich 28,738-5), of the formula

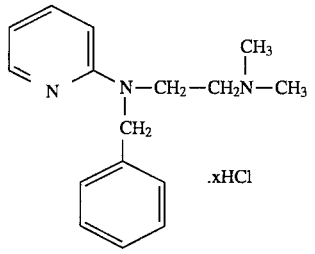

(49) pyridinium bromide perbromide (Aldrich 13,324-8), of the formula

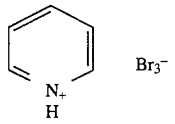

(50) pyridinium 3-nitrobenzenesulfonate (Aldrich 27,198-5), of the formula

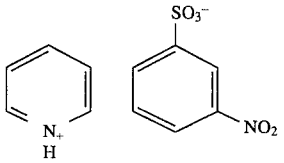

(51) 1-ethyl-3-hydroxy pyridinium bromide (Aldrich 19,264-3), of the formula

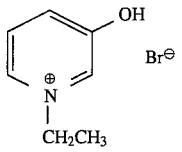

(52) 1-ethyl-4-(methoxy carbonyl)pyridinium iodide (Aldrich 32,625-9), of the formula

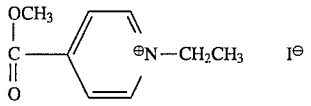

(53) 1-heptyl-4-(4-pyridyl)pyridinium bromide (Aldrich 37,778-3), of the formula

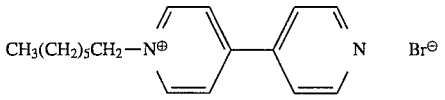

(54) 1-dodecyl pyridinium chloride (Aldrich 27,860-2), of the formula

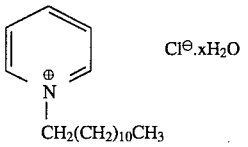

(55) 1-hexadecyl pyridinium chloride monohydrate (also called 1-cetyl pyridinium chloride monohydrate, Aldrich 85,556-1, Acetoquat CPC, Aceto Chemical), of the formula

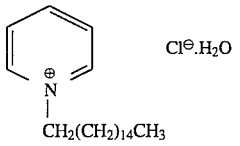

(56) 1-hexadecyl pyridinium bromide monohydrate (also called 1-cetyl pyridinium bromide monohydrate, Aldrich 28,531-5, Acetoquat CPB, Aceto Chemical), of the formula

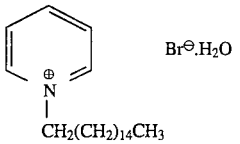

(57) 1-(carboxymethyl)pyridinium chloride (Aldrich 15274-9), of the formula

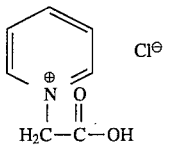

(58) 1-(carboxymethyl)pyridinium chloride hydrazide (Girards Reagent, Aldrich 12,451-6), of the formula

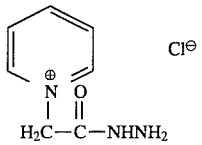

(59) 1-(3-nitrobenzyloxymethyl)pyridinium chloride (Aldrich 22,031-0), of the formula

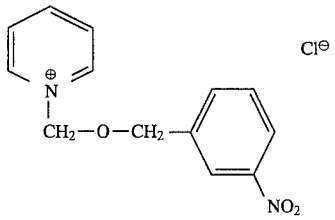

(60) 1-(3-sulfopropyl)pyridinium hydroxide (Aldrich 25,167-4), of the formula

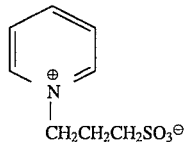

(61) N-(lauroyl colamino formyl methyl)pyridinium chloride (Emcol E-607L, available from Witco Chemical Ltd.), of the formula

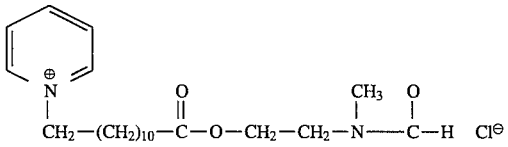

(62) N-(stearoyl colamine formyl methyl)pyridinium chloride (Emcol E-607S, available from Witco Chemical Ltd.), of the formula

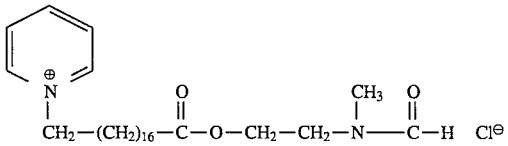

(63) 2-chloro-1-methyl pyridinium iodide (Aldrich 19,800-5), of the formula

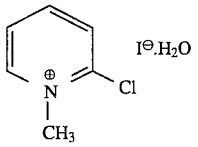

(64) 2-pyridine aldoxime-1-methyl methane sulfonate (Aldrich P6,060-4), of the formula

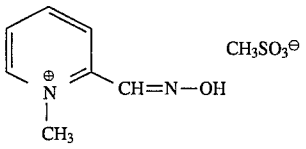

(65) 2-pyridine aldoxime-1-methyl chloride (Aldrich P6,020-5), of the formula

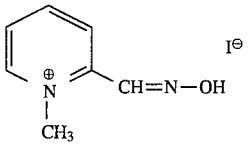

(66) 2-[4-(dimethyl amino)styryl]1-ethylpyridinium iodide (Aldrich 28,012-7), of the formula

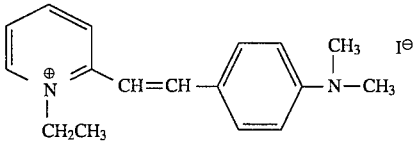

(67) 1-benzyl-3-hydroxy pyridinium chloride (Aldrich B2,313-1), of the formula

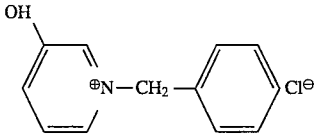

(68) 1,4 dimethyl pyridinium iodide (Aldrich 37,643-4), of the formula

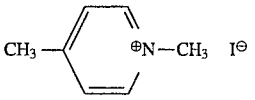

(69) 1-ethyl-4-phenyl pyridinium iodide (Aldrich 36,208-5), of the formula

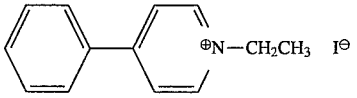

(70) 4-phenyl-1-propyl pyridinium iodide (Aldrich 36,215-8), of the formula

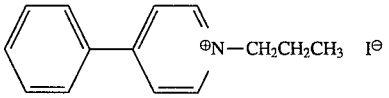

(71) 1-docosyl-4-(4 hydroxystyryl)pyridinium bromide (Aldrich 36,684-6), of the formula

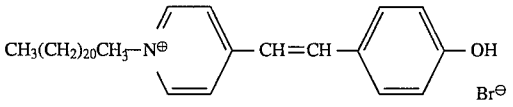

(72) 1,1'-dimethyl-4,4'-bipyridinium dichloride (Aldrich 85,617-7), of the formula

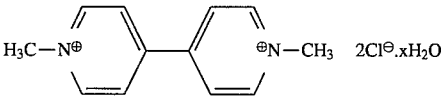

(73) 1,1'-diethyl-4,4'-bipyridinium dibromide (Aldrich 38,409-7), of the formula

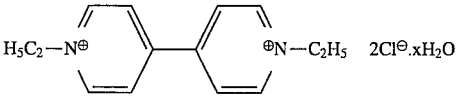

(74) 1,1'-dibenzyl-4,4'-bipyridinium dichloride (Aldrich 27,184-5), of the formula

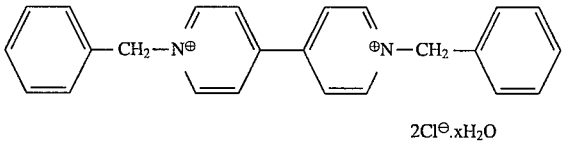

(75) 1,1'-diheptyl-4,4'-bipyridinium dibromide (Aldrich 18,085-8), of the formula

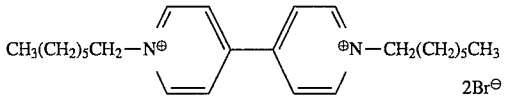

(76) 1,7-phenanthroline (Aldrich 30,184-1), of the formula

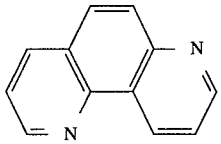

(77) 1,10-phenanthroline (Aldrich 13,137-7), of the formula

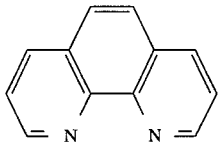

(78) 5-chloro-1,10-phenanthroline (Aldrich 30,177-9), of the formula

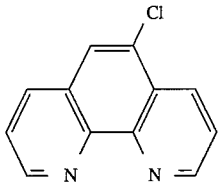

(79) 4,5-dihydro-3-(4-pyridinyl)-2H-benz[g]indazole methane sulfonate (Aldrich 21,413-2), of the formula

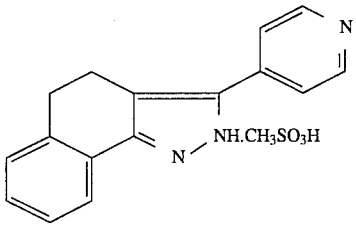

and the like;

(K) quinolines and quinoline derivatives, and isoquinolines and isoquinoline derivatives, including those of the general formulae

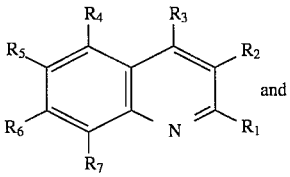

and

-continued

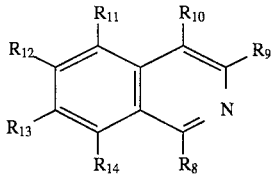

wherein $R_1$, $R_2$, $R_3$, $R_4$, $R_5$, $R_6$, $R_7$, $R_8$, $R_9$, $R_{10}$, $R_{11}$, $R_{12}$, $R_{13}$, and $R_{14}$ each, independently of the others, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, $R_8$, $R_9$, $R_{10}$, $R_{11}$, $R_{12}$, $R_{13}$, and $R_{14}$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds can also be in acid salt form, wherein they are associated with a compound of the general formula $xH_nY_n$-, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like, as well as mixtures thereof.

Examples of suitable quinoline and isoquinoline compounds include (1) 1,2,3,4-tetrahydro quinoline (Aldrich T1,550-4), of the formula

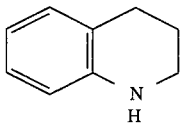

(2) 6-ethoxy-1,2,3,4-tetrahydro-2,2,4-trimethyl quinoline (Aldrich 19,636-3), of the formula

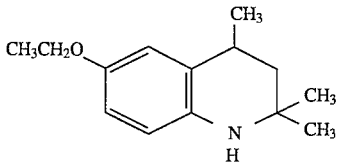

(3) 2-cyanoquinoline (Aldrich 36,894-6), of the formula

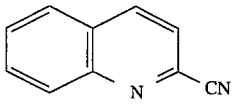

(4) 1-cyanoisoquinoline (Aldrich 35,795-2), of the formula

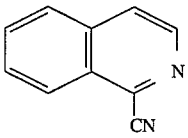

(5) 3-cyanoisoquinoline (Aldrich 33,853-2), of the formula

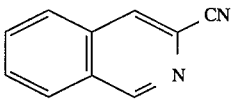

(6) 3-amino quinoline (Aldrich 23,228-9), of the formula

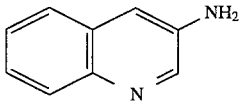

(7) 8-aminoquinoline (Aldrich 26,078-9), of the formula

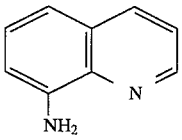

(8) 7,8-benzoquinoline (Aldrich 12,361-7), of the formula

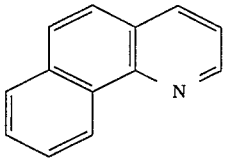

(9) 8-hydroxy quinoline (Aldrich H5,830-7), of the formula

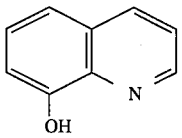

(10) 8-hydroxyquinoline, aluminium salt (Aldrich 41,628-2), of the formula

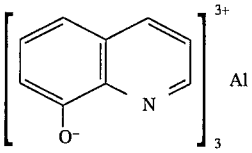

(11) 8-hydroxyquinaldine (Aldrich H5,760-2), of the formula

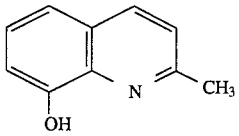

(12) 3,4,5,6,7,8-hexahydro 2 (1H)-quinolinone (Aldrich 29,964-2), of the formula

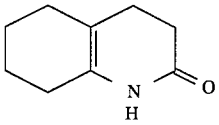

(13) julolidine (Aldrich J100-1 ), of the formula

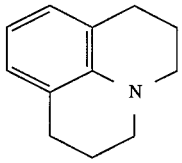

(14) quinoxaline (Aldrich Q160-3), of the formula

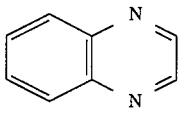

(15) ethyl-2-quinoxalinecarboxylate (Aldrich 28,905-1 ), of the formula

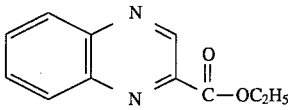

(16) quinoline (Aldrich Q125-5), of the formula

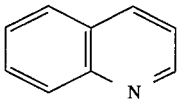

(17) 2-hydroxyquinoline (Aldrich 27,087-3), of the formula

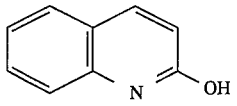

(18) 4-hydroxy quinoline (Aldrich H5,800-5), of the formula

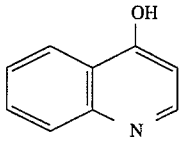

(19) 5-hydroxy quinoline (Aldrich 12,879-1), of the formula

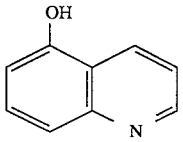

(20) 5-amino quinoline (Aldrich A7,920-5), of the formula

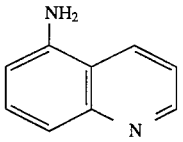

(21 ) 6-amino quinoline (Aldrich 27,558-1 ), of the formula

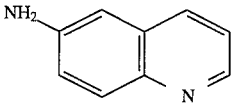

(22) 2-quinoline carboxylic acid (Aldrich 16,066-0), of the formula

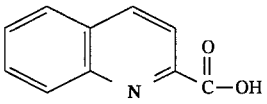

(23) 3-quinoline carboxylic acid (Aldrich 17,714-8), of the formula

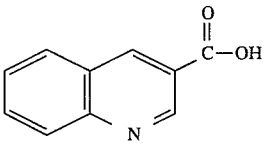

(24) 4-quinoline carboxylic acid (Aldrich 17,482-3), of the formula

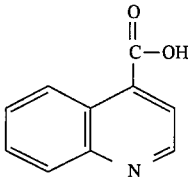

(25) 4-quinoline carboxaldehyde (Aldrich 17,696-6), of the formula

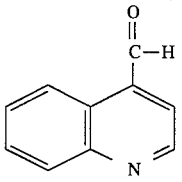

(26) 2-quinoline thiol (Aldrich 11,627-0), of the formula

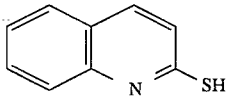

(27) 2,4-quinoline diol (Aldrich Q133-6), of the formula

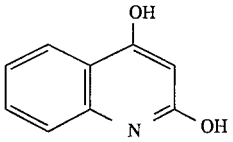

(28) quinaldine (Aldrich 12,332-3), of the formula

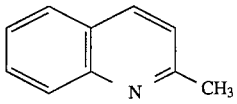

(29) 4-aminoquinaldine (Aldrich A7,900-0), of the formula

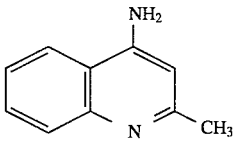

(30) 2,6-dimethyl quinoline (Aldrich 14,402-9), of the formula

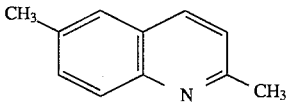

(31) 2,7-dimethyl quinoline (Aldrich 14,564-5), of the formula

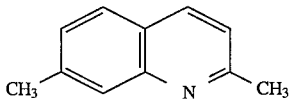

(32) 4-methoxy-2-quinoline carboxylic acid (Aldrich 30,508-1), of the formula

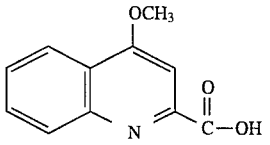

(33) methyl-2-phenyl-4-quinoline carboxylate (Aldrich 15,367-2), of the formula

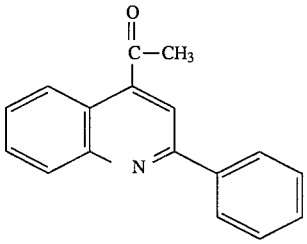

(34) 2-(N-butyl carbamoyl)-1,2,3,4-tetrahydro-isoquinoline (Aldrich 29,156-0), of the formula

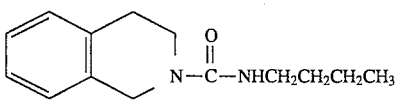

(35) 1-hydroxyisoquinoline (Aldrich 15,210-2), of the formula

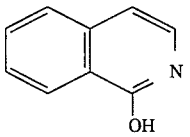

(36) 1-isoquinoline carboxylic acid (Aldrich 15,013-4), of the formula

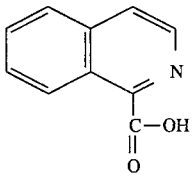

(37) 3-isoquinoline carboxylic acid (Aldrich 33,854-0), of the formula

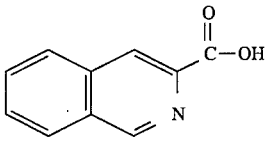

(38) 1,5-isoquinoline diol (Aldrich 28,191-3), of the formula

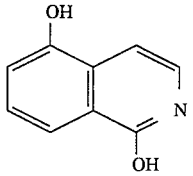

(39) 8-hydroxyquinoline hemisulfate hemihydrate (Aldrich 10,807-3), of the formula

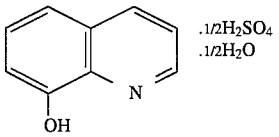

(40) 5-amino-8-hydroxy quinoline dihydrochloride (Aldrich 30,552-9), of the formula

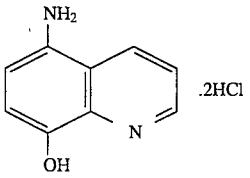

(41) 2-(chloromethyl) quinoline monohydrochloride (Aldrich C5,710-3), of the formula

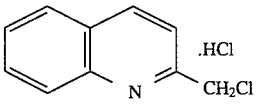

(42) 8-hydroxyquinoline-5-sulfonic acid monohydrate (Aldrich H5,875-7), of the formula

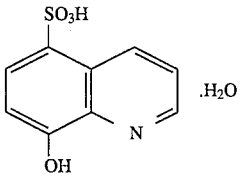

(43) 8-ethoxy-5-quinoline sulfonic acid sodium salt hydrate (Aldrich 17,346-0), of the formula

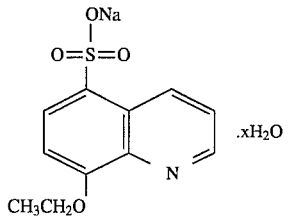

(44) 1,2,3,4-tetrahydroisoquinoline hydrochloride (Aldrich 30,754-8), of the formula

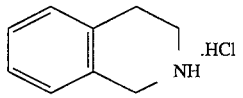

(45) 1,2,3,4-tetrahydro-3-isoquinoline carboxylic acid hydrochloride (Aldrich 21,493-0), of the formula

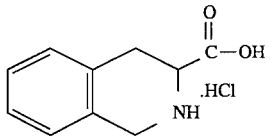

(46) 6,7-dimethoxy-1,2,3,4-tetrahydro isoquinoline hydrochloride (Aldrich 29,191-9), of the formula

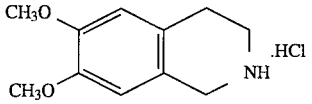

(47) 1-methyl-6,7-dihydroxy-1,2,3,4-tetrahydro isoquinoline hydrobromide (Aldrich 24,420-1), of the formula

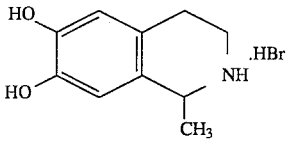

(48) primaquine diphosphate [8-(4-amino-1-methyl butyl amino)-6-methoxy quinoline diphosphate] (Aldrich 16,039-3), of the formula

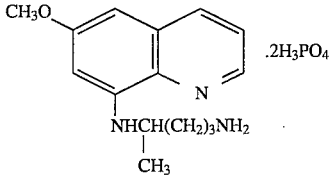

(49) pentaquine phosphate (Aldrich 30,207-4), of the formula

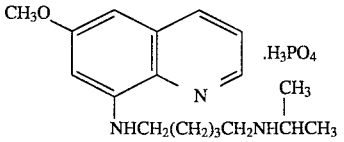

(50) dibucaine hydrochloride [2-butoxy-N-(2-diethyl amino ethyl)-4-quinoline carboxamide hydrochloride] (Aldrich 28,555-2), of the formula

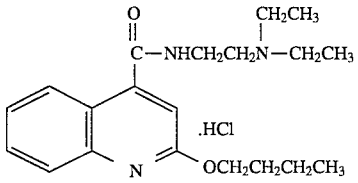

(51) 9-aminoacridine hydrochloride hemihydrate (Aldrich A3,840-1), of the formula

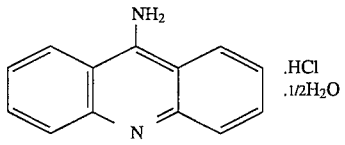

(52) 3,6-diamino acridine hemisulfate (Aldrich 19,822-6), of the formula

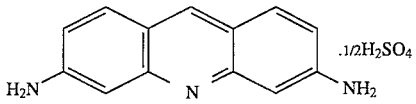

(53) 2-quinoline thiol hydrochloride (Aldrich 35,978-5), of the formula

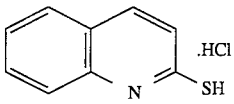

(54) (–) sparteine sulfate pentahydrate (Aldrich 23,466-4), of the formula

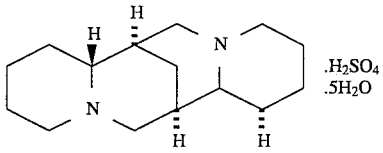

(55) papaverine hydrochloride (Aldrich 22,287-9), of the formula

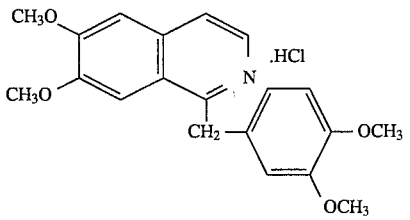

(56) (+)-emetine dihydrochloride hydrate (Aldrich 21,928-2), of the formula

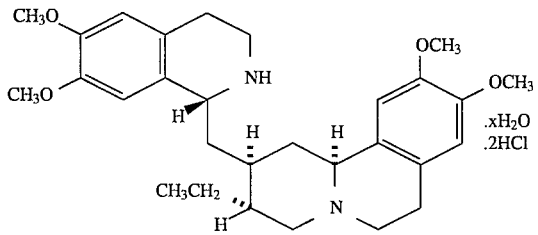

(57) 1,10-phenanthroline monohydrochloride monohydrate (Aldrich P1,300-2), of the formula

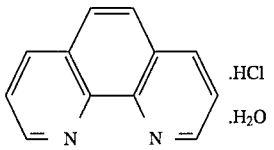

(58) neocuproine hydrochloride trihydrate (Aldrich 12,189-6), of the formula

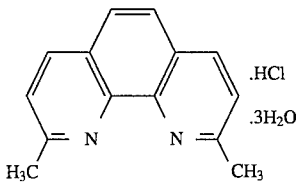

and the like;

(L) pyrimidines and pyrimidine derivatives, including those of the general formula

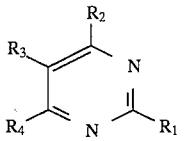

wherein $R_1$, $R_2$, $R_3$, and $R_4$ each, independently of the others, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, and $R_4$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds can also be in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like, as well as mixtures thereof.

Examples of suitable pyrimidines include (1) pyrimidine (Aldrich 13,169-5), of the formula

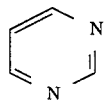

(2) 2 chloropyrimidine (Aldrich 19,329-1), of the formula

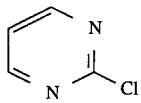

(3) 4-phenylpyrimidine (Aldrich P3,380-1), of the formula

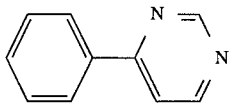

(4) 5-bromopyrimidine (Aldrich 21,914-2), of the formula

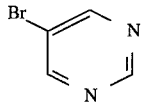

(5) 2,4-dichloropyrimidine (Aldrich 14,384-7), of the formula

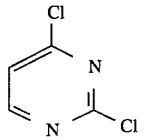

(6) 4,6-dichloropyrimidine (Aldrich 14,537-8), of the formula

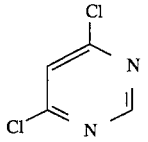

(7) 2,4-dichloro-6-methylpyrimidine (Aldrich 14,418-5), of the formula

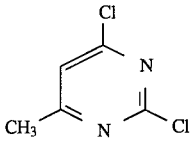

(8) 6-chloro-2,4-dimethoxypyrimidine (Aldrich C3,640-8), of the formula

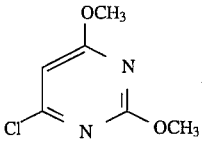

(9) 2-amino-4,6-dimethoxypyrimidine (Aldrich 37,534-9), of the formula

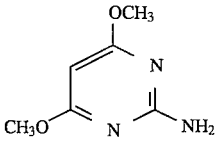

(10) 2,4,6-trichloropyrimidine (Aldrich T5,620-0), of the formula

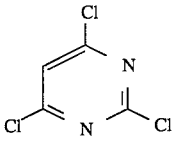

(11) 2,4,5,6-tetrachloropyrimidine (Aldrich 24,671-9), of the formula

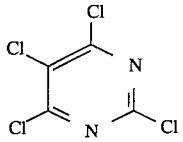

(12) 1,3,4,6,7,8-hexahydro-1-methyl-2H-pyrimido[1,2-a] pyrimidine (Aldrich 35,950-5), of the formula

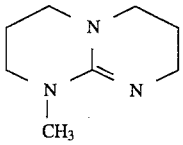

(13) 1,3,4,6,7,8-hexahydro-2H-pyrimido[1,2-a]pyrimidine (Aldrich 34,557-1), of the formula

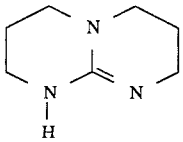

(14) hexetidine (Aldrich 25,918-7), of the formula

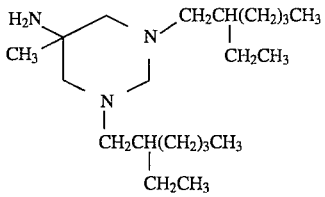

(15) tert-butyl S-(4,6-dimethylpyrimidin-2-yl)thiocarbonate (Aldrich 85,957of the formula

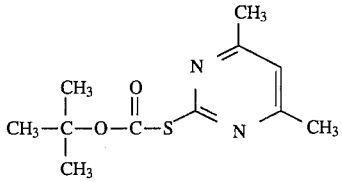

(16) 4-methoxybenzyl-S(4,6-dimethylpyrimidin-2-yl) thiocarbonate (Aldrich 85,956-7), of the formula

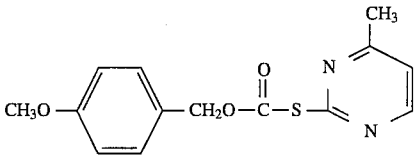

(17) 2-amino pyrimidine (Aldrich A7,860-8), of the formula

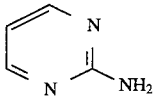

(18) 2-amino-4-methyl pyrimidine (Aldrich A6,570-0), of the formula

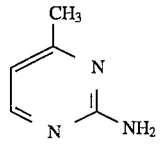

(19) 2-amino-5-nitropyrimidine (Aldrich A7,083-6), of the formula

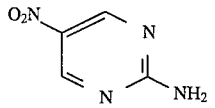

(20) 2-amino-5-bromopyrimidine (Aldrich 30,352-6), of the formula

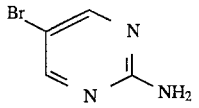

(21) 2-amino-4-chloro-6-methyl pyrimidine (Aldrich A4,600-5), of the formula

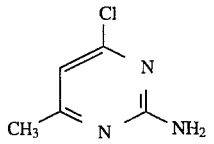

(22) 2-amino-4,6-dimethyl pyrimidine (Aldrich A5,200-5), of the formula

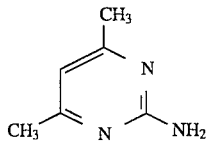

(23) 2-amino-4-hydroxy-6-methyl pyrimidine (Aldrich A5,800-3), of the formula

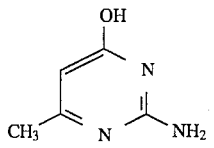

(24) 2-amino-4,6-dichloropyrimidine (Aldrich A4,860-1), of the formula

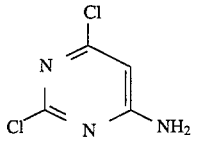

(25) 2-amino-5-bromo-6-methyl-4-pyrimidinol (Aldrich 20,520-6), of the formula

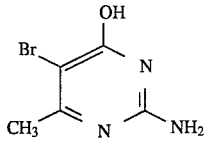

(26) 4-aminopyrimidine (Aldrich 26,182-3), of the formula

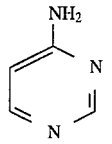

(27) 4,5-diamino pyrimidine (Aldrich D2,450-1), of the formula

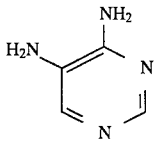

(28) 4-amino-2,6-dimethyl pyrimidine (Aldrich 18,675-9), of the formula

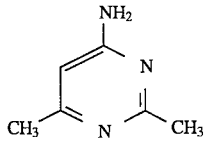

(29) 2,4-diamino-6-hydroxypyrimidine (Aldrich D 1,920-6), of the formula

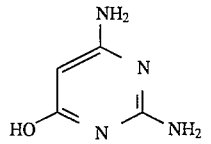

(30) 2,6-diamino-4-chloro pyrimidine (Aldrich C3,320-4), of the formula

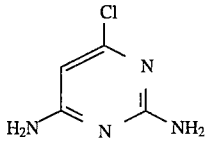

(31) 4,6-diamino-2-mercaptopyrimidine hemihydrate (Aldrich 12,580-3), of the formula

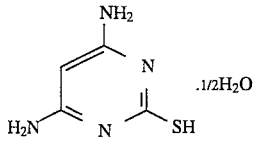

(32) 2,4,6-triamino pyrimidine (Aldrich T4,580-2), of the formula

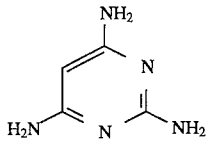

(33) 5-nitroso-2,4,6-triamino pyrimidine (Aldrich 19,420-4), of the formula

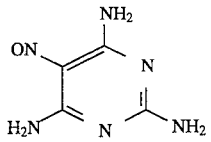

(34) 4,6-dihydroxy pyrimidine (Aldrich D12,040-5), of the formula

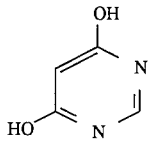

(35) 4,6-dihydroxy-2-amino pyrimidine (Aldrich A5,040-1), of the formula

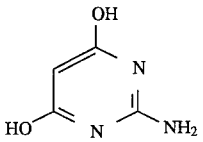

(36) 4,6-dihydroxy-2-methyl pyrimidine (Aldrich D11,525-8), of the formula

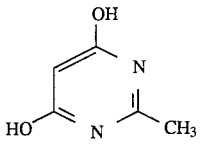

(37) 4,6-dihydroxy-5-nitropyrimidine (Aldrich 12,623-3), of the formula

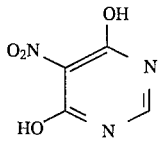

(38) 2,4-dihydroxy-5-methyl pyrimidine (Aldrich 13,199-7), of the formula

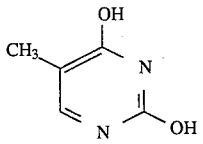

(39) 2,4-dihydroxy-6-methyl pyrimidine (Aldrich D 11,520-7), of the formula

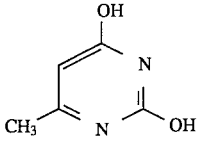

(40) 2,4-dihydroxy-5,6-dimethyl pyrimidine (Aldrich 16,536-0), of the formula

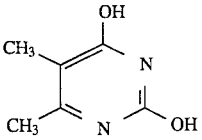

(41) 2,6-dihydroxy pyrimidine-5-carboxylic acid hydrate (Aldrich 27,770-3), of the formula

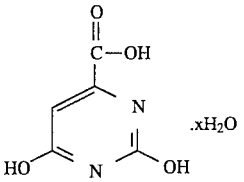

(42) 2,6-dihydroxy-4-amino pyrimidine (Aldrich A5,060-1), of the formula

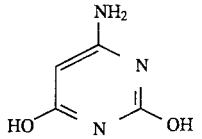

(43) 2,4,5-trihydroxy pyrimidine (Aldrich T6,670-2), of the formula

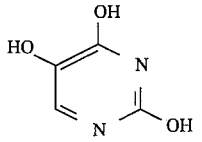

(44) 2-thiouracil [4-hydroxy-2-mercaptopyrimidine] (Aldrich 11,588-4), of the formula

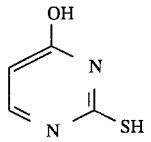

(45) 6-amino-5-nitroso-2-thiouracil (Aldrich 86,055-7), of the formula

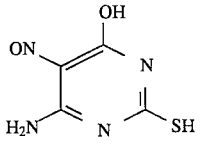

(46) folic acid dihydrate (Aldrich 23,587-3), of the formula

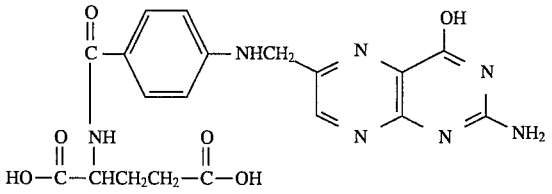

(47) folinic acid, calcium salt hydrate (Aldrich 86,189-8), of the formula

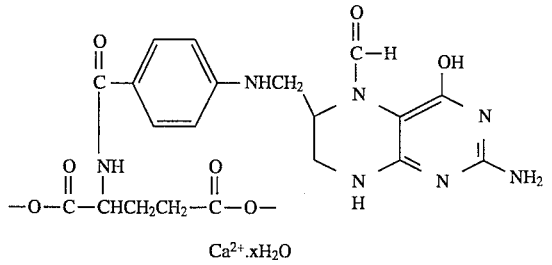

(48) 2-hydroxypyrimidine hydrochloride (Aldrich H5,740-8), of the formula

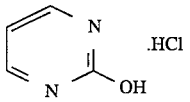

(49) 2-hydroxy-4-methyl pyrimidine hydrochloride (Aldrich H4,320-2), of the formula

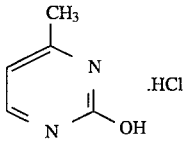

(50) 4,6-dimethyl-2-hydroxypyrimidine hydrochloride (Aldrich 33,996-2), of the formula

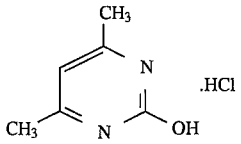

(51 ) 2-mercapto-4-methyl pyrimidine hydrochloride (Aldrich M480-5), of the formula

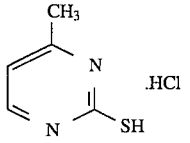

(52) 4,6-diamino pyrimidine hemisulfate monohydrate (Aldrich D2,480-3), of the formula

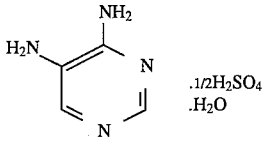

(53) 4,5,6-triamino pyrimidine sulfate hydrate (Aldrich T4,600-0; 30,718-1), of the formula

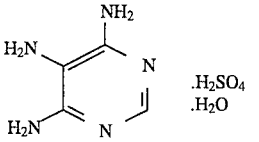

(54) 4,5-diamino-6-hydroxy pyrimidine sulfate (Aldrich D1,930-3), of the formula

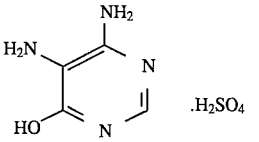

(55) 2,4-diamino-6-mercapto pyrimidine hemisulfate (Aldrich D1,996-6), of the formula

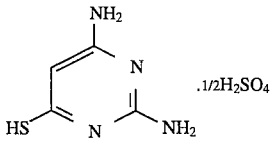

(56) 2,4-diamino-6-hydroxy pyrimidine hemisulfate hydrate (Aldrich 30,231-7), of the formula

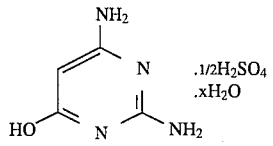

(57) 6-hydroxy-2,4,5-triamino pyrimidine sulfate (Aldrich H5,920-6), of the formula

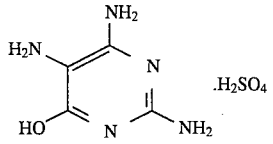

(58) 5,6-diamino-2,4-dihydroxy pyrimidine sulfate (Aldrich D1,510-3), of the formula

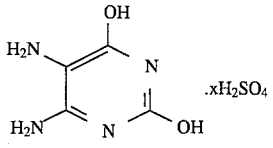

(59) N4-(2-amino-4-pyrimidinyl)sulfanilamide monohydrochloride (Aldrich 15,237-4), of the formula

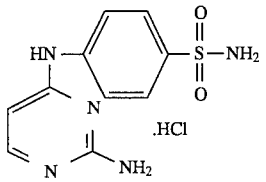

(60) 2,4,5,6-tetraamino pyrimidine sulfate (Aldrich T380-7), of the formula

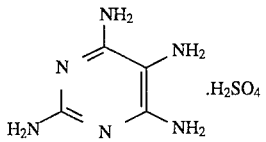

(61) pyrimidine diones, including those of the general formula

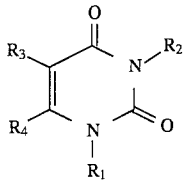

wherein $R_1$, $R_2$, $R_3$, and $R_4$ each, independently of the others, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, and $R_4$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds can also be in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like, as well as mixtures thereof, such as (a) 2,4 (1H,3H)-pyrimidine dione (uracil) (Aldrich 13,078-8), of the formula

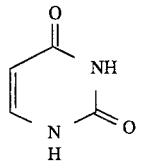

(b) 5-amino uracil (Aldrich 85,528-6), of the formula

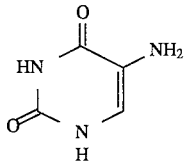

(c) 5-nitrouracil (Aldrich 85,276-7), of the formula

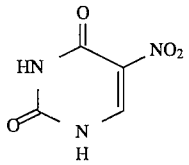

(d) 5-iodouracil (Aldrich 85,785-8), of the formula

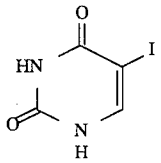

(e) 5-(hydroxymethyl) uracil hydrate (Aldrich 85,258-9), of the formula

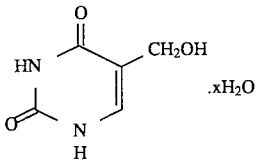

(f) 5,6-dihydrouracil (Aldrich 21,964-9), of the formula

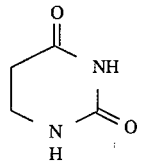

(g) 6-amino-1-methyl uracil (Aldrich 34,679-9), of the formula

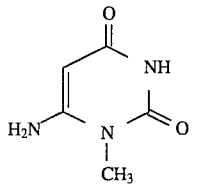

(h) 5,6-diamino-1,3-dimethyl uracil hydrate (Aldrich D,1590-1), of the formula

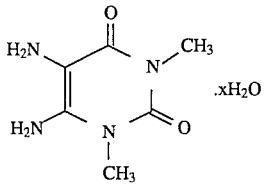

(i) uridine (Aldrich U288-1), of the formula

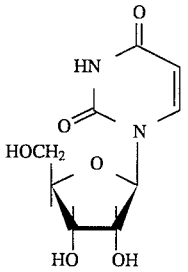

(j) 5-methyl uridine (Aldrich 28,669-9), of the formula

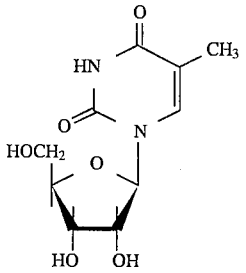

(k) 5-iodouridine (Aldrich 85,259-7), of the formula

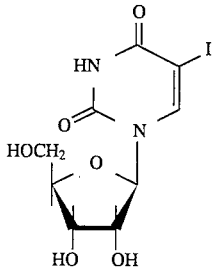

(l) thimidine (Aldrich 85,500-6) of the formula

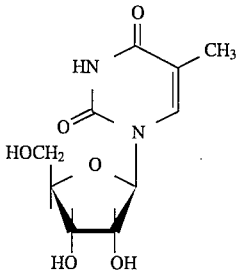

and the like;

(62) thiouracils, such as (a) 5-methyl-2-thiouracil (Aldrich 23,346-3), of the formula

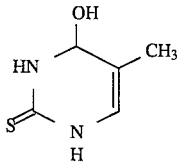

(b) 4-thiouridine (Aldrich 28,729-6), of the formula

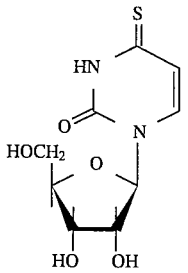

(c) 2-thiocytidine dihydrate (Aldrich 86,083-2), of the formula

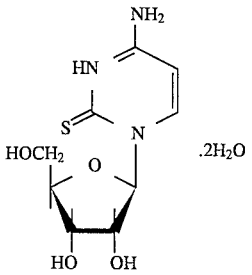

and the like;

(63) orotic acid compounds, such as (a) orotic acid monohydrate (Aldrich 0-840-2), of the formula

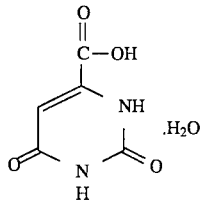

(b) L-hydroorotic acid (Aldrich 28,559-5), of the formula

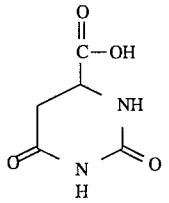

(c) 5-aminoorotic acid (Aldrich 19, 121-3), of the formula

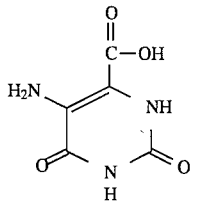

(d) methylorotate (orotic acid methyl ester) (Aldrich 22,478-2), of the formula

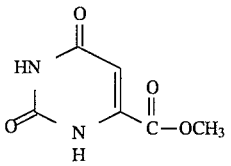

and the like;

(64) pyrimidine trione compounds, such as (a) barbituric acid (Aldrich B20o8), of the formula

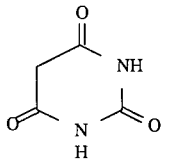

(b) 5-nitrobarbituric acid trihydrate (Aldrich N1,070-5), of the formula

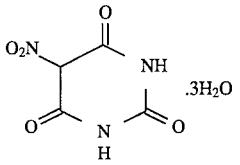

(c) violuric acid monohydrate (Aldrich 26,083-5), of the formula

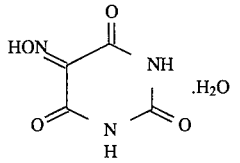

(d) alloxan monohydrate [2,4,5,6-(1H,3H)-pyrimidinetetrone] (Aldrich 23,437-0), of the formula

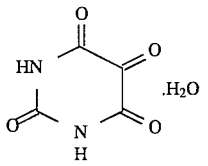

(65) 4,5,6-triamino-2(1H)-pyrimidinethione sulfate (Aldrich 26,096-7), of the formula

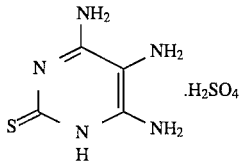

(66) (−)-cyclocytidine hydrochloride (Aldrich 85,883-8), of the formula

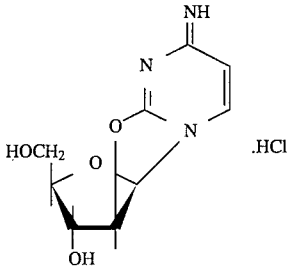

(67) cytosine arabinoside hydrochloride (Aldrich 85,585-5), of the formula

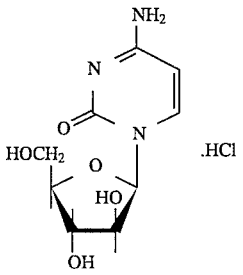

and the like;

(M) pyradizines and pyridazine derivatives, including those of the general formula

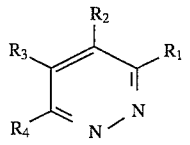

wherein $R_1$, $R_2$, $R_3$, and $R_4$ each, independently of the others, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, and $R_4$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds can also be in acid salt form, wherein they are associated with a compound of the general formula $xH_nY_{n^-}$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like, as well as mixtures thereof.

Examples of suitable pyridazines include (1) pyridazine (Aldrich P5,720-4), of the formula

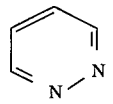

(2) phthalazine (Aldrich P3,870-6), of the formula

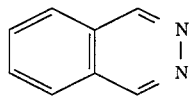

(3) 4,5-dihydro-6-methyl-3(2H)-pyridazinone monohydrate (Aldrich 27,8203), of the formula

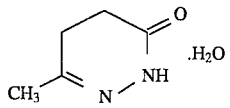

(4) 3,6-dichloropyridazine (Aldrich D7,320-9), of the formula

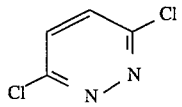

(5) 3,4,5-trichloropyridazine (Aldrich 13,894-0), of the formula

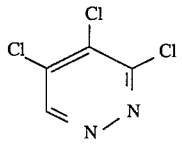

(6) 3,6-dichloro-4-methylpyridazine (Aldrich 29,774-7), of the formula

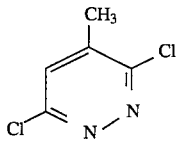

(7) 3-chloro-6-methoxypyridazine (Aldrich 10,859-6), of the formula

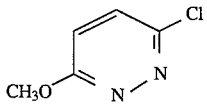

and the like;

(N) pyrazines and pyrazine derivatives, including those of the general formula

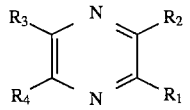

wherein $R_1$, $R_2$, $R_3$, and $R_4$ each, independently of the others, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, and $R_4$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds can also be in acid salt form, wherein they are associated with a compound of the general formula $xH_nY_n$-, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $so_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like, as well as mixtures thereof.

Examples of suitable pyrazines include (1) pyrazine (Aldrich P5,600-3), of the formula

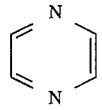

(2) acetylpyrazine (Aldrich 25,180-1), of the formula (3) aminopyrazine (Aldrich A7,695-8), of the formula

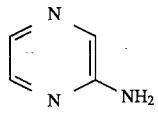

(4) 2,6-dichloropyrazine (Aldrich 13,249-7), of the formula

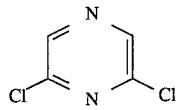

(5) 2,3,5-trimethylpyrazine (Aldrich 19,941-9), of the formula

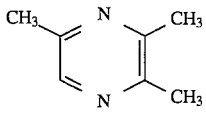

(6) tetramethylpyrazine (Aldrich 18,393-8), of the formula

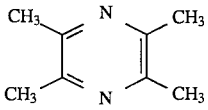

(7) 5-methyl-2-pyrazine carboxylic acid (Aldrich 34,764-7), of the formula

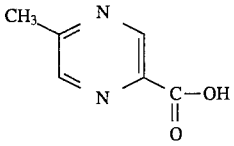

(8) pyrazine amide (Aldrich 13,157-1), of the formula

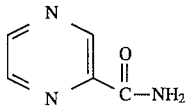

(9) 2,3-pyrazine dicarboxamide (Aldrich P 5,615-1 ), of the formula

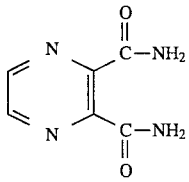

(10) 4-pyridazine carboxylic acid (Aldrich 29,776-3), of the formula

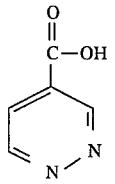

(11) 2,3-pyrazine dicarboxylic acid (Aldrich P5,620-8), of the formula

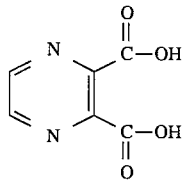

(12) lumazine monohydrate (Aldrich L330-7), of the formula

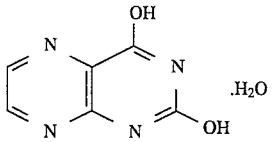

(13) xanthopterin monohydrate (Aldrich X 70-8), of the formula

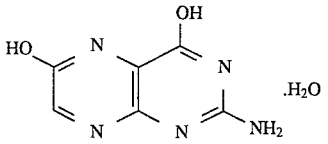

(14) 2-quinoxazoline carboxylic acid (Aldrich 29,340-7), of the formula

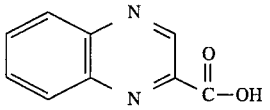

(15) 2-quinoxalinol (Aldrich 26,051-7), of the formula

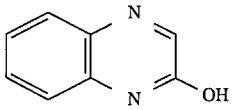

(16) 2,3-dihydroxy quinoxaline (Aldrich 14,478-9), of the formula

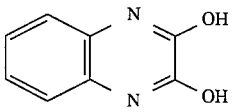

(17) phenazine methosulfate (Kodak 1360155, available from Eastman Kodak Co.), of the formula

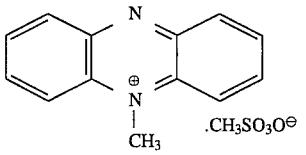

and the like;

(O) lactams and lactam derivatives, and thiolactams and thiolactam derivatives, including those of the general formulae

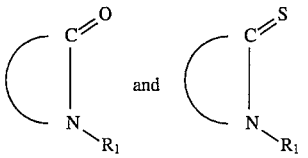

wherein $R_1$ can be selected from (but is not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, and wherein the curved portion of the structure represents a hydrocarbon chain or a substituted hydrocarbon chain, preferably of from about 2 to about 10 carbon atoms, wherein two or more substituents can be joined together to form a ring, and wherein the substituents on the substituted alkyl groups, substituted aryl groups, substituted arylalkyl groups, and substituted hydrocarbon chain can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds can also be in acid salt form, wherein they are associated with a compound of the general formula $xH_nY_{n^-}$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like, as well as mixtures thereof.

Examples of suitable lactams and thiolactams include (1) 2-azetidinone (β-propiolactam) (Aldrich 32,846-4), of the formula

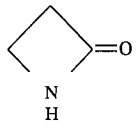

(2) 2-pyrrolidinone (Aldrich P7,437-0), of the formula

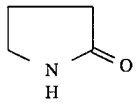

(3) pyrrolidone hydrotribromide (Aldrich 15,520-9), of the formula

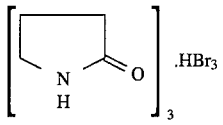

(4) δ-valerolactam (Aldrich V20-9), of the formula

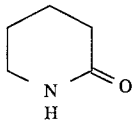

(5) ϵ-caprolactam (Aldrich C220-4), of the formula

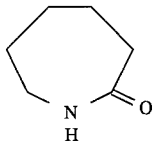

(6) amino-ϵ-caprolactam (Aldrich 26,359-1), of the formula

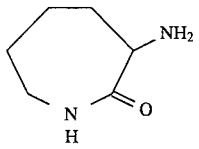

(7) N-methyl caprolactam (Aldrich 22,476-6), of the formula

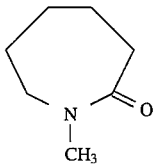

(8) 2-azacyclooctanone (Aldrich A9,463-8), of the formula

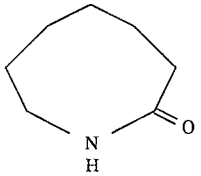

(9) 2-azacyclononanone (Aldrich 12,327-7), of the formula

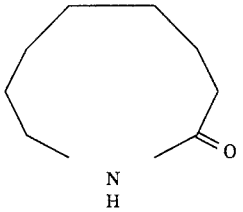

(10) ω-thiocaprolactam (Aldrich T2,828-2), of the formula

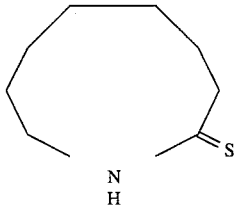

(11) N-vinylcaprolactam (Aldrich 41,546-4), of the formula

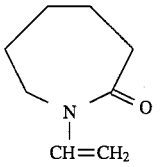

(12) (±)-2-azabicyclo[2.2.1]hept-5-en-3-one (Aldrich 33,191-0), of the formula

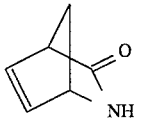

and the like;

(P) imides and imide derivatives, including those of the general formula

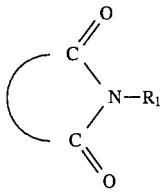

wherein $R_1$ can be selected from (but is not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, aryl groups, acid anhydride groups, azide groups, and the like, and wherein the curved portion of the structure represents a hydrocarbon chain or a substituted hydrocarbon chain, preferably of from about 1 to about 20 carbon atoms, wherein two or more substituents can be joined together to form a ring, and wherein the substituents on the substituted alkyl groups, substituted aryl groups, substituted arylalkyl groups, and substituted hydrocarbon chain can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds can also be in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like, as well as mixtures thereof.

Examples of suitable imide compounds include (1) maleimide (Aldrich 12,958-5), of the formula

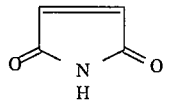

(2) N-ethylmaleimide (Aldrich 12,828-7), of the formula

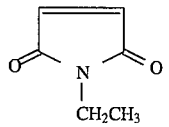

(3) N-butylmaleimide (Aldrich 38,296-5), of the formula

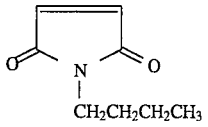

(4) N-cyclohexylmaleimide (Aldrich 38, 154-3), of the formula

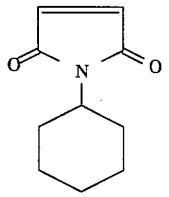

(5) N-phenylmaleimide (Aldrich P2,710-0), of the formula

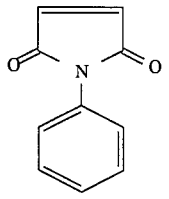

(6) N-benzylmaleimide (Aldrich 40,801-8), of the formula

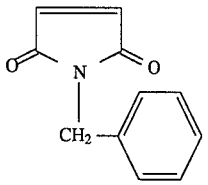

(7) N-hydroxymaleimide (Aldrich 22,635-1), of the formula

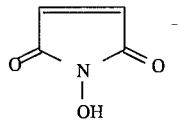

(8) succinimide (Aldrich S555-3), of the formula

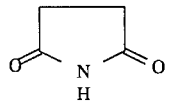

(9) N-methylsuccinimide (Aldrich 32,538-4), of the formula

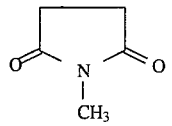

(10) (S)-(−)-2-hydroxy-N-methylsuccinimide (Aldrich 37,014-2), of the formula

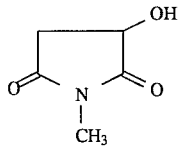

(11) N-hydroxysuccinimide (Aldrich 13,067-2), of the formula

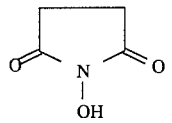

(12) succinimidyl 2,2,2-trichloroethyl carbonate (Aldrich 34,109-6), of the formula

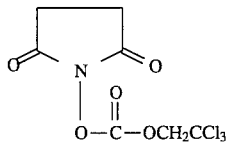

(13) 2-dodecyl-N-(2,2,6,6-tetramethyl-4-ppiperidinyl-)succinimide (Aldrich 41,317-8), of the formula

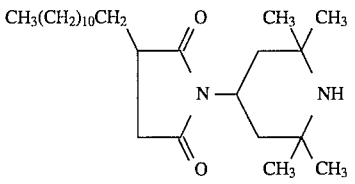

(14) 2-dodecyl-N-(1,2,2,6,6-pentamethyl-4-piperdinyl-)succinimide (Aldrich 41,318-6), of the formula

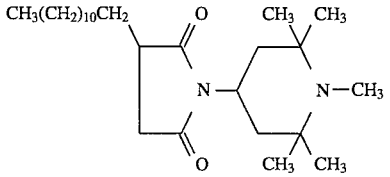

(15) N-(1-acetyl-2,2,6,6-tetramethyl-4-piperidinyl)-2-dodecyl succinimide (Aldrich 41,319-4), of the formula

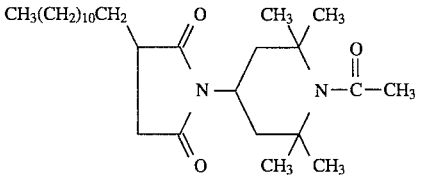

(16) α-methyl-α-propylsuccinimide (Aldrich 19,495-6), of the formula

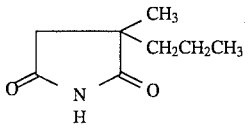

(17) α-methyl-α-phenylsuccinimide (Aldrich 86,058-1 ), of the formula

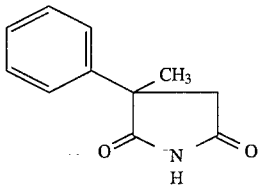

(18) N-vinylphthalimide (Aldrich 34,954-2), of the formula

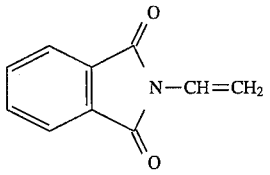

(19) N-ethylphthalimide (Aldrich 40,321-0), of the formula

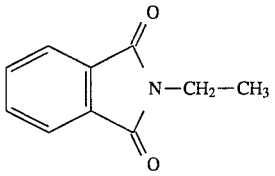

(20) N-(trimethylsilylmethyl)phthalimide (Aldrich 37,616-7), of the formula

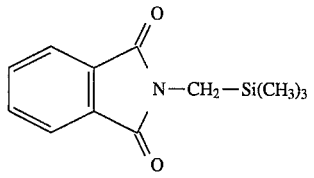

(21) N-(2-bromoethyl)phthalimide (Aldrich B6,630-2), of the formula

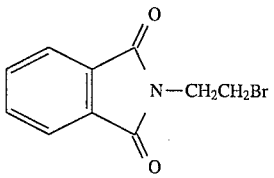

(22) N-(3-bromopropyl)phthalimide (Aldrich B8,000-3), of the formula

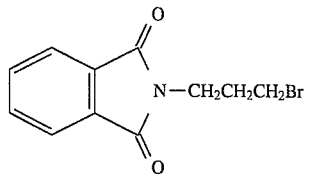

(23) N-(4-bromobutyl)phthalimide (Aldrich 10,091-9), of the formula

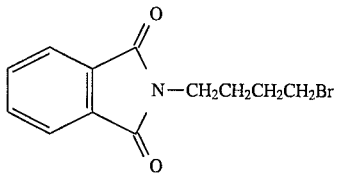

(24) phthalimidoacetaldehyde diethyl acetal (Aldrich P4,020-4), of the formula

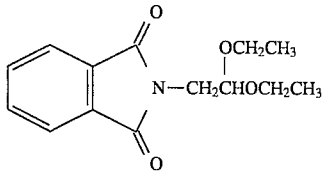

(25) diethyl(phthalimidomethyl)phosphonate (Aldrich 36,622-6), of the formula

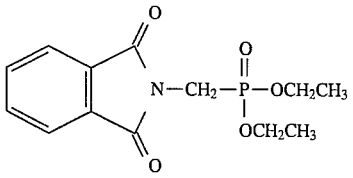

(26) N-benzylphthalimide (Aldrich 40,475-6), of the formula

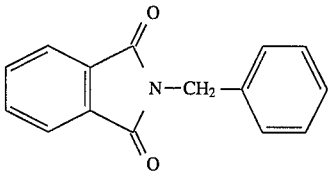

(27) phthalimide, DBU (1,8-diazabicyclo[5.4.0]undec-7-ene) salt (Aldrich 42,036-0), of the formula

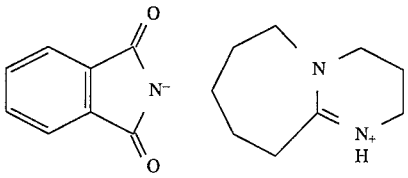

(28) phthalimide, DBN (1,5-diazabicyclo[4.3.0]non-5-ene), of the formula

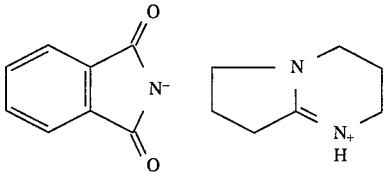

and the like;

II. Oxa-aza-cyclic compounds, including (A) oxazoles and oxazole derivatives, and isoxazoles and isoxazole derivatives, including those of the general formulae

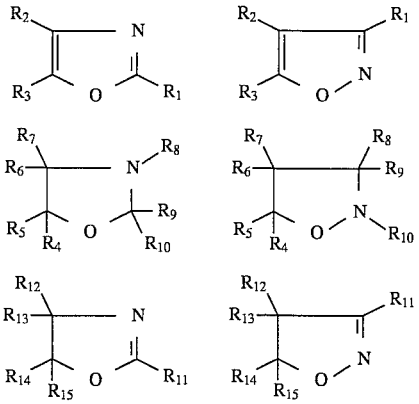

wherein $R_1$, $R_2$, $R_3$, $R_4$, $R_5$, $R_6$, $R_7$, $R_8$, $R_9$, $R_{10}$, $R_{11}$, $R_{12}$, $R_{13}$, $R_{14}$, and $R_{15}$ each, independently of the others, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, $R_8$, $R_9$, $R_{10}$, $R_{11}$, $R_{12}$, $R_{13}$, $R_{14}$, and $R_{15}$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds can also be in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{-3}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like, as well as mixtures thereof.

Examples of suitable oxazole and isoxazole compounds include (1) 3-amino-5-methyl isoxazole (Aldrich 23,227-0), of the formula

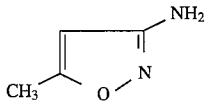

(2) 5-amino-3-methyl isoxazole (Aldrich 30,427-1), of the formula

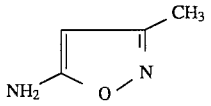

(3) 3,5-dimethyl-4-nitroisoxazole (Aldrich 33,824-9), of the formula

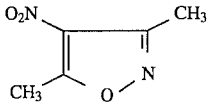

(4) 1,2-benzisoxazole (Aldrich 23,230-0), of the formula

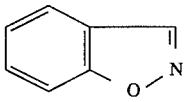

(5) 2,1-benzisoxazole (Anthranil) (Aldrich 14,451-7) of the formula

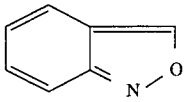

(6) cycloserine [4-amino-3-isoxazolidinone] (Aldrich 85,857-9), of the formula

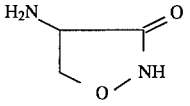

(7) 4-benzyl-2-methyl-2-oxazoline (Aldrich 42,163-4), of the formula

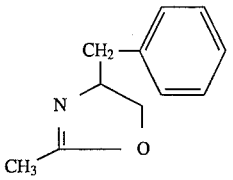

(8) 2-methyl-5-phenyl-2-oxazoline-4-methanol (Aldrich 18,766-6), of the formula

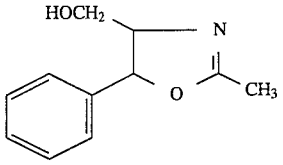

(9) benzoxazole (Aldrich B 1,170-2), of the formula

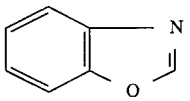

(10) 2-methylbenzoxazole (Aldrich 10,893-6), of the formula

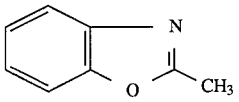

(11) 2-chlorobenzoxazole (Aldrich 27,408-9) of the formula

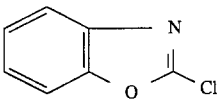

(12) 2-chloro-3-ethylbenzeneoxazolium tetrafluoroborate (Aldrich 23,255-6), of the formula

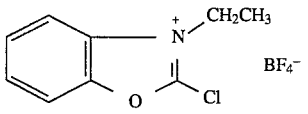

(13) 2-oxazolidone (Aldrich 0-940-9), of the formula

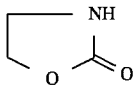

(14) 3-methyl-2-oxazolidinone (Aldrich 22,800-1), of the formula

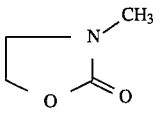

(15) 5-chloromethyl-2-oxazolidinone (Aldrich 13,565-8), of the formula

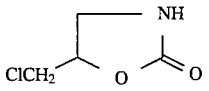

(16) 4-isopropyl-2-oxazolidinone (Aldrich 29,888-3), of the formula

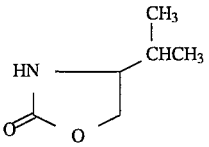

(17) 3-acetyl-2-oxazolidinone (Aldrich 34,851-1), of the formula

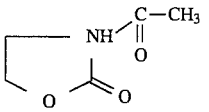

(18) 5,5-dimethyl oxazolidine-2,4-dione (Aldrich 21,900-2), of the formula

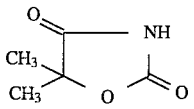

(19) 3-ethyl-2-thioxo-4-oxazolidinone (Aldrich 12,202-5), of the formula

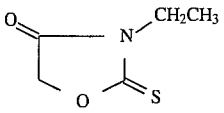

(20) 4-methyl-5-phenyl-2-oxazolidinone (Aldrich 29,889-1), of the formula

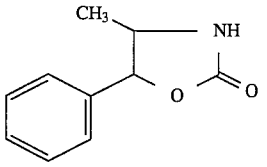

(21) 4-benzyl-2-oxazolidinone (Aldrich 29,464-0; 30,097-7), of the formula

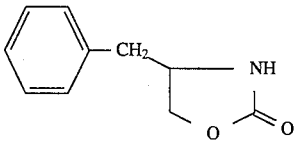

(22) 2-benzoisoxazolinone (Aldrich 15,705-8), of the formula

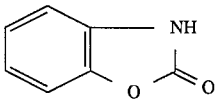

(23) muscimol hydrate[5-(aminomethyl)-3-isoxazolol hydrate] (Aldrich 23,779-5), of the formula

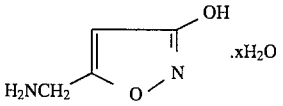

(24) 5-methyl-3-phenyl isoxazole-4-carboxylic acid (Aldrich 13,419-8), of the formula

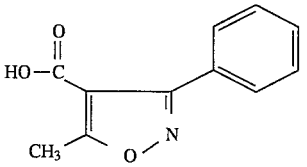

(25) 2-methyl-5-phenyl-2-oxazoline-4-methanol (Aldrich 18,766-6), of the formula

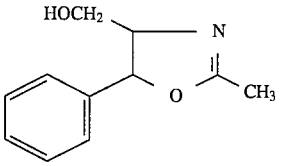

(26) sulfamethoxazole[4-amino-N-(5-methyl-3-isoxazolyl)benzene sulfonamide] (Aldrich 28,720-2), of the formula

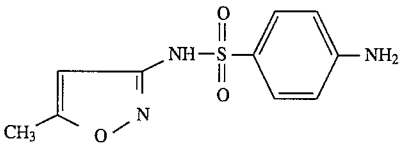

(27) sulfisoxazole[4-amino-N-(3,4-dimethyl-5-isoxazolyl)benzene sulfonamide] (Aldrich 28,722-9), of the formula

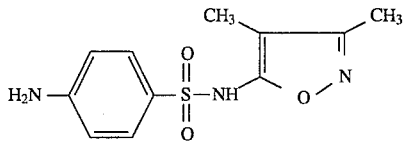

(28) N'-(4,5-dimethyloxazol-2-yl)sulfanilamide (Aldrich 13,989-0), of the formula

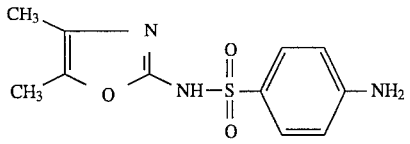

(29) cycloserine [4-amino-3-isoxazolidinone] (Aldrich 85,857-9), of the formula

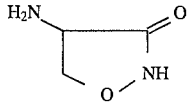

(30) chlorzoxazone[5-chloro-2-benzoxazolone] (Aldrich 85,974-5), of the formula

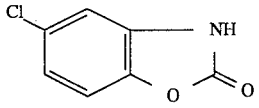

(31) 3,3'-dimethyl oxacarbocyanine iodide (Aldrich 32,069-2), of the formula

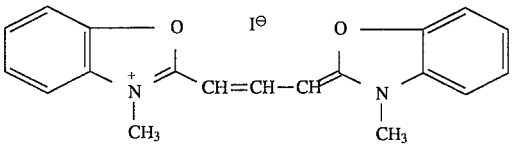

(32) 2-ethyl-5-phenyl isoxazolium-3'-sulfonate (Aldrich E4,526-0), of the formula

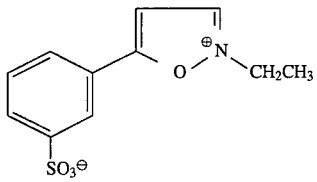

(33) 2-chloro-3-ethylbenzoxazolium tetrafluoroborate (Aldrich 23,255-6), of the formula

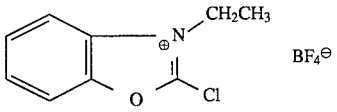

(34) 2-tert-butyl-5-methyl isoxazolium perchlorate (Aldrich B9,695-3), of the formula

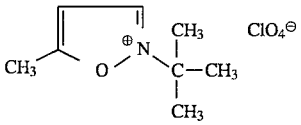

(35) 5-phenyl-2-(4-pyridyl) oxazole hydrochloride hydrate (Aldrich 23,748-5), of the formula

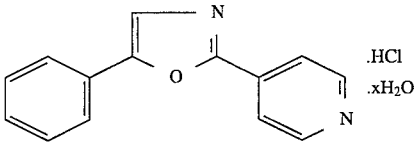

(36) 5-phenyl-2-(4-pyridyl) oxazole methyl tosylate salt (Aldrich 23,749-3), of the formula

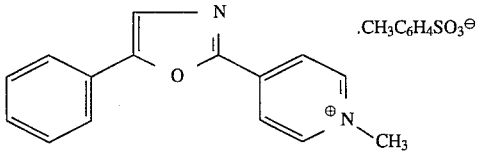

and the like;

(B) morpholines and morpholine derivatives, including those of the general formula

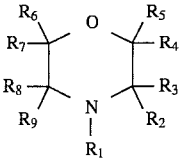

wherein $R_1$, $R_2$, $R_3$, $R_4$, $R_5$, $R_6$, $R_7$, $R_8$, and $R_9$ each, independently of the others, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, $R_8$, and $R_9$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds can also be in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like, as well as mixtures thereof.

Examples of suitable morpholines include (1) 4-aminomorpholine (Aldrich A6630-8), of the formula

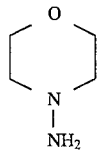

(2) 4-morpholine carbonitrile (Aldrich 21,852-9), of the formula

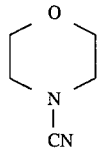

(3) 4-morpholine propionitrile (Aldrich 32,512-0), of the formula

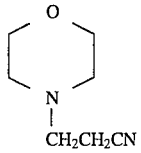

(4) 4-formyl morpholine (Aldrich 25,037-6), of the formula

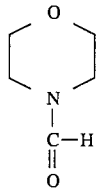

(5) 4-acetylmorpholine (Aldrich A1,883-4), of the formula

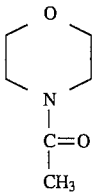

(6) 4-(2-hydroxyethyl)morpholine (Aldrich H2,820-3), of the formula

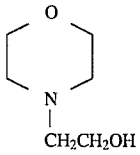

(7) 3-morpholino-1,2-propane diol (Aldrich 21,848-0), of the formula

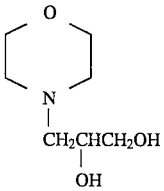

(8) 4-(3-amino propyl)morpholine (Aldrich 12,309-9), of the formula

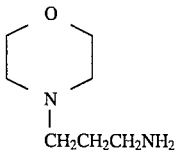

(9) 1-morpholino-1ocyclopentene (Aldrich C11,490-1), of the formula

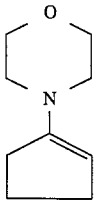

(10) 1-morpholino-1-cyclohexene (Aldrich M8,780-0), of the formula

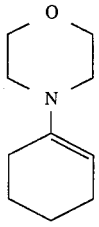

(11) 1-morpholino-1-cycloheptene (Aldrich 38,557-3), of the formula

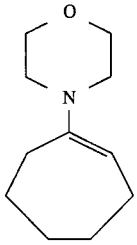

(12) 4-phenyl morpholine (Aldrich 21,133-8), of the formula

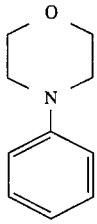

(13) 4-morpholinoaniline (Aldrich 19,715-7), of the formula

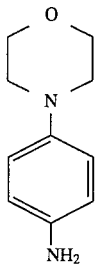

(14) 2,2,2-tribromoethyl phosphoromorpholino chloridate (Aldrich 19,569-3), of the formula

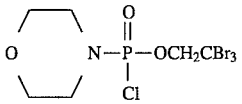

(15) 1-(morpholino carbonyl methyl) piperazine (Aldrich 19,780-7), of the formula

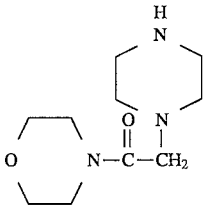

(16) 1,3-dimorpholine-2-nitropropane (Aldrich 30,237-6), of the formula

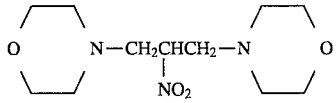

(17) hemicholinium-3 (Aldrich H30-3), of the formula

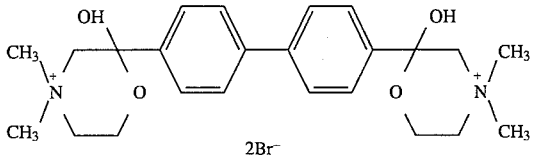

(18) hemicholinium-15 (Aldrich 11,603-3), of the formula

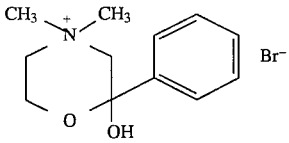

(19) 2-methoxy-4-morpholinobenzene diazoniumchloride, zinc chloride (Aldrich M 1,680-6), of the formula

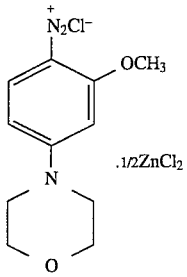

(20) fomocaine (Aldrich 32,998-3), of the formula

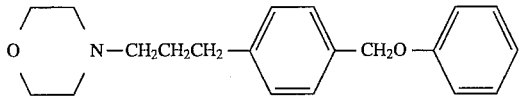

(21 ) 4-morpholinobenzophenone (Aldrich 13,620-4), of the formula

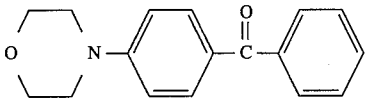

(22) 4,4'-ethylene-bis(2,6-morpholinedione) (Aldrich 33,204-6), of the formula

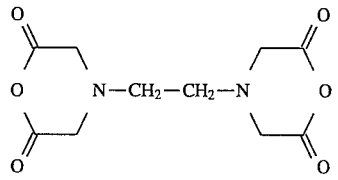

(23) N,N'-dicylcohexyl-4-morpholine carboxamidine (Aldrich 16,320-1), of the formula

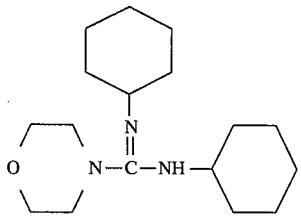

(24) 1-cyclohexyl-3-(2-morpholino ethyl)-2-thiourea (Aldrich C10,660-7), of the formula

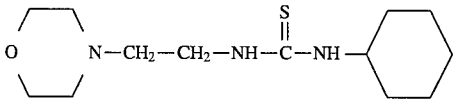

(25) 4-morpholinoacetophenone (Aldrich 11,986-5), of the formula

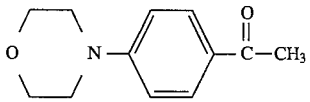

(26) 4-(2-chloroethyl) morpholine hydrochloride (Aldrich C4,220-3), of the formula

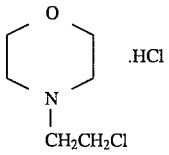

(27) 4-morpholine ethane sulfonic acid (Aldrich 16,373-2), of the formula

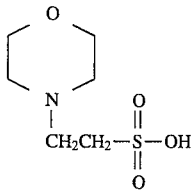

(28) 4-morpholine propane sulfonic acid (Aldrich 16,377-5), of the formula

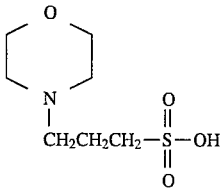

(29) β-hydroxy morpholine propane sulfonic acid (Aldrich 28,481-5), of the formula

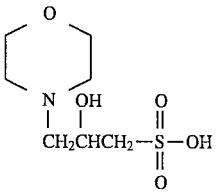

(30) [N-(aminoiminomethyl)-4-morpholine carboximidamide]hydrochloride (Aldrich 27,861-0), of the formula

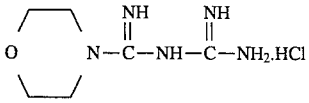

(31) 4-morpholine carbodithioic acid compound with morpholine (Aldrich 32,318-7), of the formula

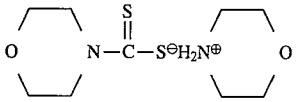

(32) 2,5-dimethyl-4-(morpholinomethyl) phenol hydrochloride monohydrate (Aldrich 18,671-6), of the formula

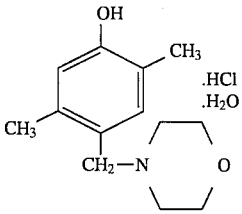

(33) 1-cyclohexyl-3-(2-morpholinoethyl)carbodiimide metho-p-toluene sulfonate (Aldrich C10,640-2), of the formula

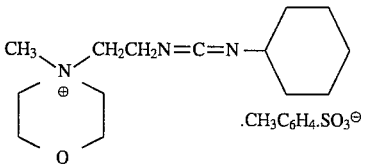

(34) hemicholinium-382,2'-(4,4'-biphenylene) bis(2-hydroxy-4,4-dimethyl morpholinium bromide) (Aldrich H30, 3), of the formula

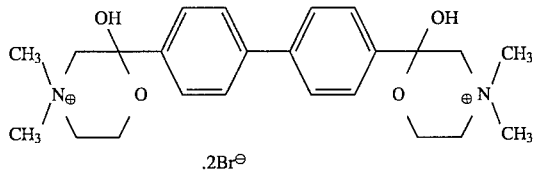

(35) hemicholinium-15[4,4-dimethyl-2-hydroxy-2-phenyl morpholinium bromide] (Aldrich 11,603-3), of the formula

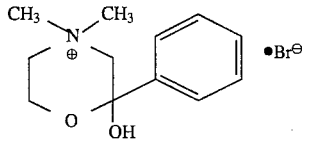

and the like; (C) cyclic azaoethers and diazaethers, such as (1) 1-aza-12-crown-4 (Aldrich 36,408-8), of the formula

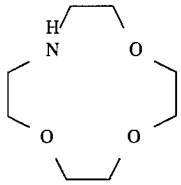

(2) 1-aza-15-crown-5 (Aldrich 36,409-6), of the formula

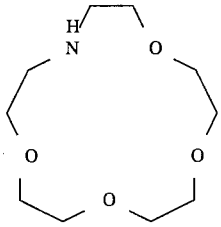

(3) 1-aza-18-crown-6 (Aldrich 36,411-8), of the formula

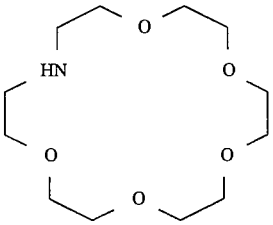

(4) 1,4,10-trioxa-7,13-diazacyclopentadecane (Aldrich 30,732-7), of the formula

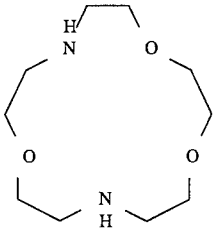

(5) 1,4,10,13-tetraoxa-7,16-diazacyclooctadecane (Aldrich 29,580-9), of the formula

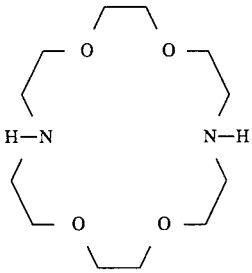

(6) N,N'-dibenzyl-1,4,10,13-tetraoxa-7,16-diazacyclooctadecane (Aldrich 29,472-1), of the formula

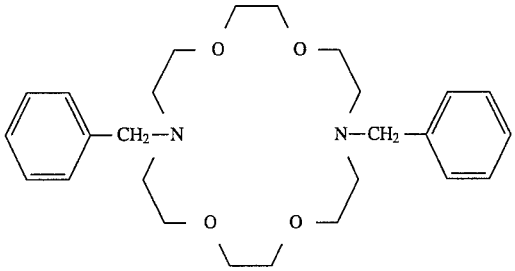

(7) 4,7,13,18-tetraoxa-1,10-diazabicyclo[8.5.5]eicosane (Aldrich 30,733-5), of the formula

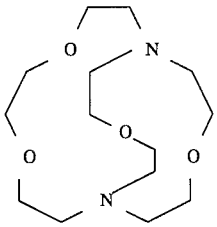

(8) 4,7,13,16,21-pentaoxa-1,10-diazabicyclo[8.5.5]tricosane (Aldrich 29,116-1), of the formula

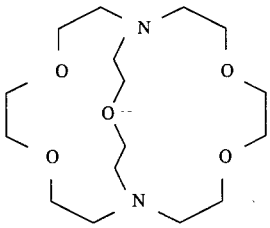

(9) 4,7,13,16,21,24-hexaoxa-1,10-diazabicyclo[8.8.8] hexacosane (Aldrich 29,111-0), of the formula

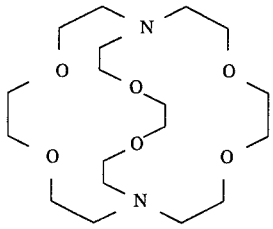

(10) 5,6-benzo-4,17,13,16,21,24-hexaoxa-1,10-diazabicyclo[8.8.8]hexacosane (Aldrich 30,857-9), of the formula

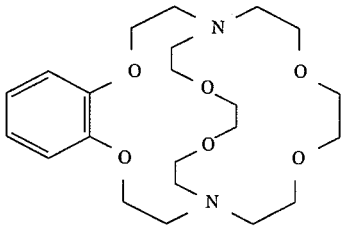

and the like;

III. Oxacyclic compounds, including (A) cyclic compounds wherein the ring contains one oxygen atom, such as (1) lactones and lactone derivatives, including those of the general formula

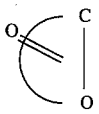

wherein the curved portion of the structure represents a hydrocarbon chain or a substituted hydrocarbon chain, preferably of from about 2 to about 20 carbon atoms, wherein two or more substituents can be joined together to form a ring, and wherein the substituents on the hydrocarbon chain can be (but are not limited to) alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds can also be in acid salt form, wherein they are associated with a compound of the general formula $xH_nY_{n^-}$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like, as well as mixtures thereof.

Examples of lactone compounds include (a) γ-butyrolactone (Aldrich B10,360-8), of the formula

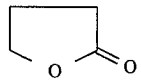

(b) γ-valerolactone (Aldrich V40-3), of the formula

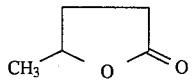

(c) γ-caprolactone (Aldrich 30,383-6), of the formula

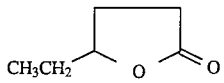

(d) γ-octanoic lactone (Aldrich 0-400-8), of the formula

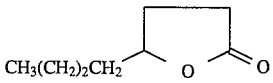

(e) γ-nonanoic lactone (Aldrich 29,237-0), of the formula

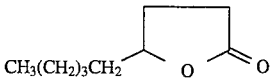

(f) γ-decanolactone (Aldrich D80-4), of the formula

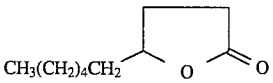

(g) undecanoic γ-lactone (Aldrich U80-6), of the formula

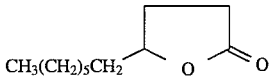

(h) γ-phenyl-γ-butyrolactone (Aldrich 17,645-1), of the formula

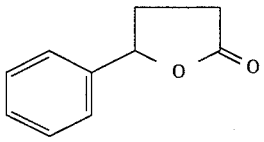

(i) (±)-α-carbethoxy-γ-phenyl-butyrolactone (Aldrich 29,370-9), of the formula

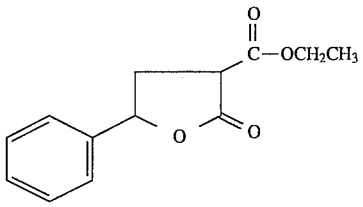

(j) 2-coumaranone (Aldrich 12,459-1), of the formula

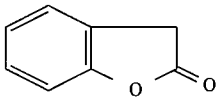

(k) (±)-β,β-dimethyl-γ-(hydroxymethyl)-γ-butyrolactone (Aldrich 26,496-2), of the formula

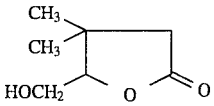

(l) (S)-(±)-γ-ethoxy carbonyl-γ-butyrolactone (Aldrich 31,852-3), of the formula

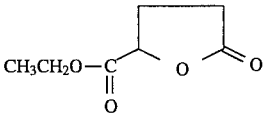

(m) (S)-(−)-5-(hydroxymethyl)-2(5H)-furanone (Aldrich 34,686-1 ), of the formula

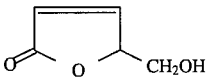

(n) dihydro-4,4-dimethyl-2,3-furandione (Aldrich 30,584-7), of the formula

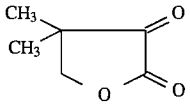

(o) 2,5-dimethyl-4-hydroxy-3(2H)-furanone (Aldrich 32,248-2), of the formula

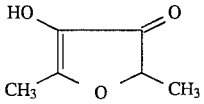

(p) (±)-mevalonic(β-hydroxy β-methyl-δ-valero)lactone (Aldrich 28,670-2), of the formula

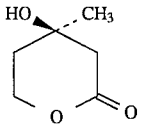

(q) (±)-δ-decanolactone (Aldrich 29,806-9), of the formula

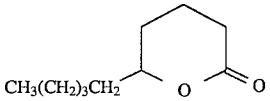

(r) (±)-undecanoic δ-lactone (Aldrich 29,127-7), of the formula

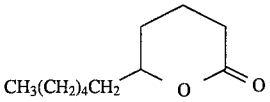

(s) (±)-δ-dodecanolactone (Aldrich 29,807-7), of the formula

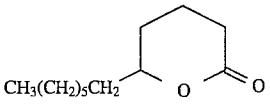

(t) undecanoic ω-lactone (Aldrich 34,361-7), of the formula

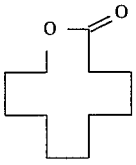

(u) oxacyclotridecan-2-one (Aldrich 34,896-1 ), of the formula

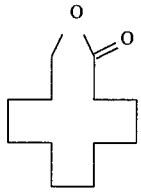

(v) ω-pentadecalactone (Aldrich 41,913-3), of the formula

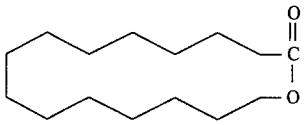

(w) hydrindantin(2,2'-dihydroxy-2,2'-biindan-1,1'3,3'-tetrone (Aldrich H1,730-9), of the formula

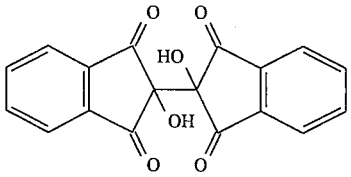

(x) hydrindantin dihydrate (Aldrich 13,563-1), of the formula

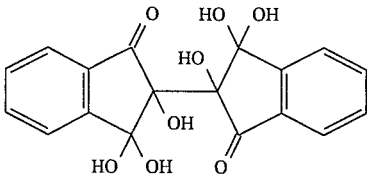

(y) 2-oxepanone (Aldrich 16,763-3), of the formula

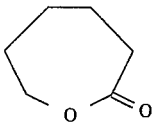

and the like;

(2) pyrans and pyran derivatives, including those of the general formulae

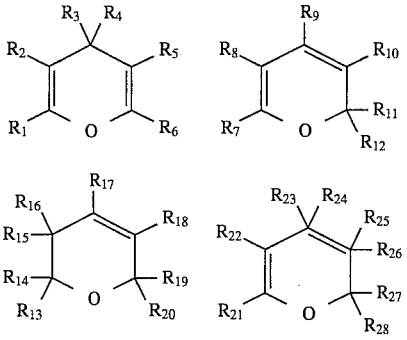

wherein $R_1$, $R_2$, $R_3$, $R_4$, $R_5$, $R_6$, $R_7$, $R_8$, $R_9$, $R_{10}$, $R_{11}$, $R_{12}$, $R_{13}$, $R_{14}$, $R_{15}$, $R_{16}$, $R_{17}$, $R_{18}$, $R_{19}$, $R_{20}$, $R_{21}$, $R_{22}$, $R_{23}$, $R_{24}$, $R_{25}$, $R_{26}$, $R_{27}$, and $R_{28}$ each, independently of the others, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, $R_8$, $R_9$, $R_{10}$, $R_{11}$, $R_{12}$, $R_{13}$, $R_{14}$, $R_{15}$, $R_{16}$, $R_{17}$, $R_{18}$, $R_{19}$, $R_{20}$, $R_{21}$, $R_{22}$, $R_{23}$, $R_{24}$, $R_{25}$, $R_{26}$, $R_{27}$, and $R_{28}$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds can also be in acid salt form, wherein they are associated with a compound of the general formula $xH_nY_{n^-}$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like, as well as mixtures thereof.

Examples of pyran compounds include (a) 4H-pyran-2-one (Aldrich 28,444-0), of the formula

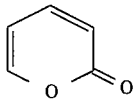

(b) methylcoumalate (methyl-2-oxo-2H-pyran-5-carboxylate (Aldrich 26,143-2:), of the formula

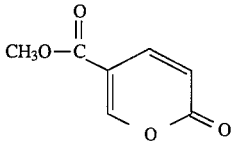

(c) methyl 2-oxo-2H-pyran-3-carboxylate (Aldrich 35,947-5), of the formula

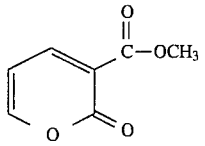

(d) 4,6-dimethyl-α-pyrone (Aldrich 37,020-7), of the formula

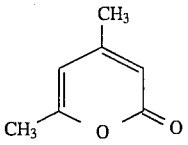

(e) 4-methoxy-6-methyl-2H-pyran-2-one (Aldrich 15,428-8), of the formula

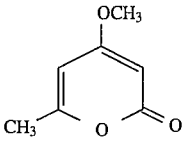

(f) 2-oxo-6-pentyl-2H-pyran-3-carboxylic acid (Aldrich 27,369-4), of the formula

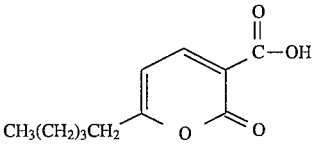

(g) methylisodehydracetate (Aldrich 19,034-9), of the formula

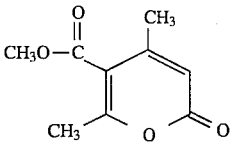

(h) ethylisodehydracetate (Aldrich E3,340-8), of the formula

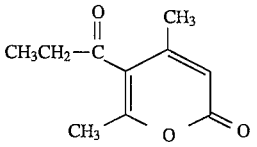

(i) 5,6-dihydro-2H-pyran-2-one (Aldrich 26,210-2), of the formula

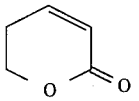

(j) 3,6-dihydro-4,6,6-trimethyl-2H-pyran-2-one, of the formula

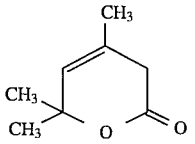

(k) 3,4-dihydro-6-methyl-2H-pyran-2-one (Aldrich 30,542-1), of the formula

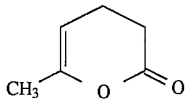

(l) 3-acetyl coumarin (Aldrich 21,467-1), of the formula

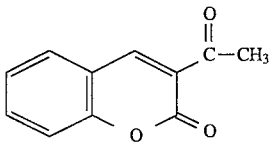

(m) 6-methyl coumarin (Aldrich M3,620-3), of the formula

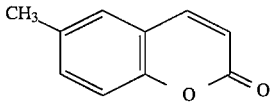

(n) 7-ethoxy coumarin (Aldrich 19,564-2), of the formula

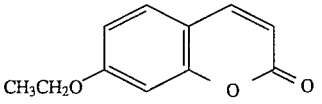

(o) ethyl-3-coumarin carboxylate (Aldrich 39,080-1), of the formula

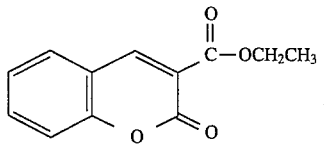

(p) 7-diethylamino-4-methyl coumarin (Aldrich D8,775-9), of the formula

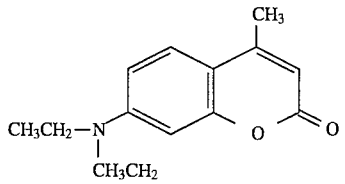

(q) dihydro coumarin (Aldrich D10,480-9), of the formula

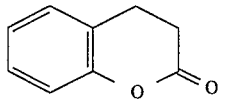

(r) 3-bromo-2-coumaranone (Aldrich 30,345-3), of the formula

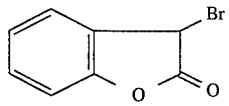

(s) patulin (4-hydroxy-4H-furo[3.2.c]pyran-2(6H)-one) (Aldrich 85,958-3), of the formula

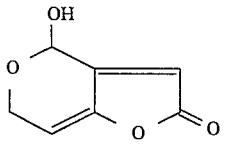

(t) 4H-pyran-4-one (Aldrich 17,722-9), of the formula

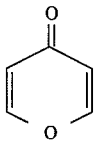

(u) 2-ethyl-3-hydroxy-4H-pyran-4-one (Aldrich 41,292-9), of the formula

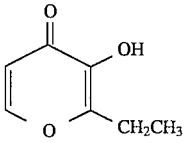

(v) butopyronoxyl(butyl 3,4-dihydro-2,2-dimethyl-4-oxo-2H-pyran-6-carboxylate (Aldrich 18,605-8), of the formula

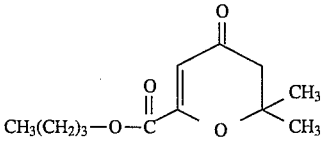

(w) dehydroacetic acid (Aldrich D290-0), of the formula

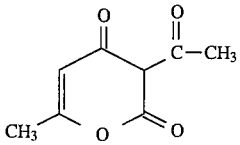

(x) 4-chromone (1-benzylpyran-4(4H)-one) (Aldrich 19,922-2), of the formula

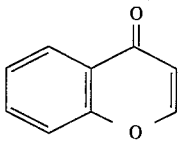

(y) 4-chromanone (Aldrich 12,235-1), of the formula

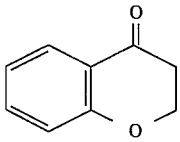

(z) 4-chromanol (Aldrich 30,389-5), of the formula

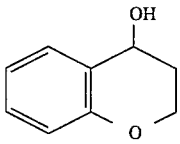

(aa) 6,7-dimethoxy-2,2-dimethyl-4-chromanone (Aldrich 30,063-2), of the formula

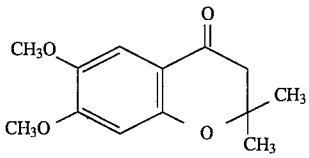

(bb) 3-isochromanone (Aldrich 35,935-1), of the formula

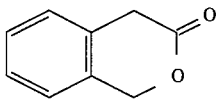

(cc) 6,7-dimethoxy-3-isochromanone (Aldrich 30,280-5), of the formula

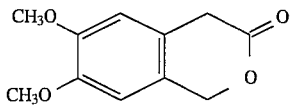

(dd) 6-ethyl-4-oxo-4H-1-benzopyran-3-carbonitrile (Aldrich 40,190-0), of the formula

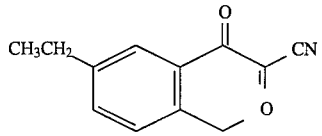

(ee) 6-ethyl-4-oxo-4H-1-benzopyran-3-carboxaldehyde (Aldrich 40,213-0), of the formula

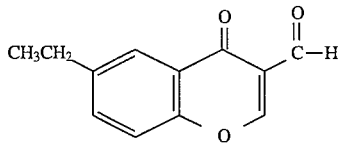

(ff) 6-isopropyl-4-oxo-4H-1-benzopyran-3-carbonitrile (Aldrich 40, 191-9), of the formula

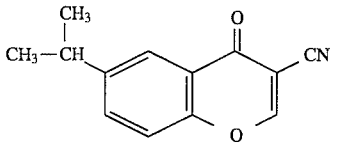

(gg) 6-isopropyl-4-oxo-4H-1-benzopyran-3-carboxaldehyde (Aldrich 40,214-1), of the formula

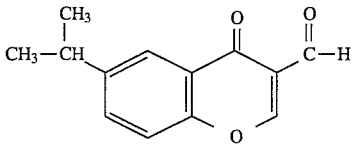

and the like;

(3) cyclic anhydrides and anhydride derivatives, including those of the general formulae

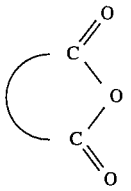

wherein the curved portion of the structure represents a hydrocarbon chain or a substituted hydrocarbon chain, preferably of from about 1 to about 20 carbon atoms, wherein two or more substituents can be joined together to form a ring, and wherein the substituents on the hydrocarbon chain can be (but are not limited to) alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds can also be in acid salt form, wherein they are associated with a compound of the general formula $xH_nY_n$-, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like, as well as mixtures thereof.

Examples of cyclic anhydrides include (a) maleic anhydride (Aldrich M18-8), of the formula

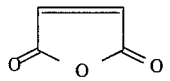

(b) bromomaleic anhydride (Aldrich 10,502-3), of the formula

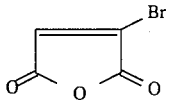

(c) citraconic anhydride (Aldrich 12,531-8), of the formula

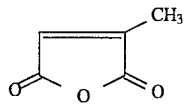

(d) 2,3-dimethylmaleic anhydride (Aldrich D16,780-0), of the formula

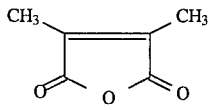

(e) dichloromaleic anhydride (Aldrich D6,500-3), of the formula

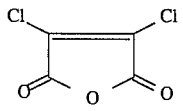

(f) cis-aconitic anhydride (Aldrich 21,780-8), of the formula

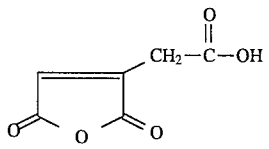

(g) itaconic anhydride (Aldrich 25,992-6), of the formula

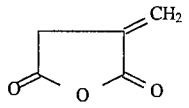

(h) methylsuccinic anhydride (Aldrich M8,140-3) of the formula

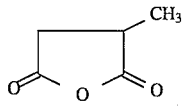

(i) S-acetylmercaptosuccinic an hydride (Aldrich 19,732-7), of the formula

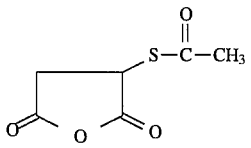

(j) 2,2-dimethylsuccinic anhydride (Aldrich 35,769-3), of the formula

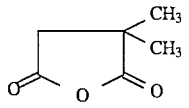

(k) phenylsuccinic anhydride (Aldrich 41,662-2), of the formula

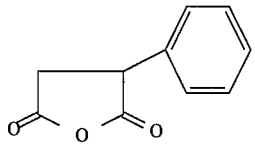

(l) (±)-2-octen-1-ylsuccinic anhydride (Aldrich 41,648-7), of the formula

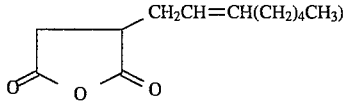

(m) 2-dodecen-1-ylsuccinic anhydride (Aldrich D22,190-2), of the formula

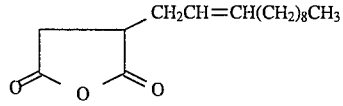

(n) 2-octadecen-1-ylsuccinic anhydride (Aldrich 41,649-5), of the formula

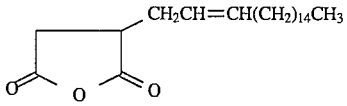

(o) 3-oxabicyclo[3.1.0]hexane-2,4-dione (Aldrich 39,117-4), of the formula

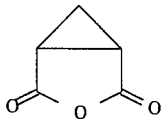

(p) diglycolic anhydride (Aldrich D10,370-5), of the formula

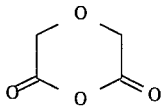

(q) glutaric anhydride (Aldrich G380-6), of the formula

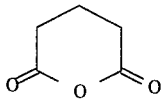

(r) 3-methylglutaric anhydride (Aldrich M4,780-9) of the formula

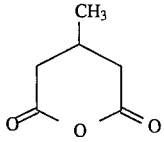

(s) 2,2-dimethylglutaric anhydride (Aldrich D 15,960-3), of the formula

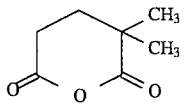

(t) 3,3-tetramethyleneglutaric anhydride (Aldrich T2,195-4), of the formula

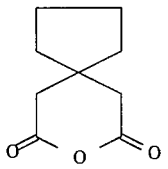

(u) 1-cyclopentene-1,2-dicarboxylic anhydride (Aldrich 31,835-3), of the formula

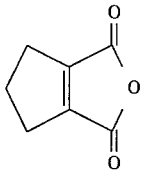

(v) 3,4,5,6-tetrahydrophthalic anhydride (Aldrich T1,400-1), of the formula

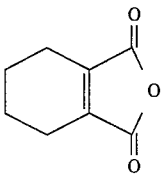

(w) cis-1,2-cyclohexanedicarboxylic anhydride (Aldrich 12,346-3), of the formula

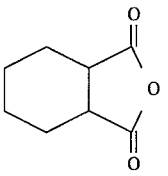

(x) (±)-hexahydro-4-methylphthalic anhydride (Aldrich 14,993-4), of the formula

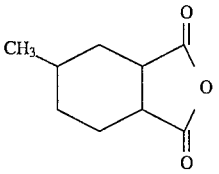

(y) methyl-5-norbornene-2,3-dicarboxylic anhydride (Aldrich 23,543-1), of the formula

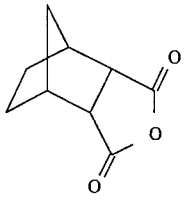

(z) 2,3-pyridinecarboxylic anhydride (Aldrich P6,440-5), of the formula

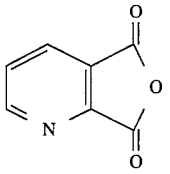

(aa) 3,4-pyridinecarboxylic anhydride (Aldrich 28,271-5), of the formula

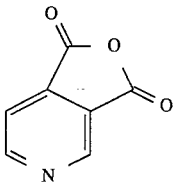

and the like;

(4) cyclic oxa-sulfur compounds and their derivatives, including (a) furfurylmercaptan (Aldrich F2,040-8), of the formula

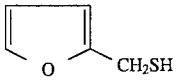

(b) S-furfurylthioacetate (Aldrich 29,299-0), of the formula

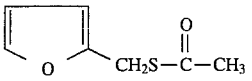

(c) furfurylsulfide (Aldrich 30,343-7), of the formula

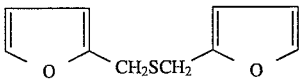

(d) furfurylmethyldisulfide (Aldrich 30,357-7), of the formula

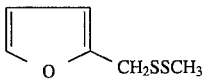

(e) furfuryldisulfide (Aldrich 26,476-8), of the formula

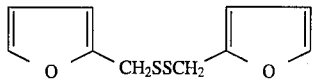

and the like;

(B) cyclic compounds wherein the ring contains at least two oxygen atoms, such as (1) dioxanes and dioxane derivatives, and trioxanes and trioxand derivatives, including those of the general formulae

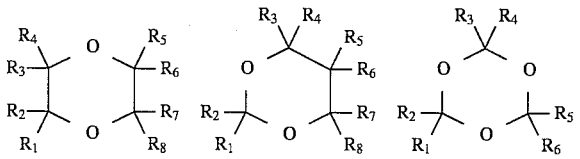

wherein $R_1$, $R_2$, $R_3$, $R_4$, $R_5$, $R_6$, $R_7$, and $R_8$ each, independently of the others, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, and $R_8$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds can also be in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like, as well as mixtures thereof.

Examples of suitable dioxanes and trioxanes include (a) glycolaldehyde dimer (2,5-dihydroxy-1,4-dioxane), of the formula

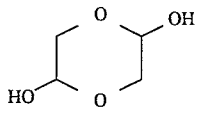

(b) 6,7-dihydrocyclopenta-1,3-dioxin-5(4H)-one (Aldrich 36,681-1), of the formula

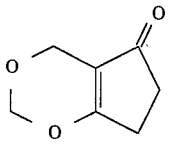

(c) (2R,6R)-tert-butyl-6-methyl-1,3-dioxan-4-one (Aldrich 37,457-1), of the formula

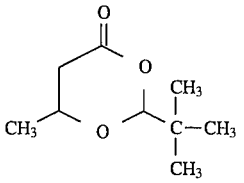

(d) 2,2-dimethyl-1,3-dioxane-4,6-dione (Aldrich 21,014-5), of the formula

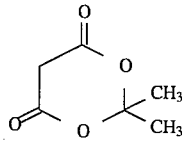

(e) 3,6-dimethyl-1,4-dioxane-2,5-dione (Aldrich 30,314-3; 36,704-4), of the formula

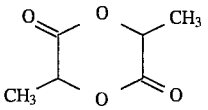

(f) 2,2,6-trimethyl-4H-1,3-dioxin-4-one (Aldrich 24,510-0), of the formula

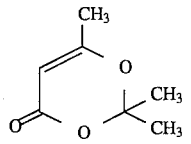

(g) 2,2,5-trimethyl-1,3-dioxane-4,6-dione (Aldrich 21,015-3), of the formula

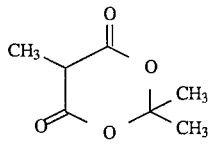

(h) 5-bromo-2,2,5-trimethyl-1,3-dioxane-4,6-dione (Aldrich 21,316-0), of the formula

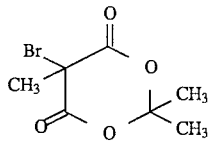

(i) 1,3-dioxane-5,5-dimethanol (Aldrich 22,062-0), of the formula

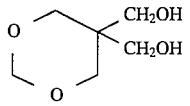

(j) 1,3,5-trioxane (Aldrich T8,110-5), of the formula

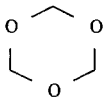

and the like;

(2) oxaspiros and oxaspiro derivatives, and ketals and ketal derivatives, including those of the general formulae

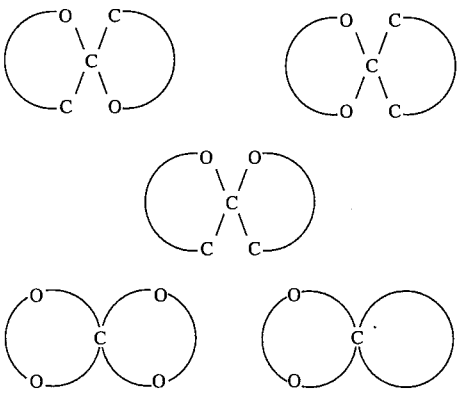

-continued

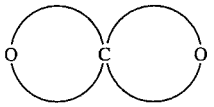

wherein the curved portions of the structures represent a hydrocarbon chain or a substituted hydrocarbon chain, preferably of from 1 to about 20 carbon atoms, wherein two or more substituents can be joined together to form a ring, and wherein the substituents on the hydrocarbon chains can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds can also be in acid salt form, wherein they are associated with a compound of the general formula $xH_nY_n$-, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like, as well as mixtures thereof.

Examples of oxaspiros and ketals include (a) 1,6-dioxaspiro[4.4]nonane-2,7-dione (Aldrich 27,197-7), of the formula

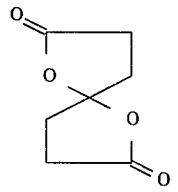

(b) 1,4-dioxaspiro[4.5]decan-2-one (Aldrich 29,594-9), of the formula

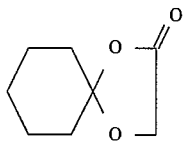

(c) 1,7-dioxaspiro [5.5]undecane (Aldrich 30,130-2), of the formula

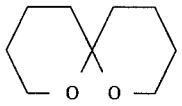

(d) 2,4,8,10-tetraoxaspiro[5.5]undecane (Aldrich 22,061-6), of the formula

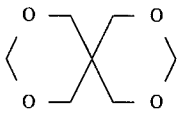

(e) 3,9-divinyl-2,4,8-tetraoxaspiro[5.5]undecane (Aldrich 19,152-3), of the formula

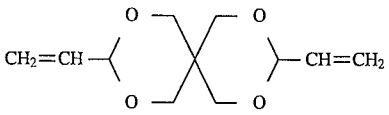

(f) 2,2-pentamethylene-1,3-dioxalane (Aldrich 24,429-5), of the formula

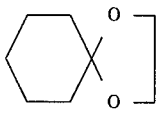

(g) 2-phenyl-1,3-dioxalane (Aldrich 34,003-0), of the formula

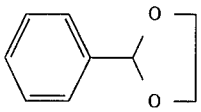

(h) 1,4-cyclohexanedione monoethylene ketal (Aldrich 27,487-9), of the formula

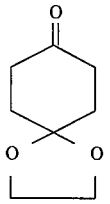

(i) 1,4-cyclohexanedione bis(ethylene ketal) (Aldrich 29,874-3), of the formula

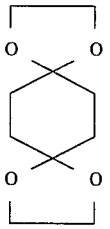

(j) 1,4-cyclohexanedione mono-2,2-dimethyl trimethylene ketal (Aldrich 21,557-0), of the formula

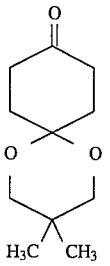

and the like;

(3) methylene dioxys and methylene dioxy derivatives, including those of the general formula

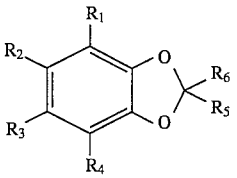

wherein $R_1$, $R_2$, $R_3$, $R_4$, $R_5$, and $R_6$ each, independently of the others, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, and $R_6$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds can also be in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like, as well as mixtures thereof.

Examples of suitable methylenedioxy compounds include (a) piperonal (Aldrich P4,910-4), of the formula

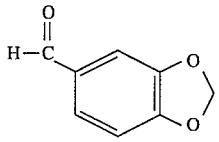

(b) piperonyl acetate (Aldrich 33,791-9), of the formula

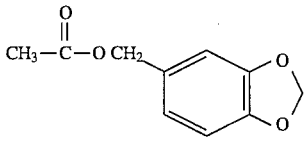

(c) piperonyl alcohol (Aldrich P4,940-6), of the formula

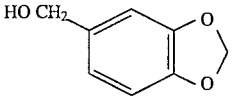

(d) piperonylnitrile (Aldrich 11,564-9), of the formula

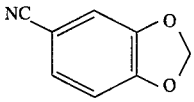

(e) piperonyl amine (Aldrich P4,590-3), of the formula

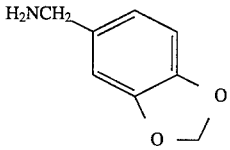

(f) 6-nitropiperonal (Aldrich 13,765-0), of the formula

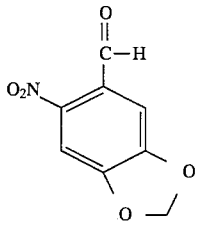

(g) 6-nitropiperonyl alcohol (Aldrich 19,629-0), of the formula

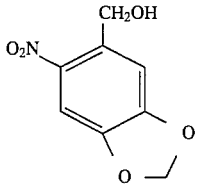

(h) 3',4'-(methylenedioxy)acetophenone (Aldrich 27,480-1), of the formula

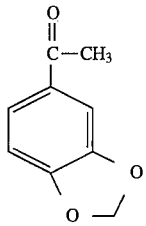

(i) 3,4-(methylenedioxy)aniline (Aldrich 16,149-7), of the formula

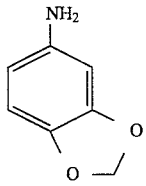

(j) 2,3-(methylenedioxy)benzaldehyde (Aldrich 38,988-9), of the formula

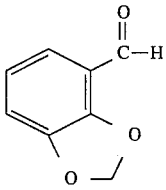

(k) 3,4-(methylenedioxy)phenylacetonitrile (Aldrich 14,530-0), of the formula

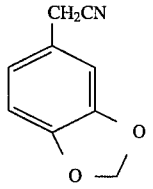

(l) 3,4-(methylenedioxy)toluene (Aldrich 28,454-8), of the formula

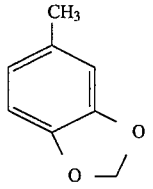

and the like;

(C) crown ethers, including (1) 1,4,7,10-tetraoxacyclododecane (12-crown-4) (Aldrich 19,490-5), of the formula

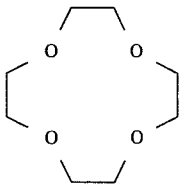

(2) 2-(hydroxyethyl)-12-crown-4 (Aldrich 38,265-5), of the formula

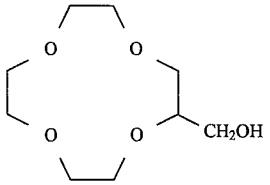

(3) 2-(aminoethyl)-12-crown-4 (Aldrich 38,840-8), of the formula

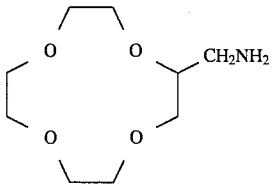

(4) benzo-12-crown-4 (Aldrich 34,775-2), of the formula

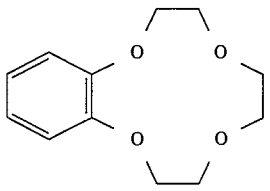

(5) 1,4,7,10,13-pentaoxacyclododecane (15-crown-5) (Aldrich 18,883-2), of the formula

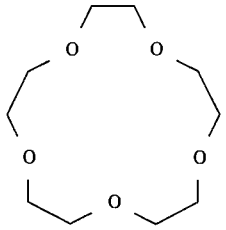

(6) 2-(hydroxyethyl)-15-crown-5 (Aldrich 38,842-4), of the formula

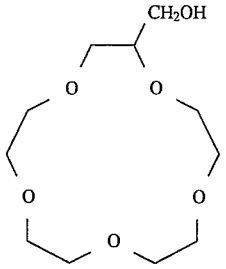

(7) 2-(aminoethyl)-15-crown-5 (Aldrich 38,841-6), of the formula

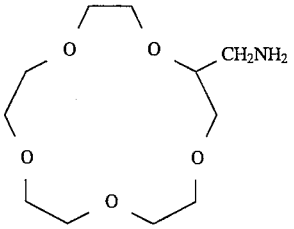

(8) benzo-15-crown-5 (Aldrich 28,279-0), of the formula

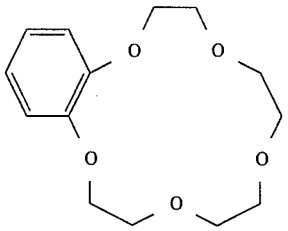

(9) 4'-aminobenzo-15-crown-5 (Aldrich 39,342-8), of the formula

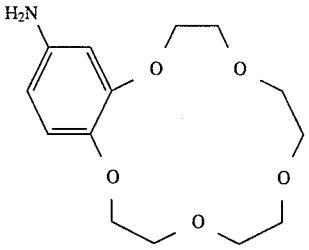

(10) 4'-formylbenzo-15-crown-5 (Aldrich 41,997-4), of the formula

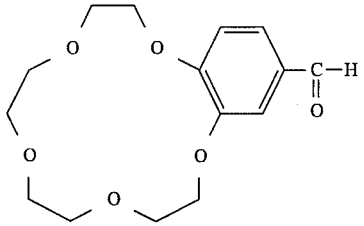

(11) 4'-nitrobenzo-15-crown-5 (Aldrich 34, 187-0), of the formula

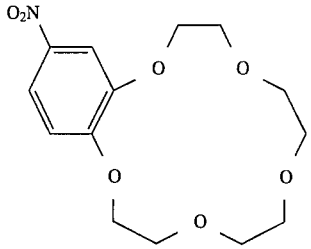

(12) bis [(benzo-15-crown-5)-15-ylmethyl]pimelate (Aldrich 28,430 0), of the formula

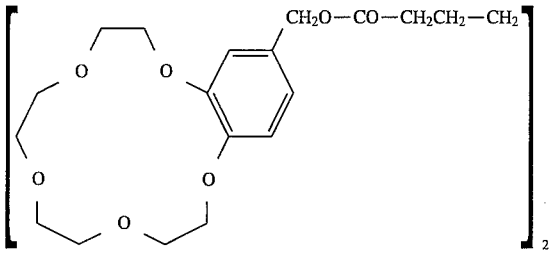

(13) 1,4,7,10,13,16-hexaoxacyclooctadecane (18-crown-6) (Aldrich 18,6651-1), of the formula

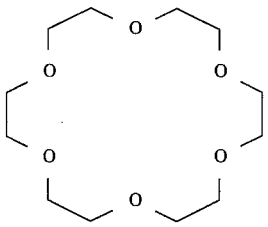

(14) 2-(aminoethyl)-18 crown-6 (Aldrich 38,843-2), of the formula

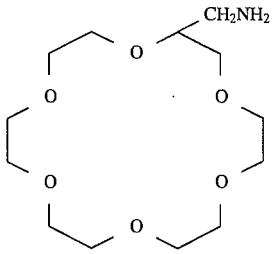

(15) benzo-18 crown-6 (Aldrich 37,229-3), of the formula

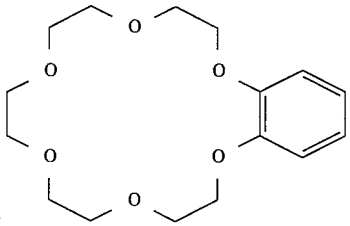

(16) 4'-bromobenzo-18-crown-6 (Aldrich 39,918-3), of the formula

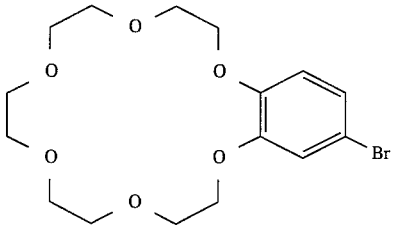

(17) dibenzo-18-crown-6 (2,3,11,12-dibenzo-1,4,7,10,13,16-hexaoxacyclooctadeca-2,11-diene) (Aldrich 15,839-9), of the formula

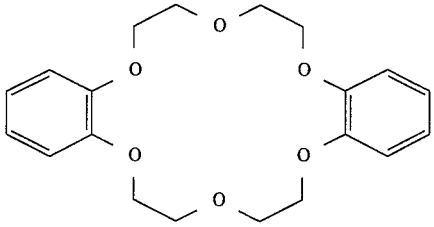

(18) di-tert-butyldibenzo-18-crown-6 (Aldrich 39,644-3), of the formula

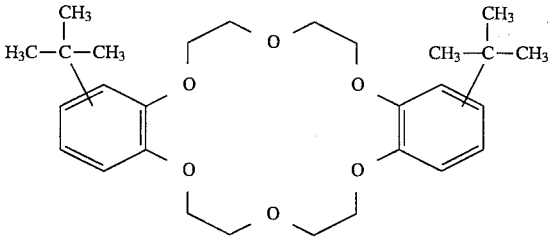

(19) cis-dicyclohexane-18 crown-6 (2,3,11,12-dicyclohexano-1,4,7,10,13,16-hexaoxacyclooctadecane) (Aldrich 15,840-2), of the formula

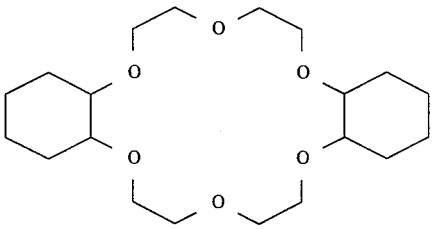

(20) dibenzo-24-crown-8 [2,3,14,15-dibenzo-1,4,7,10,13,16,19,22-octaoxacyclotetracosa 2,14-diene] (Aldrich 25,319-7), of the formula

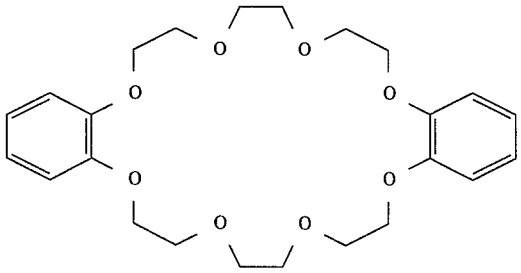

(21) dicyclohexano-24-crown-8 (Aldrich 22,623-8), of the formula

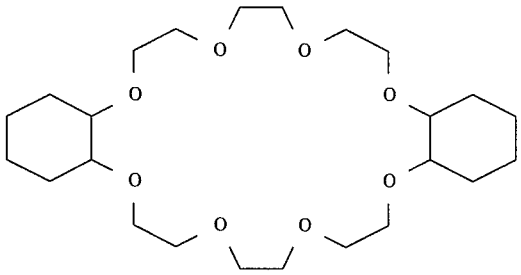

(22) dibenzo-30-crown-10,[2,3,17,18-dibenzo-1,4,7,10,13,16,19,22,25,28-decaozacyclotriaconta-2,17-diene] (Aldrich 33,251-8), of the formula

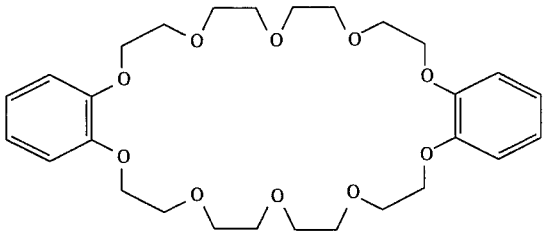

and the like;

III. Cyclic hydrocarbons (wherein the compound contains at least one ring with only carbon atoms, although other rings present in the compound may contain atoms other than carbon and substituents may be present on the ring(s)), including (A) norbornanes and norbornane derivatives, and norbornenes and norbornene derivatives, including those of the general formulae

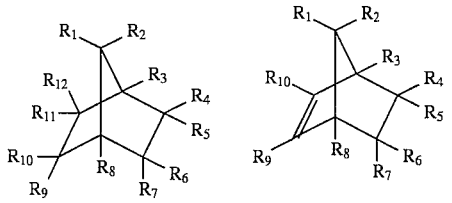

wherein $R_1$, $R_2$, $R_3$, $R_4$, $R_5$, $R_6$, $R_7$, $R_8$, $R_9$, $R_{10}$, $R_{11}$, and $R_{12}$ each, independently of the others, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, $R_8$, $R_9$, $R_{10}$, $R_{11}$, and $R_{12}$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds can also be in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like, as well as mixtures thereof.

Examples of norbornanes and norbornenes include (1) norbornane (Aldrich N3,200-8), of the formula

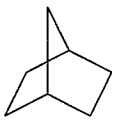

(2) 2-norbornane carbonitrile (Aldrich N3,205-9), of the formula

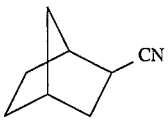

(3) 2-norbornane methanol (Aldrich 10,939-8), of the formula

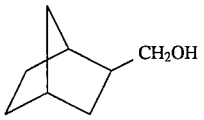

(4) 3-methyl-2-norbornane methanol (Aldrich 13,057-5), of the formula

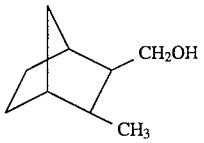

(5) camphene (Aldrich C30-1; 37,659-0; 31,042-5), of the formula

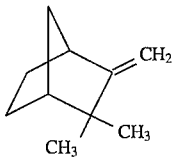

(6) fenchyl alcohol (Aldrich 19,644-4), of the formula

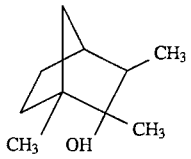

(7) thiocamphor (Aldrich 27,346-5), of the formula

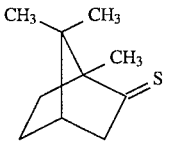

(8) norbornene (Aldrich N3,240-7), of the formula

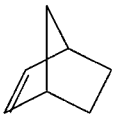

(9) 5-norbornene-2-carbonitrile (Aldrich 15,057-6), of the formula

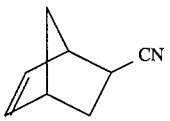

(10) 5-norbornene-2-carboxaldehyde (Aldrich 10,937-1), of the formula

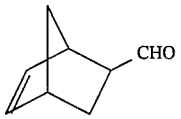

(11) 5-norbornene-2-methanol (Aldrich 24,853-3), of the formula

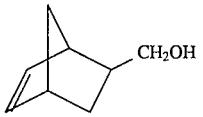

(12) 5-norbornene-2,2-dimethanol (Aldrich 15,218-8), of the formula

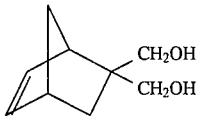

(13) 5-norbornene-2-benzoyl (Aldrich 11,506-1), of the formula

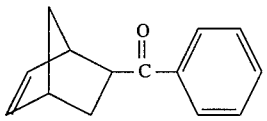

(14) 2-norbornanone (norcamphor) (Aldrich N3,260-1), of the formula

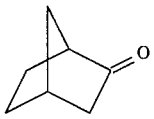

(15) 3-chloro-2-norbornanone (Aldrich C6,243-3), of the formula

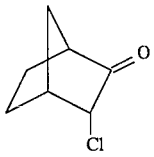

(16) fenchone (1,3,3-trimethyl-2-norbornanone (Aldrich 19,643-6), of the formula

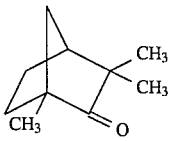

(17)(+)-3-(trifluoroacetyl)camphor (Aldrich 18,900-6), of the formula

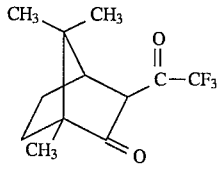

(18) 3-heptafluorobutyryl camphor (Aldrich 19,593-6; 29,833-6), of the formula

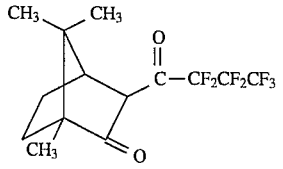

(19) 3-bromocamphor (Aldrich 14,716-8; 31,103-0), of the formula

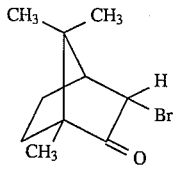

(20) 9,10-dibromocamphor (Aldrich 31,113-8; 31,115-4), of the formula

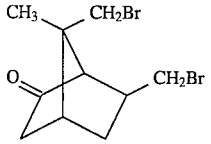

(21) 3,9,10-tribromocamphor (Aldrich 30,792-0;31,660-1), of the formula

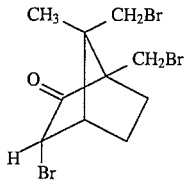

(22) dicyclopentadiene (Aldrich 11,279-8), of the formula

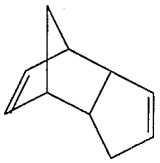

(23) methylcyclopentadiene dimer (Aldrich 12,982-8) of the formula

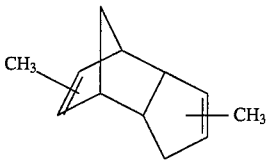

(24) tricyclo[5.2.1]decane (Aldrich 16,427-5), of the formula

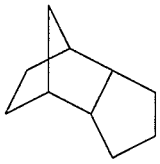

(25) 4,8-bis(hydroxymethyl)tricyclo[5.2.1.$0^{2,6}$]decane (Aldrich B4,590-9), of the formula

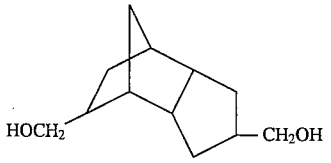

(26) 8-ketotricyclo[5.2.1.$0^{2,6}$]decane (Aldrich K375-1), of the formula

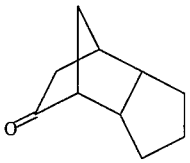

and the like;

(B) cyclobutenes and cyclobutene derivatives, of the general formula

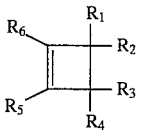

wherein $R_1$, $R_2$, $R_3$, $R_4$, $R_5$, and $R_6$ each, independently of the others, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, and $R_6$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds can also be in acid salt form, wherein they are associated with a compound of the general formula $xH_nY_n$-, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, or the like, as well as mixtures thereof.

Examples of cyclobutenes and cyclobutene derivatives include (1) 3,4-dimethoxy-3-cyclobutene-1,2-dione (Aldrich 37,740-6), of the formula

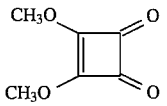

(2) 3,4-diethoxy-3-cyclobutene-1,2-dione (Aldrich 31,677-8), of the formula

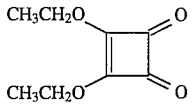

(3) 3,4-diisopropoxy-3-cyclobutene-1,2-dione (Aldrich 33,823-0), of the formula

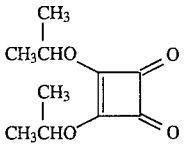

(4) 3,4-dibutoxy-3-cyclobutene-1,2-dione (Aldrich 33,979-2), of the formula

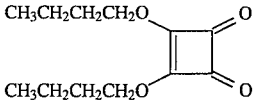

and the like;

(C) cyclopentanes and cyclopentane derivatives, and cyclopentenes and cyclopentene derivatives, of the formulae

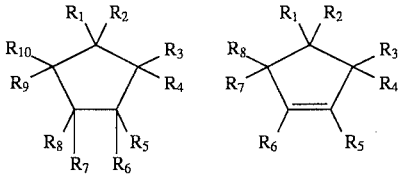

wherein $R_1$, $R_2$, $R_3$, $R_4$, $R_5$, $R_6$, $R_7$, $R_8$, $R_9$, and $R_{10}$ each, independently of the others, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, $R_8$, $R_9$, and $R_{10}$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds can also be in acid salt form, wherein they are associated with a compound of the general formula $xH_nY_n$-, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like, as well as mixtures thereof.

Examples of cyclopentanes and cyclopentenes include (1) 3-methyl-2-(nitromethyl)-5-oxocyclopentaneacetic acid (Aldrich 29,295-8), of the formula

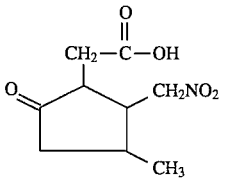

(2) 3-ethyl-2-hydroxy-2-cyclopenten-1-one (Aldrich 30,174-4), of the formula

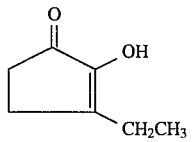

(3) methyl-4-methoxy-2-oxo-3-cyclopentene-1-carboxylate (Aldrich 40,133-1), of the formula

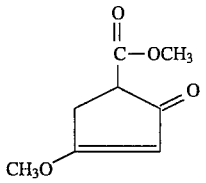

(4) 3,3a,6,6a-tetrahydro-2H-cyclopenta[b]furan-2-one (Aldrich 27,992-7), of the formula

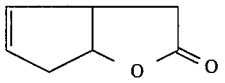

(5) 3a,4,5,6a-hexahydro-5-hydroxy-4(hydroxymethyl)-2H-cyclopenta[b]furan-2-one (Aldrich 34,157-6), of the formula

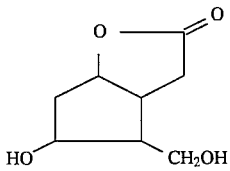

(6) 3-methyl-1,2-cyclopentanedione (Aldrich 17,850-0), of the formula

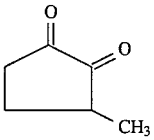

(7) 4-hydroxy-5-methyl-4-cyclopentene-1,3-dione monohydrate (Aldrich 32,299-7), of the formula

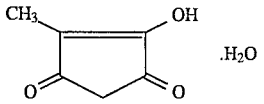

and the like;

(D) cyclohexane, cyclohexene, and cyclohexadiene compounds and derivatives, of the general formulae

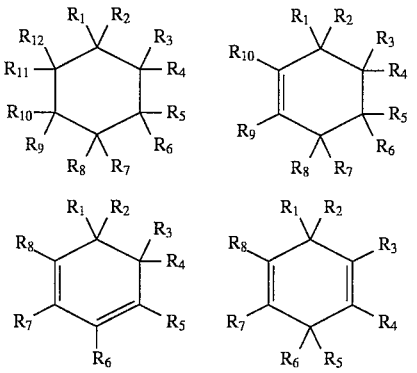

wherein $R_1$, $R_2$, $R_3$, $R_4$, $R_5$, $R_6$, $R_7$, $R_8$, $R_9$, $R_{10}$, $R_{11}$, and $R_{12}$ each, independently of the others, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, $R_8$, $R_9$, $R_{10}$, $R_{11}$, and $R_{12}$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds can also be in acid salt form, wherein they are associated with a compound of the general formula $xH_nY_{n^-}$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like, as well as mixtures thereof.

Examples of cyclohexanes, cyclohexenes, and cyclohexadienes include (1) 2,4,4-trimethylcyclohexen-1-one (Aldrich 37,151-3), of the formula

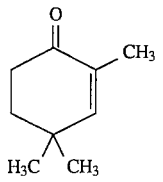

(2) ethyl-6-methyl-2-oxo-3-cyclohexene-1-carboxylate (Aldrich 34,520-2), of the formula

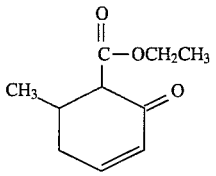

(3) ethyl 4-hydroxy-6-methyl-2-oxo-3-cyclohexene-1-carboxylate (Aldrich 29,872-7), of the formula

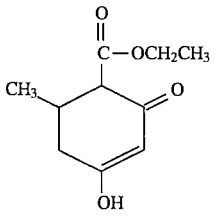

(4) 5-( 1-acetoxyol-methylethyl)-2-methyl-2-cyclohexen-1-one (Aldrich 27,806-8), of the formula

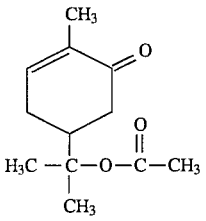

(5) thymoquinone (Aldrich 27,466-6), of the formula

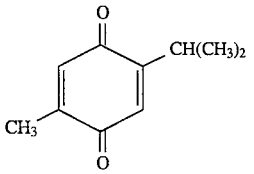

(6) 2,6,6-trimethyl-2-cyclohexene-1,4-dione (Aldrich 32,951-7), of the formula

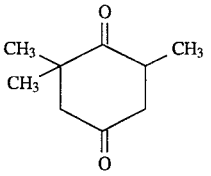

and the like;

(E) indans and indan derivatives, including those of the general formula

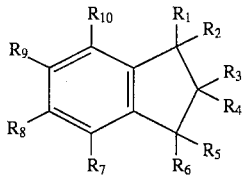

wherein $R_1$, $R_2$, $R_3$, $R_4$, $R_5$, $R_6$, $R_7$, $R_8$, $R_9$, and $R_{10}$ each, independently of the others, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, $R_8$, $R_9$, and $R_{10}$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds can also be in acid salt form, wherein they are associated with a compound of the general formula $xH_nY_n$-, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like, as well as mixtures thereof.

Examples of indans and indan derivatives include (1) indan (Aldrich 1-180-4), of the formula

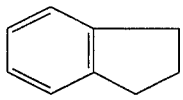

(2) 1-indanol (Aldrich 32.841-1; 19,373-9; 32,312-8), of the formula

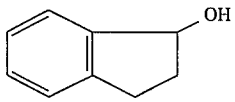

(3) 2-indanol (Aldrich 18,035-1), of the formula

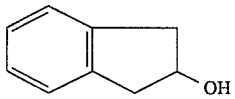

(4) 1-indanone (Aldrich 1,230-4), of the formula

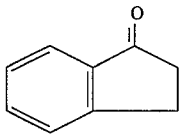

(5) 2-indanone (Aldrich 14,669-2), of the formula

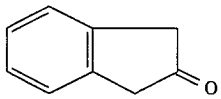

and the like;

(F) tetralones and tetralone derivatives, including those of the general formulae

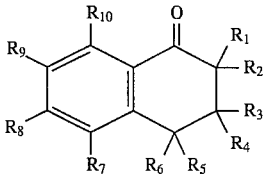

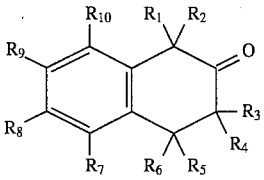

wherein $R_1$, $R_2$, $R_3$, $R_4$, $R_5$, $R_6$, $R_7$, $R_8$, $R_9$, and $R_{10}$ each, independently of the others, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, $R_8$, $R_9$, and $R_{10}$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds can also be in acid salt form, wherein they are associated with a compound of the general formula $xH_nY_n$-, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like, as well as mixtures thereof.

Examples of tetralones and tetralone derivatives include (1) 2-acetyl-1-tetralone (Aldrich 15,037-1), of the formula

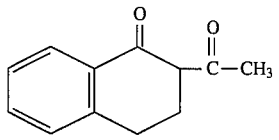

(2) 4-methyl-1-tetralone (Aldrich M8,300-7), of the formula

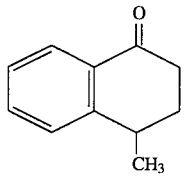

(3) 5,7-dimethyl-1-tetralone (Aldrich 16,897-1), of the formula

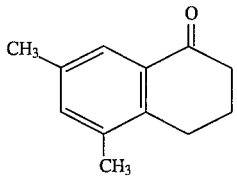

(4) 6,7-dimethoxy-1-tetralone (Aldrich 27,393-7), of the formula

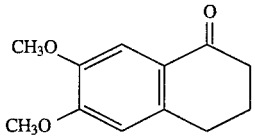

(5) 1-methyl-2-tetralone (Aldrich M8,290-6), of the formula

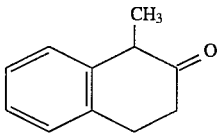

(6) 6,7-dimethoxy-2-tetralone (Aldrich 22,926-1), of the formula

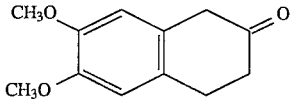

and the like;

(G) cyclonones and cyclonone derivatives, of the general formula

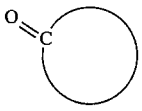

wherein the curved portion of the structure represents a hydrocarbon chain or a substituted hydrocarbon chain, preferably of from about 3 to about 11 carbon atoms, wherein two or more substituents can be joined together to form a ring, and wherein the substituents on the hydrocarbon chain can be (but are not limited to) alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds can also be in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like, as well as mixtures thereof.

Examples of cyclonones and cyclonone derivatives include (1) cyclohexanone (Aldrich C10,218-0), of the formula

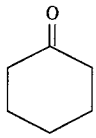

(2) cycloheptanone (Aldrich C9,900-0), of the formula

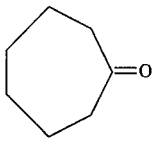

(3) cyclooctanone (Aldrich C10,980-0), of the formula

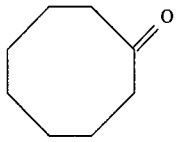

(4) cyclononanone ($C_9H_{16}$(=0), Aldrich C10,900-2); (5) cyclodecanone ($C_{10}H_{18}$(=0), Aldrich C9,660-5); (6) cycloundecanone ($C_{11}H_{20}$(=0), Aldrich 10,186-9); (7) cyclododecanone ($C_{12}H_{22}$(=0), Aldrich C9,745-8); (8) cyclotridecanone ($C_{13}H_{24}$(=0), Aldrich 16,063-6); (9) cyclopentadecanone ($C_{15}H_{28}$(=0), Aldrich C11,120-1); (10) 2-acetylcyclohexanone (Aldrich 17,976-0), of the formula

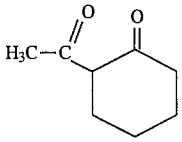

(11) 2-allylcyclohexanone (Aldrich 40,575-2), of the formula

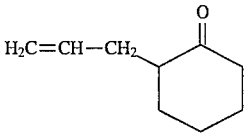

(12) 2-phenylcyclohexanone (Aldrich P2,227-3), of the formula

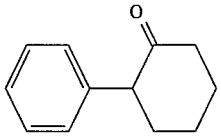

(13) cyclohexanedione (Aldrich C10,140-0), (Aldrich C10,160-5) and (Aldrich 12;542-3), of the formulae

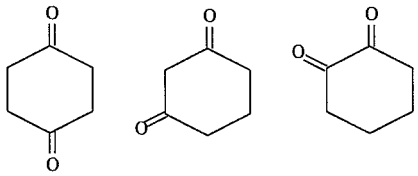

(14) 2-acetyl-1,3-cyclohexanedione (Aldrich 15,649-3), of the formula

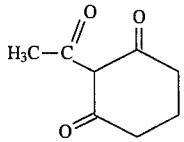

(15) 4,4-dimethyl-1,3-cyclohexanedione (Aldrich 34,125-8), of the formula

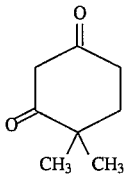

(16) 2-acetyl-1,3-cyclopentanedione (Aldrich 39,084-4), of the formula

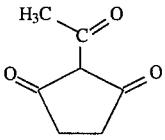

(17) 3,3,5,5-tetramethyl-1,2-cyclopentanedione (Aldrich 36,145-3), of the formula

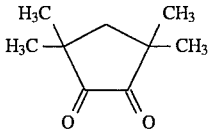

and the like;

(H) bicyclo[3.2.1]octan-2-one (Aldrich 11,903-2), of the formula

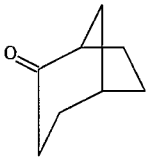

(I) endo-dimethyl 7-oxabicyclo[2.2.1]heptane-2,3-dicarboxylate (Aldrich 34,763-9), of the formula

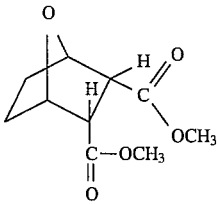

(J) cineole (Aldrich C8,060-1), of the formula

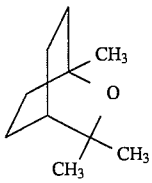

(K) bicyclo[2.2.2]oct-5-ene-2,3-dimethanol (Aldrich 33,175-9), of the formula

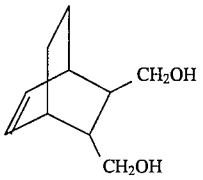

(L) tropone (Aldrich 25,283-2), of the formula

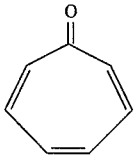

(M) tropolone (Aldrich T8,970-2), of the formula

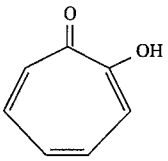

(N) cyclooctene oxide (9-oxabicyclo[6.1.0]nonane) (Aldrich C11,050-7), of the formula

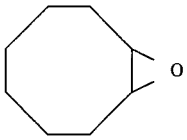

(O) 1,2,5,6-diepoxycyclooctane (Aldrich 16,046-6), of the formula

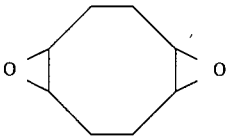

(P) 9-methyl-$\Delta^{5(10)}$-octalin-1,6-dione, of the formula

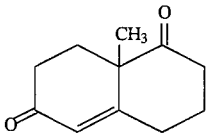

(Q) cis-bicyclo[3.3.0]octane-3.7-dione (Aldrich 19,210-4), of the formula

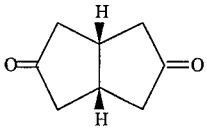

(R) azulene (Aldrich B1,058-7), of the formula

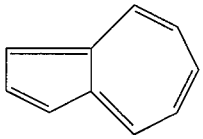

(S) 1-benzosuberone (Aldrich B1,058-7), of the formula

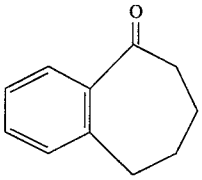

(T) 1,5,9-cyclododecatriene (Aldrich 23,427-3) and (Aldrich C9,748-2), of the formula

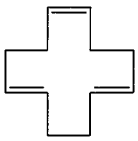

(U) cyclododecane epoxide (Aldrich C9,720-2), of the formula

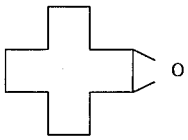

(V) 2,3-cyclododeceno pyridine (Aldrich 19,750-5), of the formula

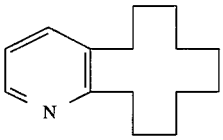

(W) 1,2,5,6,9,10-hexabromo cyclododecane (Aldrich 14,476-2), of the formula

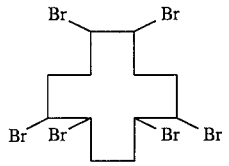

(X) 8-cyclohexadecen-1-one (Aldrich 30,967-2), of the formula

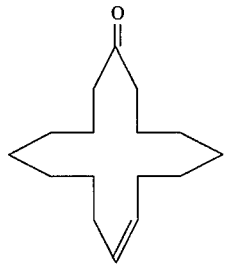

(Y) bicyclo[10.3.0]pentadec-12(1)-en-13-one (Aldrich 33,100-7), of the formula

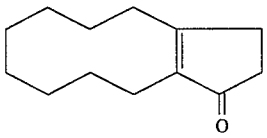

(Z) 1,4,4a,8a-tetrahydro-endo-1,4-methanonaphthalene-5,8-dione (Aldrich 34,180-0), of the formula

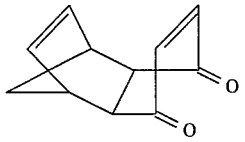

and the like;

IV. Sulfur-containing compounds, including (A) thioureas and thiourea derivatives, such as (1) 1-allyl-2-thiourea (Aldrich 10,880-4), of the formula $H_2C{=}CHCH_2NHCSNH_2$, (2) 1-methallyl-3-methyl-2-thiourea (Aldrich 19,046-2), of the formula $H_2C{=}C(CH_3)CH_2NHCSNHCH_3$, (3) 4-allyl-3-thiosemicarbazide (Aldrich A3,590-9), of the formula $H_2C{=}CHCH_2NHCSNHNH_2$, (4) 1,3-diethyl-2-thiourea (Aldrich D10,090-0), of the formula $C_2H_5NHCSNHC_2H_5$, (5) 1,3-dibutyl-2-thiourea (Aldrich D4,959-8), of the formula $CH_3(CH_2)_3NHCSNH(CH_2)_3CH_3$, (6) 1-benzyl-3-methyl-2-thiourea (Aldrich 27,550-6), of the formula $C_6H_5CH_2NHCSNHCH_3$, (7) 1,1,3,3-tetramethyl-2-thiourea (Aldrich 11,516-9), of the formula $(CH_3)_2NCSN(CH_3)_2$, (8) 2-imino-4-thiobiuret (Aldrich 33,467-7), of the formula $H_2NC(=NH)NHCSNH_2$, (9) 1-allyl-3-(2-hydroxyethyl)-2-thiourea (Aldrich A3,280-2), of the formula $HOCH_2CH_2NHCSNHCH_2CH{=}CH_2$, (10) S-(2-aminoethyl)isothiouronium bromide hydrobromide (Aldrich A5,460-1), of the formula $H_2NC(SCH_2CH_2NH_2){=}NH\text{-}2HBr$, (11) S,S-diphenylsulfillimine monohydrate (Aldrich 23,217-3), of the formula $(C_6H_5)_2S(=NH).H_2O$, and the like; (B) sulfones and sulfone derivatives, such as (1) methylsulfone (dimethylsulfone) (Aldrich M8,170-5), of the formula $(CH_3)_2SO_2$, (2) ethylsulfone (diethylsulfone) (Aldrich 24,246-2), of the formula $(C_2H_5)_2SO_2$, (3) butylsulfone (dibutylsulfone) (Aldrich B10,220-2), of the formula $[CH_3(CH_2)_3[_2SO_2$, (4) butadiene sulfone (Aldrich B8,450-5), of the formula

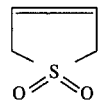

(5) tetramethylene sulfone (Aldrich T2,220-9), of the formula

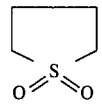

(6) 1,4-butane sulfone (Aldrich B8,550-1), of the formula

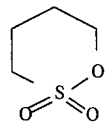

(7) 1,4-butanediolcyclic sulfate (Aldrich 38,748-7), of the formula

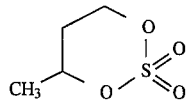

(8) benzylsulfone (Aldrich 34,352-8), of the formula $(C_6H_5CH_2)_2SO_2$, (9) phenylsulfone (diphenylsulfone) (Aldrich P3,535-9), of the formula $(C_6H_5)_2SO_2$, (10) phenylvinylsulfone (Aldrich 24,171-7), of the formula $C_6H_5SO_2CH{=}CH_2$, (11) phenylstyrenesulfone (Aldrich 41,117-5), of the formula $C_6H_5CH{=}CHSO_2C_6H_5$, (12) phenyl-2-(trimethylsilyl)methyl sulfone (Aldrich 30,674-6), of the formula $(CH_3)_3SiCH_2SO_2C_6H_5$, (13) phenyl 2 -(trimethylsilyl)ethyl sulfone (Aldrich 37,625-6), of the formula $(CH_3)_3SiCH_2CH_2SO_2C_6H_5$, (14) phenyl 2-(trimethylsilyl-)ethynyl sulfone (Aldrich 29,655-4), of the formula $(CH_3)_3SiC{\equiv}CSO_2C_6H_5$, (15) 4 -(fluorophenyl)sulfone (Aldrich F1,514-5), of the formula $(FC_6H_4)_2SO_2$, (16) 4-(fluorophenyl)methyl sulfone (Aldrich 18,433-0), of the formula $FC_6H_4SO_2CH_3$, (17) chloromethylphenyl sulfone (Aldrich 32,460-4), of the formula $C_6H_5SO_2CH_2Cl$, (18) chloromethyl-p-tolyl sulfone (Aldrich 36,449-5), of the formula $CH_3C_6H_4SO_2CH_2Cl$, (19) 2-chloroethylphenyl sulfone (Aldrich 41,764-5), of the formula $C_6H_5SO_2CH_2CH_2Cl$, (20) methylthiomethylphenyl sulfone (Aldrich 36,853-9), of the formula $C_6H_5SO_2CH_2SCH_3$, (21) methylthiomethyl-p-tolyl sulfone (Aldrich 29,379-2), of the formula $C_6H_5CH_2SO_2CH_2SCH_3$, (22) 2-(phenylsulfonyl) tetrahydropyran (Aldrich 31,748-9), of the formula

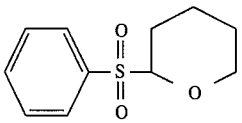

(23) 1-(phenylsulfonyl)indole (Aldrich 36,663-3), of the formula

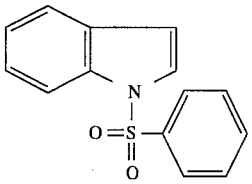

(24) 1-(p-toluenesulfonyl)imidazole (Aldrich 24,424-4), of the formula

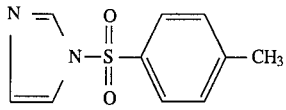

(25) 1-(p-tosyl)-3,4,4-trimethyl imidazolidine (Aldrich 31,758-6), of the formula

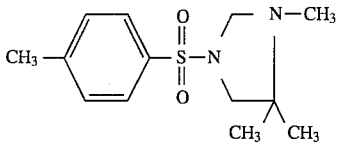

(26) 4-(p-tosylsulfonyl)hexahydro-1,4-thiazepine (Aldrich 34,587-3), of the formula

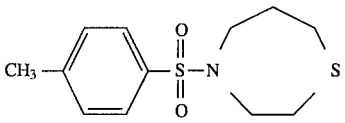

and the like;

(C) thiocyclic compounds, such as (1) thionaphthene (Aldrich T2,740-5), of the formula

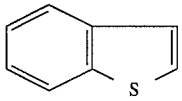

(2) 4-keto-4,5,6,7-tetrahydrothianaphthene (Aldrich K360-3), of the formula

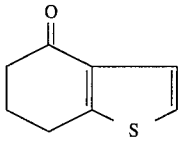

(3) 2,2'-bithiophene (Aldrich 24, 163-6), of the formula

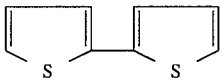

(4) 2,2':5',2"-terthiophene (Aldrich 31,107-3), of the formula

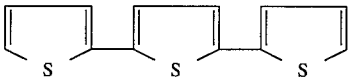

(5) D,L-N-acetylhomocysteine thiolactone (Aldrich A1,660-2), of the formula

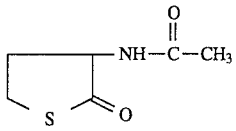

(6) tetrahydrothiopyran-4-one (Aldrich 15,516-0), of the formula

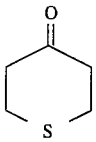

(7) thiochroman-4-one (Aldrich 12,239-4), of the formula

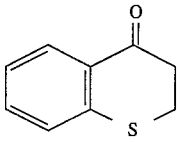

(8) thiochroman-4-ol (Aldrich 12,238-6), of the formula

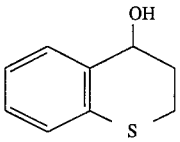

(9) D,L-thioctic acid (Aldrich T2,860-6), of the formula

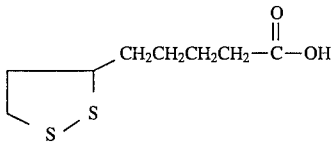

(10) ethyl 1,3-dithiolane-2-carboxylate (Aldrich 22,630-0), of the formula

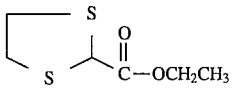

(11) 3H-1,2-benzodithiol-3-one (Aldrich 37,546-2), of the formula

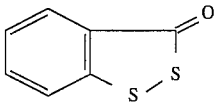

(12) 1,3-dithiane (Aldrich 15,787-2), of the formula

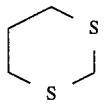

(13) 2-phenyl-1,3-dithiane (Aldrich 27,961-7), of the formula

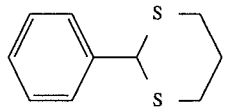

(14) ethyl-1,3-dithiane-2-carboxylate (Aldrich 23,541-5), of the formula

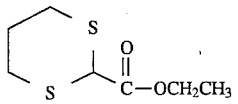

(15) 5,6-dihydro-5-methyl-4H-1,3,5-dithiazine (Aldrich 28,052-6), of the formula

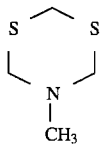

(16) 1,4-dithiane (Aldrich D21,770-0), of the formula

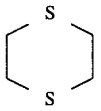

(17) 2,5-dihydroxy-2,5-dimethyl-1,4-dithiane (Aldrich 32,993-2), of the formula

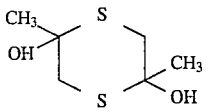

(18) 1,5-dithiacyclooactan-3-ol (Aldrich 25,073-2), of the formula

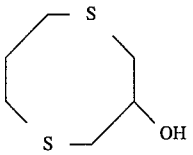

(19) 1,4-dithiaspiro[45]decan-8-ol (Aldrich 32,235-0), of the formula

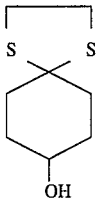

(20) 1,3,5-trithiane (Aldrich T8,840-4), of the formula

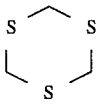

(21) 1,4,7-trithiacyclononane (Aldrich 30,080-2), of the formula

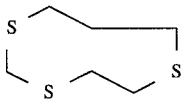

(22) 1,4,7-trithiacyclodecane (Aldrich 33,139-2), of the formula

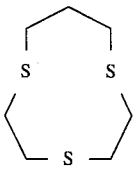

(23) 1,4,7,10-tetrathiacyclododecane (Aldrich 28,136-0), of the formula

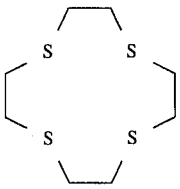

(24) 3,6,9,14-tetrathiabicyclo[9.2.1]tetradeca-11,13-diene (Aldrich 36,140-2), of the formula

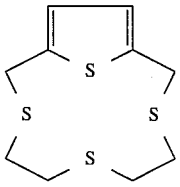

(25) 1,4,8,1-tetrathiacyclotetradecane (Aldrich 25,072-4), of the formula

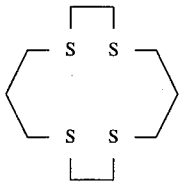

(26) 1,5,9,13-tetrathiocyclohexadecane (Aldrich 28, 129-8), of the formula

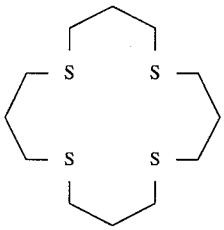

(27) 1,5,9,13-tetrathiacyclohexadecane-3,11-diol (Aldrich 25,823-7), of the formula

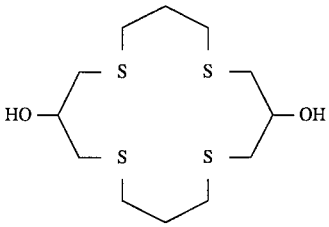

(28) 1,4,7,10,13-pentathiacyclopentadecane (Aldrich 28,134-4), of the formula

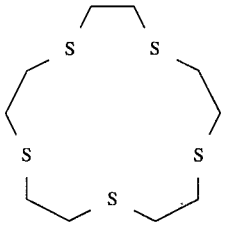

(29) 1,4,7,10,13,16-hexathiacyclooctadecane (Aldrich 28,127-1), of the formula

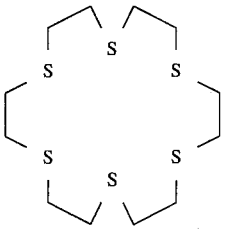

(30) 1,5,9,13,17,21-hexathiacyclotetracosane-3,11,19-triol (Aldrich 26,842-9), of the formula

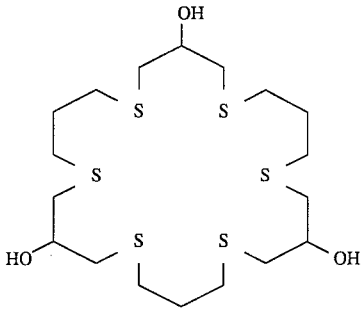

(31) 1,4,7,10,13,16,19,22-octathiacyclotetracosane (Aldrich 28,137-9), of the formula

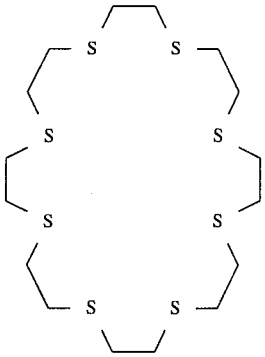

(32) 1,4,8, 11,15,18,22,25-octathiacyclooctacosane (Aldrich 36,702-8), of the formula

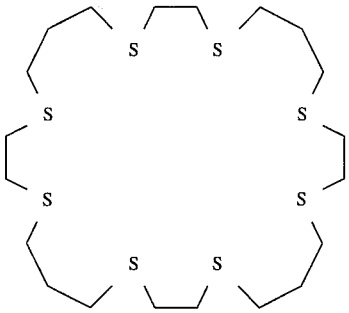

(33) 1,4,7,10,13,16,19,22,25-nonathiacycloheptacosane (Aldrich 41,549-9), of the formula

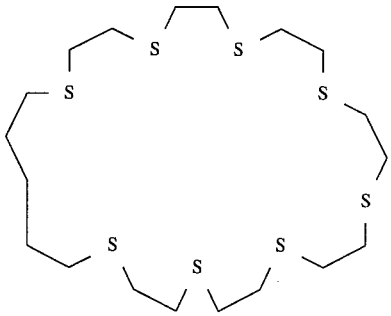

and the like;

(D) sulfites and sulfite derivatives, including (1) dimethylsulfite (Aldrich 10,861-8), of the formula $(CH_3O)_2SO$, (2) diethylsulfite (Aldrich 22,624-6), of the formula $(C_2H_5O)_2SO$, (3) sodium sulfite (Aldrich 23,932-1), of the formula $Na_2SO_3$, and the like; (E) sulfides and sulfide derivatives, including (1) allyldisulfide (Aldrich 31,769-1), of the formula $[H_2C{=}CHCH_2]_2S_2$, (2) aminophenyldisulfide (Aldrich 16,676-6, Aldrich 36,946-2), of the formula $(H_2NC_6H_4)_2S_2$, (3) benzyldisulfide (Aldrich B2,180-5), of the formula $(C_6H_5CH_2)_2S_2$, (4) benzylphenylsulfide (Aldrich B2,920-2), of the formula $C_6H_5CH_2SC_6H_5$, and the like; (F) quaternary sulfur compounds and their derivatives, including (1) trimethylsulfonium methylsulfate (Aldrich 30,359-3), of the formula $(CH_3)_3S(OSO_3CH_3)$, (2) (2 -chloroethyl)dimethylsulfonium iodide (Aldrich 30,322-4), of the formula $ClCH_2CH_2S(CH_3)_2I$, (3) 3-(chloropropyl)diphenylsulfonium tetrafluoroborate (Aldrich 33,132-5), of the formula $Cl(CH_2)_3S(C_6H_5)_2BF_4$, (4) trimethyl sulfonium iodide (Aldrich T8-048-9), of the formula $(CH_3)3SI$, (5) trimethyl sulfoxonium iodide (Aldrich T8,050-0), of the formula

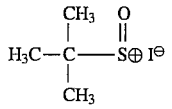

(6) trimethyl sulfoxonium chloride (Aldrich 29,300-8), of the formula

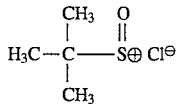

(7) triphenyl methane sulfenyl chloride (Aldrich 27,696-0), of the formula

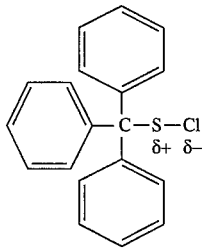

(8) dimethyl(2-methoxy-5-nitrobenzyl)sulfonium bromide (Aldrich 85,775-0), of the formula

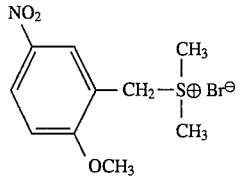

(9) thionin perchlorate (Aldrich 34,115-0), of the formula

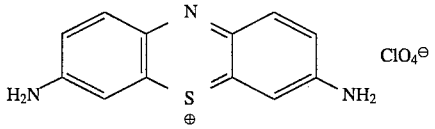

(10) p-xylylene bis(tetrahydrothiopheneum chloride) (Aldrich 37,708-2), of the formula

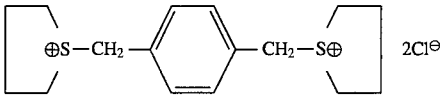

(11) tris(dimethyl amino)sulfonium difluorotrimethyl silicate (Fluka 93336), of the formula

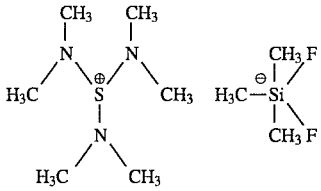

(12) tris(dimethyl amino)sulfonium trifluoromethoxide (Fluka 93343), of the formula

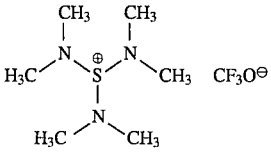

(13) (3-amino-3-carboxypropyl)dimethyl sulfonium chloride (Fluka 64382), of the formula

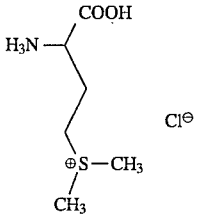

and the like;

V. Thia-aza-cyclic compounds, including (A) thiazoles and thiazole derivatives, and thiazolidines and thiazolidine derivatives, and thiadiazoles and thiadiazole derivatives, including those of the general formulae

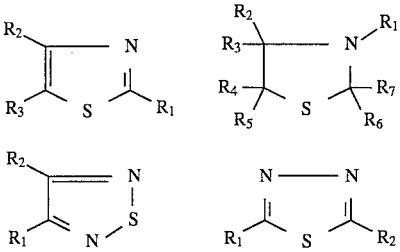

wherein $R_1$, $R_2$, $R_3$, $R_4$, $R_5$, $R_6$, and $R_7$ each, independently of the others, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, and $R_7$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds can also be in acid salt form, wherein they are associated with a compound of the general formula $xH_nY_n$-, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like, as well as mixtures thereof.

Examples of thiazoles include (1) 2-amino-2-thiazoline (Aldrich A8,080-7), of the formula

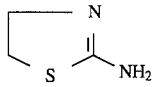

(2) 2-amino thiazole (Aldrich 12,312-9), of the formula

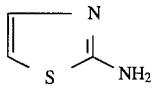

(3) 2-amino-4-methylthiazole (Aldrich A6,600-6), of the formula:

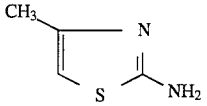

(4) 2-amino-4-methylthiazole (Aldrich A6,600-6), of the formula

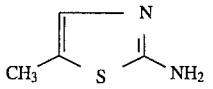

(5) 2-amino-4-thiazoleacetic acid (Aldrich 24,969-6), of the formula

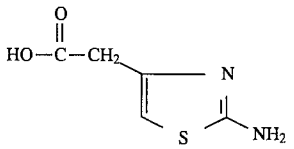

(6) 2-acetamido-4-methylthiazole (Aldrich 30,192-2), of the formula

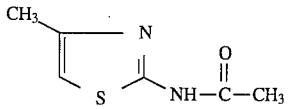

(7)2-acetylthiazole (Aldrich 28,841-1), of the formula

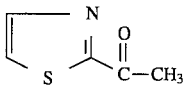

(8) 5-acetyl-2,4-dimethylthiazole (Aldrich 29,808-5), of the formula

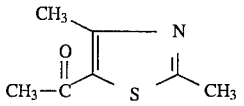

(9) 4-methyl-5-vinylthiazole (Aldrich 24,200-4), of the formula

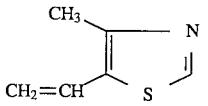

(10) 2-amino-4-phenyl-5-tetradecylthiazole (Aldrich 14,105-4), of the formula

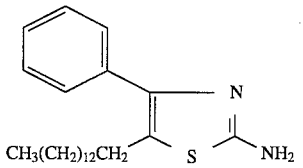

(11) 2,4-thiazolidine dione (Aldrich 13,632-8), of the formula

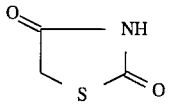

(12) 3-aminorhodanine (Aldrich A7,950-7), of the formula

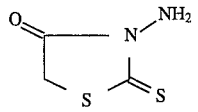

(13) 3-methylrhodanine (Aldrich M8045-8), of the formula

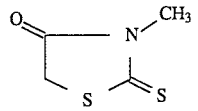

(14) 3-ethylrhodanine (Aldrich 38,577-8), of the formula

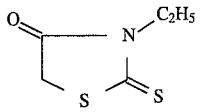

(15) 3-allylrhodanine (Aldrich A3,560-7), of the formula

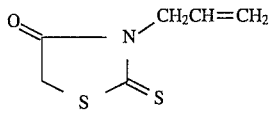

(16) 3-hydroxy-4-methyl-2(3H)-thiazolethione (Aldrich 36,319-7), of the formula

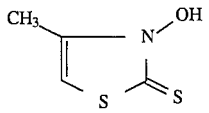

(17) benzothiazole (Aldrich 10,133-8), of the formula

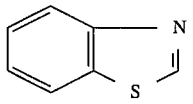

(18) 2-methylbenzothiazole (Aldrich 11,214-3), of the formula

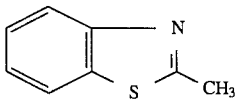

(19) 2-(methylthio)benzothiazole (Aldrich 16,865-3), of the formula

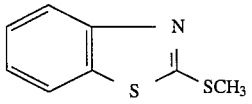

(20) 2-amino-4-methylbenzothiazole (Aldrich 19,322-4), of the formula

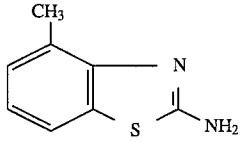

(21) 3-methylbenzothiazole-2-thione (Aldrich M300-0), of the formula

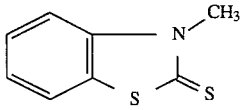

(22) 2,1,3-benzothiadiazole (Aldrich B1,090-0), of the formula

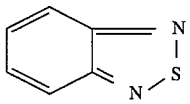

(23) 4-amino-2,1,3-benzothiadiazole (Aldrich 10,252-0), of the formula

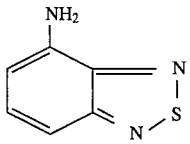

(24) 3,4-dimethyl-5-(2-hydroxyethyl)thiazolium iodide (Aldrich 25,782-6), of the formula

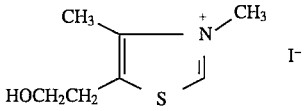

(25) 3-ethyl-5-(2-hydroxyethyl)4-methylthiazolium bromide (Aldrich 33,124-4), of the formula

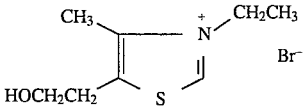

(26) 2-amino-5-nitrothiazole (Aldrich 13,350-7), of the formula

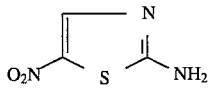

(27) 2-amino-α-(methoxyimino)-4-thiazole acetic acid (Aldrich 28,014-3), of the formula

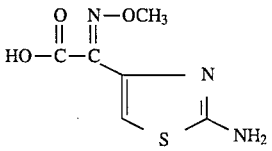

(28) ethyl 2-amino-α-(hydroxyimino)-4-thiazole acetate (Aldrich 28,017-8), of the formula

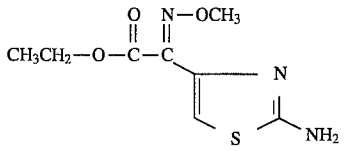

(29) ethyl 2-amino-α-(methoxyimino)-4-thiazole acetate (Aldrich 28,015-1), of the formula

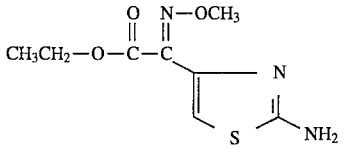

(30) ethyl 2-amino-4-thiazole acetate (Aldrich 22,055-8), of the formula

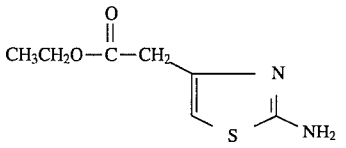

(31) ethyl 2-amino-4-thiazole glyoxylate (Aldrich 28,006-2), of the formula

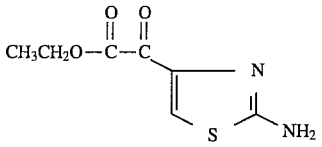

(32) 1-phenyl-3-(2-thiazolyl)-2-thiourea (Aldrich 15,796-1), of the formula

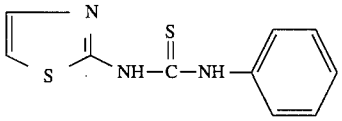

(33) 2-amino-4-methoxy benzothiazole (Aldrich 13,821-5), of the formula

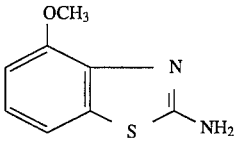

(34) 2-amino-5,6-dimethylbenzothiazole (Aldrich A5,140-8), of the formula

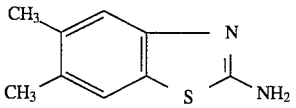

(35) N'-(2-thiazolyl)sulfanilamide (Aldrich 29,290-7), of the formula

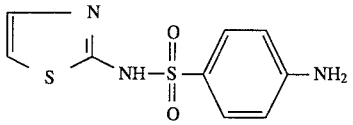

(36) 6-ethoxy-2-benzothiazole sulfonamide (Aldrich 33,332-8), of the formula

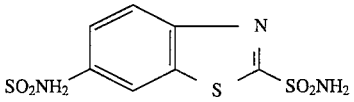

(37) ethyl-2-(formylamino)-4-thiazoleacetate (Aldrich 27,975-7), of the formula

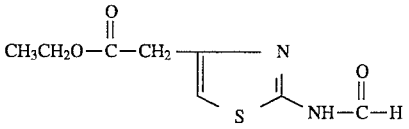

(38) ethyl-2-(formylamino)-4-thiazoleglyoxylate (Aldrich 28,005-4), of the formula

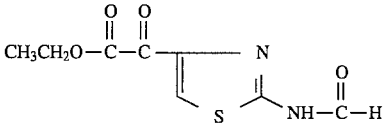

(39) 2-(formylamino)-α-(methoxyimino)-4-thiazole acetic acid (Aldrich 28,019-4), of the formula

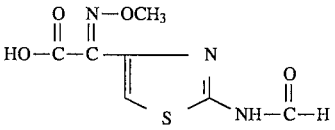

(40) 2-acetamido-4-methyl-5-thiazole sulfonyl chloride (Aldrich 10,785-9), of the formula

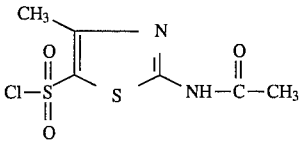

(41 ) (4R)-(–)-2-thioxo-4-thiazolidine carboxylic acid (Aldrich 27,344-9), of the formula

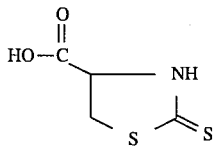

(42) (R)-(–)-thiazolidine-4-carboxylic acid (Aldrich T2,750-2), of the formula

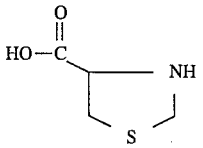

(43) pseudothiohydantoin (Aldrich P5,560-0), of the formula

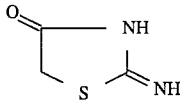

(44) 2-amino-1,3,4-thiadiazole (Aldrich 25,888-1), of the formula

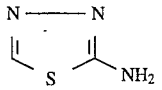

(45) 2-amino-5-trifluoromethyl-1,3,4-thiadiazole (Aldrich 19,696-7), of the formula:

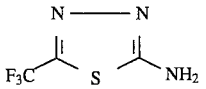

(46) 2-amno-5-methyl-1,3,4-thiadiazole (Aldrich 13,227-2), of the formula

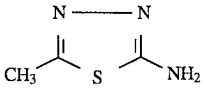

(47) 2-amino-5-ethyl-1,3,4-thiadiazole (Aldrich 19,692-4), of the formula

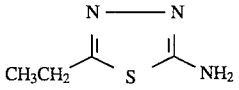

(48) 2-amino-5-(ethylthio)-1,3,4-thiadiazole (Aldrich 33,466-9), of the formula

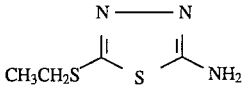

(49) 5-amino-1,3,4-thiadiazole-2-thiol (Aldrich 12,790-6), of the formula

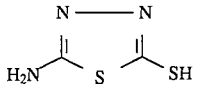

(50) 2-acetamido-5-benzyl thio-1,3,4-thiadiazole (Aldrich 21,136-2), of the formula

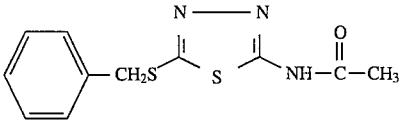

(51) 5-acetamido-1,3,4-thiadiazole-2-sulfonamide (Aldrich 27,195-0), of the formula

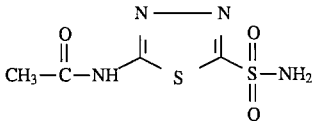

(52) 5-anilino-1,2,3,4-thiatriazole (Aldrich 15,240-4), of the formula

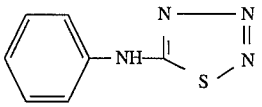

(53) 2-amino-4,5-dimethyl thiazole hydrochloride (Aldrich 17,440-8), of the formula

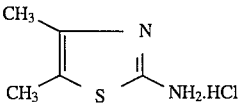

(54) 2-amino 4-imino-2-thiazoline hydrochloride (Aldrich 13,318-3), of the formula

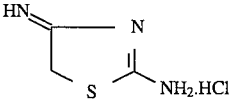

(55) 2-amino-2-thiazoline hydrochloride (Aldrich 26,372-9), of the formula

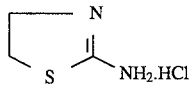

(56) 2-amino-5-bromothiazole monohydrobromide (Aldrich 12,802-3), of the formula

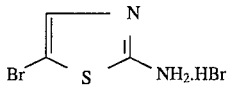

(57) 5-amino-3-methyl isothiazole hydrochloride (Aldrich 15,564-0), of the formula:(Aldrich P100-4), of the formula

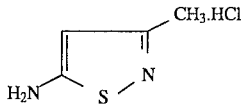

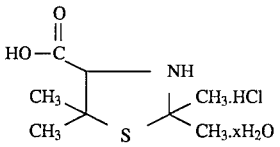

(58) 3-methyl-2-benzothiazolinone hydrazone hydrochloride hydrate (Aldrich 12,973-9), of the formula

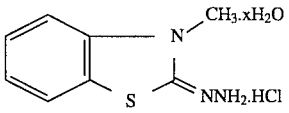

(59) 5-amino-2-methylbenzothiazole dihydrochloride (Aldrich A6,330-9), of the formula

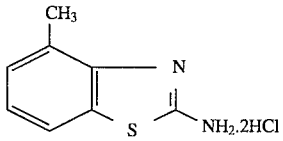

(60) 2,4-diamino-5-phenyl thiazole monohydrobromide (Aldrich D2,320-3), of the formula

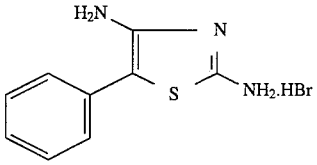

(61) 2-amino-4-phenyl thiazole hydrobromide monohydrate (Aldrich A7,500-5), of the formula

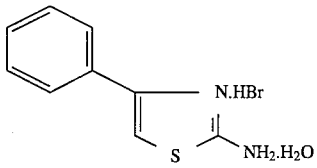

(62) 2-(tritylamino)-α-(methoxyimino)-4-thiazole acetic acid hydrochloride (Aldrich 28,018-6), of the formula

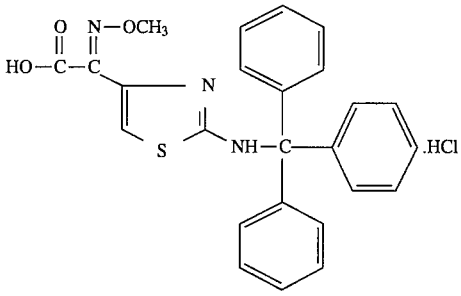

(63) (2,3,5,6-tetrahydro-6-phenylimidazo[2,1-b]thiazole hydrochloride (Aldrich 19,613-4; 19614-2), of the formula

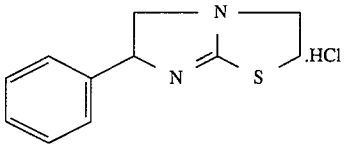

(64) 3-ethyl-2-methyl-2-thiazolium iodide (Aldrich 32,249-0), of the formula

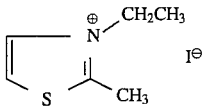

(65) 3-benzyl-5-(2-hydroxyethyl)-4-methyl thiazolium chloride (Aldrich 25,623-4), of the formula

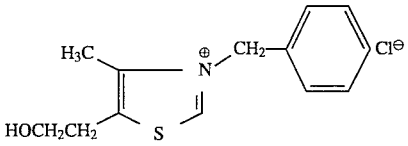

(66) thiamine hydrochloride (Aldrich 10,917-7), of the formula

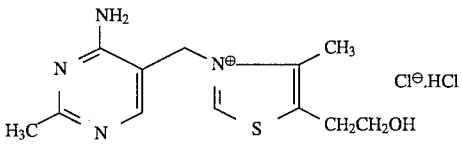

(67) 3-(carboxymethyl) benzothiazolium bromide (Aldrich 37,163-7), of the formula

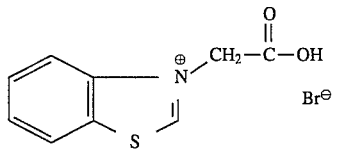

(68) 2-azido-3-ethyl benzothiazolium tetrafluoroborate (Aldrich 36,065-1), of the formula

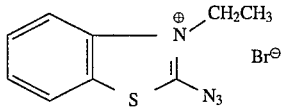

(69) 3-ethyl-2-methyl benzothiazolium iodide (Aldrich 37,700-7), of the formula

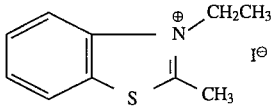

(70) 2-methyl-3-propyl benzothiazolium iodide (Aldrich 36,329-4), of the formula

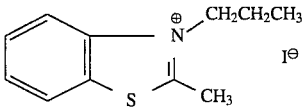

(71) 3-ethyl-2-(2-hydroxy-1-propenyl) benzothiazolium chloride (Aldrich 29,365-2), of the formula

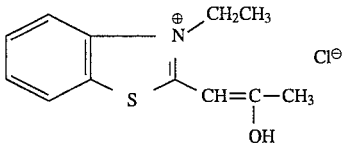

(72) 3,6-dimethyl-2-(4-dimethyl aminophenyl) benzothiazolium bromide (Aldrich 15,242-0), of the formula

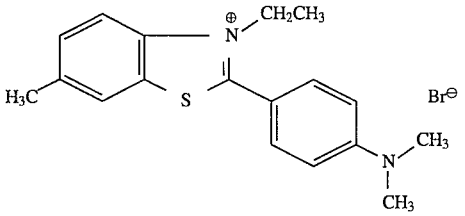

and the like;

(b) phenothiazines, including those of the general formula

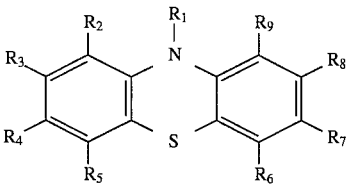

wherein $R_1$, $R_2$, $R_3$, $R_4$, $R_5$, $R_6$, $R_7$, $R_8$, and $R_9$ each, independently of the others, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, $R_8$, and $R_9$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds can also be in acid salt form, wherein they are associated with a compound of the general formula $xH_nY_{n^-}$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like, as well as mixtures thereof.

Examples of phenothiazines include (1) trifluoroperazine dihydrochloride (Aldrich 28,388-6), of the formula

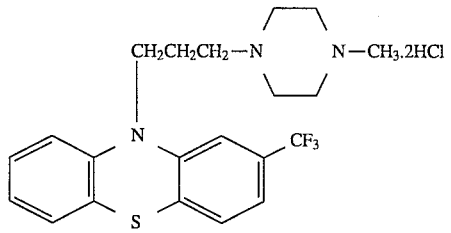

(2) thioridazine hydrochloride (Aldrich 25,770-2), of the formula

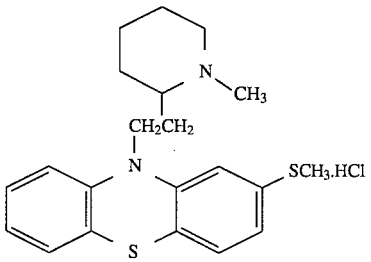

(3) (±)-promethazine hydrochloride (Aldrich 28,411-4), of the formula

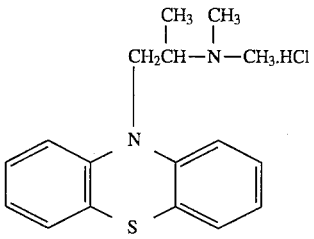

(4) ethopropazine hydrochloride (Aldrich 28,583-8), of the formula

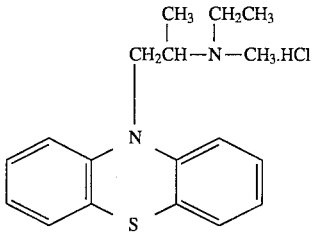

(5) chlorpromazine hydrochloride (Aldrich 28,537-4), of the formula

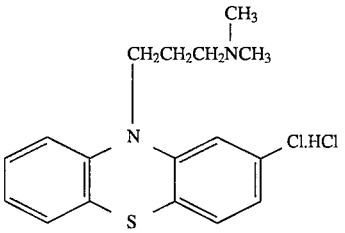

and the like;

VI. Phosphorus compounds and their derivatives, including (A) phosphines, such as (1) trialkyl, triaryl, and heterocyclic phosphines and their derivatives, including (a) triphenylphosphine (Aldrich T8,440-9), of the formula $(C_6H_5)_3P$, (b) tri-m-tolyl phosphine (Aldrich 28,784-9), of the formula $(CH_3C_6H_4)_3P$, (c) tris(3-methoxyphenyl)phosphine (Aldrich 30,516-2)), of the formula $(CH_3OC_6H_4)_3P$, (d) tris(4-chlorophenyl)phosphine (Aldrich 24,949-1), of the formula $(ClC_6H_4)_3P$, (e) tris(pentafluorophenyl)phosphine (Aldrich 29,057-2), of the formula $(C_6F_5)_3P$, (f) tricyclohexylphosphine (Aldrich 26,197-1), of the formula $(C_6H_{11})P$, (g) tribenzylphosphine (Aldrich 33,694-7), of the formula $(C_6H_5CH_2)_3P$, (h) tri-2-furylphosphine (Aldrich 38,376-7), of the formula

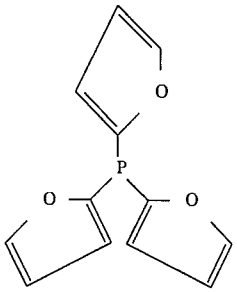

(i) bis(pyrrolidino)methoxy phosphone (Aldrich 27,735-5), of the formula

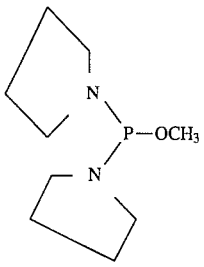

(j) compounds of the general formula $(C_6H_5)_2P(CH_2)nP(C_6H_5)_2$ where n is an integer of from 0 to about 10, such as (1) n=0: tetraphenylbiphosphine (Aldrich 31,019-0), of the formula $(C_6H_5)_2PP(C_6H_5)_2$, (2) n=3: 1,3 -bis(diphenylphosphino)propane (Aldrich 26,204-8), of the formula $(C_6H_5)_2P(CH_2)_3P(C_6H_5)_2$, (3) n=5: 1,5-bis(diphenylphosphino)pentane (Aldrich 28,799-7), of the formula $(C_6H_5)_2P(CH_2)_5P(C_6H_5)_2$, (4) n=6: 1,6-bis(diphenenylphosphino)hexane (Aldrich 28,798-9), of the formula $(C_6H_5)_2P(CH_2)_6P(C_6H_5)_2$, and the like; (k) alkyldiphenyl or dialkylphenyl compounds, including (1)isopropyl diphenyl phosphine (Aldrich 33,692-0), of the formula $(C_6H_5)_2PCH(CH_3)_2$, (2) diphenyl(p-tolyl)phosphine (Aldrich 15,503-9), of the formula $(C_6H_5)_2PC_6H_4CH_3$, (3) (4-bromophenyl)diphenyl phosphine (Aldrich 28,800-4), of the formula $BrC_6H_4P(C_6H_5)_2$, (4) diphenyl-2-pyridylphosphine (Aldrich 32,296-0), of the formula

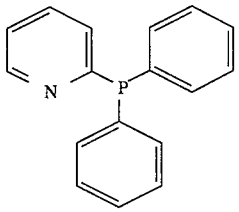

(5) dicyclohexylphenyl phosphine (Aldrich 28,828-4), of the formula $(C_6H_{11})_2PC_6H_5$, and the like;

(B) phosphites and phosphite derivatives, including (1) trialkyl and triaryl phosphites and their complexes, such as (a) trimethyl phosphite (Aldrich T7,970-7), of the formula $(CH_3O)_3P$, (b) triethyl phosphite (Aldrich T6,120-4), of the formula $(C_2H_5O)_3P$, (c) tris(2-chloroethyl) phosphite (Aldrich T8,540-5), of the formula $(ClCH_2CH_2O)_3P$, (d) tributyl phosphite (Aldrich 36,114-3), of the formula $(CH_3(CH_2)_2O)_3P$, (e) triphenyl phosphite (Aldrich T8,465-4), of the formula $(C_6H_5O)_3P$, (f) trimethyl phosphite copper iodide (Aldrich T33,890-7), of the formula $(CH_3O)_3PCuI$, (g) triethyl phosphite copper iodide (Aldrich 33,172-4), of the formula $(C_2H_5O)_3PCuI$, and the like; (2) dialkyl and diaryl phosphites, such as (a) dipropyl phosphite (Aldrich D21,610-0), of the formula $(CH_3CH_2CH_2O)_2P(O)H$, (b) bis(2-ethylhexyl)phosphite (Aldrich 24,895-9), of the formula $[CH_3(CH_2)_3CH(C_2H_5)CH_2O]_2P(O)H$, (c) bis(4-nitrobenzyl)phosphite (Aldrich 29,367-9), of the formula $[O_2NC_6H_4CH_2O]_2P(O)H$, (d) 2,2'-ethylidene bis(4,6-di-tert-butylphenyl)fluorophosphite (Aldrich 37,048-7), of the formula

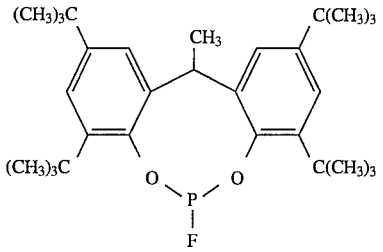

(e) pentaerythritol diphenyl diphosphite, of the formula

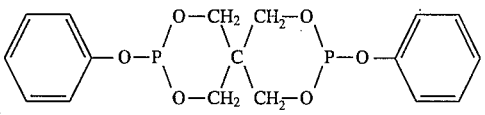

and the like;

(C) cyclic phosphorus compounds, including (1) 2-furyltetramethyl phosphorodiamidate (Aldrich 30,804-8), of the formula

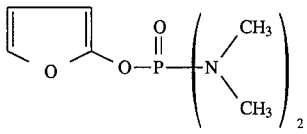

(2) diethyl(pyrrolidinomethyl)phosphonate (Aldrich 37,416-4), of the formula

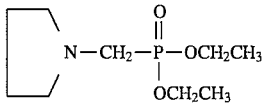

(3) cyclophosphamide monohydrate (Aldrich 21,870-7), of the formula

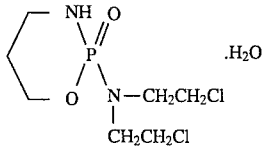

(4) 2-chloro-1,3,2-dioxaphospholane-2-oxide (Aldrich 37,795-3), of the formula

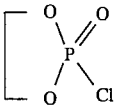

(5) N,N-diethyl-1,5-dihydro-2,4,3-benzodioxaphosphepin-3-amine (Aldrich 39,383-5), of the formula

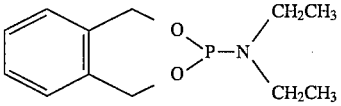

(6) 1,2-phenylene phosphochloridite (Aldrich 15,576-4), of the formula

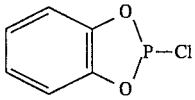

(7) 1,2-phenylene phosphochloridate (Aldrich 15,614-0), of the formula

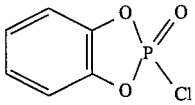

(8) 2-chloro-4H-1,3,2-benzodioxaphosphorin-4-one (Aldrich 32,412-4), of the formula

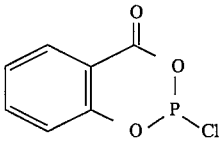

(9) 2,4-bis(methylthio)-1,3-dithia-2,4-diphosphetane-2,4-disulfide (Aldrich 34,674-8), of the formula

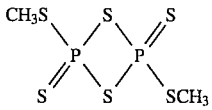

and the like;

(D) phosphine oxide compounds, including (1) trisubstituted phosphine oxides, such as (a) triphenyl phosphine oxide (Aldrich T8,460-3), of the formula $(C_6H_5)_3P(O)$, (b) tris(hydroxymethyl)phosphine oxide (Aldrich 17,790-3), of the formula $(CH_2OH)_3P(O)$, (c) trimethoxy phosphine oxide (Aldrich 13,219-5), of the formula $(CH_3O)_3P(O)$, (d) triethoxy phosphine oxide (Aldrich T6,110-7), of the formula $(C_2H_5O)_3P(O)$, (e) triphenoxy phosphine oxide (Aldrich 10,585-6), of the formula $(C_6H_5O)P(O)$, (f) tris(2-butoxy ethoxy)phosphine oxide (Aldrich 13,059-1), of the formula $[CH_3(CH_2)_3OCH_2CH_2O]_3P(O)$, and the like; (2) disubstituted phosphine oxides, such as (a) diphenyl phosphine oxide (Aldrich 28,788-1), of the formula $(C_6H_5)_2P(O)H$, (b) diphenyl(2,4,6-trimethylbenzoyl)phosphine oxide (Aldrich 41,595-2), of the formula $(CH_3)_3C_6H_4COP(C_6H_5)_2$, and the like; (3) hydroxy phosphine oxide compounds, such as (a)

phenyl phosphinic acid (Aldrich P2,880-8), of the formula $C_6H_5P(O)(OH)H$, (b) diphenyl phosphate (Aldrich 85,060-8), of the formula $(C_6H_5O)_2P(O)OH$, (c) vinyl phosphonic acid (Aldrich 39,631-1), of the formula $H_2C{=}CHP(O)(OH)_2$, (d) propyl phosphonic acid (Aldrich 30,568-5), of the formula $CH_3CH_2CH_2P(O)(OH)_2$, (e) pyrophosphoric acid (Aldrich 30,841-2), of the formula $O[P(O)(OH)_2]_2$, (f) triphenylphosphate (Aldrich 24,128-8) (Aldrich 10,585-6), of the formula $(C_6H_5O)_3P(O)$, and the like; (E) quaternary phosphonium salts, including (1) tetrabutylphosphonium chloride (Aldrich 14,480-0), of the formula $[CH_3(CH_2)_3]_4PCI$, (2) tetrabutylphosphonium bromide (Aldrich 18,913-8), of the formula $[CH_3(CH_2)_3]_4PBr$, (3) hexadecyltributylphosphonium bromide (Aldrich 27,620-0), of the formula $CH_3(CH_2)_{15}P[(CH_2)_3CH_3]_3Br$, (4)stearyltributylphosphonium bromide (Aldrich 29,303-2), of the formula $CH_3(CH_2)17P[(CH_2)_3CH_3]_3Br$, (5) azidotris-(diethylamino)phosphonium bromide (Aldrich 38,082-2), of the formula $N_3P[N(C_2H_5)_2]_3Br$, (6) phosphonitrilic chloride trimer (Aldrich 23,028-6), of the formula

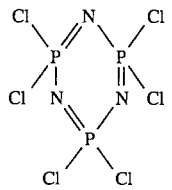

(7) tetramethyl phosphonium bromide (Aldrich Chemical Co. 28,826-8), of the formula $(CH_3)_4PBr$, (8) tetramethyl phosphonium chloride (Aldrich 28,827-6), of the formula $(CH_3)_4PCI$, (9) tetraethyl phosphonium bromide (Aldrich 33,365-4), of the formula $(C_2H_5)_4PBr$, (10) tetraethyl phosphonium chloride (Aldrich 32,539-2), of the formula $(C_2H_5)_4PCI$, (11) tetraethyl phosphonium iodide (Aldrich 32,540-6), of the formula $(C_2H_5)_4PI$, (12) tetraphenyl phosphonium bromide (Aldrich 21,878-2), of the formula $(C_6H_5)_4PBr$, (13) tetraphenyl phosphonium chloride (Aldrich 21870-0), of the formula $(C_6H_5)_4PCI$, (14) tetraphenyl phosphonium Iodide (Aldrich 21880-4), of the formula $(C_6H_5)_4PI$, (15) methyl triphenyl phosphonium bromide (Aldrich 13,007-9), (16) methyl triphenyl phosphonium iodide (Aldrich 24,505-4), (17) ethyl triphenyl phosphonium bromide (Aldrich E5,060-4), (18) n-propyl triphenyl phosphonium bromide (Aldrich 13,156-3), (19) isopropyl triphenyl phosphonium iodide (Aldrich 37,748-1), (20) cyclopropyl triphenyl phosphonium bromide (Aldrich 15,731-7), (21) n-butyl triphenyl phosphonium bromide (Aldrich B10, 280-6), (22) isobutyl triphenyl phosphonium bromide (Aldrich 37,750-3), (23) hexyl triphenyl phosphonium bromide (Aldrich 30,144-2), (24) benzyl triphenyl phosphonium chloride (Aldrich B3, 280-7), (25) bromomethyl triphenyl phosphonium bromide (Aldrich 26, 915-8), (26) chloromethyl triphenyl phosphonium chloride (Aldrich C5,762-6), (27) 3-bromopropyl triphenyl phosphonium bromide (Aldrich 13,525-9), (28) 3-bromobutyl triphenyl phosphonium bromide (Aldrich 30, 537-5), (29) 4-bromobutyl triphenyl phosphonium bromide (Aldrich 27, 213-2), (30) 2-dimethyl aminoethyl triphenyl phosphonium bromide (Aldrich 21,544-9), (31) [(3-dimethyl amino) propyl]triphenyl phosphonium bromide (Aldrich 30,585-5), (32) 2-hydroxyethyl triphenyl phosphonium bromide (Aldrich 30,413-1), (33) (2-hydroxyethyl) triphenyl phosphonium chloride (Aldrich H3,065-8), (34) [(R)-(+)-3-hydroxy-2-methyl propyl]triphenyl phosphonium bromide (Aldrich 32,507-4), (35) [(S)-(−)-3-hydroxy-2-methyl propyl]triphenyl phosphonium bromide (Aldrich 32,508-2), (36) (2-hydroxybenzyl triphenyl phosphonium bromide (Aldrich 21,629-1), (37) (formyl methyl)triphenyl phosphonium chloride (Aldrich 30,532-4), (38) (methoxymethyl)triphenyl phosphonium chloride (Aldrich 30,956-7), (39) acetonyl triphenyl phosphonium chloride (Aldrich 15, 807-0), (40) carbomethoxymethyl triphenyl phosphonium bromide (Aldrich 25,906-3), (41) (ethoxy carbonyl methyl)triphenyl phosphonium chloride (Aldrich 30,531-6), (42) carbethoxymethyl triphenyl phosphonium bromide (Aldrich C530-0), (43) (tert-butoxy carbonyl methyl)triphenyl phosphonium bromide (Aldrich 36,904-7), (44) phenacyl triphenyl phosphonium bromide (Aldrich 15, 133-5), (45) (4-ethoxybenzyl)triphenyl phosphonium bromide (Aldrich 26,648-5), (46) 4-butoxybenzyl triphenyl phosphonium bromide (Aldrich 27,489-5), (47) 2-(1,3-dioxan-2-yl)ethyl]triphenyl phosphonium bromide (Aldrich 21,959-2), (48) (1,3-dioxolan-2-ylmethyl)triphenyl phosphonium bromide (Aldrich 22,385-9), (49) vinyl triphenyl phosphonium bromide (Aldrich 15,019-3), (50) allyl triphenyl phosphonium bromide (Aldrich A3,660-3), (51) allyl triphenyl phosphonium chloride (Aldrich 33,351-4), (52) propargyl triphenyl phosphonium bromide (Aldrich 22,648-3), (53) (3-trimethyl silyl-2-propynyl)triphenyl phosphonium bromide (Aldrich 29,958-8), (54) p-xylylene bis(triphenyl phosphonium bromide) (Aldrich 112-1), and the like;

VII. Nitrile compounds and their derivatives, including (1) cyanoacetohydrazide (Aldrich C8,860-2), of the formula $NCCH_2CONHNH_2$, (2) 4,4-dimethyl-3-oxopentanenitrile (Aldrich 26,238-2), of the formula $(CH_3)_3CCOCH_2CN$, (3) 1-cyano-N-methylthioformamide (Aldrich 30,807-2), of the formula $NCCSNHCH_3$, (4) cyanomethyl N,N-dimethyl dithiocarbamate (Aldrich 28,054-2), of the formula $(CH_3)_2NCSSCH_2CN$, (5) 4-hydroxy-3-methoxy-phenyl acetonitrile (Aldrich 22,374-3), of the formula $HOC_6H_3(OCH_3)CH_2CN$, (6) tosyl cyanide (Aldrich 24,883-5), of the formula $CH_3C_6H_4SO_2CN$, (7) tosylmethyl isocyanide (Aldrich 18,820-4), of the formula $CH_3C_6H_4SO2CH_2NC$, (8) 5-fluoro-2-methyl benzonitrile (Aldrich 30,447-6), of the formula $FC_6H_4CH_3CN$, (9) 2-fluoro-5-methyl benzonitrile (Aldrich 38,133-0), of the formula $FC_6H_4CH_3CN$, (10) 4-(methylthio) benzonitrile (Aldrich 27,968-4), of the formula $CH_3SC_6H_4CN$, (11) 4-(dimethylamino) benzonitrile (Aldrich D13,950-5), of the formula $(CH_3)_2NC_6H_4CN$, (12) 3,4-dimethoxy benzonitrile (Aldrich D13,233-0), of the formula $(CH_3O)_2C_6H_3CN$, (13) 4-hydroxy-3-methoxy benzonitrile (Aldrich 16,260-4), of the formula $HOC_6H_3(OCH_3)CN$, (14) 4-(trans-4-pentyl cyclohexyl)benzonitrile (Aldrich 37,011-8), of the formula $CH_3(CH_2)_4C_6H_{10}C_6H_4CN$, (15) 4'-pentyl-4'-biphenyl carbonitrile (Aldrich 32,851-0), of the formula $CH_3(CH_2)_4C_6H_4C_6H_4CN$, (16) 4'-(pentyloxy)-4-biphenylcarbonitrile (Aldrich 32,852-9), of the formula $CH_3(CH_2)_4OC_6H_4C_6H_4CN$, $(17)_4$'-hexyl-4-biphenyl carbonitrile (Aldrich 33,864-8), of the formula $CH_3(CH_2)_5C_6H_4C_6H_4CN$, (18) 4'-(hexyloxy)-4-biphenyl carbonitrile (Aldrich 33,865-6), of the formula $CH_3(CH_2)_5OC_6H_4C_6H_4CN$, (19) 4'-heptyl-4-biphenyl carbonitrile (Aldrich 33,081-7), of the formula $CH_3(CH_2)_6C_6H_4C_6H_4CN$, (20) 4'-heptyloxy-4-biphenyl carbonitrile (Aldrich 33,866-4), of the formula $CH_3(CH_2)_6OC_6H_4C_6H_4CN$, (21) 4'-octyl-4-biphenyl carbonitrile (Aldrich 33,868-0), of the formula $CH_3(CH_2)_7C_6H_4C_6H_4CN$, (22) 4'-(octyloxy)-4-biphenyl carbonitrile (Aldrich 33,867-2), of the formula $CH_3(CH_2)_7OC_6H_4C_6H_4CN$, (23) succinonitrile (Aldrich 16,096-2), of the formula $NCCH_2CH_2CN$, (24) fumaronitrile (Aldrich 13,101-6), of the formula $NCCH{=}CHCN$, (25) 1,4-dicyano-2-butene (Aldrich D7,720-6), of the formula $NCCH_2CH{=}CHCH_2CN$, (26) (dimethyl aminomethylene)malononitrile (Aldrich 14,444-4), of the formula $(CH_3)_2NCH{=}C(CN)2$, (27) (1-ethoxyethylidene)malononitrile (Aldrich 15,926-3), of the formula $CH_3C(OC_2H_5){=}C(CN)_2$, (28) α-chlorobenzylidenemalononitrile (Aldrich 37,528-4), of the formula $C_6H_5C(Cl){=}C(CN)_2$, (29) benzylidenemalononitrile (Aldrich 14,733-8), of the formula $C_6H_5CH{=}C(CN)_2$, (30) 2-benzoyloxy-2-phenyl malononitrile (Aldrich 18,890-5), of the formula $C_6H_5COOC(CN)_2C_6H_5$, (31) O-(p-tosyl)isonitrosomalononitrile (Aldrich 22,223-2), of the formula $CH_3C_6H_4SO_2ON{=}C(CN)_2$, (32) tetrafluorophthalonitrile (Aldrich 19,681-9), of the formula $C_6F_4(CN)_2$, (33) iminodiacetonitrile (Aldrich 14,825-3), of the formula $HN(CH_2CN)_2$, (34) phenylene diacetonitrile (Aldrich P2,340-7; P2,370-9; P2,380-6), of the formula $C_6H_4(CH_2CN)_2$, (35) 3,3'-(4-formyl phenylimino)dipropionitrile (Aldrich 39,964-7), of the formula $HCOC_6H_4N(CH_2CH_2CN)_2$, (36) tris(2-cyanoethyl) nitromethane (Aldrich 35,794-4), of the formula $O_2N(CH_2CH_2CN)_3$, (37) 1,1,3,3-propanetetracarbonitrile (Aldrich 37,571-3), of the formula $(NC)_2CHCH_2CH(CN)_2$, (38) tetracyanoethylene oxide (Aldrich 31,119-7), of the formula

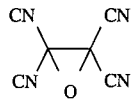

and the like;

VIII. Isothiocyanate compounds and isocyanate compounds and their derivatives, including (A) 4-azidophenyl isothiocyanate (Aldrich 35,956-4), of the formula $N_3C_6H_4NCS$, (B) 1-naphthyl isothiocyanate (Aldrich N452-5), of the formula $C_{10}H_7NCS$, (C) 4-dimethyl amino-1-naphthyl isothiocyanate (Aldrich 22,627-0), of the formula $(CH_3)_2NC_{10}H_6NCS$, (D) 1-isothiocyanato-4-(trans-4-propyl cyclohexyl) benzene (Aldrich 36,629-3), of the formula $CH_3CH_2CH_2C_6H_{10}C_6H_4NCS$, (E) 1-(trans-4-hexyl cyclohexyl)-4-isothiocyanato benzene (Aldrich 36,685-4), of the formula $CH_3(CH_2)_5C_6H_{10}NCS$, (F) 1-(4-trans-hexyl cyclohexyl)-4-[ 2-(4-isothio cyanatophenyl)] benzene (Aldrich 37,725-2), of the formula $CH_3(CH_2)_5C_6H_{10}C_6H_4CH_2CH_2C_6H_4NCS$, (G) 1-isothiocyanato- 4-(trans-4-octylcyclohexyl)benzene (Aldrich 36,686-2), of the formula $CH_3(CH_2)_7C_6H_{10}C_6H_4NCS$, (H) 4-isothiocyanatophenyl-4-pentabicyclo[2.2.2]octane-1-carboxylate (Aldrich 37,005-3), (I) benzylthiocyanate (Aldrich B3,200-9), of the formula $C_6H_5CH_2SCN$, (J) guanidinethiocyanate (Aldrich 29,288-5), of the formula $H_2NC({=}NH)NH_2{\bullet}HSCN$, (K) methylene dithiocyanate (Aldrich 10,509-0), of the formula $CH_2(SCN)_2$, (L) 4,4'-methylene bis(phenyl isocyanate) (Aldrich 25,634-9), of the formula $CH_2(C_6H_4NCO)_2$, (M) 4,4'-methylene bis(2,6-diethyl isocyanate) (Aldrich 38,153-5), of the formula $CH_2[C_6H_2(C_2H_5)_2NCO]_2$, and the like;

IX. Oxime compounds and their derivatives, including (A) formamidoxime (Aldrich 14,019-8), of the formula $HC(NOH)NH_2$) (B) acetaldoxime (Aldrich 40,776-3), of the formula $CH_3CH{=}NOH$, (C) pyruvic aldehyde-1-oxime (Aldrich 26,056-8), of the formula $CH_3COCH{=}NOH$, (D) acetone oxime (Aldrich A1,050-7), of the formula

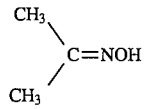

(E) ethylchlorooximido acetate (Aldrich 29,262-1), of the formula $HON{=}C(Cl)COOC_2H_5$, (F) 2,3-butane dione monoxime (Aldrich 11,213-5), of the formula $CH_3C({=}NOH)COCH_3$, (G) 5-hydroxy pentenal oxime (Aldrich 31,641-5), of the formula HO(CH2)4CH=NOH, (H) cyclopentanone oxime (Aldrich C11,243-7), of the formula $C_5H_8({=}NOH)$, (I) cyclohexanone oxime (Aldrich C10,220-2), of the formula $C_6H_{10}({=}NOH)$, (J) cyclooctanone oxime (Aldrich 39,392-4), of the formula $C_8H_{14}({=}NOH)$, (K) benzaldehyde oxime (Aldrich 24,567-4), of the formula $C_6H_5CH{=}NOH$, (L) 2-nitrobenzaldehyde oxime (Aldrich 24,204-7), of the formula $O_2NC_6H_4CH{=}NOH$, (M) salicyl aldoxime (Aldrich 22,307-7), of the formula $(HO)_2C_6H_4CH{=}NOH$, (N) 2-isonitroso acetphenone (Aldrich I-1,820-2), of the formula $C_6H_5COCH{=}NOH$, (O) 1-phenyl-1,2-propanedione 2-oxime (Aldrich 22,009-4), of the formula $C_6H_5COC({=}NOH)CH_3$, (P) 2-pyridine aldoxime (Aldrich P5,820-0), of the formula

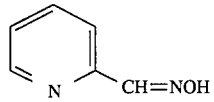

(Q) nifuroxime (Aldrich 14,928-4), of the formula

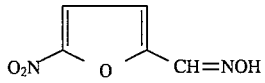

and the like;

X. Hydroxamic acid derivatives, including (A) acetohydroxamic acid (Aldrich 15,903-4), of the formula $CH_3CONHOH$, (B) suberohydroxamic acid (Aldrich 39,058-5), of the formula $[-(CH_2)_3CONHOH]_2$, (C) mandelohydroxamic acid (Aldrich 37,373-7), of the formula $C_6H_4CH(OH)CONHOH$, (D) benzohydroxamic acid (Aldrich 41,226-0), of the formula $C_6H_5CONHOH$, (E) N-phenylbenzohydroxamic acid (Aldrich 27,485-2), of the formula $C_6H_5CON(C_6H_5)OH$, and the like;

XI. Halide compounds, including (A) tetraalkyl ammonium salts, such as (1) tetramethylammonium fluoride tetrahydrate (Aldrich 10,721-2), of the formula $(CH_3)_4NF{\bullet}4H_2O$, (2) tetraethylammonium acetate tetrahydrate (Aldrich 20,558-3), of the formula $(C_2H_5)_4N(OOCCH_3){\bullet}4H_2O$, (3) tetrabutylammonium chloride (Aldrich 39,687-7), of the formula $[CH_3(CH_2)_3]_4NCl$, (4) tetrabutylammonium chloride hydrate (Aldrich 34,585-7), of the formula $[CH_3(CH_2)_3]_4NCl{\bullet}H_2O$, (5) tetrabutylammonium bromide (Aldrich 19,311-9), of the formula $[CH_3(CH_2)_3]_4NBr$, (6) tetrabutylammonium tribromide (Aldrich 30,159-0), of the formula $[CH_3(CH_2)_3]_4NBr3$, (7) tetrabutylammonium acetate (Aldrich 33,599-1), of the formula $[CH_3(CH_2)3]_4N(O_2CCH_3)$, (8) tetrabutylammonium thiocyanate (Aldrich 32,331-4), of the formula $[CH_3(CH_2)_3]_4NSCN$, (9) tetrapentylammonium bromide (Aldrich 24,197-0), of the formula $[CH_3(CH_2)_4]_4NBr$, (10) tetrahexylammonium bromide (Aldrich 25,281-6), of the formula $[CH_3(CH_2)_5]_4NBr$, (11) tetrahexylammonium chloride (Aldrich 26,383-4), of the formula $[CH_3(CH_2)_5]_4NCl$, (12) tetrahexylammonium hydrogensulfate (Aldrich 39,692-3), of the formula $[CH_3(CH_2)_5]_4N(HSO_4)$, (13) tetraheptylammonium chloride (Aldrich 41,990-7), of the formula $[CH_3(CH_2)_6]_4NCl$, (14) tetraheptylammonium bromide (Aldrich 23,784-1), of the formula $[CH_3(CH_2)_6]_4NBr$, (15) tetraoctylammonium bromide (Aldrich 29,413-6), of the formula $[CH_3(CH_2)_7]_4NBr$, (16) tetrakisdecylammonium bromide (Aldrich 36,517-3), of the formula $[CH_3(CH_2)_9]_4NBr$, (17) tetrahexadecylammonium bromide (Aldrich 36,752-4), of the formula $[CH_3(CH_2)_{15}]_4NBr$, (18) tetramethyl ammonium bromide (available from Aldrich Chemical Co., 19,575-8), (19) tetramethyl ammonium chloride (Aldrich T1,952-6), (20) tetramethyl ammonium iodide (Aldrich 23,594-6), (21) tetraethyl ammonium bromide (Aldrich 24,105-9), (22) tetraethyl ammonium chloride (Aldrich 11304-2), (23) tetraethyl ammonium iodide (Aldrich 23,593-8), (24) tetrapropyl ammonium bromide (Aldrich 22,556-8), (25) tetrapropyl ammonium iodide (Aldrich 23,595-4), (26) tetrabutyl ammonium iodide (Aldrich 14,077-5), (27) tetrapentyl ammonium chloride (Aldrich 25,896-2), (28) tetrahexyl ammonium bromide (Aldrich 25,281-6), (29) tetrahexyl ammonium iodide (Fluka 87307), (30) tetradecyl ammonium bromide (Fluka 87582), (31) tetradodecyl ammonium bromide (Fluka 87249), (32) tetraoctadecyl ammonium bromide (Aldrich 35,873-8), and the like; (B) alkyl trialkyl ammonium salts, aryl trialkyl ammonium salts, alkyl triaryl ammonium salts, and aryl triaryl ammonium salts, such as (1) methyltrioctylammonium bromide (Aldrich 36,571-8), of the formula $CH_3N[(CH_2)_7CH_3]_3Br$, (2) tridodecylmethylammonium chloride (Aldrich 36,772-9), of the formula $CH_3N[(CH_2)_{11}CH_3]_3Cl$, (3) tridodeylmethylammonium iodide (Aldrich 37,435-0), of the formula $CH_3N[(CH_2)_{11}CH_3]_3I$, (4) (–)-N-dodecyl-N-methylephedrinium bromide (Aldrich 23,540-7), of the formula $C_6H_5CH(OH)CH(CH_3)N(CH_3)_2[(CH_2)_{11}CH_3]Br$, (5) phenyltrimethylammonium tribromide (Aldrich 13,971-8), of the formula $C_6H_5N(CH_3)_3Br{\bullet}Br_2$, (6) tricapryl methyl ammonium chloride (Aliquat 336 Aldrich 20,561-3), (7) tridodecyl methyl ammonium chloride (Fluka 91661), (8) tridecyloxypropyl dihydroxy ethyl methyl ammonium chloride (Tomah Q-17-2, Tomah), (9) N-tetradecyl dimethylnaphthyl methyl ammonium chloride (BTC 1100, Onyx), (10) octadecyl diethanol methyl ammonium chloride (M-Quat 32, Mazer Chemicals), (11) octadecyl dihydroxyethyl methyl ammonium chloride (Tomah Q-18-2, Tomah), (12) dihydrogenated tallow benzyl methyl ammonium chloride (Variquat B 343, Sherex Chemicals), (13) 2-aminoethyl trimethyl ammonium chloride hydrochloride (Aldrich 28,455-6), (14) 2-bromoethyl trimethyl ammonium bromide (Aldrich 11,719-6), (15) 2-chloroethyl trimethyl ammonium chloride (Aldrich 23,443-5), (16) 3-carboxypropyl trimethyl ammonium chloride (Aldrich 23,443-5), (17) [3-(methacryloyl amino)propyl]trimethyl ammonium chloride (Aldrich 28,065-8), of the formula

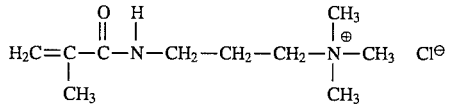

(18) phenyl trimethyl ammonium bromide (Aldrich 13,532-1), (19) phenyl trimethyl ammonium chloride (Aldrich 19,916-8), (20) phenyl trimethyl ammonium iodide (Aldrich 13,914-9), (21) benzyl trimethyl ammonium chloride (Aldrich 22,557-6, Hipochem Migrator J from High Point Chemical Corporation, Variquat B200 from Sherex Chemicals), (22) benzyl trimethyl ammonium bromide (Aldrich 14,711-7), (23) 4-nitrobenzyl trimethyl ammonium chloride (Aldrich 29,369-5), (24) [2-(4-nitrophenyl)allyl] trimethyl ammonium iodide (Aldrich 30,217-1), of the formula

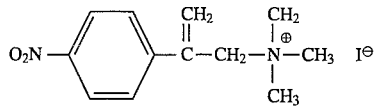

(25) coco trimethyl ammonium chloride (Arquad C-33, C-33W, C-50 from Akzo Chemie, Noramium MC-50 from Diamond Shamrock, Jet Quat C-50 from Jetco Chemicals, Quartamin CPR from Kao Corporation), (26) palmityl trimethyl ammonium chloride (Adogen 444 from Sherex Chemicals), (27) myristyl trimethyl ammonium bromide (Aldrich 86,042-5) (Cetrimide BP Triple Crown America), (28) oleyl trimethyl ammonium chloride (Noramium MO-50 from Diamond Shamrock), (29) soya trimethyl ammonium chloride (Arquad S-20 Akzo Chemie, Jet Quat S-2C-50 Jetco Chemicals, Tomah Q-S from Tomah), (30) tallow trimethyl ammonium chloride (Arquad T-S0, T-27W Akzo Chemie, Jet Quat T-50 Jetco Chemicals, Quartamin TPR from Kao Corp, Radiaquat 6471 from Oleofina S. A., Adogen 471 from Sherex Chemicals, Querton BGCL50 from Kenobel), (31) hydrogenated tallow trimethyl ammonium chloride (Noramium MSH-50 from Diamond Shamrock, Quartamin HTPR from Kao Corp, Adogen 441 from Sherex Chemicals), (32) stearyl trimethyl ammonium chloride (Arquad 18–50 from Akzo Chemie), (33) behenyl trimethyl ammonium chloride (Incroquat TMC/P, Croda Universal Inc.), (34) guar hydroxypropyl trimethyl ammonium chloride (C-261 from Henkel), (35) benzyl triethyl ammonium chloride (Aldrich 14,655-2), (36) benzyl triethyl ammonium bromide (Aldrich 14,712), (37) butyl tripropyl ammonium bromide (Aldrich 28038-0), (38) methyl tributyl ammonium chloride (Aldrich 25,516-5), (39) methyl tributyl ammonium bromide (Fluka 90802), (40) methyl tributyl ammonium iodide (Fluka 90804), (41) benzyl tributyl ammonium chloride (Aldrich 19,377-1), (42) benzyl tributyl ammonium bromide (Aldrich 24,378-7), (43) benzyl tributyl ammonium iodide (Aldrich 29,301-6), (44) heptyl tributyl ammonium bromide (Fluka 90797), and the like; (C) dialkyl dialkyl ammonium salts, such as (1) benzyldodecyldimethylammonium bromide (Aldrich 28,088-7), of the formula $C_6H_5CH_2N[(CH_2)_{11}CH_3](CH_3)_2Br$, (2) benzyltetradecyldimethylammonium chloride dihydrate (Aldrich 29,279-6), of the formula $C_6H_5CH_2N[(CH_2)_{13}CH_3](CH_3)_2Cl{\bullet}2H_2O$, (3) benzylcetyldimethylammonium chloride monohydrate (Aldrich 22,900-8), of the formula $C_6H_5CH_2N[(CH_2)_{15}CH_3](CH_3)_2Cl{\bullet}H_2O$, (4) benzylstearyldimethylammonium chloride monohydrate (Aldrich 22,901-6), of the formula $C_6H_5CH_2N[(CH_2)_{17}CH_3](CH_3)_2Cl{\bullet}H_2O$, (5) N,N-dimethyl methylene ammonium chloride (Aldrich 32,449-3), (6) N,N-dimethyl methylene ammonium iodide (Aldrich 21,491-4), (7) chloromethylene dimethyl ammonium chloride (Aldrich 28,090-9), (8) dichloromethylene dimethyl ammonium chloride (Aldrich 16,287-6), (9) dimethyl amino methylene amino methylene dimethyl ammonium chloride (Golds Reagent Aldrich 28,907-8), of the formula

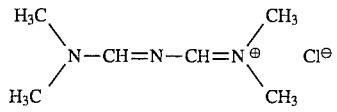

(10) benzethonium chloride (Aldrich B470-8), of the formula

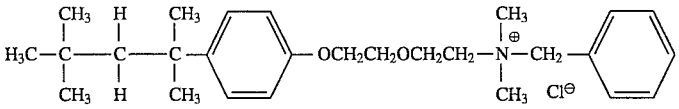

(11) methyl benzethoniumchloride (Aldrich 28,659), of the formula

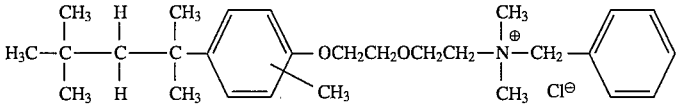

(12) 1-propanaminium 2,3-dihydroxy-N-dimethyl-N-[3(oxococoyl)amino] propyl]-chloride (Lexquat AMG-WC from Inolex Chemical Corporation), (13) cetyl dimethyl ethyl ammonium bromide (Aldrich 22,899-0), (14) octyl dodecyl dimethyl ammonium chloride (BTC812 from Onyx), (15) dodecyl (2-hydroxy-1-methyl-2-phenyl-ethyl)dimethyl ammonium bromide (also called N-dodecyl N-methyl ephedrinium bromide, Aldrich 23,540-7), of the formula

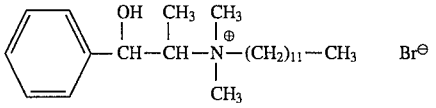

(16) dodecyl dimethyl 2-phenoxyethyl ammonium bromide (domiphen bromide Aldrich 24,748-0), of the formula

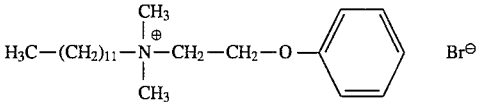

(17) dodecanoyl-N-methylamino ethyl-(phenyl carbamyl methyl) dimethyl ammonium chloride (Desogen from Ciba Geigy PLC), (18) 3-chloro-2-hydroxypropyl N,N,N-dimethyl dodecyl ammonium chloride, such as Quab 342 from Degussa, of the formula

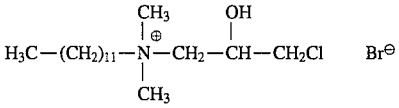

(19) 3-chloro-2-hydroxypropyl N,N,N-dimethyl octadecyl ammonium chloride, such as Quab 426 from Degussa, (20) dodecyl benzyl dimethyl ammonium bromide (Aldrich 28,088-7), (21) dodecyl benzyl dimethyl ammonium chloride (Loraquat B50 Dutton and Reinisch Ltd., Retartder N from Hart Chemicals), (22) coco benzyl dimethyl ammonium chloride (Merpiquat K-8-2 from Kempen, Nissan cation $F_2$-10R, $F_2$-20R, $F_2$-40E, $F_2$-50 from Nippon oils and Fats, Querton KKBCL from Lilachim), (23) benzyl tetradecyl dimethyl ammonium chloride (Arquad DM 14B-90 from Akzo Chemie, Variquat 50ME, 80ME from Sherex Chemicals, Cyncal Hilton-Davis Chemicals, 29,279-6 Aldrich), (24) benzyl cetyl dimethyl ammonium chloride (Querton 16BCL from Lilachim, Aldrich 22,90 0-8), (25) benzyl octadecyl dimethyl ammonium chloride (also called benzyl stearyl dimethyl ammonium chloride, Arquad DM 18B-90 Akzo Chemie, Varisoft 6112 from Sherex Chemicals, Nissan Cation $S_2$-100 from Nippon Oils and Fats, Carsosoft SDQ-25, SDQ-85 from Lonza inc, 22,901-6 Aldrich), (26) benzyl tallow dimethyl ammonium chloride (Kemamine BQ-9742C from Witco Chemicals and Noramium S-75 from Diamond Shamrock), (27) benzyl hydrogenated tallow dimethyl ammonium chloride (Arquad DMHTB-75 from Akzo Chemie, Kemamine BQ-9702C from Witco Chemicals, Querton 441-BC, HBG BCL from Kenobel), (28) benzyl behenyl dimethyl ammonium chloride (Incroquat behenyl BDQ/P from Croda Universal Inc., Kemamine Q-2802-C from Witco Chemicals), (29) dioctyl dimethyl ammonium chloride (Querton 28CL from Lilachim), (30) didecyl dimethyl ammonium chloride (Bio-Dac from Bio-Lab Inc., Querton 210 CL from Lilachim, Bardac 2250 from Lonza Inc., BTC 1010 from Onyx Chemicals), (31) didecyl dimethyl ammonium bromide (Aldrich 29,801-8), (32) dicoco dimethyl ammonium chloride (Accoquat 2C-75, Armstrong Chemical Co. Ltd., Kemamine Q-6503C, Witco, Jet Quat 2C-75, Jetco Chemicals, M-Quat 2475, Mazer, Quartamine DCP, Kao Corp., Arquad 2C-75, Akzo Chemie, Radiaquat 6462, Oleofina S. A., Variquat K300, Sherex Chemicals, Adogen 462, Sherex Chemicals), (33) dicetyl dimethyl ammonium chloride (Adogen 432CG, Sherex Chemicals), (34) disoya dimethyl ammonium chloride (Arquad 2S-75 from Akzo Chemie), (35) ditallow dimethyl ammonium chloride (Adogen 470, Sherex Chemicals), (36) dihydrogenated tallow dimethyl ammonium chloride (Arquad 2HT-75, Akzo Chemie, Kemamine Q-9702C, Witco, Carsosoft V-90, V-100, Lonza Inc., Adogen 442, Sherex Chemicals, Varisoft 3262,Varisoft DHT, Sherex Chemicals, Radiaquat 6442, Oleofina S. A., Jet Quat 2HT-75, Jetco Chemicals, Accosoft 707, Stepan), (37) dibehenyl/diarachidyl dimethyl ammonium chloride (Kemamine Q -1902C, 1302C from Witco Chemicals), (38) soya amido propyl benzyl dimethyl ammonium chloride (Schercoquat, SOAB, Scher Chemicals), of the formula

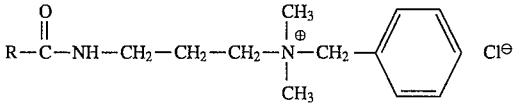

R =soya

(39) soya dicoco quaternary ammonium chloride (Jet Quat S-2C-50, Jetco Chemicals), (40)gluconamidopropyl dimethyl-2-hydroxyethyl ammonium chloride (Quaternium 22, Ceraphyl 60, Van Dyk), of the formula

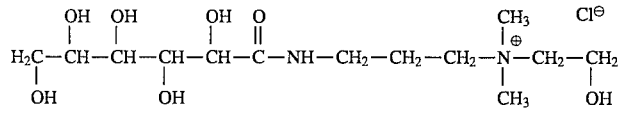

(41) N-alkyl-N-N-dimethyl-N(dodecyl acetate) ammonium chloride, wherein alkyl has from 14 to 20 carbon atoms (Schercoquat ALA, Scher Chemicals), (42) mink amidopropyl dimethyl-2-hydroxyethyl ammonium chloride (Quaternium 26, Ceraphyl 65, Van Dyk), of the formula

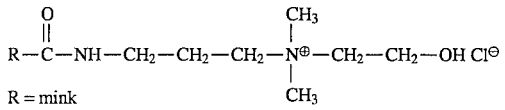

(43) N-rapeseed-(3-amidopropyl)-N-N-dimethyl-N-(2,3 epoxy propyl) ammonium chloride (Schercoquat ROEP, Scher Chemicals), of the formula

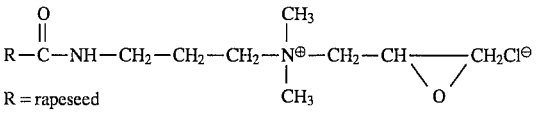

(44) N-stearyl-(3-amido propyl)-N-benzyl dimethyl ammonium chloride (Schercoquat SAB, Scher Chemicals), (45) rapeseed amido propyl benzyl dimethyl ammonium chloride, (Schercoquat ROAB, Scher Chemicals), (46) rapeseed amido propyl ethyl dimethyl ammonium chloride (Schercoquat ROAS, Scher Chemicals), of the formula

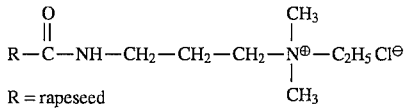

(47) cocamidopropyl polyethylene glycol dimethyl ammonium chloride phosphate (Monaquat P-TC from Mona Industries), and the like; (D) choline salts, such as butyrylcholine chloride (Aldrich 85,537-5), of the formula $CH_3CH_2CH_2COOCH_2CH_2N(CH_3)_3Cl$, and the like.

Any other transparentizing agent suitable for the selected migration marking material(s) can also be employed, as well as mixtures thereof.

Figure 4:
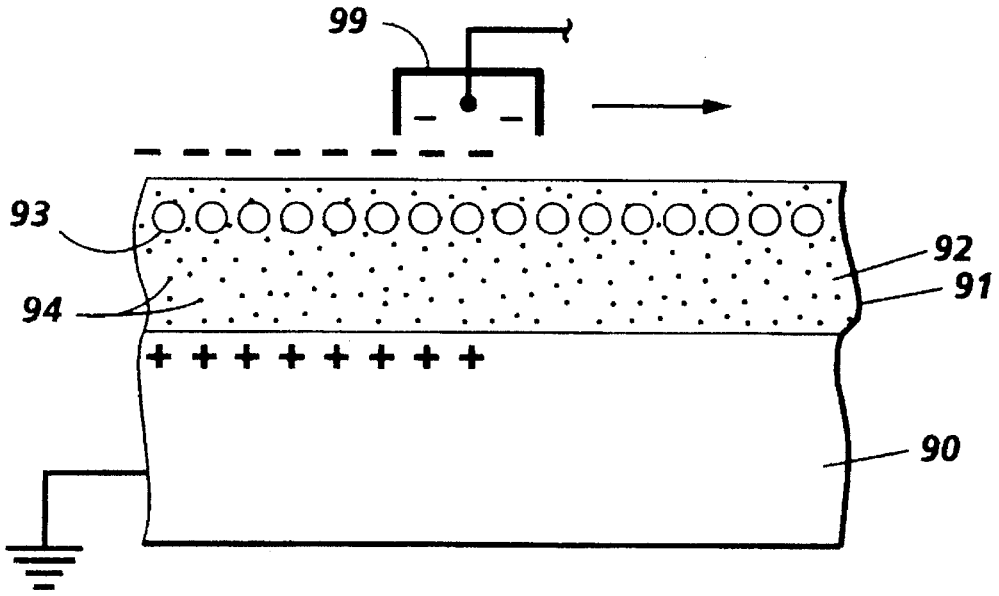
FIGS. 4 through 9 illustrate schematically a process for imaging and developing a migration imaging member according to the present invention.

The process of the present invention proceeds as illustrated schematically in FIGS. 4 through 12. FIGS. 4, 5, 6, 7, 8, 9, 10, 11, and 12 illustrate schematically a migration imaging member comprising a conductive substrate layer 90 that is connected to a reference potential such as a ground, and a softenable layer 91 comprising softenable material 92, migration marking material 93, and optional charge transport material 94. As illustrated schematically in FIG. 4, the member is uniformly charged in the dark to either polarity (negative charging is illustrated in FIG. 4) by a charging means 99 such as a corona charging apparatus.

Figure 5:
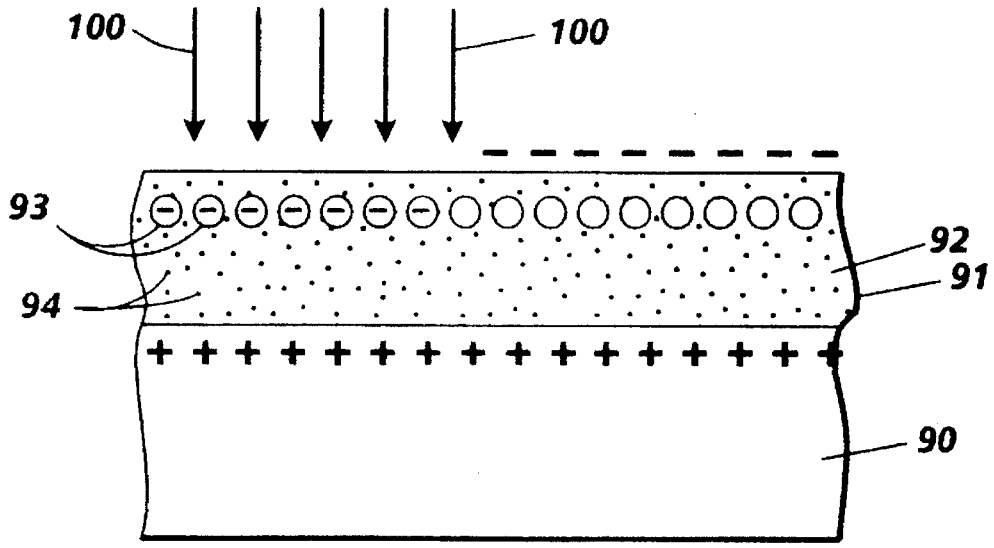

As illustrated schematically in FIG. 5, the charged member is then exposed imagewise to radiation 100 at a wavelength to which the migration marking material 93 is sensitive. For example, when the migration marking material is selenium particles, blue or green light can be used for imagewise exposure. Substantial photodischarge then occurs in the exposed areas.

Figure 6:
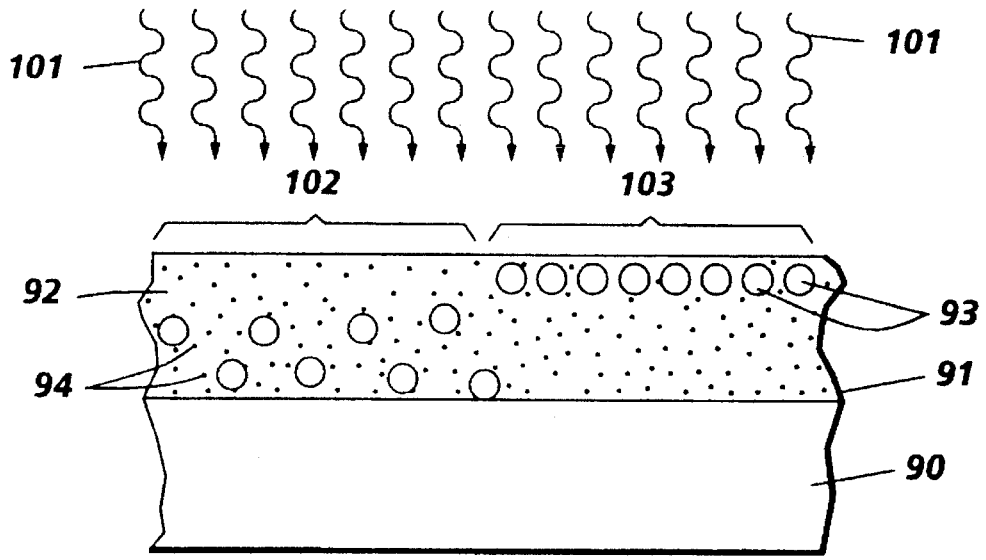

As illustrated schematically in FIG. 6, subsequent to formation of a charge image pattern, the imaging member is developed by causing the softenable material to soften by any suitable means (in FIG. 6, by uniform application of heat energy 101 to the member). Application of heat in the illustrated manner causes softenable material 92 to soften, thereby enabling migration marking material 93 to migrate through softenable material 92 toward substrate 90. The heat development temperature and time depend upon factors such as the melt viscosity of the softenable layer, thickness of the softenable layer, the amount of heat energy, and the like. For example, at a temperature of 110° C. to about 130° C., heat need only be applied for a few seconds. For lower temperatures, more heating time can be required. When the heat is applied, the softenable material decreases in viscosity, thereby decreasing its resistance to migration of the marking material 93 through the softenable layer 91. As shown in FIG. 6, in areas 102 of the imaging member, wherein the migration marking material has a substantial net charge, upon softening of the softenable layer 91, the net charge causes the charged marking material to migrate in image configuration towards the conductive layer 90 and disperse in the softenable layer 91, resulting in a $D_{min}$ area. The uncharged migration marking particles in areas 103 of the imaging member remain essentially neutral and uncharged. Thus, in the absence of migration force, the unexposed migration marking particles remain substantially in their original position in softenable layer 91, resulting in a $D_{max}$ area.

If desired, solvent vapor development can be substituted for heat development. Vapor development of migration imaging members is well known in the art. Generally, if solvent vapor softening is utilized, the solvent vapor exposure time depends upon factors such as the solubility of the softenable layers in the solvent, the type of solvent vapor, the ambient temperature, the concentration of the solvent vapors, and the like.

The application of either heat, or solvent vapors, or combinations thereof, or any other suitable means should be sufficient to decrease the resistance of the softenable material of softenable layer 91 to allow migration of the migration marking material 93 through softenable layer 91 in imagewise configuration. With heat development, satisfactory results can be achieved by heating the imaging member to a temperature of about 100° C. to about 130° C. for only a few seconds when the unovercoated softenable layer contains an 80/20 mole percent copolymer of styrene and hexylmethacrylate having an intrinsic viscosity of 0.179 dl/gm and N,N'-diphenyl-N,N'-bis(3"-methylphenyl)-(1,1'-biphenyl)-4,4'-diamine. The test for a satisfactory combination of time and temperature is to maximize optical contrast density and electrostatic contrast potential for xeroprinting. With vapor development, satisfactory results can be achieved by exposing the imaging member to the vapor of toluene for between about 4 seconds and about 60 seconds at a solvent vapor partial pressure of between about 5 millimeters and 30 millimeters of mercury when the unovercoated softenable layer contains an 80/20 mole percent copolymer of styrene and hexylmethacrylate having an intrinsic viscosity of 0.179 dl/gm and N,N'-diphenyl-N,N'-bis(3"-methylphenyl)-(1,1'-biphenyl)-4,4'-diamine.

Thereafter, transparentizing agent 105 is applied to the surface of softenable layer 91. Migration marking material 93 in unmigrated areas 103 remains at or near the surface of softenable layer 91 and thus comes into contact with transparentizing agent 105, while migration marking material 93 in migrated areas 102 has migrated towards the conductive layer 90 and dispersed within softenable layer 91, and thus does not come into contact with transparentizing agent 105. As illustrated schematically in FIG. 7, transparentizing agent 105 can be dissolved or dispersed in a solvent, if the material itself is a solid and not a liquid, and applied to the surface of softenable layer 91 with an applicator 107 (which can be any suitable applicator, such as a gravure roller, a porous roll, a squeegee applicator, a painting member, a dabbing or wiping member, or the like. If transparentizing agent 105 is a liquid, it can be applied directly from applicator 107.

Figure 8:
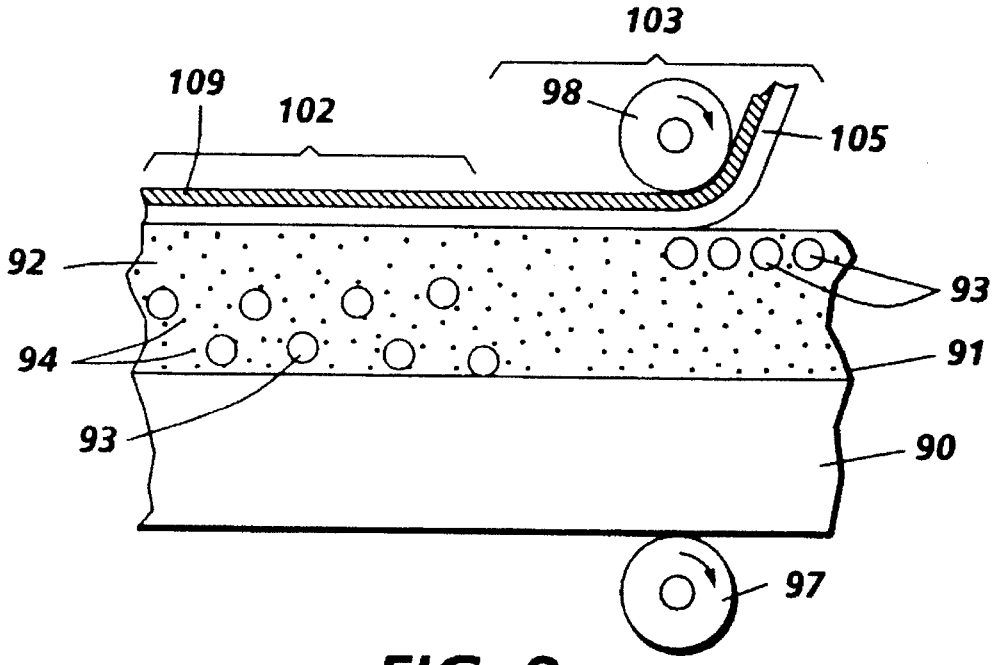

Alternatively, as illustrated schematically in FIG. 8, transparentizing agent 105 can be coated onto base sheet 109, followed by contacting base sheet 109 with the surface of softenable layer 91 and applying heat and/or pressure. Specifically, as illustrated schematically in FIG. 8, base sheet 109 coated with transparentizing agent 105 (which can, if desired, be dispersed within an optional binder)is placed in intimate contact with softenable layer 91 of the migration imaging member and the "sandwich" created by laying base sheet 109 onto the imaging member is passed through a nip created by roller 97 and roller 98. In a preferred embodiment, roller 98 which contacts base sheet 109 is heated, although either or both of the rollers 97 and 98 can be heated if desired. Rollers 97 and 98 are situated with respect to each other so as to form a nip, such that pressure is applied to softenable layer 91 and base sheet while they are in intimate contact with each other. Application of heat and pressure in the illustrated manner causes softenable material 92 and/or the optional binder on base sheet 109 to soften, thereby enabling unmigrated migration marking material 93 in areas 103 of the migration imaging member to come into contact with transparentizing agent 105. The temperature and time depend upon factors such as the melt viscosity of the softenable layer and/or binder, thickness of the softenable layer and/or binder layer, the amount of heat energy, and the like. For example, at a temperature of 110° C. to about 130° C., heat need only be applied for a few seconds. For lower temperatures, more heating time can be required. Preferred temperatures for rollers 97 and/or 98 typically are from about 50° to about 130° C., and more preferably from about 80° to about 130° C., although the temperature can be outside these ranges. Preferred pressures within the nip between rollers 97 and 98 typically are from about 0.5 to about 5 pounds per square inch, although the pressure can be outside this range.

Figure 7:
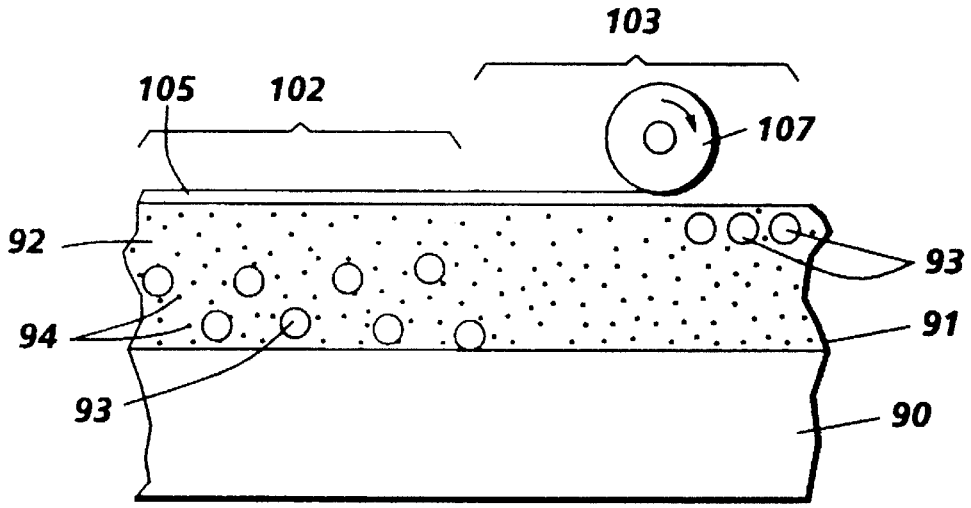
Figure 9:
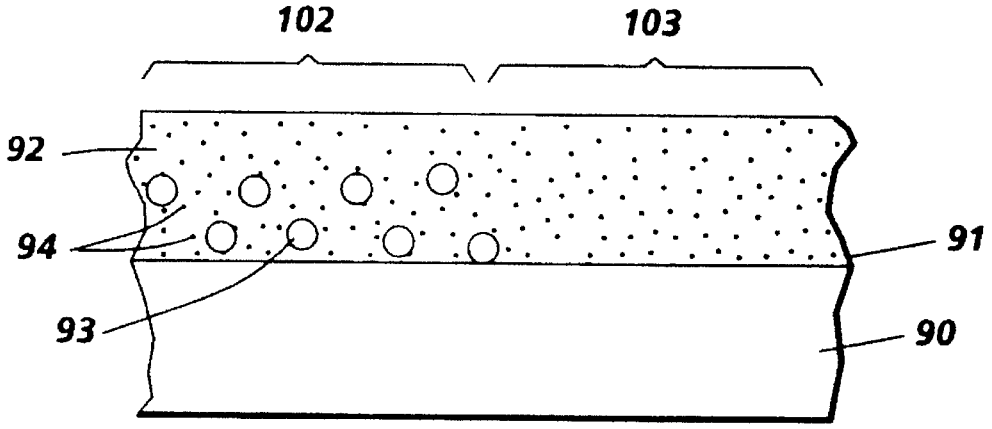

Subsequent to contacting unmigrated migration marking material 93 in areas 103 of the imaging member with transparentizing agent 105 as illustrated in FIG. 7 or FIG. 8, unmigrated migration marking material 93 in areas 103 of the imaging member becomes effectively transparentized, resulting in an imaged migration imaging member as illustrated in FIG. 9, in which the former $D_{min}$ areas (areas 102 of the imaging member) have become $D_{max}$ areas and the former $D_{max}$ areas (areas 103) have become $D_{min}$ areas, as illustrated schematically in FIG. 9.

Figure 10:
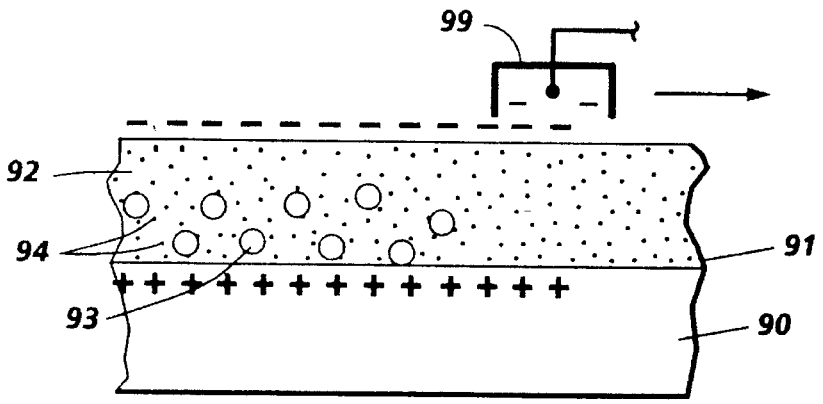
FIGS. 10 through 12 illustrate schematically optional further process steps for maximizing the optical contrast density of the developed member according to the present invention.
Figure 11:
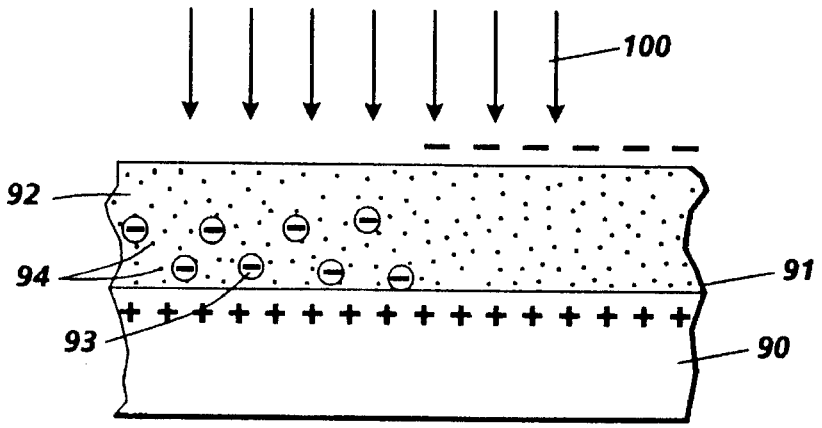
Figure 12:
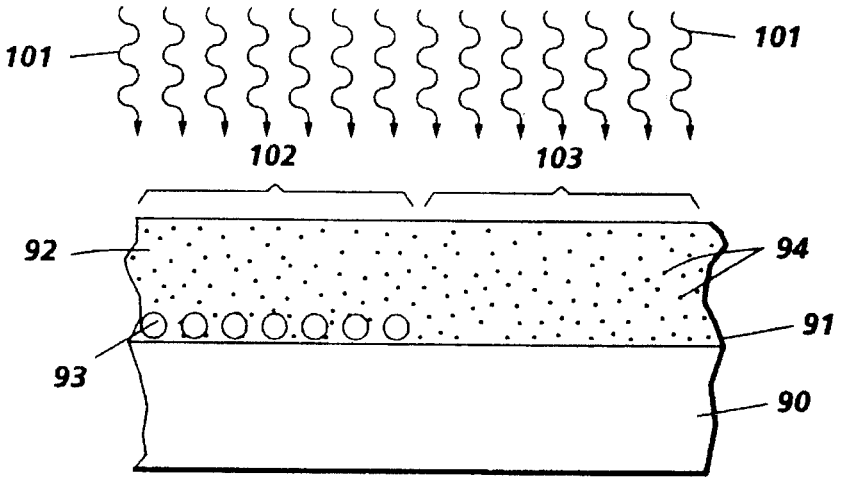

Optionally, as illustrated schematically in FIGS. 10, 11, and 12, the optical contrast density of the imaged member can be further improved. Any residual transparentizing agent, solvent, and/or binder is cleaned from the surface of softenable layer 91, followed by uniformly charging the imaging member in the dark to either polarity (negative charging is illustrated in FIG. 10) by a charging means 99 such as a corona charging apparatus, as illustrated schematically in FIG. 10.

Thereafter, as illustrated schematically in FIG. 11, the charged member is then uniformly exposed imagewise to radiation 100 at a wavelength to which the migration marking material 93 is sensitive. For example, when the migration marking material is selenium particles, blue or green light can be used for imagewise exposure. Substantial photodischarge then occurs in the exposed areas.

As illustrated schematically in FIG. 12, subsequent to uniform exposure, the softenable material is once again caused to soften by any suitable means (in FIG. 12, by uniform application of heat energy 101 to the member). Application of heat in the illustrated manner causes softenable material 92 to soften, thereby enabling migration marking material 93 in areas 102 of the imaging member to migrate further through softenable material 92 toward substrate 90. Thereafter, the migration marking particles 93 collect near substrate 90, resulting in a $D_{max}$ which approaches or matches that of the original unimaged member, while the $D_{min}$ areas exhibit little or no optical density attributable to migration marking material.

The imaging member illustrated in FIGS. 4, 5, 6, 7, 8, 9, 10, 11, and 12 is shown without any optional layers such as those illustrated in FIGS. 1, 2, and 3. If desired, alternative imaging member embodiments, such as those employing any or all of the optional layers illustrated in FIGS. 1, 2, and 3, can also be employed.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

Migration imaging members were prepared as follows. A solution for the softenable layer was prepared by dissolving about 84 parts by weight of a terpolymer of styrene/ethylacrylate/acrylic acid (prepared as disclosed in U.S. Pat. No. 4,853,307, the disclosure of which is totally incorporated herein by reference) and about 16 parts by weight of N,N'-diphenyl-N,N'-bis(3"-methylphenyl)-(1,1'-biphenyl)-4,4'-diamine (prepared as disclosed in U.S. Pat. No. 4,265,990, the disclosure of which is totally incorporated herein by reference) in about 450 parts by weight of toluene. N,N'-diphenyl-N,N'-bis(3"-methylphenyl)-(1,1'-biphenyl)-4,4'-diamine is a charge transport material capable of transporting positive charges (holes). The resulting solution was coated by a solvent extrusion technique onto 3 mil thick polyester substrates (Melinex 442, obtained from Imperial Chemical Industries (ICI), aluminized to 50 percent light transmission), and the deposited softenable layers were allowed to dry at about 115° C. for about 2 minutes, resulting in dried softenable layers with thicknesses of about 4 microns. The temperature of the softenable layers was then raised to about 115° C. to lower the viscosity of the exposed surfaces of the softenable layers to about $5\times10^3$ poises in preparation for the deposition of marking material. Thin layers of particulate vitreous selenium were then applied by vacuum deposition in a vacuum chamber maintained at a vacuum of about $4\times10^{-4}$ Torr. The imaging members were then rapidly chilled to room temperature. Reddish monolayers of selenium particles having an average diameter of about 0.3 micron embedded about 0.05 to 0.1 micron below the surfaces of the copolymer layers were formed.

Separate sheets of polyester 100 microns thick were solvent coated from solutions of toluene containing about 10 percent by weight solids with blends of various transparentizing agents as indicated in the tables below with a styrene/ethyl acrylate/acrylic acid binder (obtained from Scientific Polymer Products, #815) to form coating layers about 4 microns thick. The weight ratio of transparentizing agent to binder was 1:4 in each instance. All of the transparentizing agents were obtained from Aldrich Chemicals, Milwaukee, Wis. The coated sheets were dried at 25° C. for 1 hour. Thereafter, the coated surfaces of the polyester sheets were placed in intimate contact with the surfaces of the migration imaging members coated with the softenable material and the migration marking material, and the "sandwiches" thus formed were subjected to temperatures of 100° C. for 1 minute, at which temperature the softenable layer was softened sufficiently to enable contact between the embedded selenium particles and the transparentizing agents while the softenable material was in a molten state. The polyester sheets coated with the transparentizing agents were then separated from the migration imaging members and the UV absorption spectra at 685 nm of the migration imaging members were measured to determine the extent of migration marking material transparentization. UV absorption spectra were measured with a Shimadzu UV-160 spectrometer; all spectra were recorded by using 50% transmission aluminized ICI 442 polyester as a reference. The optical densities of the migration imaging members were also measured with a Macbeth $TR_{927}$ densitometer in the visible, ultraviolet, and infrared range, using a Wratten No. 47 filter for the blue measurements, a Wratten No. 18A filter for the UV measurements, and a Wratten No. 25 filter for the IR measurements. For comparison purposes, the UV absorption spectrum at 685 nm and the optical density of the migration imaging members prior to contact with the sheet coated with transparentizing agent were also measured. The results were as follows:

| Agent | UV absorption | Optical Density vis. | UV | IR |
|---|---|---|---|---|
| none | 1.50 | 1.82 | 2.65 | 0.89 |
| piperidine thiocyanate | 0.00 | 0.40 | 1.30 | 0.70 |
| 2-piperidine methanol | 0.50 | 0.65 | 0.50 | 0.36 |
| bis(pentamethylene) urea | 0.00 | 0.27 | 0.60 | 0.35 |
| 4,4'-trimethylene bis(1-piperidine propionitrile) | 0.00 | 0.25 | 0.60 | 0.50 |
| tripiperidino phosphine oxide | 0.00 | 0.24 | 0.55 | 0.35 |
| homopiperazine | 0.00 | 0.30 | 0.55 | 0.32 |
| 1-piperonyl piperazine | 0.00 | 0.28 | 1.09 | 0.30 |
| hexacyclentrisulfate | 0.50 | 0.60 | 1.20 | 0.70 |
| 5,10,15,20-tetraphenyl-21H,23H porphine | 0.40 | 1.00 | 1.50 | 0.80 |
| 5,10,15,20-tetrakis(4-methoxyphenyl)-2H,23H-porphine | 0.70 | 1.00 | 1.50 | 1.10 |
| pyrrole-2-carboxaldehyde | 0.00 | 0.28 | 0.76 | 0.35 |
| 3-pyrrolidino-1,2-propanediol | 0.00 | 0.25 | 0.95 | 0.31 |
| pyrazole | 0.50 | 0.38 | 0.79 | 0.45 |
| 3-aminopyrazole | 0.10 | 0.41 | 1.00 | 0.50 |
| imidazole | 1.00 | 0.60 | 1.10 | 0.60 |
| 2-ethylimidazole | 0.00 | 0.35 | 0.55 | 0.38 |
| 2-(2-piperidinoethyl)pyridine | 0.00 | 0.25 | 0.75 | 0.28 |
| 1-dodecyl pyridinium chloride | 0.00 | 0.32 | 0.83 | 0.27 |
| pyridinium bromide perbromide | 0.00 | 0.11 | 0.90 | 0.19 |
| 3-aminoquinoline | 0.20 | 0.45 | 0.97 | 0.48 |
| 8-hydroxyquinoline | 0.40 | 0.40 | 0.85 | 0.50 |
| 8-hydroxyquinaldine | 0.10 | 0.40 | 0.72 | 0.55 |
| quinoxaline | 0.00 | 0.30 | 0.57 | 0.37 |
| 4,5-dihydro-6-methyl-3(2H)-pyridazinone monohydrate | 1.00 | 0.80 | 1.50 | 0.70 |
| phthalazine | 0.50 | 0.45 | 0.97 | 0.48 |
| 1,10-phenanthroline | 0.20 | 0.41 | 1.30 | 0.45 |

-continued

| Agent | UV absorption | Optical Density vis. | UV | IR |
|---|---|---|---|---|
| 1,3,5-triazine | 0.00 | 0.50 | 0.97 | 0.52 |
| trichloromelamine | 0.00 | 0.15 | 0.57 | 0.09 |
| trichloroisocyanouric acid | 0.00 | 0.11 | 0.55 | 0.08 |
| norbornane | 0.05 | 0.34 | 0.85 | 0.44 |
| tricyclo[5.2.1.0] decane | 0.00 | 0.26 | 0.53 | 0.35 |
| norcamphor | 0.00 | 0.37 | 0.51 | 0.39 |
| tropolone | 0.00 | 0.28 | 3.55 | 0.08 |
| 1-indanol | 0.00 | 0.20 | 0.40 | 0.33 |
| trans,trans,cis-1,5,9-cyclododecatriene | 0.00 | 0.23 | 0.80 | 0.30 |
| cyclodecane epoxide | 0.00 | 0.26 | 0.50 | 0.33 |
| 2,3-cyclododecane pyridine | 0.50 | 0.71 | 0.50 | 0.33 |
| 1,2,5,6,9,10-hexabromo-cyclododecane | 0.00 | 0.35 | 0.85 | 0.35 |
| 1,4,4a,8a-tetrahydro-endo-1,4-methano-naphthalene-5,8-dione | 0.10 | 0.39 | 1.41 | 0.43 |
| γ-butyrolactone | 0.00 | 0.62 | 0.94 | 0.63 |
| β,β-dimethyl-γ-(hydroxymethyl)-γ-butyrolactone | 0.30 | 0.42 | 1.20 | 0.50 |
| 2,5-dimethyl-4-hydroxy-3(2H)-furanone | 0.00 | 0.28 | 0.65 | 0.35 |
| hydrindantin dihydrate | 0.33 | 0.60 | 1.00 | 0.65 |
| 2,4,8,10-tetraoxaspiro [5.5] undecane | 0.00 | 0.27 | 0.65 | 0.35 |
| 1,3,5-trioxane | 0.00 | 0.26 | 0.50 | 0.35 |
| cyclooctanone | 0.00 | 0.27 | 0.48 | 0.33 |
| piperonal | 0.00 | 0.25 | 0.90 | 0.28 |
| piperonylalcohol | 0.00 | 0.31 | 0.88 | 0.40 |
| piperonyl nitrite | 0.00 | 0.25 | 0.40 | 0.35 |
| 3,4(methylenedioxy) phenylacetonitrile | 0.10 | 0.40 | 0.75 | 0.40 |
| maleic anhydride | 0.00 | 0.27 | 0.65 | 0.35 |
| 5-acetylmercapto succinic anhydride | 0.00 | 0.30 | 0.48 | 0.38 |
| 2-octadecen-1-yl succinic anhydride | 0.00 | 0.28 | 0.55 | 0.35 |
| 18-crown-6 | 0.00 | 0.30 | 0.60 | 0.35 |
| benzo-18 crown-6 | 0.16 | 0.41 | 1.00 | 0.60 |
| dibenzo-18 crown-6 | 0.60 | 0.60 | 1.20 | 0.65 |
| dibenzo-24 crown-8 | 0.00 | 0.30 | 1.00 | 0.50 |
| 5-amino-3-methyl isooxazole | 0.00 | 0.32 | 0.55 | 0.45 |
| 2-oxazolidone | 0.50 | 0.71 | 0.95 | 0.75 |
| 5,5-dimethyl oxazolidine-2,4-dione | 0.15 | 0.37 | 0.90 | 0.44 |
| 3-ethyl-2-thioxo-4-oxazolidinone | 0.00 | 0.22 | 0.45 | 0.35 |
| 3-morpholino-1,2-propandiol | 0.20 | 0.35 | 0.73 | 0.55 |
| 4-phenyl morpholine | 0.00 | 0.30 | 0.55 | 0.32 |
| N,N'-dibenzyl-1,4,10,13-tetraoxa-7,16 diazacycloocta-decane | 0.00 | 0.26 | 0.70 | 0.30 |
| 4,7,13,16,21,24-hexaoxa-1,10-diazabicyclo[8.8.8] hexacosane | 0.00 | 0.30 | 0.70 | 0.60 |
| γ-valerolactam | 0.20 | 0.46 | 1.15 | 0.51 |
| ε-caprolactam | 0.00 | 0.26 | 0.50 | 0.35 |
| 2-azacyclooctanone | 0.00 | 0.30 | 0.45 | 0.40 |
| 2-azacyclononanone | 0.00 | 0.30 | 0.41 | 0.40 |
| maleimide | 0.00 | 0.35 | 0.70 | 0.35 |
| n-methylsuccinimide | 0.00 | 0.32 | 0.70 | 0.42 |
| phthalimide DBU salt | 0.00 | 1.20 | 0.20 | 0.80 |
| 1-allyl-2-thiourea | 0.00 | 0.52 | 1.00 | 0.55 |
| 1-benzyl-3-methyl-2-thiourea | 0.00 | 0.22 | 1.12 | 0.33 |
| 2-imino-4-thiobiuret | 0.00 | 0.60 | 1.25 | 0.67 |
| butyl sulfone | 0.00 | 0.25 | 0.72 | 0.40 |
| 2,2'-bithiophene | 0.00 | 0.58 | 1.45 | 0.58 |
| 2-phenyl-1,3-dithiane | 0.00 | 0.30 | 0.50 | 0.41 |
| 3,6,9,14-tetrathiabicyclo [9.2.1] tetradeca-11,13-diene | 0.25 | 0.50 | 1.10 | 0.65 |
| 1,5,9,13-tetra-thiacyclohexa-decane-3,11-diol | 0.00 | 0.30 | 0.60 | 0.45 |
| 1,4,7,10,13-penta-thiacyclopenta-decane | 0.60 | 0.70 | 1.50 | 0.70 |
| 2-aminothiazole | 0.10 | 0.30 | 1.60 | 0.45 |
| 2-amino-2-thiazoline | 0.00 | 0.23 | 0.65 | 0.30 |
| 3-methyl rhodanine | 0.20 | 0.50 | 1.85 | 0.33 |
| 3-ethyl-5-(2-hydroxy-ethyl)-4-methylthiazolium bromide | 0.00 | 0.29 | 1.04 | 0.32 |

-continued

| Agent | UV absorption | Optical Density vis. | UV | IR |
|---|---|---|---|---|
| triphenylphosphine | 0.00 | 0.28 | 0.55 | 0.32 |
| tricyclohexylphosphine | 0.20 | 0.25 | 0.68 | 0.35 |
| 1,3-bis (diphenylphosphino) propane | 0.00 | 0.22 | 0.76 | 0.31 |
| 1,5-bis(diphenyl phosphino) pentane | 0.00 | 0.23 | 0.48 | 0.30 |
| isopropyldiphenyl phosphine | 0.10 | 0.23 | 0.55 | 0.30 |
| triethyl phosphite | 0.00 | 0.25 | 0.70 | 0.33 |
| triphenyl phosphite | 0.00 | 0.05 | 0.30 | 0.05 |
| triethyl phosphite copper iodide | 0.20 | 0.28 | 0.46 | 0.25 |
| dipropyl phosphite | 0.00 | 0.05 | 0.12 | 0.05 |
| bis(2-ethylhexyl) phosphite | 0.00 | 0.15 | 0.70 | 0.12 |
| bis(4-nitrobenzyl) phosphite | 0.10 | 0.20 | 1.15 | 0.15 |
| diphenyl phosphine oxide | 0.00 | 0.23 | 0.66 | 0.31 |
| diphenyl(2,4,6-trimethylbenzoyl) phosphine oxide | 0.00 | 0.26 | 3.45 | 0.31 |
| vinyl phosphonic acid | 0.00 | 0.24 | 0.65 | 0.30 |
| cyanoaceto-hydrazide | 0.10 | 0.35 | 0.95 | 0.45 |
| cyanomethyl N,N-dimethyl dithiocarbamate | 0.00 | 0.56 | 1.00 | 0.40 |
| 4'-pentyl-4'-biphenyl carbonitrile | 0.00 | 0.22 | 1.15 | 0.30 |
| 4'-(octyloxy)-4-biphenyl carbonitrile | 0.00 | 0.30 | 0.70 | 0.39 |
| 1,4-dicyano-2-butene | 0.00 | 0.30 | 0.68 | 0.40 |
| benzylidene malononitrile | 0.00 | 0.30 | 1.00 | 0.35 |
| 1-isothiocyanato-4-(trans-4-propylcyclohexyl)benzene | 0.00 | 0.33 | 0.70 | 0.35 |
| formamidoxime | 0.00 | 0.28 | 1.00 | 0.35 |
| ethyl chlorooximido acetate | 0.00 | 0.09 | 0.15 | 0.07 |
| acetohydroxamic acid | 0.00 | 0.25 | 0.50 | 0.35 |
| tetraheptylammonium chloride | 0.00 | 0.25 | 0.80 | 0.32 |
| tetraheptylammonium bromide | 0.00 | 0.30 | 0.75 | 0.30 |

As the data indicate, contact between the migration marking material and the indicated transparentizing agents while the softenable material was in a molten state resulted in transparentization of the migration marking material. The process was repeated except that poly (2-hydroxyethyl methacrylate) (obtained from Scientific Polymer Products, #414) was substituted for the styrene/ethyl acrylate/acrylic acid terpolymer as the binder. Substantially similar results were obtained.

EXAMPLE II

Migration imaging members were prepared as described in Example I. The surfaces of the members thus formed were uniformly negatively charged to a surface potential of −142 Volts with a corona charging device and were subsequently optically exposed by placing test pattern masks comprising silver halide images in contact with the imaging members and exposing the members to blue light of 480 nanometers through the mask for a period of 5 seconds. The imaging members were then developed by heating them with an aluminum heating block in contact with the polyester substrates at temperatures of from about 85° to about 100° C. for about 5 seconds. Images corresponding to the images on the test pattern masks were subsequently visible in the developed imaging members.

The developed migration imaging members were then cut into pieces and pieces containing only $D_{min}$ areas (i.e., areas wherein the selenium particles had migrated in depth through the softenable layer) were placed in intimate contact with polyester sheets coated with a binder and a transparentizing agent and prepared as described in Example I. The UV absorption spectra at 685 nm of the $D_{min}$ areas of the migration imaging members were measured to determine the extent of migration marking material transparentization. UV absorption spectra were measured with a Shimadzu UV-160 spectrometer; all spectra were recorded by using 50% transmission aluminized ICI 442 polyester as a reference. The optical densities of the $D_{min}$ areas of the migration imaging members were also measured with a Macbeth $TR_{927}$ densitometer in the visible, ultraviolet, and infrared range, using a Wratten No. 47 filter for the blue measurements, a Wratten No. 18A filter for the UV measurements, and a Wratten No. 25 filter for the IR measurements. For comparison purposes, the UV absorption spectrum at 685 nm and the optical density of the $D_{min}$ areas of the migration imaging members prior to contact with the sheet coated with transparentizing agent were also measured. The results were as follows:

| Agent | UV absorption | Optical Density vis. | UV | IR |
|---|---|---|---|---|
| none | 1.45 | 0.74 | 1.63 | 0.79 |
| piperidine | 0.00 | 0.25 | 0.85 | 0.35 |
| 2-piperidine methanol | 0.50 | 0.50 | 0.40 | 0.28 |
| bis(pentamethylene) urea | 0.00 | 0.25 | 0.50 | 0.30 |
| 4,4'-trimethylene bis(1-piperidine propionitrile) | 0.00 | 0.20 | 0.50 | 0.40 |
| homopiperazine | 0.00 | 0.25 | 0.50 | 0.28 |
| hexacyclentrisulfate | 0.25 | 0.40 | 0.80 | 0.50 |
| 5,10,15,20-tetraphenyl-21H,23H porphine | 0.25 | 0.50 | 0.78 | 0.50 |
| 3-pyrrolidino-1,2-propanediol | 0.00 | 0.24 | 0.75 | 0.28 |
| 1-dodecyl pyridinium chloride | 0.00 | 0.29 | 0.80 | 0.30 |
| 7,8-benzoquinoline | 0.15 | 0.28 | 0.61 | 0.33 |
| 8-hydroxyquinaldine | 0.05 | 0.26 | 0.74 | 0.35 |
| phthalazine | 0.25 | 0.30 | 0.85 | 0.36 |
| 1,10-phenanthroline | 0.10 | 0.36 | 0.80 | 0.42 |
| 1,3,5-triazine | 0.00 | 0.42 | 0.83 | 0.40 |
| norbornane | 0.05 | 0.30 | 0.80 | 0.45 |
| γ-butyrolactone | 0.00 | 0.45 | 1.01 | 0.52 |
| 1,3,5-trioxane | 0.00 | 0.28 | 0.66 | 0.31 |
| piperonal | 0.00 | 0.29 | 0.65 | 0.35 |
| piperonylalcohol | 0.00 | 0.23 | 0.55 | 0.37 |
| maleic anhydride | 0.00 | 0.28 | 0.73 | 0.34 |
| benzo-18-crown-6 | 0.10 | 0.35 | 0.77 | 0.33 |
| 5-amino-3-methyi isooxazole | 0.00 | 0.28 | 0.57 | 0.40 |
| 3-ethyl-2-thioxo-4-oxazolidinone | 0.00 | 0.26 | 0.85 | 0.31 |
| 3-morpholino-1,2-propandiol | 0.10 | 0.37 | 0.88 | 0.42 |
| 4-phenyl morpholine | 0.00 | 0.26 | 0.65 | 0.32 |
| N,N'-dibenzyl-1,4,10,13-tetraoxa-7,16 diazacyclo-octadecane | 0.00 | 0.24 | 0.65 | 0.30 |
| γ-valerolactam | 0.10 | 0.29 | 0.83 | 0.31 |
| 2-azacyclooctanone | 0.00 | 0.26 | 0.74 | 0.38 |
| 1-allyl-2-thiourea | 0.00 | 0.30 | 0.95 | 0.35 |
| 1,3-dithiane | 0.15 | 0.34 | 0.54 | 0.35 |
| 2-amino-2-thiazoline | 0.00 | 0.23 | 0.90 | 0.30 |
| 3-ethyl-5-(2-hydroxy-ethyl)-4-methylthiazolium bromide | 0.00 | 0.31 | 1.09 | 0.27 |
| triphenylphosphine | 0.00 | 0.31 | 0.87 | 0.29 |
| tricyclohexylphosphine | 0.10 | 0.30 | 0.75 | 0.40 |
| 1,3-bis (diphenyl-phosphino) propane | 0.00 | 0.25 | 0.80 | 0.35 |
| 1,5-bis(diphenyl phosphino) pentane | 0.00 | 0.26 | 0.60 | 0.30 |
| triethyl phosphite copper iodide | 0.10 | 0.35 | 0.50 | 0.33 |
| bis(4-nitrobenzyl) phosphite | 0.10 | 0.25 | 0.80 | 0.30 |
| diphenyl phosphine oxide | 0.00 | 0.24 | 0.71 | 0.35 |
| vinyl phosphonic acid | 0.00 | 0.30 | 0.75 | 0.25 |
| triphenyl phosphate | 0.20 | 0.35 | 0.80 | 0.45 |
| cyanoaceto-hydrazide | 0.10 | 0.30 | 0.92 | 0.42 |
| 1-isothiocyanato-4-(trans-4-propylcyclohexyl)benzene | 0.00 | 0.41 | 0.72 | 0.41 |
| formamidoxime | 0.00 | 0.28 | 1.30 | 0.38 |
| acetohydroxamic acid | 0.00 | 0.23 | 0.77 | 0.30 |
| tetrahexylammonium chloride | 0.40 | 0.34 | 0.90 | 0.41 |
| tetraheptylammonium bromide | 0.00 | 0.27 | 0.75 | 0.30 |

As the data indicate, contact between the migration marking material in the $D_{min}$ areas and the indicated transparentizing agents while the softenable material was in a molten state resulted in transparentization of the migration marking material in the $D_{min}$ areas. The process was repeated except that poly (2-hydroxyethyl methacrylate) (obtained from Scientific Polymer Products, #414) was substituted for the styrene/ethyl acrylate/acrylic acid terpolymer as the binder. Substantially similar results were obtained.

EXAMPLE III

A migration imaging member was prepared as described in Example I and imaged as described in Example II. Thereafter, to the surface of the softenable layer was contacted a solution of heptane containing 2 percent by weight triethylphosphite by pouring the solution onto the surface of the softenable layer. Within 30 seconds, the selenium particles on the top surface of the softenable layer were transparentized, thereby revealing the image comprising the selenium particles which had migrated in depth within the softenable layer (formerly the $D_{min}$ area, now the $D_{max}$ area). The imaging member was then washed with hexane to remove residual triethylphosphite therefrom.

EXAMPLE IV

The process of Example III is repeated with the transparentizing agents employed in Examples I and II. It is believed that results substantially similar to those of Example III will be obtained.

Other embodiments and modifications of the present invention may occur to those skilled in the art subsequent to a review of the information presented herein; these embodiments and modifications, as well as equivalents thereof, are also included within the scope of this invention.

What is claimed is:

1. A process which comprises (a) providing a migration imaging member comprising
  (1) a substrate and
  (2) a softenable layer comprising a softenable material and a photosensitive migration marking material present in the softenable layer as a monolayer of particles situated at or near the surface of the softenable layer spaced from the substrate;

(b) uniformly charging the imaging member;

(c) imagewise exposing the charged imaging member to activating radiation at a wavelength to which the migration marking material is sensitive;

(d) subsequent to step (c), causing the softenable material to soften and enabling a first portion of the migration marking material to migrate through the softenable material toward the substrate in an imagewise pattern while a second portion of the migration marking material remains substantially unmigrated within the softenable layer; and (e) contacting the second portion of the migration marking material with a transparentizing agent which transparentizes migration marking material.

2. A process according to claim 1 wherein subsequent to contacting the second portion of the migration marking material with the transparentizing agent, in the following order:

(a) the migration imaging member is uniformly charged, (b) the migration imaging member is uniformly exposed to activating radiation at a wavelength to which the migration marking material is sensitive, and (c) the softenable material is caused to soften, thereby enabling the first portion of the migration marking material to migrate further through the softenable material toward the substrate.

3. A process according to claim 1 wherein the transparentizing agent is contacted to the second portion of the migration marking material by applying a liquid containing the transparentizing agent to the second portion of the migration marking material.

4. A process according to claim 1 wherein the transparentizing agent is contacted to the second portion of the migration marking material by coating the transparentizing agent onto a base sheet and placing the coated base sheet in intimate contact with the surface of the migration imaging member containing the second migration marking material.

5. A process according to claim 4 wherein heat is applied to the base sheet and the migration imaging member while in intimate contact.

6. A process according to claim 4 wherein pressure is applied to the base sheet and the migration imaging member while in intimate contact.

7. A process according to claim 1 wherein the migration marking material is selected from the group consisting of (a) selenium, (b) tellurium, (c) alloys of selenium and a material selected from the group consisting of tellurium, arsenic, antimony, thallium, bismuth, or mixtures thereof, (d) alloys of tellurium and a material selected from the group consisting of arsenic, antimony, thallium, bismuth, or mixtures thereof, (e) halogen doped selenium, (f) halogen doped tellurium, (g) halogen doped alloys of selenium and a material selected from the group consisting of tellurium, arsenic, antimony, thallium, bismuth, or mixtures thereof, (h) halogen doped alloys of tellurium and a material selected from the group consisting of arsenic, antimony, thallium, bismuth, or mixtures thereof, and (i) mixtures thereof.

8. A process according to claim 1 wherein the migration marking material is selenium.

9. A process according to claim 1 wherein the transparentizing agent is an azacyclic compound.

10. A process according to claim 1 wherein the transparentizing agent is selected from the group consisting of:

(A) materials of the general formulae:

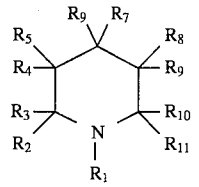

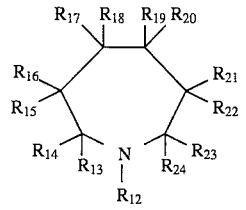

-continued

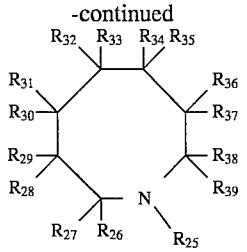

wherein $R_1$, $R_2$, $R_3$, $R_4$, $R_5$, $R_6$, $R_7$, $R_8$, $R_9$, $R_{10}$, $R_{11}$, $R_{12}$, $R_{13}$, $R_{14}$, $R_{15}$, $R_{16}$, $R_{17}$, $R_{18}$, $R_{19}$, $R_{20}$, $R_{21}$, $R_{22}$, $R_{23}$, $R_{24}$, $R_{25}$, $R_{26}$, $R_{27}$, $R_{28}$, $R_{29}$, $R_{30}$, $R_{31}$, $R_{32}$, $R_{33}$, $R_{34}$, $R_{35}$, $R_{36}$, $R_{37}$, $R_{38}$, and $R_{39}$ each, independently of the others, are selected from the group consisting of hydrogen atoms, alkyl groups, substituted alkyl groups, aryl groups, substituted aryl groups, arylalkyl groups, substituted arylalkyl groups, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, and azide groups, wherein two or more of $R_1$, $R_2$, $R_3$, $R_4$, $R_5$, $R_6$, $R_7$, $R_8$, $R_9$, $R_{10}$, $R_{11}$, $R_{12}$, $R_{13}$, $R_{14}$, $R_{15}$, $R_{16}$, $R_{17}$, $R_{18}$, $R_{19}$, $R_{20}$, $R_{21}$, $R_{22}$, $R_{23}$, $R_{24}$, $R_{25}$, $R_{26}$, $R_{27}$, $R_{28}$, $R_{29}$, $R_{30}$, $R_{31}$, $R_{32}$, $R_{33}$, $R_{34}$, $R_{35}$, $R_{36}$, $R_{37}$, $R_{38}$, and $R_{39}$ can be joined together to form a ring;

(B) materials of the general formulae:

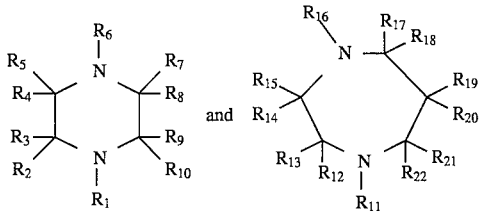

wherein $R_1$, $R_2$, $R_3$, $R_4$, $R_5$, $R_6$, $R_7$, $R_8$, $R_9$, $R_{10}$, $R_{11}$, $R_{12}$, $R_{13}$, $R_{14}$, $R_{15}$, $R_{16}$, $R_{17}$, $R_{18}$, $R_{19}$, $R_{20}$, $R_{21}$, and $R_{22}$ each, independently of the others, are selected from the group consisting of hydrogen atoms, alkyl groups, substituted alkyl groups, aryl groups, substituted aryl groups, arylalkyl groups, substituted arylalkyl groups, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, and azide groups, wherein two or more of $R_1$, $R_2$, $R_3$, $R_4$, $R_5$, $R_6$, $R_7$, $R_8$, $R_9$, $R_{10}$, $R_{11}$, $R_{12}$, $R_{13}$, $R_{14}$, $R_{15}$, $R_{16}$, $R_{17}$, $R_{18}$, $R_{19}$, $R_{20}$, $R_{21}$, and $R_{22}$ can be joined together to form a ring;

(C) materials of the general formulae:

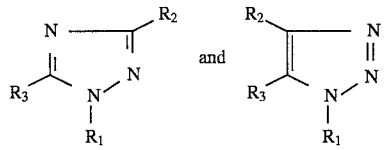

wherein $R_1$, $R_2$, and $R_3$ each, independently of the others, are selected from the group consisting of hydrogen atoms, alkyl groups, substituted alkyl groups, aryl groups, substituted aryl groups, arylalkyl groups, substituted arylalkyl groups, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, and azide groups, wherein two or more of $R_1$, $R_2$, and $R_3$ can be joined together to form a ring;

(D) materials of the general formulae:

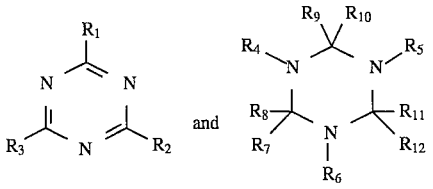

wherein $R_1$, $R_2$, $R_3$, $R_4$, $R_5$, $R_6$, $R_7$, $R_8$, $R_9$, $R_{10}$, $R_{11}$, and $R_{12}$ each, independently of the others, are selected from the group consisting of hydrogen atoms, alkyl groups, substituted alkyl groups, aryl groups, substituted aryl groups, arylalkyl groups, substituted arylalkyl groups, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, and azide groups, wherein two or more of $R_1$, $R_2$, $R_3$, $R_4$, $R_5$, $R_6$, $R_7$, $R_8$, $R_9$, $R_{10}$, $R_{11}$, and $R_{12}$ can be joined together to form a ring;

(E) materials of the general formulae:

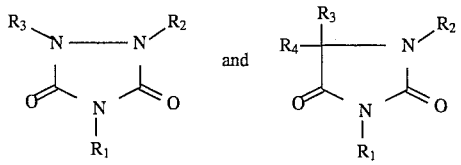

wherein $R_1$, $R_2$, $R_3$, and $R_4$ each, independently of the others, are selected from the group consisting of hydrogen atoms, alkyl groups, substituted alkyl groups, aryl groups, substituted aryl groups, arylalkyl groups, substituted arylalkyl groups, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, and azide groups, wherein two or more of $R_1$, $R_2$, $R_3$, and $R_4$ can be joined together to form a ring;

(F) materials of the general formula:

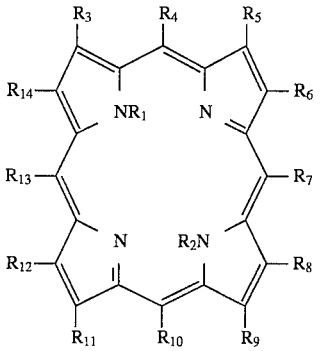

$R_1$, $R_2$, $R_3$, $R_4$, $R_5$, $R_6$, $R_7$, $R_8$, $R_9$, $R_{10}$, $R_{11}$, $R_{12}$, $R_{13}$, and $R_{14}$ each, independently of the others, are selected from the group consisting of hydrogen atoms, alkyl groups, substituted alkyl groups, aryl groups, substituted aryl groups, arylalkyl groups, substituted arylalkyl groups, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, and azide groups, wherein two or more of $R_1$, $R_2$, $R_3$, $R_4$, $R_5$, $R_6$, $R_7$, $R_8$, $R_9$, $R_{10}$, $R_{11}$, $R_{12}$, $R_{13}$, and $R_{14}$ can be joined together to form a ring;

(G) materials of the general formula:

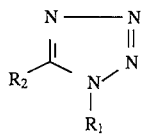

wherein $R_1$ and $R_2$ each, independently of the other, are selected from the group consisting of hydrogen atoms, alkyl groups, substituted alkyl groups, aryl groups, substituted aryl groups, arylalkyl groups, substituted arylalkyl groups, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, and azide groups, wherein $R_1$ and $R_2$ can be joined together to form a ring;

(H) materials of the general formula:

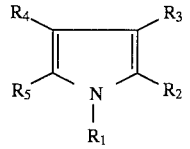

wherein $R_1$, $R_2$, $R_3$, $R_4$, and $R_5$ each, independently of the others, are selected from the group consisting of hydrogen atoms, alkyl groups, substituted alkyl groups, aryl groups, substituted aryl groups, arylalkyl groups, substituted arylalkyl groups, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, and azide groups, wherein two or more of $R_1$, $R_2$, $R_3$, $R_4$, and $R_5$ can be joined together to form a ring;

(I) materials of the general formula:

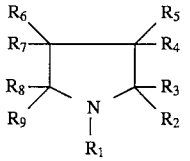

wherein $R_1$, $R_2$, $R_3$, $R_4$, $R_5$, $R_6$, $R_7$, $R_8$, and $R_9$ each, independently of the others, are selected from the group consisting of hydrogen atoms, alkyl groups, substituted alkyl groups, aryl groups, substituted aryl groups, arylalkyl groups, substituted arylalkyl groups, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, and azide groups, wherein two or more of $R_1$, $R_2$, $R_3$, $R_4$, $R_5$, $R_6$, $R_7$, $R_8$, and $R_9$ can be joined together to form a ring;

(J) materials of the general formula:

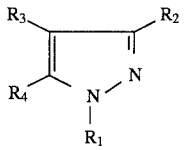

wherein $R_1$, $R_2$, $R_3$, and $R_4$ each, independently of the others, are selected from the group consisting of hydrogen atoms, alkyl groups, substituted alkyl groups, aryl groups, substituted aryl groups, arylalkyl groups, substituted arylalkyl groups, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, and azide groups, wherein two or more of $R_1$, $R_2$, $R_3$, and $R_4$ can be joined together to form a ring;

(K) materials of the general formula:

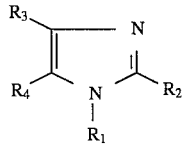

wherein $R_1$, $R_2$, $R_3$, and $R_4$ each, independently of the others, are selected from the group consisting of hydrogen atoms, alkyl groups, substituted alkyl groups, aryl groups, substituted aryl groups, arylalkyl groups, substituted arylalkyl groups, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, and azide groups, wherein two or more of $R_1$, $R_2$, $R_3$, and $R_4$ can be joined together to form a ring;

(L) materials of the general formula:

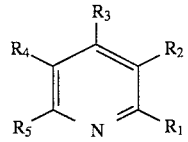

wherein $R_1$, $R_2$, $R_3$, $R_4$, and $R_5$ each, independently of the others, are selected from the group consisting of hydrogen atoms, alkyl groups, substituted alkyl groups, aryl groups, substituted aryl groups, arylalkyl groups, substituted arylalkyl groups, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, and azide groups, wherein two or more of $R_1$, $R_2$, $R_3$, $R_4$, and $R_5$ can be joined together to form a ring;

(M) materials of the general formulae:

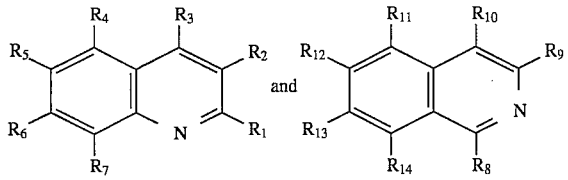

wherein $R_1$, $R_2$, $R_3$, $R_4$, $R_5$, $R_6$, $R_7$, $R_8$, $R_9$, $R_{10}$, $R_{11}$, $R_{12}$, $R_{13}$, and $R_{14}$ each, independently of the others, are selected from the group consisting of hydrogen atoms, alkyl groups, substituted alkyl groups, aryl groups, substituted aryl groups, arylalkyl groups, substituted arylalkyl groups, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, and azide groups, wherein two or more of $R_1$, $R_2$, $R_3$, $R_4$, $R_5$, $R_6$, $R_7$, $R_8$, $R_9$, $R_{10}$, $R_{11}$, $R_{12}$, $R_{13}$, and $R_{14}$ can be joined together to form a ring;

(N) materials of the general formula:

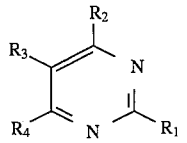

wherein $R_1$, $R_2$, $R_3$, and $R_4$ each, independently of the others, are selected from the group consisting of hydrogen atoms, alkyl groups, substituted alkyl groups, aryl groups, substituted aryl groups, arylalkyl groups, substituted arylalkyl groups, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, and azide groups, wherein two or more of $R_1$, $R_2$, $R_3$, and $R_4$ can be joined together to form a ring;

(O) materials of the general formula:

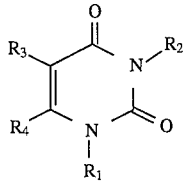

wherein $R_1$, $R_2$, $R_3$, and $R_4$ each, independently of the others, are selected from the group consisting of hydrogen atoms, alkyl groups, substituted alkyl groups, aryl groups, substituted aryl groups, arylalkyl groups, substituted arylalkyl groups, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, and azide groups, wherein two or more of $R_1$, $R_2$, $R_3$, and $R_4$ can be joined together to form a ring;

(P) materials of the general formula:

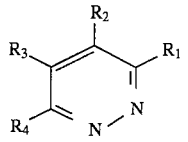

wherein $R_1$, $R_2$, $R_3$, and $R_4$ each, independently of the others, are selected from the group consisting of hydrogen atoms, alkyl groups, substituted alkyl groups, aryl groups, substituted aryl groups, arylalkyl groups, substituted arylalkyl groups, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, and azide groups, wherein two or more of $R_1$, $R_2$, $R_3$, and $R_4$ can be joined together to form a ring;

(Q) materials of the general formula:

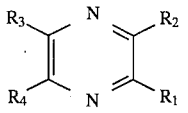

wherein $R_1$, $R_2$, $R_3$, and $R_4$ each, independently of the others, are selected from the group consisting of hydrogen atoms, alkyl groups, substituted alkyl groups, aryl groups, substituted aryl groups, arylalkyl groups, substituted arylalkyl groups, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, and azide groups, wherein two or more of $R_1$, $R_2$, $R_3$, and $R_4$ can be joined together to form a ring;

(R) materials of the general formulae:

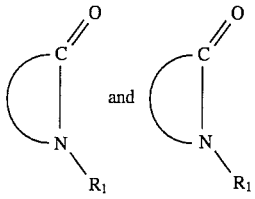

wherein $R_1$ is selected from the group consisting of hydrogen atoms, alkyl groups, substituted alkyl groups, aryl groups, substituted aryl groups, arylalkyl groups, substituted arylalkyl groups, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, and azide groups, and wherein the curved portion of the structure represents a hydrocarbon chain or a substituted hydrocarbon chain, wherein two or more substituents can be joined together to form a ring;

(S) materials of the general formula:

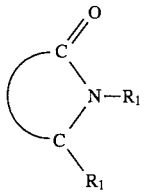

wherein $R_1$ is selected from the group consisting of hydrogen atoms, alkyl groups, substituted alkyl groups, aryl groups, substituted aryl groups, arylalkyl groups, substituted arylalkyl groups, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, and azide groups, and wherein the curved portion of the structure represents a hydrocarbon chain or a substituted hydrocarbon chain, wherein two or more substituents can be joined together to form a ring; and (T) mixtures thereof.

11. A process according to claim 1 wherein the transparentizing agent is selected from the group consisting of (1) homopiperidine, (2) piperidinethiocyanate, (3) -2-piperidinemethanol, (4) 3-piperidinemethanol, (5) 2-piperidineethanol, (6) 4-piperidineethanol, (7) 4-piperidine monohydrate hydrochloride, (8) 1-aminopiperidine, (9) 1-(2-aminoethyl)piperidine, (10) 4-(aminomethyl)piperidine, (11) 3-piperidino-1,2-propanediol (Aldrich 21,849-9), (12) 1-piperidine propionic acid, (13) 1-methyl-4-(methylamino)piperidine, (14) 1-acetyl-3-methylpiperidine, (15) 4'-piperidinoacetophenone, (16) 4-phenylpiperidine, (17) 4-piperidinopiperidine, (18) 4-benzylpiperidine, (19) 4-(4-methylpiperidino)pyridine, (20) 4-piperidone ethylene ketal, (21) bis(pentamethylene)urea, (22) 1-benzyl-4-hydroxypiperidine, (23) 1-benzoyl-4-piperidone, (24) 1,1'-methylenebis(3-methylpiperidine), (25) 4,4'-trimethylenedipiperidine, (26) 4,4'-trimethylenebis(1-menthylpiperidine), (27) 4,4'-trimethylenebis(1-piperidinepropionitrile), (28) 4,4'-trimethylenebis(1-piperidineethanol), (29) 2,2,6,6-tetramethylpiperidine, (30) 4-amino-2,2,6,6-tetramethylpiperidine, (31) 4-(dimethylamino)-1,2,2,6,6-pentamethylpiperidine, (32) N,N'-bis(2,2,6,6-tetramethyl-4-piperidinyl)-1,6-hexanediamine, (33) tripiperidinophosphine oxide, (34) tropane, (35) tropinehydrate, (36) tropinone, (37) 8-hydroxytropinone, (38) 2-piperidine carboxylic acid, (39) 2-piperidone, (40) 4,4'-trimethylene bis(1-piperidine carboxamide), (41) 4-methyl-2-(piperidinomethyl)phenol, (42) 1-methyl-4-piperidinyl bis(chlorophenoxy)acetate, (43) 2-(hexamethylene imino)ethyl chloride monohydrochloride, (44) 3-(hexahydro-1H-azepin-1-yl)-3'-nitropropiophenone hydrochloride, (45) imipramine hydrochloride, (46) carbamezepine, (47) 5,6,11,12-tetrahydro dibenz[b,f]azocine hydrochloride, (48) quinuclidine hydrochloride, (49) 3-quinuclidinol hydrochloride, (50) 3-quinuclidinone hydrochloride, (51) 2-methylene-3-quinuclidinone dihydrate hydrochloride, (52) 3-amino quinuclidine dihydrochloride, (53) 3-chloro quinuclidine hydrochloride, (54) quinidine sulfate dihydrate, (55) quinine monohydrochloride dihydrate, (56) quinine sulfate monohydrate, (57) hydroquinidine hydrochloride, (58) hydroquinine hydrobromide dihydrate, (59) piperazine, (60) homopiperazine, (61) 1-methylpiperazine, (62) 2-methylpiperazine, (63) 1-acetylpiperazine, (64) 1-(2-hydroxyethyl)piperazine, (65) 1-(2aminoethyl)piperazine, (66) tert-butyl 1-piperazinecarboxylate, (67) N-isopropyl-1-piperazineacetamide, (68) 1-(2-methoxyphenyl)piperazine, (69) 1-(2-pyridyl)piperazine, (70) 1-benzylpiperazine, (71) 1-cinnamylpiperazine, (72) 1-(4-chlorobenzhydryl)piperazine, (73) 2,6-dimethylpiperazine, (74) 1-amino-4-methylpiperazine, (75) 1-amino-4-(2-hydroxyethyl)piperazine, (76) 1,4-bis(2-hydroxyethyl)piperazine, (77) 1,4-bis(3-aminopropyl)piperazine, (78) tert-butyl-4-benzyl-1-piperazinecarboxylate, (79) 1-piperonyl piperazine, (80) bis(4-methyl-1-homopiperazinylthio-carbonyl)disulfide, (81 ) 1-amino-4-methyl piperazine dihydrochloride monohydrate, (82) 1-(3-chloropropyl)-piperazine dihydrochloride monohydrate, (83) 1-(2,3-xylyl)piperazine monohydrochloride, (84) 1,1-dimethyl-4-phenyl piperazineium iodide, (85) 1,4,7-triazacyclononane, (86) 1,5,9-triazacyclododecane, (87) 1,2,3-triazole, (88) 4-amino-1,2,4-triazole, (89) 3-amino-5-methylthio-1H-1,2,4-triazole, (90) benzotriazole, (91) 1-aminobenzotriazole, (92) 1-cyanobenzotriazole, (93) 5-methyl-1H-benzotriazole, (94) 1H-benzotriazole-1-ylmethyl isocyanide, (95) 2-[3-(2H-benzotriazole-2-yl)-4-hydroxyphenyl]ethyl methacrylate, (96) 1,2,4-triazole, (97) 1,2,4-triazole sodium derivative, (98) 3-amino-1,2,4-triazole, (99) 3,5-diamino-1,2,4-triazole, (100) 3-amino-5-mercapto-1,2,4-triazole, (101) 3-amino-1,2,4-triazole-5-carboxylic acid hemihydrate, (102) 4-amino-3-hydrazino-5-mercapto-1,2,4-triazole, (103) 1,2,3-triazole-4,5-dicarboxylic acid monohydrate, (104) nitron, (105) 1-hydroxybenzotriazole hydrate, (106) 1,3,5-triazine, (107) cyanuric acid, (108) trithiocyanuric acid, (109) 2,4-bis(methylthio)-6-chloro-1,3,5-triazine, (110) 2-chloro-4,6-dimethoxy-1,3,5-triazine, (111) 2-chloro-4,6-diamino-1,3,5-triazine, (112) trichloromelamine, (113) cyanuric chloride, (114) 2,4,6-tris(perfluoroheptyl)-1,3,5-triazine, (115) hexahydro-2,4,6-trimethyl-1,3,5-triazine trihydrate, (116) 1,3,5-trimethylhexahydro-1,3,5-triazine, (117) 1,3,5-triethylhexahydro-1,3,5-triazine, (118) 1,3,5-triclohexylhexahydro-1,3,5-triazine, (119) 1,3,5-tribenzylhexahydro-1,3,5-triazine, (120) trichloroisocyanuric acid, (121 ) tris(2,3-dibromopropylisocyanurate), (122) cyanuric acid compound with melamine, (123) urazole, (124) 1-methyl urazole, (125) 4-phenyl urazole, (126) 5-(4-hydroxyphenyl)-5-phenyl hydantoin, (127) β-tetralone hydantoin, (128) cyclen (1,4,7,10-tetraazacyclododecane), (129) 1,4,8,11-tetraazacyclotetradecane, (130) 1,4,8,11-tetramethyl-1,4,8,11-tetraazacyclotetradecane, (131) 1,4,8,11-tetraazacyclotetradecane-5,7-dione, (132) 1,4,8,12-tetraazacyclopentadecane, (133) 2,3,7,8,12,13,17,18-octaethyl-21H,23H-porphine, (134) dimethyl 3,7,12,17-tetramethyl-21H,23H-porphine-2,18-dipropionate, (135) dimethyl 7,12-diacetyl-3,8,13,17-tetramethyl-21H,23H-porphine-2,18-dipropionate, (136) 8,3-divinyl-3,7,12,17-tetramethyl-21H,23H-porphine-2,18-dipropionic acid, disodium salt, (137) 5,10,15,20-tetraphenyl-21H,23H-porphine, (138) 5,10,15,20-tetrakis(4-methoxyphenyl)-21H,23H-porphine, (139) 5,10,15-20-tetrakis[4-(trimethylamino)phenyl]-21H,23H-porphine tetra-p-tosylate salt, (140) 5,10,15,20-tetra(4-pyridyl)-21H,23H-porphine, (141) 5,10,15,20-tetrakis(1-methyl-4-pyridyl)-21H,23H-porphine, tetra-p-tosylate salt), (142) 1,5-pentamethylenetetrazole, (143) 1-H-tetrazole, (144) 5-amino tetrazole monohydrate, (145) 2,3,5-triphenyl-2H-tetrazolium chloride, (146) 2-(4-iodophenyl)-5-(4-nitrophenyl)-3-phenyltetrazolium chloride, (147) 1,2,3,3-tetramethyl-3H-indolinium iodide, (148) hexacyclen trisulfate, (149) hexamethylhexacyclen, (150) pyrrole-2-carboxaldehyde, (151) proline amide, (152) 3-pyrrolidino-1,2-propane diol, (153) 1-(pyrrolidino carbonylmethyl)piperazine, (154) 4-pyrrolidinopyridine, (155) 3-indolylacetonitrile, (156) 6-nitroindoline, (157) 7-azaindole, (158) indazole, (159) 2-acetyl-pyrrole, (160) 2-acetyl-1-methylpyrrole, (161) 3-acetyl-1-methylpyrrole, (162) 3-acetyl-2,4-dimethylpyrrole, (163) pyrrole-2-carboxylic acid, (164) 3-carboxy-1,4-dimethyl-2-pyrroleacetic acid, (165) proline, (166) 2-pyrrolidone-5-carboxylic acid, (167) 4-hydroxyproline, (168) 1,1'-ethylene bis(5-oxo-3-pyrrolidine carboxylic acid), (169) kainic acid monohydrate, (170) 1-amino pyrrolidine hydrochloride, (171) 2-(2-chloroethyl)-1-methyl pyrrolidine hydrochloride, (172) 1-(2-chloroethyl)pyrrolidine hydrochloride, (173) tremorine dihydrochloride, (174) L-proline methyl ester hydrochloride, (175) ammonium pyrrolidine dithiocarbamate, (176) pyrrolidone hydrotribromide, (177) 1-(4-chlorobenzyl)-2-(1-pyrrolidinyl methyl)benzimidazole hydrochloride, (178) billverdin dihydrochloride, (179) indole, (180) 4,5,6,7-tetrahydroindole, (181) 3-indolemethanol hydrate, (182) 3-indole ethanol, (183) indole-3-carboxaldehyde, (184) 3-indolylacetate, (185) indole-3-acetamide, (186) indole-3-carboxylic acid, (187) indole-3-acetic acid, (188) 3-Indole propionic acid, (189) 3-indole acrylic acid, (190) 3-indole glyoxylic acid, (191) indole-3-pyruvic acid, (192) 3-indolelactic acid, (193) 3-indole butyric acid, (194) N-acetyltryptophanamide, (195) N-(3-indolylacetyl)alanine, (196) N-(3-indolyl acetyl)valine, (197) N-(3-indolyl acetyl)isoleucine, (198) N-(3-indolyl acetyl)leucine, (199) N-(3-indolyl acetyl)aspartic acid, (200) N-(3-indolyl acetyl)-L-phenylalanine, (201)4-hydroxyindole, (202)indole-4-carboxylic acid, (203) 4-indolyl acetate, (204) 4-methyl indole, (205) 5-hydroxy indole, (206) 5-hydroxy indole-3-acetic acid, (207) 5-hydroxy-2-indole carboxylic acid, (208) N-acetyl-5-hydroxytryptamine, (209) indole-5-carboxylic acid, (210) 5-methyl indole, (211) 5-methoxy indole, (212) indole-2-carboxylic acid, (213) indolene-2-carboxylic acid, (214) indole-2,3-dione, (215) 2-methyl indole, (216) 2,3,3-trimethyl indolenine, (217) tryptamine hydrochloride, (218) 5-methyl tryptamine hydrochloride (219) serotonin hydrochloride hemihydrate, (220) norharman hydrochloride monohydrate, (221) harmane hydrochloride monohydrate, (222) harmine hydrochloride hydrate, (223) harmaline hydrochloride dihydrate, (224) harmol hydrochloride dihydrate, (225) harmalol hydrochloride dihydrate, (226) 3,6-diamino acridine hydrochloride, (227) (3-indolyl)isothiuronium iodide, (228) yohimbine hydrochloride, 229) pyrazole, (230) 3-amino pyrazole, (231) 5-amino-1-ethylpyrazole, (232) 3-amino-4-carbethoxypyrazole, (233) 3-amino-5-methylpyrazole, (234) 3-amino-5-phenylpyrazole, (235) ethyl 4-pyrazole carboxylate, (236) diethyl 3,5-pyrazolecarboxylate, (237) 1,1'-(1-ethylpropylidene)bis 1H-pyrazole, (238) 4-bromopyrazole, (239) 4-bromo- 3-methyl pyrazole, (240) 3,5-dimethyl pyrazole, (241) 4-bromo-3,5-dimethyl pyrazole, (242) 3,5-dimethyl pyrazole-1-carboxamide, (243) 3,5-dimethylpyrazole-1-methanol, (244) 3-methyl-1-vinylpyrazole, (245) 4-benzoyl-3-methyl-1-phenyl-2-pyrazolin-5-one, (246) 1-nitropyrazole, (247) 4-pyrazole carboxylic acid, (248) 3,5-pyrazole dicarboxylic acid monohydrate, (249) 3-amino-5-hydroxypyrazole, (250) 3-amino-4-pyrazole carbonitrile, (251) 3-amino-4-pyrzaolecarboxylic acid, (252) 4-methyl pyrazole hydrochloride, (253) 3,4-diamino-5-hydroxy pyrazole sulfate, (254) (3,5-dimethyl pyrazole-1-carboxamidine nitrate), (255) 3-amino-4-pyrazole carboxamide hemisulfate, (256) acid salt of 6-amino indazole hydrochloride, (257) 4-hydroxypyrazolo[3,4-d]pyrimidine, (258) 4-mercapto-1H-pyrazolo-[3,4-d]-pyrimidine, (259) indazole, (260) 5-aminoindazole, (261) 6-aminoindazole, (262) 3-indazolinone, (263) N'-(6-indazolyl)sulfanilamide, (264) 4,5-dihydro-3-(4-pyridinyl)-2H-benz[g]indazole methane sulfonate, (265) imidazole, (266) 4-methylimidazole, (267) 2-ethylimidazole, (268) 2-proplylimidazole, (269) 1-butylimidazole, (270) 2-undecylimidazole, (271) histamine, (272) 1-(3-aminopropyl)imidzole, (273) 1-acetylimidazole, (274) 2-methyl-1-vinylimidazole, (275) 2-ethyl-4-methylimidazole, (276) 1-benzyl-2-methylimidazole, (277) 1-methylbenzimidazole, (278) 1-ethyl-3-methyl-1,H-imidazolinium chloride, (279) 2-(aminomethyl)benzimidazole dihydrochloride hydrate, (280) 2,6-diamino-8-purinol hemisulfate monohydrate, (281) purin-6-yl-trimethyl ammonium chloride, (282) 4-methyl-5-imidazole methanol hydrochloride, (283) N,N'-bis[3-(4,5-dihydro-1H-imidazol-2-yl)phenyl]urea dipropanoate, (284) 1-(p-tosyl)-3,4,4-trimethyl-2-imidazolinium iodide, (285) 1-ethyl-3-methyl-1H-imidazolinium chloride, (286) 2-amino imidazole sulfate, (287) 4-amino-5-imidazole carboxamide hydrochloride, (288) 2-hydrazino-2-imidazoline hydrobromide, (289) imidazole hydrochloride, (290) 4-imidazole acetic acid hydrochloride, (291) 2-benzyl-2-imidazoline hydrochloride, (292) propyl-1-(1-phenyl ethyl imidazole-5-carboxylate hydrochloride, (293) 2,6-diamino purine sulfate hydrate, (294) 1-tallow amido ethyl-3-methyl-2-heptadecyl imidazolinium methyl sulfate, (295) isostearyl ethyl imidonium ethyl sulfate, (296) methyl-1-tallow amido ethyl-2-tallow imidazolinium methyl sulfate, (297) isostearyl benzyl imidonium chloride, (298) methyl-1-hydrogenated tallow amido ethyl (299) hydrogenated tallow imidazolinium methyl sulfate, (300) 1-methyl-1-oleyl amido ethyl-2-oleyl-imidazolinium methyl sulfate, (301) cocohydroxyethyl polyethyleneglycol imidazotinium chloride phosphate, (302) guanine, (303) guanosine hydrate, (304) xanthine, (305) 1-methylxanthine, (306) 3-methyl xanthine, (307) 3-isobutyl-1-methyl xanthine, (308) hypoxanthin, (309) xanthosine dihydrate, (310) 6-thioxanthene, (311) purine, (312) 6-amino purine, (313) 6-methoxy purine hemihydrate, (314) 6-mercaptopurine monohydrate, (315) 2-amino-6-chloropurine, (316) 2-amino-6,8-dihydroxy purine, (317) theophylline (3,7 dihydro-1,3-dimethyl-1H-purine-2,6-dione), (318) kinetin, (319) 1-methyl adenine, (320) 3-methyl adenine, (321) adenosine, (322) inosine, (323) 6-mercaptopurine riboside, (324) 6-amino purine hydrochloride hemihydrate, (325) 6-amino purine sulfate, (326) 2,6-diamino-8-purinol hemisulfate monohydrate, (327) benzimidazole, (328) 2-aminobenzimidazole, (329) 2-amino-5,6-dimethlybenzimidazole, (330) 5-benzimidazole carboxylic acid, (331) 2,4,5-trimethyl benzimidazole, (332) 2-guanidinobenzimidazole, (333) 2-hydroxybenzimidazole, (334) 4-(2-keto-1-benzimidazolinyl)piperidine, (335) 2-imidazolidine thione, (336) 2-imidazolidone, (337) hydantoin, (338) 1-methyl hydantoin, (339) creatinine, (340) 2-thiohydrantoin, (341) 5-hydantoin acetic acid, (342) 5-ureidohydantoin, (343) 5,5-dimethyl hydantoin, (344) 2-imidazolidone-4-carboxylic acid, (345) N,N-bis(2-hydroxyethyl)isonicotinamide, (346) 1,2-bis(4-pyridyl)ethylene, (347) 2-(2-piperidinoethyl)pyridine, (348) 1,2-bis(4-pyridyl)ethane, (349) 4,4'-trimethylene pyridine, (350) aldrithiol-2, (351) aldrithiol-4, (352) 1,3-bis(3-pyridylmethyl)-2-thiourea, (353) 2,2':6',2"-terpyridin, (354) 2-[N,N-bis(triflouromethylsulfonyl)amino] pyridine, (355) 2,3-pyridine dicarboxylic acid, (356) 2,4-pyridine dicarboxylic acid monohydrate, (357) 2,5-pyridine dicarboxylic acid, (358) 2,6-pyridine dicarboxylic acid, (359) 3,4-pyridine dicarboxylic acid, (360) 3,5-pyridine dicarboxylic acid, (361) 2,6-pyridine dicarboxaldehyde, (362) 3,4-pyridine carboxamide, (363) 3,4-pyridine carboximide, (364) 2,3-pyridine carboxylic anhydride, (365) 3,4-pyridine carboxylic anhydride, (366) 2,6-pyridine methanol, (367) 2-pyridine ethane sulfonic acid, (368) 4-pyridine ethane sulfonic acid, (369) 3-pyridine sulfonic acid, (370) pyridoxic acid, (371) trans-3-(3-pyridyl)acrylic acid, (372) 2-pyridyl hydroxymethane sulfonic acid, (373) 3-pyridyl hydroxymethane sulfonic acid, (374) 6-methyl-2,3-pyridine dicarboxylic acid, (375) isonicotinic acid, (376) pyridine hydrobromide, (377) pyridine hydrochloride, (378) 2-(chloromethyl)pyridine hydrochloride, (379) 2-pyridylacetic acid hydrochloride, (380) nicotinoyl chloride hydrochloride, (381) 2-hydrazinopyridine dihydrochloride, (382) 2-(2-methyl aminoethyl)pyridine dihydrochloride, (383) 1-methyl-1,2,3,6-tetrahydropyridine hydrochloride, (384) 2,6-dihydroxypyridine hydrochloride, (385) 3-hydroxy-2(hydroxymethyl)pyridine hydrochloride, (386) pyridoxine hydrochloride, (387) pyridoxal hydrochloride, (388) pyridoxal 5-phosphate monohydrate, (389) 3-amino-2,6-dimethoxy pyridine hydrochloride, (390) pyridoxamine dihydrochloride monohydrate, (391) iproniazid phosphate, (392) tripelennamine hydrochloride, (393) pyridinium bromide perbromide, (394) pyridinium 3-nitrobenzenesulfonate, (395) 1-ethyl-3-hydroxy pyridinium bromide, (396) 1-ethyl-4-(methoxy carbonyl)pyridinium iodide, (397) 1-heptyl-4-(4-pyridyl)pyridinium bromide, (398) 1-dodecyl pyridinium chloride, (399) 1-hexadecyl pyridinium chloride monohydrate, (400) 1-hexadecyl pyridinium bromide monohydrate, (401) 1-(carboxymethyl)pyridinium chloride, (402) 1-(carboxymethyl)pyridinium chloride hydrazide, (403) 1-(3-nitrobenzyloxymethyl)pyridinium chloride, (404) 1-(3-sulfopropyl)pyridinium hydroxide, (405) N-(lauroyl colamino formyl methyl)pyridinium chloride, (406) N-(stearoyl colamine formyl methyl)pyridinium chloride, (407) 2-chloro-1-methyl pyridinium iodide, (408) 2-pyridine aldoxime-1-methyl methane sulfonate, 2-pyridine aldoxime-1-methyl chloride, (409) 2-[4-(dimethyl amino)styryl]1-ethylpyridinium iodide, (410) 1-benzyl-3-hydroxy pyridinium chloride, (411) 1,4 dimethyl pyridinium iodide, (412) 1-ethyl-4-phenyl pyridinium iodide, (413) 4-phenyl-1-propyl pyridinium iodide, (414) 1-docosyl-4-(4 hydroxystyryl)pyridinium bromide, (415) 1,1'-dimethyl-4,4'-bipyridinium dichloride, (416) 1,1'-diethyl-4-4'-bipyridinium dibromide, (417) 1,1'-dibenzyl-4,4'-bipyridinium dichloride, (418) 1,1'-diheptyl-4,4'-bipyridinium dibromide, (419) 1,7-phenanthroline, (420) 1,10-phenanthroline, (421) 5-chloro-1,10-phenanthroline, (422) 4,5-dihydro-3-(4-pyridinyl)-2H-benz[g]indazole methane sulfonate, (423) 1,2,3,4-tetrahydro quinoline, (424) 6-ethoxy-1,2,3,4-tetrahydro-2,2,4-trimethyl quinoline, (425) 2-cyanoquinoline, (426) 1-cyanoisoquinoline, (427) 3-cyanoisoquinoline, (428) 3-amino quinoline, (429) 8-aminoquinoline, (430) 7,8-benzoquinoline, (431) 8-hydroxy quinoline, (432) 8-hydroxyquinoline, aluminium salt, (433) 8-hydroxyquinaldine, (434) 3,4,5,6,7,8-hexahydro 2(1H)-quinolinone, (435) julolidine, (436) quinoxaline, (437) ethyl-2-quinoxalinecarboxylate, (438) quinoline, (439) 2-hydroxyquinoline, (440) 4-hydroxy quinoline, (441) 5-hydroxy quinoline, (442) 5-amino quinoline, (443) 6-amino quinoline, (444) 2-quinoline carboxylic acid, (445) 3-quinoline carboxylic acid, (446) 4-quinoline carboxylic acid, (447) 4-quinoline carboxaldehyde, (448) 2-quinoline thiol, (449) 2,4-quinoline diol, (450) quinaldine, (451) 4-aminoquinaldine, (452) 2,6-dimethyl quinoline, (453) 2,7-dimethyl quinoline, (454) 4-methoxy-2-quinoline carboxylic acid, (455) methyl-2-phenyl-4-quinoline carboxylate, (456) 2-(N-butyl carbamoyl)-1,2,3,4-tetrahydroisoquinoline, (457) 1-hydroxyisoquinoline, (458) 1-isoquinoline carboxylic acid, (459) 3-isoquinoline carboxylic acid, (460) 1,5-isoquinoline diol, (461) 8-hydroxyquinoline hemisulfate hemihydrate, (462) 5-amino-8-hydroxy quinoline dihydrochloride, (463) 2-(chloromethyl)quinoline monohydrochloride, (464) 8-hydroxyquinoline-5-sulfonic acid monohydrate, (465) 8-ethoxy-5-quinoline sulfonic acid sodium salt hydrate, (466) 1,2,3,4-tetrahydroisoquinoline hydrochloride, (467) 1,2,3,4-tetrahydro-3-isoquinoline carboxylic acid hydrochloride, (468) 6,7-dimethoxy-1,2,3,4-tetrahydro isoquinoline hydrochloride, (469) 1-methyl-6,7-dihydroxy-1,2,3,4-tetrahydro isoquinoline hydrobromide, (470) primaquine diphosphate, (471) pentaquine phosphate, (472) dibucaine hydrochloride, (473) 9-aminoacridine hydrochloride hemihydrate, (474) 3,6 -diamino acridine hemisulfate, (475) 2-quinoline thiol hydrochloride, (476) sparteine sulfate pentahydrate, (477) papaverine hydrochloride, (478) emetine dihydrochioride hydrate, (479) 1,10-phenanthroline monohydrochloride monohydrate, (480) neocuproine hydrochloride trihydrate, (481) pyrimidine, (482) 2 chloropyrimidine, (483) 4-phenylpyrimidine, (484) 5-bromopyrimidine, (485) 2,4-dichloropyrimidine, (486) 4,6-dichloropyrimidine, (487) 2,4-dichloro-6-methylpyrimidine, (488) 6-chloro-2,4-dimethoxypyrimidine, (489) 2-amino-4,6-dimethoxypyrimidine, (490) 2,4,6-trichloropyrimidine, (491) 2,4,5,6-tetrachloropyrimidine, (492) 1,3,4,6,7,8-hexahydro-1-methyl-2H-pyrimido[1,2-a]pyrimidine, (493) 1,3,4,6,7,8-hexahydro-2H-pyrimido[1,2-a]pyrimidine, (494) hexetidine, (495) tert-butyl S-(4,6-dimethylpyrimidin-2-yl)thiocarbonate, (496) 4-methoxybenzyl-S(4,6-dimethylpyrimidin-2-yl)thiocarbonate, (497) 2-amino pyrimidine, (498) 2-amino-4-methyl pyrimidine, (499) 2-amino-5-nitropyrimidine, (500) 2-amino-5-bromopyrimidine, (501) 2-amino-4-chloro-6-methyl pyrimidine, (502) 2-amino-4,6-dimethyl pyrimidine, (503) 2-amino-4-hydroxy-6-methyl pyrimidine, (504) 2-amino-4,6-dichloropyrimidine, (505) 2-amino-5-bromo-6-methyl-4-pyrimidinol, (506) 4-aminopyrimidine, (507) 4,5-diamino pyrimidine, (508) 4-amino-2,6-dimethyl pyrimidine, (509) 2,4-diamino-6-hydroxypyrimidine, (510) 2,6-diamino-4-chloro pyrimidine, (511) 4,6-diamino-2-mercaptopyrimidine hemihydrate, (512) 2,4,6-triamino pyrimidine, (513) 5-nitroso-2,4,6-triamino pyrimidine, (514) 4,6-dihydroxy pyrimidine, (515) 4,6-dihydroxy-2-amino pyrimidine, (516) 4,6-dihydroxy-2-methyl pyrimidine, (517) 4,6-dihydroxy-5-nitropyrimidine, (518) 2,4-dihydroxy-5-methyl pyrimidine, (519) 2,4-dihydroxy-6-methyl pyrimidine, (520) 2,4-dihydroxy-5,6-dimethyl pyrimidine, (521) 2,6-dihydroxy pyrimidine-5-carboxylic acid hydrate, (522) 2,6-dihydroxy-4-amino pyrimidine, (523) 2,4,5-trihydroxy pyrimidine, (524) 2-thiouracil, (525) 6-amino-5-nitroso-2-thiouracil, (526) folic acid dihydrate, (527) folinic acid, calcium salt hydrate, (528) 2-hydroxypyrimidine hydrochloride, (529) 2-hydroxy-4-methyl pyrimidine hydrochloride, (530) 4,6-dimethyl-2-hydroxypyrimidine hydrochloride, (531) 2-mercapto-4-methyl pyrimidine hydrochloride, (532) 4,6-diamino pyrimidine hemisulfate monohydrate, (533) 4,5,6-triamino pyrimidine sulfate hydrate, (534) 4,5-diamino-6-hydroxy pyrimidine sulfate, (535) 2,4-diamino-6-mercapto pyrimidine hemisulfate, (536) 2,4-diamino-6-hydroxy pyrimidine hemisulfate hydrate, (537) 6-hydroxy-2,4,5-triamino pyrimidine sulfate, (538) 5,6-diamino-2,4-dihydroxy pyrimidine sulfate, (539) $N^4$-(2-amino-4-pyrimidinyl)sulfanilamide monohydrochloride, (540) 2,4,5,6-tetraamino pyrimidine sulfate, (541) 2,4(1H,3H)-pyrimidine dione, (542) 5-amino uracil, (543) 5-nitrouracil, (544) 5-iodouracil, (545) 5-(hydroxymethyl)uracil hydrate, (546) 5,6-dihydrouracil, (547) 6-amino-1-methyl uracil, (548) 5,6-diamino-1,3-dimethyl uracil hydrate, (549) uridine, (550) 5-methyl uridine, (551) 5-iodouridine, (552) thimidine, (553) 5-methyl-2-thiouracil, (554) 4-thiouridine, (555) 2-thiocytidine dihydrate, (556) orotic acid monohydrate, (557) hydroorotic acid, (558) 5-aminoorotic acid, (559) methylorotate, (560) barbituric acid, (561) 5-nitrobarbituric acid trihydraet, (562) violuric acid monohydrate, (563) alloxan monohydrate, (564) 4,5,6-triamino-2(1H)-pyrimidinethione sulfate, (565) cyclocytidine hydrochloride, (566) cytosine arabinoside hydrochloride, (567) pyridazine, (568) phthalazine, (569) 4,5-dihydro-6-methyl-3(2H)-pyridazinone monohydrate, (570) 3,6-dichloropyridazine, (571) 3,4,5-trichloropyridazine, (572) 3,6-dichloro-4-methylpyridazine, (573) 3-chloro-6-methoxypyridazine, (574) pyrazine, (575) acetylpyrazine, (576) aminopyrazine, (577) 2,6-dichloropyrazine, (578) 2,3,5-trimethylpyrazine, (579) tetramethylpyrazine, (580) 5-methyl-2-pyrazine carboxylic acid, (581) pyrazine amide, (582) 2,3-pyrazine dicarboxamide, (583) 4-pyridazine carboxylic acid, (584) 2,3-pyrazine dicarboxylic acid, (585)lumazine monohydrate, (586) xanthopterin monohydrate, (587) 2-quinoxazoline carboxylic acid, (588) 2-quinoxalinol, (589) 2,3-dihydroxy quinoxaline, (590) phenazine methosulfate, (591) 2-azetidinone, (592) 2-pyrrolidinone, (593) pyrrolidone hydrotribromide, (594) δ-valerolactam, (595) ϵ-caprolactam, (596) amino-ϵ-caprolactam, (597) N-methyl caprolactam, (598) 2-azacyclooctanone, (599) 2-azacyclononanone, (600) ω-thiocaprolactam, (601) N-vinylcaprolactam, (602) 2-azabicyclo[2.2.1]hept-5-en-3-one, (603) maleimide, (604) N-ethylmaleimide, (605) N-butylmaleimide, (606) N-cyclohexylmaleimide, (607) N-phenylmaleimide, (608) N-benzylmaleimide, (609) N-hydroxymaleimide, (610) succinimide, (611) N-methylsuccinimide, (612) 2-hydroxy-N-methylsuccinimide, (613) N-hydroxysuccinimide, (614) succinimidyl 2,2,2-trichloroethyl carbonate, (615) 2-dodecyl-N-(2,2,6,6-tetramethyl-4-ppiperidinyl)succinimide, (616) 2-dodecyl-N-(1,2,2,6,6-pentamethyl-4-piperdinyl- )succinimide, (617) N-(1-acetyl-2,2,6,6-tetramethyl-4-piperidinyl)-2-dodecyl succinimide, (618) α-methyl-α-propylsuccinimide, (619) α-methyl-α-phenylsuccinimide, (620) N-vinylphthalimide, (621) N-ethylphthalimide, (622) N-(trimethylsilylmethyl)phthalimide, (623) N-(2-bromoethyl)phthalimide, (624) N-(3-bromopropyl)phthalimide, (625) N-(4-bromobutyl)phthalimide, (626) phthalimidoacetaldehyde diethyl acetal, (627) diethyl(phthalimidomethyl)phosphonate, (628) N-benzylphthalimide, (629) phthalimide, DBU (1,8-diazabicyclo[5.4.0]undec-7-ene) salt, (630) phthalimide, DBN (1,5-diazabicyclo[4.3.0]non-5-ene), and (631) mixtures thereof.

12. A process according to claim 1 wherein the transparentizing agent is an oxa-aza-cyclic compound.

13. A process according to claim 1 wherein the transparentizing agent is selected from the group consisting of:

(A) materials of the general formulae:

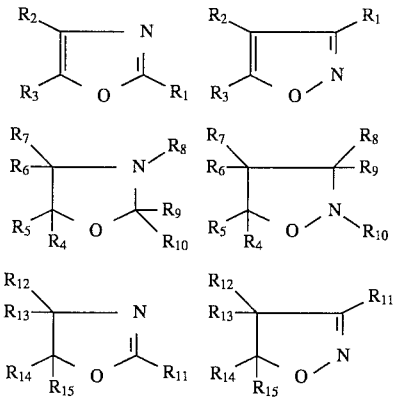

wherein $R_1$, $R_2$, $R_3$, $R_4$, $R_5$, $R_6$, $R_7$, $R_8$, $R_9$, $R_{10}$, $R_{11}$, $R_{12}$, $R_{13}$, $R_{14}$, and $R_{15}$ each, independently of the others, are selected from the group consisting of hydrogen atoms, alkyl groups, substituted alkyl groups, aryl groups, substituted aryl groups, arylalkyl groups, substituted arylalkyl groups, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, and azide groups, wherein two or more of $R_1$, $R_2$, $R_3$, $R_4$, $R_5$, $R_6$, $R_7$, $R_8$, $R_9$, $R_{10}$, $R_{11}$, $R_{12}$, $R_{13}$, $R_{14}$, and $R_{15}$ can be joined together to form a ring;

(B) materials of the general formula:

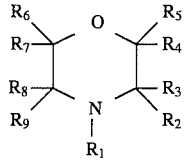

wherein $R_1$, $R_2$, $R_3$, $R_4$, $R_5$, and $R_6$ each, independently of the others, are selected from the group consisting of hydrogen atoms, alkyl groups, substituted alkyl groups, aryl groups, substituted aryl groups, arylalkyl groups, substituted arylalkyl groups, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, and azide groups, wherein two or more of $R_1$, $R_2$, $R_3$, $R_4$, $R_5$, and $R_6$ can be joined together to form a ring;

(C) mixtures thereof.

14. A process according to claim 1 wherein the transparentizing agent is selected from the group consisting of (1) 3-amino-5-methyl isoxazole, (2) 5-amino-3-methyl isoxazole, (3) 3,5-dimethyl-4-nitroisoxazole, (4) 1,2-benzisoxazole, (5) 2,1-benzisoxazole, (6) cycloserine, (7) 4-benzyl-2-methyl-2-oxazoline, (8) 2-methyl-5-phenyl-2-oxazoline-4-methanol, (9) benzoxazole, (10) 2-methylbenzoxazole, (11) 2-chlorobenzoxazole, (12) 2-chloro-3-ethylbenzeneoxazolium tetrafluoroborate, (13) 2-oxazolidone, (14) 3-methyl-2-oxazolidinone, (15) 5-chloromethyl-2-oxazolidinone, (16) 4-isopropyl-2-oxazolidinone, (17) 3-acetyl-2-oxazolidinone, (18) 5,5-dimethyl oxazolidine-2,4-dione, (19) 3-ethyl-2-thioxo-4-oxazolidinone, (20) 4-methyl-5-phenyl-2-oxazolidinone, (21) 4-benzyl-2-oxazolidinone, (22) 2-benzoisoxazolinone, (23) muscimol hydrate, (24) 5-methyl-3-phenyl isoxazole-4-carboxylic acid, (25) 2-methyl-5-phenyl-2-oxazoline-4-methanol, (26) sulfamethoxazole, (27) sulfisoxazole, (28) N'-(4,5-dimethyloxazol-2-yl)sulfanilamide, (29) chlorzoxazone, (30) 3,3'-dimethyl oxacarbocyanine iodide, (31) 2-ethyl-5-phenyl isoxazolium-3'-sulfonate, (32) 2-tert-butyl-5-methyl isoxazolium perchlorate, (33) 5-phenyl-2-(4-pyridyl)oxazole hydrochloride hydrate, (34) 5-phenyl-2-(4-pyridyl)oxazole methyl tosylate salt, (35) 4-aminomorpholine, (36) 4-morpholine carbonitrile, (37) 4-morpholine propionitrile, (38) 4-formyl morpholine, (39) 4-acetylmorpholine, (40) 4-(2-hydroxyethyl)morpholine, (41) 3-morpholino-1,2-propane diol, (42) 4-(3-amino propyl)morpholine, (43) 1-morpholino-1-cyclopentene, (44) 1-morpholino-1-cyclohexene, (45) 1-morpholino-1-cycloheptene, (46) 4-phenyl morpholine, (47) 4-morpholinoaniline, (48) 2,2,2-tribromoethyl phosphoromorpholino chloridate, (49) 1-(morpholino carbonyl methyl)piperazine, (50) 1,3-dimorpholine-2-nitropropane, (51) hemicholinium-3, (52) hemicholinium-15, (53) 2-methoxy-4-morpholinobenzene diazoniumchloride, zinc chloride, (54) fomocaine, (55) 4-morpholinobenzophenone, (56) 4,4'-ethylene-bis(2,6-morpholinedione), (57) N,N'-dicylcohexyl-4-morpholine carboxamidine, (58) 1-cyclohexyl-3-(2-morpholino ethyl)-2-thiourea, (59) 4-morpholinoacetophenone, (60) 4-(2-chloroethyl)morpholine hydrochloride, (61) 4-morpholine ethane sulfonic acid, (62) 4-morpholine propane sulfonic acid, (63) β-hydroxy morpholine propane sulfonic acid, (64) [N-(aminoiminomethyl)-4-morpholine carboximidamide] hydrochloride, (65) 4-morpholine carbodithioic acid compound with morpholine, (66) 2,5-dimethyl-4-(morpholinomethyl)phenol hydrochloride monohydrate, (67) 1-cyclohexyl-3-(2-morpholinoethyl)carbodiimide metho-p-toluene sulfonate, (68) hemicholinium-3[2,2'-(4,4'-biphenylene)bis(2-hydroxy-4,4-dimethyl morpholinium bromide), (69) hemicholinium-15[4,4-dimethyl-2-hydroxy-2-phenyl morpholinium bromide], (70) 1-aza-12-crown-4, (71) 1-aza-15-crown-5, (72) 1-aza-18-crown-6, (73) 1,4,10-trioxa-7,13-diazacyclopentadecane, (74) 1,4,10,13-tetraoxa-7,16-diazacyclooctadecane, (75) N,N'-dibenzyl-1,4,10,13-tetraoxa-7,16-diazacyclooctadecane, (76) 4,7,13,18-tetraoxa-1,10-diazabicyclo[8.5.5]eicosane, (77) 4,7,13,16,21-pentaoxa-1,10-diazabicyclo[8.5.5]tricosane, (78) 4,7,13,16,21,24-hexaoxa-1,10-diazabicyclo[8.8.8]hexacosane, (79) 5,6-benzo-4,17,13,16,21,24-hexaoxa-1,10-diazabicyclo[8.8.8]hexacosane, and (80) mixtures thereof.

15. A process according to claim wherein the transparentizing agent is an oxacyclic compound.

16. A process according to claim 1 wherein the transparentizing agent is selected from the group consisting of:

(A) materials of the general formula:

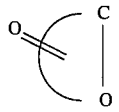

wherein the curved portion of the structure represents a hydrocarbon chain or a substituted hydrocarbon chain, wherein two or more substituents can be joined together to form a ring;

(B) materials of the general formulae:

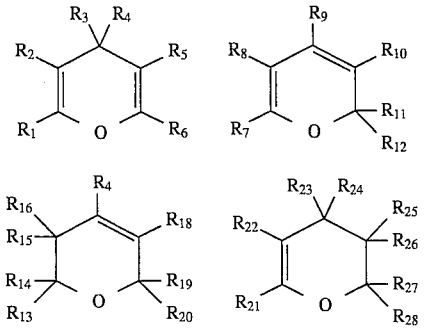

wherein $R_1$, $R_2$, $R_3$, $R_4$, $R_5$, $R_6$, $R_7$, $R_8$, $R_9$, $R_{10}$, $R_{11}$, $R_{12}$, $R_{13}$, $R_{14}$, $R_{15}$, $R_{16}$, $R_{17}$, $R_{18}$, $R_{19}$, $R_{20}$, $R_{21}$, $R_{22}$, $R_{23}$, $R_{24}$, $R_{25}$, $R_{26}$, $R_{27}$, and $R_{28}$ each, independently of the others, are selected from the group consisting of hydrogen atoms, alkyl groups, substituted alkyl groups, aryl groups, substituted aryl groups, arylalkyl groups, substituted arylalkyl groups, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, and azide groups, wherein two or more of $R_1$, $R_2$, $R_3$, $R_4$, $R_5$, $R_6$, $R_7$, $R_8$, $R_9$, $R_{10}$, $R_{11}$, $R_{12}$, $R_{13}$, $R_{14}$, $R_{15}$, $R_{16}$, $R_{17}$, $R_{18}$, $R_{19}$, $R_{20}$, $R_{21}$, $R_{22}$, $R_{23}$, $R_{24}$, $R_{25}$, $R_{26}$, $R_{27}$, and $R_{28}$ can be joined together to form a ring;

(C) materials of the general formula:

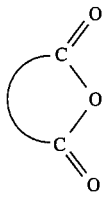

wherein the curved portion of the structure represents a hydrocarbon chain or a substituted hydrocarbon chain, wherein two or more substituents can be joined together to form a ring;

(D) materials of the general formulae:

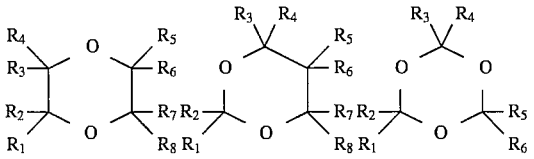

wherein $R_1$, $R_2$, $R_3$, $R_4$, $R_5$, $R_6$, $R_7$, and $R_8$ each, independently of the others, are selected from the group consisting of hydrogen atoms, alkyl groups, substituted alkyl groups, aryl groups, substituted aryl groups, arylalkyl groups, substituted arylalkyl groups, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, and azide groups, wherein two or more of $R_1$, $R_2$, $R_3$, $R_4$, $R_5$, $R_6$, $R_7$, and $R_8$ can be joined together to form a ring;

(E) materials of the general formulae:

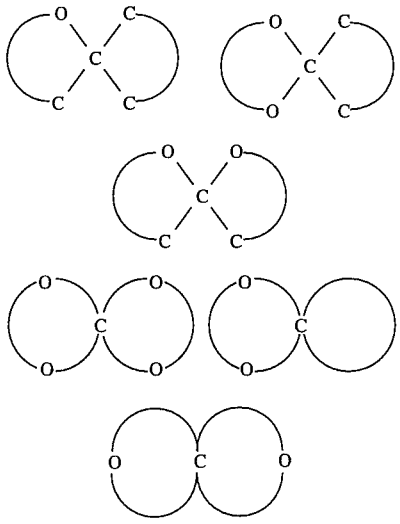

wherein the curved portions of the structures represent a hydrocarbon chain or a substituted hydrocarbon chain, wherein two or more substituents can be joined together to form a ring;

(F) materials of the general formula:

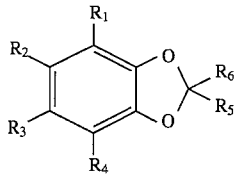

wherein $R_1$, $R_2$, $R_3$, $R_4$, $R_5$, and $R_6$ each, independently of the others, are selected from the group consisting of hydrogen atoms, alkyl groups, substituted alkyl groups, aryl groups, substituted aryl groups, arylalkyl groups, substituted arylalkyl groups, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, and azide groups, wherein two or more of $R_1$, $R_2$, $R_3$, $R_4$, $R_5$, and $R_6$ can be joined together to form a ring; and (G) mixtures thereof.

17. A process according to claim 1 wherein the transparentizing agent is selected from the group consisting of (1) γ-butyrolactone, (2) γ-valerolactone, (3) γ-caprolactone, (4) γ-octanoic lactone, (5) γ-nonanoic lactone, (6) γ-decanolactone, (7) undecanoic γ-lactone, (8) γ-phenyl-γ-butyrolactone, (9) α-carbethoxy-γ-phenylbutyrolactone, (10) 2-coumaranone, (11) β,β-dimethyl-γ-(hydroxymethyl)-γ-butyrolactone, (12) γ-ethoxy carbonyl-γ-butyrolactone, (13) 5-(hydroxymethyl)-2(5H)-furanone, (14) dihydro-4,4-dimethyl-2,3-furandione, (15) 2,5-dimethyl-4-hydroxy-3(2H)-furanone, (16) mevalonic(β-hydroxy β-methyl-δ-valero)lactone, (17) δ-decanolactone, (18) undecanoic δ-lactone, (19) δ-dodecanolactone, (20) undecanoic ω-lactone, (21) oxacyclotridecan-2-one, (22) ω-pentadecalactone, (23) hydrindantin (2,2'-dihydroxy-2,2'-biindan-1,1'3,3'-tetrone, (24) hydrindantin dihydrate, (25) 2-oxepanone, (26) 4H-pyran-2-one, (27) methylcoumalate, (28) methyl 2-oxo-2H-pyran-3-carboxylate, (29) 4,6-dimethyl-α-pyrone, (30) 4-methoxy-6-methyl-2H-pyran-2-one, (31) 3,6-dihydro-4,6,6-trimethyl-2H-pyran-2-one, (32) 3,4-dihydro-6-methyl-2H-pyran-2-one, (33) 3-acetyl coumarin, (34) 6-methyl coumarin, (35) 7-ethoxy coumarin, (36) ethyl-3-coumarin carboxylate, (37) 7-diethylamino-4-methyl coumarin, (38) dihydro coumarin, (39) 3-bromo-2-coumaranone, (40) patulin, (41) 4H-pyran-4-one, (42) 2-ethyl-3-hydroxy-4H-pyran-4-one, 43v) butopyronoxyl(butyl 3,4-dihydro-2,2-dimethyl-4-oxo-2H-pyran-6-carboxylate, (44) dehydroacetic acid, (45) 4-chromone, (46) 4-chromanone, (47) 4-chromanol, (48) 6,7-dimethoxy-2,2-dimethyl-4-chromanone, (49) 3-isochromanone, (50) 6,7-dimethoxy-3-isochromanone, (51) 6-ethyl-4-oxo-4H-1-benzopyran-3-carbonitrile, (52) 6-ethyl-4-oxo-4H-1-benzopyran-3-carboxaldehyde, (53) 6-isopropyl-4-oxo-4H-1-benzopyran-3-carbonitrile, (54) 6-isopropyl-4-oxo-4H-1-benzopyran-3-carboxaldehyde, (55) maleic anhydride, (56) bromomaleic anhydride, (57) citraconic anhydride, (58) 2,3-dimethylmaleic anhydride, (59) dichloromaleic anhydride, (60) cis-aconitic anhydride, (61) itaconic anhydride, (62) methylsuccinic anhydride, (63) acetylmercaptosuccinic anhydride, (64) 2,2-dimethylsuccinic anhydride, (65) phenylsuccinic anhydride, (66) 2-octen-1-ylsuccinic anhydride, (67) 2-dodecen-1-ylsuccinic anhydride, (68) 2-octadecen-1-ylsuccinic anhydride, (69) 3-oxabicyclo[3.1.0]hexane-2,4-dione, (70) diglycolic anhydride, (71) glutaric anhydride, (72) 3-methylglutaric anhydride, (73) 2,2-dimethylglutaric anhydride, (74) 3,3-tetramethyleneglutaric anhydride, (75) 1-cyclopentene-1,2-dicarboxylic anhydride, (76) 3,4,5,6-tetrahydrophthalic anhydride, (77) cis-1,2-cyclohexanedicarboxylic anhydride, (78) hexahydro-4-methylphthalic anhydride, (79) methyl-5-norbornene-2,3-dicarboxylic anhydride, (80) 2,3-pyridinecarboxylic anhydride, (81) 3,4-pyridinecarboxylic anhydride, (82) furfurylmercaptan, (83) S-furfurylthioacetate, (84) furfurylsulfide, (85) furfurylmethyldisulfide, (86) furfuryldisulfide, (87) glycolaldehyde dimer, (88) 6,7-dihydrocyclopenta-1,3-dioxin-5(4H)-one, (89) (2R,6R)-tert-butyl-6-methyl-1,3-dioxan-4-one, (90) 2,2-dimethyl-1,3-dioxane-4,6-dione, (91) 3,6-dimethyl-1,4-dioxane-2,5-dione, (92) 2,2,6-trimethyl-4H-1,3-dioxin-4-one, (93) 2,2,5-trimethyl-1,3-dioxane-4,6-dione, (94) 5-bromo-2,2,5-trimethyl-1,3-dioxane-4,6-dione, (95) 1,3-dioxane-5,5-dimethanol, (96) 1,3,5-trioxane, (97) 1,6-dioxaspiro[4.4]nonane-2,7-dione, (98) 1,4-dioxaspiro[4.5]decan-2-one, (99) 1,7-dioxaspiro[5.5]undecane, (100) 2,4,8,10-tetraoxaspiro[5.5]undecane, (101) 3,9-divinyl-2,4,8-tetraoxaspiro[5.5]undecane, (102) 2,2-pentamethylene-1,3-dioxalane, (103) 2-phenyl-1,3-dioxalane, (104) 1,4-cyclohexanedione monoethylene ketal, (105) 1,4-cyclohexanedione bis(ethylene ketal), (106) 1,4-cyclohexanedione mono-2,2-dimethyl trimethylene ketal, (107) piperonal, (108) piperonyl acetate, (109) piperonyl alcohol, (110) piperonylnitrile, (111) piperonyl amine, (112) 6-nitropiperonal, (113) 6-nitropiperonyl alcohol, (114) 3',4'-(methylenedioxy)acetophenone, (115) 3,4-(methylenedioxy)aniline, (116) 2,3-(methylenedioxy)benzaldehyde, (117) 3,4-(methylenedioxy)phenylacetonitrile, (118) 3,4-(methylenedioxy)toluene, and (119) mixtures thereof.

18. A process according to claim 1 wherein the transparentizing agent is a crown ether.

19. A process according to claim 1 wherein the transparentizing agent is selected from the group consisting of (1) 1,4,7,10-tetraoxacyclododecane( 12-crown-4), (2) 2-(hydroxyethyl)-12-crown-4, (3) 2-(aminoethyl)-12-crown-4, (4) benzo-12-crown-4, (5) 1,4,7,10,13-pentaoxacyclododecane( 15-crown-5), (6) 2-(hydroxyethyl)-15-crown-5, (7) 2-(aminoethyl)-15-crown-5, (8) benzo-15-crown-5, (9) 4'-aminobenzo-15-crown-5, (10) 4'-formylbenzo-15-crown-5, (11) 4'-nitrobenzo-15-crown-5, (12) bis[(benzo-15-crown-5)-15-ylmethyl]pimelate, (13) 1,4,7,10,13,16-hexaoxacyclooctadecane( 18-crown-6), (14) 2-(aminoethyl)-18 crown-6, (15) benzo-18 crown-6, (16) 4'-bromobenzo-18-crown-6, (17) dibenzo-18-crown6, (18) di-tert-butyldibenzo-18-crown-6, (19) cis-dicyclohexane-18 crown-6, (20) dibenzo-24-crown-8, (21) dicyclohexano-24-crown-8, (22) dibenzo-30-crown-10, and (23) mixtures thereof.

20. A process according to claim 1 wherein the transparentizing agent is a cyclic hydrocarbon.

21. A process according to claim 1 wherein the transparentizing agent is selected from the group consisting of:

(A) materials of the general formulae:

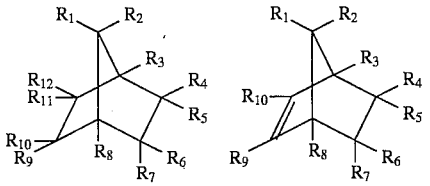

wherein $R_1$, $R_2$, $R_3$, $R_4$, $R_5$, $R_6$, $R_7$, $R_8$, $R_9$, $R_{10}$, $R_{11}$, and $R_{12}$ each, independently of the others, are selected from the group consisting of hydrogen atoms, alkyl groups, substituted alkyl groups, aryl groups, substituted aryl groups, arylalkyl groups, substituted arylalkyl groups, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, and azide groups, wherein two or more of $R_1$, $R_2$, $R_3$, $R_4$, $R_5$, $R_6$, $R_7$, $R_8$, $R_9$, $R_{10}$, $R_{11}$, and $R_{12}$ can be joined together to form a ring;

(B) materials of the general formula:

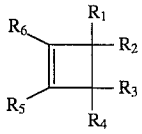

wherein $R_1$, $R_2$, $R_3$, $R_4$, $R_5$, and $R_6$ each, independently of the others, are selected from the group consisting of hydrogen atoms, alkyl groups, substituted alkyl groups, aryl groups, substituted aryl groups, arylalkyl groups, substituted arylalkyl groups, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, and azide groups, wherein two or more of $R_1$, $R_2$, $R_3$, $R_4$, $R_5$, and $R_6$ can be joined together to form a ring;

(C) materials of the general formula:

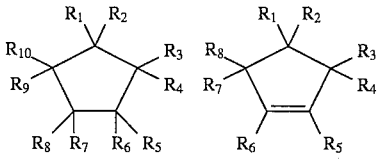

wherein $R_1$, $R_2$, $R_3$, $R_4$, $R_5$, $R_6$, $R_7$, $R_8$, $R_9$, and $R_{10}$ each, independently of the others, are selected from the group consisting of hydrogen atoms, alkyl groups, substituted alkyl groups, aryl groups, substituted aryl groups, arylalkyl groups, substituted arylalkyl groups, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, aryl groups, acid anhydride groups, and azide groups, wherein two or more of $R_1$, $R_2$, $R_3$, $R_4$, $R_5$, $R_6$, $R_7$, $R_8$, $R_9$, and $R_{10}$ can be joined together to form a ring;

(D) materials of the general formulae:

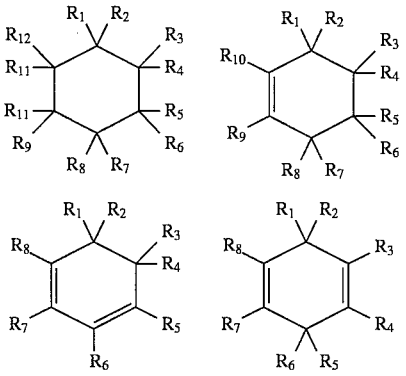

wherein $R_1$, $R_2$, $R_3$, $R_4$, $R_5$, $R_6$, $R_7$, $R_8$, $R_9$, $R_{10}$, $R_{11}$, and $R_{12}$ each, independently of the others, are selected from the group consisting of hydrogen atoms, alkyl groups, substituted alkyl groups, aryl groups, substituted aryl groups, arylalkyl groups, substituted arylalkyl groups, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, and azide groups, wherein two or more of $R_1$, $R_2$, $R_3$, $R_4$, $R_5$, $R_6$, $R_7$, $R_8$, $R_9$, $R_{10}$, $R_{11}$, and $R_{12}$ can be joined together to form a ring;

(E) materials of the general formula:

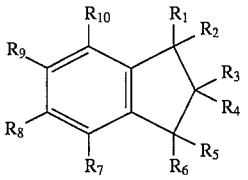

wherein $R_1$, $R_2$, $R_3$, $R_4$, $R_5$, $R_6$, $R_7$, $R_8$, $R_9$, and $R_{10}$ each, independently of the others, are selected from the group consisting of hydrogen atoms, alkyl groups, substituted alkyl groups, aryl groups, substituted aryl groups, arylalkyl groups, substituted arylalkyl groups, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, and azide groups, wherein two or more of $R_1$, $R_2$, $R_3$, $R_4$, $R_5$, $R_6$, $R_7$, $R_8$, $R_9$, and $R_{10}$ can be joined together to form a ring;

(F) materials of the general formulae:

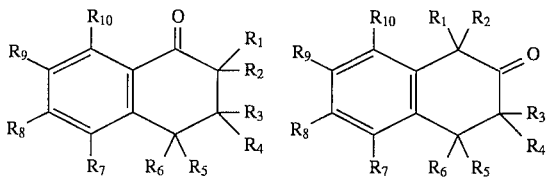

wherein $R_1$, $R_2$, $R_3$, $R_4$, $R_5$, $R_6$, $R_7$, $R_8$, $R_9$, and $R_{10}$ each, independently of the others, are selected from the group consisting of hydrogen atoms, alkyl groups, substituted alkyl groups, aryl groups, substituted aryl groups, arylalkyl groups, substituted arylalkyl groups, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, and azide groups, wherein two or more of $R_1$, $R_2$, $R_3$, $R_4$, $R_5$, $R_6$, $R_7$, $R_8$, $R_9$, and $R_{10}$ can be joined together to form a ring;

(G) materials of the general formula:

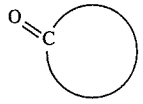

wherein the curved portion of the structure represents a hydrocarbon chain or a substituted hydrocarbon chain, wherein two or more substituents can be joined together to form a ring; and (H) mixtures thereof.

22. A process according to claim 1 wherein the transparentizing agent is selected from the group consisting of (1) norbornane, (2) 2-norbornane carbonitrile, (3) 2-norbornane methanol, (4) 3-methyl-2-norbornane methanol, (5) camphene, (6) fenchyl alcohol, (7) thiocamphor, (8) norbornene, (9) 5-norbornene-2-carbonitrile, (10) 5-norbornene-2-carboxaldehyde, (11) 5-norbornene-2-methanol, (12) 5-norbornene-2,2-dimethanol, (13) 5-norbornene-2-benzoyl, (14) 2-norbornanone, (15) 3-chloro-2-norbornanone, (16) fenchone, (17) 3-(trifluoroacetyl)camphor, (18) 3-heptafluorobutyryl camphor, (19) 3-bromocamphor, (20) 9,10-dibromocamphor, (21) 3,9,10-tribromocamphor, (22) dicyclopentadiene, (23) methylcyclopentadiene dimer, (24) tricyclo[5.2.1]decane, (25) 4,8-bis(hydroxymethyl)tricyclo[5.2.1.$0^{2,6}$]decane, (26) 8-ketotricyclo[5.2.1.$0^{2,6}$]decane, (27) 3,4-dimethoxy-3-cyclobutene-1,2-dione, (28) 3,4-diethoxy-3-cyclobutene-1,2-dione, (29) 3,4-diisopropoxy-3-cyclobutene-1,2-dione, (30) 3,4-dibutoxy-3-cyclobutene-1,2-dione, (31) 3-methyl-2-(nitromethyl)-5-oxocyclopentaneacetic acid, (32) 3-ethyl-2-hydroxy-2-cyclopenten-1-one, (33) methyl-4-methoxy-2-oxo-3-cyclopentene-1-carboxylate, (34) 3,3a,6,6a-tetrahydro-2H-cyclopenta[b]furan-2-one, (35) 3a,4,5,6a-hexahydro-5-hydroxy-4(hydroxymethyl)-2H-cyclopenta[b]furan-2-one, (36) 3-methyl-1,2-cyclopentanedione, (37) 4-hydroxy-5-methyl-4-cyclopentene-1,3-dione monohydrate, (38) 2,4,4-trimethylcyclohexen-1-one, (39) ethyl-6-methyl-2-oxo-3-cyclohexene-1-carboxylate, (40) ethyl 4-hydroxy-6-methyl-2-oxo-3-cyclohexene-1-carboxylate, (41) 5-(1-acetoxy-1-methylethyl)-2-methyl-2-cyclohexen-1-one, (42) thymoquinone, (43) 2,6,6-trimethyl-2-cyclohexene-1,4-dione, (44) indan, (45) 1-indanol, (46) 2-indanol, (47) 1-indanone, (48) 2 -indanone, (49) 2-acetyl-1-tetralone, (50) 4-methyl-1-tetralone, 513) 5,7-dimethyl-1-tetralone, (52) 6,7-dimethoxy-1-tetralone, (53) 1-methyl-2-tetralone, (54) 6,7-dimethoxy-2-tetralone, (55) cyclohexanone, (56) cycloheptanone, (57) cyclooctanone, (58) cyclononanone, (59) cyclodecanone, (60) cycloundecanone, (61) cyclododecanone, (62) cyclotridecanone, (63) cyclopentadecanone, (64) 2-acetylcyclohexanone, (65) 2-allylcyclohexanone, (66) 2-phenylcyclohexanone, (67) cyclohexanedione, (68) 2-acetyl-1,3-cyclohexanedione, (69) 4,4-dimethyl-1,3-cyclohexanedione, (70) 2-acetyl-1,3-cyclopentanedione, (71 ) 3,3,5,5-tetramethyl-1,2-cyclopentanedione, (72) bicyclo[3.2.1]octan-2-one, (73) endo-dimethyl 7-oxabicyclo[2.2.1]heptane-2,3-dicarboxylate, (74) cineole, (75) bicyclo[2.2.2]oct-5-ene-2,3-dimethanol, (76) tropone, (77) tropolone, (78) cyclooctene oxide, (79) 1,2,5,6-diepoxycyclooctane, (80) 9-methyl-$\Delta^{5(10)}$-octalin-1,6-dione, (81) cis-bicyclo[3.3.0]octane-3.7-dione, (82) azulene, (83) 1-benzosuberone, (84) 1,5,9-cyclododecatriene, (85) cyclododecane epoxide, (86) 2,3-cyclododeceno pyridine, (87) 1,2,5,6,9,10-hexabromo cyclododecane, (88) 8-cyclohexadecen-1-one, (89) bicyclo[10.3.0]pentadec-12(1)-en-13-one, (90) 1,4,4a,8a-tetrahydro-endo-1,4-methanonaphthalene-5,8-dione, and (19) mixtures thereof.

23. A process according to claim 1 wherein the transparentizing agent is a thiourea.

24. A process according to claim 1 wherein the transparentizing agent is a sulfone.

25. A process according to claim 1 wherein the transparentizing agent is a thiocyclic compound.

26. A process according to claim 1 wherein the transparentizing agent is selected from the group consisting of sulfites, sulfite derivatives, sulfides, sulfide derivatives, quaternary sulfur compounds, quaternary sulfur derivatives, and mixtures thereof.

27. A process according to claim 1 wherein the transparentizing agent is a thia-aza-cyclic compound.

28. A process according to claim 1 wherein the transparentizing agent is selected from the group consisting of (1) 1-allyl-2-thioure, (2) 1-methallyl-3-methyl-2-thiourea, (3) 4-allyl-3-thiosemicarbazide, (4) 1,3-diethyl-2-thiourea, (5) 1,3-dibutyl-2-thiourea, (6) 1-benzyl-3-methyl-2-thiourea, (7) 1,1,3,3-tetramethyl-2-thiourea, (8) 2-imino-4-thiobiuret, (9) 1-allyl-3-(2-hydroxyethyl)-2-thiourea, (10) S-(2-aminoethyl)isothiouronium bromide hydrobromide, (11) S,S-diphenylsulfillimine monohydrate, (12) methylsulfon), (13) ethylsulfone, (14) butylsulfone, (15) butadiene sulfone, (16) tetramethylene sulfone, (17) 1,4-butane sulfone, (18) 1,4-butanediolcyclic sulfate, (19) benzylsulfone, (20) phenylsulfone, (21) phenylvinylsulfone, (22) phenylstyrenesulfone, (23) phenyl-2-(trimethylsilyl)methyl sulfone, (24) phenyl 2-(trimethylsilyl)ethyl sulfone, (25) phenyl 2-(trimethylsilyl)ethynyl sulfone, (26) 4-(fluorophenyl)sulfone,

(27) 4-(fluorophenyl)methyl sulfone, (28) chloromethylphenyl sulfone, (29) chloromethyl-ρ-tolyl sulfone, (30) 2-chloroethylphenyl sulfone, (31) methylthiomethylphenyl sulfone, (32) methylthiomethyl-p-tolyl sulfone, (33) 2-(phenylsulfonyl)tetrahydropyran, (34) 1-(phenylsulfonyl)indole, (35) 1-(p-toluenesulfonyl)imidazole, (36) 1-(p-tosyl)-3,4,4-trimethyl imidazolidine, (37) 4-(p-tosylsulfonyl)hexahydro-1,4-thiazepine, (38) thionaphthene, (39) 4-keto-4,5,6,7-tetrahydrothianaphthene, (40) 2,2'-bithiophene, (41) 2,2':5',2"-terthiophene, (42) N-acetylhomocysteine thiolactone, (43) tetrahydrothiopyran-4-one, (44) thiochroman-4-one, (45) thiochroman-4-ol, (46) thioctic acid, (47) ethyl 1,3-dithiolane-2-carboxylate, (48) 3H-1, 2-benzodithiol-3-one, (49) 1,3-dithiane, (50) 2-phenyl-1,3-dithiane, (51) ethyl-1,3-dithiane-2-carboxylate, (52) 5,6-dihydro-5-methyl-4H-1,3,5-dithiazine, (53) 1,4-dithiane, (54) 2,5-dihydroxy-2,5-dimethyl-1,4-dithiane, (55) 1,5 -dithiacyclooactan-3-ol, (56) 1,4-dithiaspiro[45]decan-8-ol, (57) 1,3,5-trithiane, (58) 1,4,7-trithiacyclononane, (59) 1,4, 7-trithiacyclodecane, (60) 1,4,7,10-tetrathiacyclododecane, (61) 3,6,9,14-tetrathiabicyclo[9.2.1]tetradeca-11,13-diene, (62)1,4,8,1-tetrathiacyclotetradecane, (63) 1,5,9,13-tetrathiocyclohexadecane, (64) 1,5,9,13-tetrathiacyclohexadecane-3,11-diol, (65) 1,4,7,10,13-pentathiacyctopentadecane, (66) 1,4,7,10,13,16-hexathiacyclooctadecane, (67) 1,5,9,13,17,21-hexathiacyclotetracosane-3,11,19-triol, (68) 1,4,7,10,13,16,19,22-octathiacyclotetracosane, (69) 1,4,8, 11,15,18,22,25-octathiacyclooctacosane, (70) 1,4,7,10,13, 16,19,22,25-nonathiacycloheptacosane, (71) dimethylsulfite, (72) diethylsulfite, (73) sodium sulfite, (74) allyldisulfide, (75) aminophenyldisulfide, (76) benzyldisulfide, (77) benzylphenylsulfide, (78) trimethylsulfonium methylsulfate, (79) (2-chloroethyl)dimethylsulfonium iodide, (80) 3-(chloropropyl)diphenylsulfonium tetrafluoroborate, (81) trimethyl sulfonium iodide, (82) trimethyl sulfoxonium iodide, (83) trimethyl sulfoxonium chloride, (84) triphenyl methane sulfenyl chloride, (85) dimethyl(2-methoxy-5-nitrobenzyl)sulfonium bromide, (86) thionin perchlorate, (87) p-xylylene bis(tetrahydrothiopheneum chloride), (88) tris(dimethyl amino)sulfonium difluorotrimethyl silicate, (89) tris(dimethyl amino)sulfonium trifluoromethoxide, (90) (3-amino-3-carboxypropyl)dimethyl sulfonium chloride, and (91) mixtures thereof.

29. A process according to claim 1 wherein the transparentizing agent is of one of the general formulae:

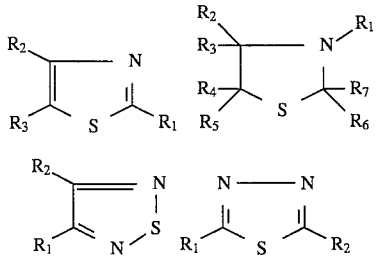

wherein $R_1$, $R_2$, $R_3$, $R_4$, $R_5$, $R_6$, and $R_7$ each, independently of the others, are selected from the group consisting of hydrogen atoms, alkyl groups, substituted alkyl groups, aryl groups, substituted aryl groups, arylalkyl groups, substituted arylalkyl groups, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, and azide groups, wherein two or more of $R_1$, $R_2$, $R_3$, $R_4$, $R_5$, $R_6$, and $R_7$ can be joined together to form a ring.

30. A process according to claim 1 wherein the transparentizing agent is selected from the group consisting of (1) 2 -amino-2-thiazoline, (2) 2-amino thiazole, (3) 2-amino-4-methylthiazole, (4) 2-amino-4-methylthiazole, (5) 2-amino-4-thiazoleacetic acid, (6) 2 -acetamido-4-methylthiazole, (7) 2-acetylthiazole, (8) 5-acetyl-2,4-dimethylthiazole, (9) 4-methyl-5-vinylthiazole, (10) 2-amino-4-phenyl-5-tetradecylthiazole, (11) 2,4-thiazolidine dione, (12) 3-aminorhodanine, (13) 3-methylrhodanine, (14) 3-ethylrhodanine, (15) 3-allylrhodanine, (16) 3-hydroxy-4-methyl-2(3H)-thiazolethione, (17) benzothiazole, (18) 2-methylbenzothiazole, (19) 2-(methylthio)benzothiazole, (20) 2-amino-4-methylbenzothiazole, (21) 3-methylbenzothiazole-2-thione, (22) 2,1,3-benzothiadiazole, (23) 4-amino-2,1,3-benzothiadiazole, (24) 3,4-dimethyl-5-(2-hydroxyethyl)thiazolium iodide, (25) 3-ethyl-5-(2-hydroxyethyl)4-methylthiazolium bromide, (26) 2-amino-5-nitrothiazole, (27) 2-amino-α-(methyoxyimino)-4-thiazole acetic acid, (28) ethyl 2-amino-α-(hydroxyimino)-4-thiazole acetate, (29) ethyl 2-amino-α-(methoxyimino)-4-thiazole acetate, (30) ethyl 2-amino-4-thiazole acetate, (31) ethyl 2-amino-4-thiazole glyoxylate, (32) 1-phenyl-3-(2-thiazolyl)-2-thiourea, (33) 2-amino-4-methoxy benzothiazole, (34) 2-amino-5,6-dimethylbenzothiazole, (35) N'-(2-thiazolyl)sulfanilamide, 6-ethoxy-2-benzothiazole sulfonamide, (37) ethyl-2-(formylamino)-4-thiazoleacetate, (38) ethyl-2-(formylamino)-4-thiazoleglyoxylate, (39) 2-(formylamino)-α-(methoxyimino)-4-thiazole acetic acid, (40) 2-acetamido-4-methyl-5-thiazole sulfonyl chloride, (41) 2-thioxo-4-thiazolidine carboxylic acid, (42) thiazolidine-4-carboxylic acid, (43) pseudothiohydantoin, (44) 2-amino-1,3,4-thiadiazole, (45) 2-amino-5-trifluoromethyl-1,3,4-thiadiazole, (46) 2-amno-5-methyl-1,3,4-thiadiazole, (47) 2-amino-5-ethyl-1, 3,4-thiadiazole, (48) 2-amino-5-(ethylthio)-1,3,4-thiadiazole, (49) 5-amino-1,3,4-thiadiazole-2-thiol, (50) 2-acetamido-5-benzyl thio-1,3,4-thiadiazole, (51) 5-acetamido-1,3, 4-thiadiazole-2-sulfonamide, (52) 5-anilino-1,2,3,4-thiatriazole, (53) 2-amino-4,5-dimethyl thiazole hydrochloride, (54) 2-amino 4-imino-2-thiazoline hydrochloride, (55) 2-amino-2-thiazoline hydrochloride, (56) 2-amino-5-bromothiazole monohydrobromide, (57) 5-amino-3-methyl isothiazole hydrochloride, (58) 3-methyl-2-benzothiazolinone hydrazone hydrochloride hydrate, (59) 5-amino-2-methylbenzothiazole dihydrochloride, (60) 2,4-diamino-5-phenyl thiazole monohydrobromide, (61) 2-amino-4-phenyl thiazole hydrobromide monohydrate, (62) 2-(tritylamino)-α-(methoxyimino)-4-thiazole acetic acid hydrochloride, (63) (2,3,5,6-tetrahydro-6-phenylimidazo[ 2,1-b]thiazole hydrochloride, (64) 3-ethyl-2-methyl-2-thiazolium iodide, (65) 3-benzyl-5-(2-hydroxyethyl)-4-methyl thiazolium chloride, (66) thiamine hydrochloride, (67) 3-(carboxymethyl)benzothiazolium bromide, (68) 2-azido-3-ethyl benzothiazolium tetrafluoroborate, (69) 3-ethyl-2-methyl benzothiazolium iodide, (70) 2-methyl-3-propyl benzothiazolium iodide, (71) 3-ethyl-2-(2-hydroxy-1-propenyl)benzothiazolium chloride, (72) 3,6-dimethyl-2-(4-dimethyl aminophenyl)benzothiazolium bromide, (73) trifluoroperazine dihydrochloride, (74) thioridazine hydrochloride, (75) promethazine hydrochloride, (76) ethopropazine hydrochloride, (77) chlorpromazine hydrochloride, and (78) mixtures thereof.

31. A process according to claim 1 wherein the transparentizing agent is selected from the group consisting of phosphines, phosphites, cyclic phosphorus compounds, phosphine oxides, quaternary phosphonium salts, and mixtures thereof.

32. A process according to claim 1 wherein the transparentizing agent is selected from the group consisting of (1) triphenylphosphine, (2) tri-m-tolyl phosphine, (3) tris(3-methoxyphenyl)phosphine, (4) tris(4-chlorophenyl)phosphine, (5) tris(pentafluorophenyl)phosphine, (6) tricyclohexylphosphine, (7) tribenzylphosphine, (8) tri-2-furylphosphine, (9) bis(pyrrolidino)methoxy phosphone, (10) tetraphenylbiphosphine, (11) 1,3-bis(diphenylphosphino)propane, (12) 1,5-bis(diphenylphosphino)pentane, (13) 1,6-bis(diphenylphosphino)hexane, (14) isopropyl diphenyl phosphine, (15) diphenyl(p-tolyl)phosphine, (16) (4-bromophenyl)diphenyl phosphine, (17) diphenyl-2-pyridylphosphine, (18) dicyclohexylphenyl phosphine, (19) trimethyl phosphite, (20) triethyl phosphite, (21) tris(2-chloroethyl)phosphite, (22) tributyl phosphite, (23) triphenyl phosphite, (24) trimethyl phosphite copper iodide, (25) triethyl phosphite copper iodide, (26) dipropyl phosphite, (27) bis(2-ethylhexyl)phosphite, (28) bis(4-nitrobenzyl)phosphite, (29) 2,2'-ethylidene bis(4,6-di-tert-butylphenyl)fluorophosphite, (30) pentaerythritol diphenyl diphosphite, (31) 2-furyltetramethyl phosphorodiamidate, (32) diethyl(pyrrolidinomethyl)phosphonate, (33) cyclophosphamide monohydrate, (34) 2-chloro-1,3,2-dioxaphospholane-2-oxide, (35) N,N-diethyl-1,5-dihydro-2,4,3-benzodioxaphosphepin-3-amine, (36) 1,2-phenylene phosphochloridite, (37) 1,2-phenylene phosphochloridate, (38) 2-chloro-4H-1,3,2-benzodioxaphosphorin-4-one, (39) 2,4-bis(methylthio)-1,3-dithia-2,4-diphosphetane-2,4-disulfide, (40) triphenyl phosphine oxide, (41) tris(hydroxymethyl)phosphine oxide, (42) trimethoxy phosphine oxide, (43) triethoxy phosphine oxide, (44) triphenoxy phosphine oxide), (45) tris(2-butoxy ethoxy)phosphine oxide, (46) diphenyl phosphine oxide, (47) diphenyl(2,4,6-trimethylbenzoyl)phosphine oxide, (48) phenyl phosphinic acid, (49) diphenyl phosphate, (50) vinyl phosphonic acid, (51) propyl phosphonic acid, (52) pyrophosphoric acid, (53) triphenylphosphate, (54) tetrabutylphosphonium chloride, (55) tetrabutylphosphonium bromide, (56) hexadecyltributylphosphonium bromide, (57) stearyltributylphosphonium bromide, (58) azidotris(diethylamino)phosphonium bromide, (59) phosphonitrilic chloride trimer, (60) tetramethyl phosphonium bromide, (61) tetramethyl phosphonium chloride, (62) tetraethyl phosphonium bromide, (63) tetraethyl phosphonium chloride, (64) tetraethyl phosphonium iodide, (65) tetraphenyl phosphonium bromide, (66) tetraphenyl phosphonium chloride, (67) tetraphenyl phosphonium Iodide, (68) methyl triphenyl phosphonium bromide, (69) methyl triphenyl phosphonium iodide, (70) ethyl triphenyl phosphonium bromide, (71) n-propyl triphenyl phosphonium bromide, (72)isopropyl triphenyl phosphonium iodide, (73) cyclopropyl triphenyl phosphonium bromide, (74) n-butyl triphenyl phosphonium bromide, (75)isobutyl triphenyl phosphonium bromide, (76) hexyl triphenyl phosphonium bromide, (77) benzyl triphenyl phosphonium chloride, (78) bromomethyl triphenyl phosphonium bromide, (79) chloromethyl triphenyl phosphonium chloride, (80) 3-bromopropyl triphenyl phosphonium bromide, (81) 3-bromobutyl triphenyl phosphonium bromide, (82) 4-bromobutyl triphenyl phosphonium bromide, (83) 2-dimethyl aminoethyl triphenyl phosphonium bromide, (84) [(3-dimethyl amino)propyl]triphenyl phosphonium bromide, (85) 2-hydroxyethyl triphenyl phosphonium bromide, (86) (2-hydroxyethyl)triphenyl phosphonium chloride, (87) [3-hydroxy-2-methyl propyl]triphenyl phosphonium bromide, (88) [3-hydroxy-2-methyl propyl]triphenyl phosphonium bromide, (89) (2-hydroxybenzyl triphenyl phosphonium bromide, (90) (formyl methyl)triphenyl phosphonium chloride, (91) (methoxymethyl)triphenyl phosphonium chloride, (92) acetonyl triphenyl phosphonium chloride, (93) carbomethoxymethyl triphenyl phosphonium bromide, (94) (ethoxy carbonyl methyl)triphenyl phosphonium chloride, (95) carbethoxymethyl triphenyl phosphonium bromide, (96) (tert-butoxy carbonyl methyl)triphenyl phosphonium bromide, (97) phenacyl triphenyl phosphonium bromide, (98) (4-ethoxybenzyl)triphenyl phosphonium bromide, (99) 4-butoxybenzyl triphenyl phosphonium bromide, (100) 2-(1,3-dioxan-2-yl)ethyl]triphenyl phosphonium bromide, (101) (1,3-dioxolan-2-ylmethyl)triphenyl phosphonium bromide, (102) vinyl triphenyl phosphonium bromide, (103) allyl triphenyl phosphonium bromide, (104) allyl triphenyl phosphonium chloride, (105) propargyl triphenyl phosphonium bromide, (106) (3-trimethyl silyl-2-propynyl-)triphenyl phosphonium bromide, (107) p-xylylene bis-(triphenyl phosphonium bromide), and (108) mixtures thereof.

33. A process according to claim 1 wherein the transparentizing agent is a nitrile.

34. A process according to claim 1 wherein the transparentizing agent is selected from the group consisting of (1) cyanoacetohydrazide, (2) 4,4-dimethyl-3-oxopentanenitrile, (3) 1-cyano-N-methylthioformamide, (4) cyanomethyl N,N-dimethyl dithiocarbamate, (5) 4-hydroxy-3-methoxy-phenyl acetonitrile, (6) tosyl cyanide, (7) tosylmethyl isocyanide, (8) 5-fluoro-2-methyl benzonitrile, (9) 2-fluoro-5-methyl benzonitrile, (10) 4-(methylthio)benzonitrile, (11) 4-(dimethylamino)benzonitrile, (12) 3,4-dimethoxy benzonitrile, (13) 4-hydroxy-3-methoxy benzonitrile, (14) 4-(trans-4-pentyl cyclohexyl)benzonitrile, (15) 4'-pentyl-4'-biphenyl carbonitrile, (16) 4'-(pentyloxy)-4-biphenylcarbonitrile, (17) 4'-hexyl-4-biphenyl carbonitrile, (18) 4'-(hexyloxy)-4-biphenyl carbonitrile, (19) 4'-heptyl-4-biphenyl carbonitrile, (20) 4'-heptyloxy-4-biphenyl carbonitrile, (21) 4'-octyl-4-biphenyl carbonitrile, (22) 4'-(octyloxy)-4-biphenyl carbonitrile, (23) succinonitrile, (24) fumaronitrile, (25) 1,4-dicyano-2-butene, (26) (dimethyl aminomethylene)malononitrile, (27) (1-ethoxyethylidene)malononitrile, (28) α-chlorobenzylidenemalononitrile, (29) benzylidenemalononitrile, (30) 2-benzoyloxy-2-phenyl malononitrile, (31) O-(p-tosyl)isonitrosomalononitrile, (32) tetrafluorophthalonitrile, (33) iminodiacetonitrile, (34) phenylene diacetonitrile, (35) 3,3'-(4-formyl phenylimino-)dipropionitrile, (36) tris(2-cyanoethyl)nitromethane, (37) 1,1,3,3-propanetetracarbonitrile, (38) tetracyanoethylene oxide, and (39) mixtures thereof.

35. A process according to claim 1 wherein the transparentizing agent is selected from the group consisting of isothiocyanates, isocyanates, and mixtures thereof.

36. A process according to claim 1 wherein the transparentizing agent is selected from the group consisting of (1) 4-azidophenyl isothiocyanate, (2) 1-naphthyl isothiocyanate, (3) 4-dimethyl amino-1-naphthyl isothiocyanate, (4) 1-isothiocyanato-4-(trans-4-propyl cyclohexyl)benzene, (5) 1-(trans-4-hexyl cyclohexyl)-4-isothiocyanato benzene, (6) 1-(4-trans-hexyl cyclohexyl)-4-[2-(4-isothio cyanatophenyl)]benzene, (7) 1-isothiocyanato-4-(trans-4-octylcyclohexyl)benzene, (8) 4-isothiocyanatophenyl-4-pentabicyclo[2.2.2]octane-1-carboxylate, (9) benzylthiocyanate, (10) guanidinethiocyanate, (11) methylene dithiocyanate, (12) 4,4'-methylene bis(phenyl isocyanate), (13) 4,4'-methylene bis(2,6-diethyl isocyanate), and (14) mixtures thereof.

37. A process according to claim 1 wherein the transparentizing agent is selected from the group consisting of oxime compound, hydroxamic acid compounds, and mixtures thereof.

38. A process according to claim 1 wherein the transparentizing agent is selected from the group consisting of (1) formamidoxime (2) acetaldoxime, (3) pyruvic aldehyde-1-oxime, (4) acetone oxime, (5) ethylchlorooximido acetate, (6) 2,3-butane dione monoxime, (7) 5-hydroxy pentenal oxime, (8) cyclopentanone oxime, (9) cyclohexanone oxime, (10) cyclooctanone oxime, (11) benzaldehyde oxime, (12) 2-nitrobenzaldehyde oxime, (13) salicyl aldoxime, (14) 2-isonitroso acetphenone, (15) 1-phenyl-1, 2-propanedione 2-oxime, (16) 2-pyridine aldoxime, (17) nifuroxime, and (18) mixtures thereof.

39. A process according to claim 1 wherein the transparentizing agent is a hydroxamic acid derivative.

40. A process according to claim 1 wherein the transparentizing agent is selected from the group consisting of (1) acetohydroxamic acid, (2) suberohydroxamic acid, (3) mandelohydroxamic acid, (4) benzohydroxamic acid, (5) N-phenylbenzohydroxamic acid, and (6) mixtures thereof.

41. A process according to claim 1 wherein the transparentizing agent is selected from the group consisting of alkyl ammonium salts, aryl ammonium salts, arylalkyl ammonium salts, and mixtures thereof.

42. A process according to claim 1 wherein the transparentizing agent is selected from the group consisting of (1) tetramethylammonium fluoride tetrahydrate, (2) tetraethylammonium acetate tetrahydrate, (3) tetrabutylammonium chloride, (4) tetrabutylammonium chloride hydrate, (5) tetrabutylammonium bromide, (6) tetrabutylammonium tribromide, (7) tetrabutylammonium acetate, (8) tetrabutylammonium thiocyanate, (9) tetrapentylammonium bromide, (10) tetrahexylammonium bromide, (11) tetrahexylammonium chloride, (12) tetrahexylammonium hydrogensulfate, (13) tetraheptylammonium chloride, (14) tetraheptylammonium bromide, (15) tetraoctylammonium bromide, (16) tetrakisdecylammonium bromide, (17) tetrahexadecylammonium bromide, (18) tetramethyl ammonium bromide, (19) tetramethyl ammonium chloride, (20) tetramethyl ammonium iodide, (21) tetraethyl ammonium bromide, (22) tetraethyl ammonium chloride, (23) tetraethyl ammonium iodide, (24) tetrapropyl ammonium bromide, (25) tetrapropyl ammonium iodide, (26) tetrabutyl ammonium iodide, (27) tetrapentyl ammonium chloride, (28) tetrahexyl ammonium bromide, (29) tetrahexyl ammonium iodide, (30) tetradecyl ammonium bromide, (31) tetradodecyl ammonium bromide, (32) tetraoctadecyl ammonium bromide, (33) methyltrioctylammonium bromide, (34) tridodecylmethylammonium chloride, (35) tridodeylmethylammonium iodide, (36) N-dodecyl-N-methylephedrinium bromide, (37) phenyltrimethylammonium tribromide, (38) tricapryl methyl ammonium chloride, (39) tridodecyl methyl ammonium chloride, (40) tridecyloxypropyl dihydroxy ethyl methyl ammonium chloride, (41) N-tetradecyl dimethyl-naphthyl methyl ammonium chloride, (42) octadecyl diethanol methyl ammonium chloride, (43) octadecyl dihydroxyethyl methyl ammonium chloride, (44) dihydrogenated tallow benzyl methyl ammonium chloride, (45) 2-aminoethyl trimethyl ammonium chloride hydrochloride, (46) 2-bromoethyl trimethyl ammonium bromide, (47) 2-chloroethyl trimethyl ammonium chloride, (48) 3-carboxypropyl trimethyl ammonium chloride, (49) [3-(methacryloyl amino) propyl]trimethyl ammonium chloride, (50) phenyl trimethyl ammonium bromide, (51) phenyl trimethyl ammonium chloride, (52) phenyl trimethyl ammonium iodide, (53) benzyl trimethyl ammonium chloride, (54) benzyl trimethyl ammonium bromide, (55) 4-nitrobenzyl trimethyl ammonium chloride, (56) [2-(4-nitrophenyl)allyl]trimethyl ammonium iodide, (57) coco trimethyl ammonium chloride, (58) palmityl trimethyl ammonium chloride, (59) myristyl trimethyl ammonium bromide, (60) oleyl trimethyl ammonium chloride, (61) soya trimethyl ammonium chloride, (62) tallow trimethyl ammonium chloride, (63) hydrogenated tallow trimethyl ammonium chloride, (64) stearyl trimethyl ammonium chloride, (365) behenyl trimethyl ammonium chloride, (66) guar hydroxypropyl trimethyl ammonium chloride, (67) benzyl triethyl ammonium bromide, (68) butyl tripropyl ammonium bromide, (69) methyl tributyl ammonium chloride, (70) methyl tributyl ammonium bromide, (71) methyl tributyl ammonium iodide, (72) benzyl tributyl ammonium chloride, (73) benzyl tributyl ammonium bromide, (74) benzyl tributyl ammonium iodide, (75) heptyl tributyl ammonium bromide, (76) benzyldodecyldimethylammonium bromide, (77) benzyltetradecyldimethylammonium chloride dihydrate, (78) benzylcetyldimethylammonium chloride monohydrate, (79) benzylstearyldimethylammonium chloride monohydrate, (80) N,N-dimethyl methylene ammonium chloride, (81) N,N-dimethyl methylene ammonium iodide, (82) chloromethylene dimethyl ammonium chloride, (83) dichloromethylene dimethyl ammonium chloride, (84) dimethyl amino methylene amino methylene dimethyl ammonium chloride, (85) benzethonium chloride, (86) methyl benzethonium-chloride, (87) 1-propanaminium 2,3-dihydroxy-N-dimethyl-N-[3(oxococoyl)amino]propyl]chloride, (88) cetyl dimethyl ethyl ammonium bromide, (89) octyl dodecyl dimethyl ammonium chloride, (90) dodecyl (2-hydroxy-1-methyl-2-phenylethyl)dimethyl ammonium bromide, (91) dodecyl dimethyl 2-phenoxyethyl ammonium bromide, (92) dodecanoyl-N-methylamino ethyl-(phenyl carbamyl methyl)dimethyl ammonium chloride, (93) 3-chloro-2-hydroxypropyl N,N,N-dimethyl dodecyl ammonium chloride, (94) 3-chloro-2-hydroxypropyl N,N,N-dimethyl octadecyl ammonium chloride, (95) dodecyl benzyl dimethyl ammonium bromide, (96) dodecyl benzyl dimethyl ammonium chloride, (97) coco benzyl dimethyl ammonium chloride, (98) benzyl tetradecyl dimethyl ammonium chloride, (99) benzyl cetyl dimethyl ammonium chloride, (100) benzyl octadecyl dimethyl ammonium chloride, (101) benzyl tallow dimethyl ammonium chloride, (102) benzyl hydrogenated tallow dimethyl ammonium chloride, (103) benzyl behenyl dimethyl ammonium chloride, (104) dioctyl dimethyl ammonium chloride, (105) didecyl dimethyl ammonium chloride, (106) didecyl dimethyl ammonium bromide, (107) dicoco dimethyl ammonium chloride, (108) dicetyl dimethyl ammonium chloride, (109) disoya dimethyl ammonium chloride, (110) ditallow dimethyl ammonium chloride, (111) dihydrogenated tallow dimethyl ammonium chloride, (112) dibehenyl/diarachidyl dimethyl ammonium chloride, (113) soya amido propyl benzyl dimethyl ammonium chloride, (114) soya dicoco quaternary ammonium chloride, (115) gluconamidopropyl dimethyl-2-hydroxyethyl ammonium chloride, (116) N-alkyl-N-N-dimethyl-N(dodecyl acetate) ammonium chloride, wherein alkyl has from 14 to 20 carbon atoms, (117) mink amidopropyl dimethyl-2-hydroxyethyl ammonium chloride, (118) N-rapeseed-(3-amidopropyl)-N-N-dimethyl-N-(2,3 epoxy propyl)ammonium chloride, (119) N-stearyl-(3-amido propyl)-N-benzyl dimethyl ammonium chloride, (120) rapeseed amido propyl benzyl dimethyl ammonium chloride, (121) rapeseed amido propyl ethyl dimethyl ammonium chloride, (122) cocamidopropyl polyethylene glycol dimethyl ammonium chloride phosphate, (123) butyrylcholine chloride, and (124) mixtures thereof.

43. A process according to claim 1 wherein the transparentizing agent is selected from the group consisting of piperidine thiocyanate, 2-piperidine methanol, bis(pentamethylene)urea, 4,4'-trimethylene bis(1-piperidine propionitrile), tripiperidino phosphine oxide, homopiperazine, 1-piperonyl piperazine, hexacyclentrisulfate, 5,10,15,20-tetraphenyl-21H,23Hporphine, 5,10,15,20-tetrakis(4-methoxyphenyl)-2H,23H-porphine, pyrrole-2-carboxaldehyde, 3-pyrrolidino-1,2-propanediol, pyrazole, 3-aminopyrazole, imidazole, 2-ethylimidazole, 2-(2-piperidinoethyl)pyridine, 1-dodecyl pyridinium chloride, pyridinium bromide perbromide, 3-aminoquinoline, 8-hydroxyquinoline, 7,8-benzoquinoline, 8-hydroxyquinaldine, quinoxaline, 4,5-dihydro-6-methyl-3(2H)-pyridazinone monohydrate, phthalazine, 1,10-phenanthroline, 1,3,5-triazine, trichloromelamine, trichloroisocyanouric acid, norbornane, tricyclo[5.2.1.0]decane, norcamphor, tropolone, 1-indanol, trans, trans, cis-1,5,9-cyclododecatriene, cyclodecane epoxide, 2,3-cyclododecane pyridine, 1,2,5,6,9,10-hexabromo-cyclododecane, 1,4,4a,8a-tetrahydro-endo-1,4-methano-napthalene-5,8-dione, γ-butyrolactone, β,β-dimethyl-γ-(hydroxymethyl)-γ-butyrolactone, 2,5-dimethyl-4-hydroxy-3(2H)-furanone, hydrindantin dihydrate, 2,4,8,10-tetraoxaspiro[5.5]undecane, 1,3,5-trioxane, cyclooctanone, piperonal, piperonylalcohol, piperonyl nitrile, 3,4(methylenedioxy)phenylacetonitrile, maleic anhydride, s-acetylmercapto succinic anhydride, 2-octadecen-1-yl succinic anhydride, 18-crown-6, benzo-18 crown-6, dibenzo-18 crown-6, dibenzo-24 crown-8, 5-amino-3-methyl isooxazole, 2-oxazolidone, 5,5-dimethyl oxazolidine-2,4-dione, 3-ethyl-2-thioxo-4-oxazolidinone, 3-morpholino-1,2-propanediol, 4-phenyl morpholine, N,N'-dibenzyl-1,4,10,13-tetraoxa-7,16-diazacyclooctadecane, 4,7,13,16,21,24-hexaoxa-1,10-diazabicyclo[8.8.8]hexacosane, γ-valerolactam, ε-caprolactam, 2-azacyclooctanone, 2-azacyclononanone, maleimide, n-methylsuccinimide, phthalimide DBU salt, 1-allyl-2-thiourea, 1,3-dithiane, 1-benzyl-3-methyl-2-thiourea, 2-imino-4-thiobiuret, butyl sulfone, 2,2'-bithiophene, 2-phenyl-1,3-dithiane, 3,6,9,14-tetrathiabicyclo[ 9.2.1]tetradeca-11,13-diene, 1,5,9,13-tetra-thiacyclohexadecane-3,11-diol, 1,4,7,10,13-penta-thiacyclopentadecane, 2-aminothiazole, 2-amino-2-thiazoline, 3-methyl rhodanine, 3-ethyl-5-(2-hydroxy-ethyl)-4-methylthiazolium bromide, triphenylphosphine, tricyclohexylphosphine, 1,3-bis(diphenylphosphino-)propane, 1,5-bis(diphenyl phosphino)pentane, isopropyldiphenyl phosphine, triethyl phosphite, triphenyl phosphite, triethyl phosphite copper iodide, dipropyl phosphite, bis(2-ethylhexyl)phosphite, bis(4-nitrobenzyl)phosphite, diphenyl phosphine oxide, diphenyl(2,4,6-trimethylbenzoyl)phosphine oxide, vinyl phosphonic acid, cyanoaceto-hydrazide, cyanomethyl N,N-dimethyl dithiocarbamate, 4'-pentyl-4'-biphenyl carbonitrile, 4'-(octyloxy)-4-biphenyl carbonitrile, 1,4-dicyano-2-butene, benzylidene malononitrile, 1-isothiocyanato-4-(trans-4propylcyclohexyl)benzene, formamidoxime, ethyl chlorooximido acetate, acetohydroxamic acid, tetrahexylammonium chloride, tetraheptylammonium chloride, tetraheptylammonium bromide, and mixtures thereof.

44. A process according to claim 1 wherein the transparentizing agent is applied in an amount of from about 0.5 part by weight transparentizing agent per 1 part by weight migration marking material to about 2 parts by weight transparentizing agent per 1 part by weight migration marking material.

* * * * *